US008770796B2

(12) United States Patent
Gordin et al.

(10) Patent No.: US 8,770,796 B2
(45) Date of Patent: Jul. 8, 2014

(54) ENERGY EFFICIENT HIGH INTENSITY LIGHTING FIXTURE AND METHOD AND SYSTEM FOR EFFICIENT, EFFECTIVE, AND ENERGY SAVING HIGH INTENSITY LIGHTING

(75) Inventors: Myron K. Gordin, Oskaloosa, IA (US); Timothy J. Boyle, Oskaloosa, IA (US)

(73) Assignee: Musco Corporation, Oskaloosa, IA (US)

( * ) Notice: Subject to any disclaimer, the term of this patent is extended or adjusted under 35 U.S.C. 154(b) by 1059 days.

(21) Appl. No.: 11/334,077

(22) Filed: Jan. 18, 2006

(65) Prior Publication Data

US 2006/0176695 A1 Aug. 10, 2006

Related U.S. Application Data

(63) Continuation-in-part of application No. 10/785,867, filed on Feb. 24, 2004, now Pat. No. 7,176,635.

(60) Provisional application No. 60/644,687, filed on Jan. 18, 2005, provisional application No. 60/644,639, filed on Jan. 18, 2005, provisional application No. 60/644,536, filed on Jan. 18, 2005, provisional application No. 60/644,747, filed on Jan. 18, 2005, provisional application No. 60/644,534, filed on Jan. 18, 2005, provisional application No. 60/644,720, filed on Jan. 18, 2005, provisional application No.

(Continued)

(51) Int. Cl.
*F21S 8/00* (2006.01)

(52) U.S. Cl.
USPC ..... 362/263; 362/269; 362/296.1; 362/319; 362/427

(58) Field of Classification Search
USPC ..... 362/248, 255, 256, 261, 263–265, 269, 362/277, 282, 296–298, 303, 319, 341, 346, 362/347, 350, 359, 427, 431
See application file for complete search history.

(56) References Cited

U.S. PATENT DOCUMENTS 2,447,923 A 8/1948 Tuck
3,149,785 A * 9/1964 Appleton ..... 362/275

(Continued)

FOREIGN PATENT DOCUMENTS

DE 195 40 326 A1 4/1997
DE 199 12 517 A1 9/2000

(Continued)

*Primary Examiner* — Hargobind S Sawhney
(74) *Attorney, Agent, or Firm* — McKee, Voorhees & Sease, P.L.C.

(57) ABSTRACT

A high intensity discharge (HID) light fixture includes a reflector frame which supports an independent high reflectivity reflecting surface. The reflector frame supports a glass lens with anti-reflective coatings on its surfaces and a visor or extension that also supports an independent high reflectivity reflecting surface. The high reflectivity reflecting surface has various sections that adjust portions of the beam created by the fixture to better place light on a target area. The reflector frame is attachable to a lamp cone. An adjustable knuckle attaches between to a cross arm on a pole and the lamp cone. An HID lamp, when mounted in the lamp cone, has its arc tube substantially surrounded by the high reflectivity reflecting surfaces of the reflector frame and visor. A lamp positioning mechanism automatically adjusts orientation of the arc lamp over a range of pivot angles for the lamp cone relative the knuckle. The HID lamp has an increased metal halide salt pool and does not include white oxide coatings at opposite ends. The lamp and the lamp positioning mechanism are configured to position the arc tube of the lamp horizontal over the normal range of aiming angles for the fixture. The modified HID lamp, its operating position, the high reflectivity reflecting surfaces, and other aspects of the fixture produce more light from the fixture than without these features for the same amount of energy to operate. Optionally, a ballast circuit can save energy over operating life of the lamp.

47 Claims, 134 Drawing Sheets

Related U.S. Application Data

60/644,688, filed on Jan. 18, 2005, provisional application No. 60/644,636, filed on Jan. 18, 2005, provisional application No. 60/644,517, filed on Jan. 18, 2005, provisional application No. 60/644,609, filed on Jan. 18, 2005, provisional application No. 60/644,516, filed on Jan. 18, 2005, provisional application No. 60/644,546, filed on Jan. 18, 2005, provisional application No. 60/644,547, filed on Jan. 18, 2005, provisional application No. 60/644,638, filed on Jan. 18, 2005, provisional application No. 60/644,537, filed on Jan. 18, 2005, provisional application No. 60/644,637, filed on Jan. 18, 2005, provisional application No. 60/644,719, filed on Jan. 18, 2005, provisional application No. 60/644,784, filed on Jan. 18, 2005.

(56) References Cited

U.S. PATENT DOCUMENTS

| | | | | | |
|---|---|---|---|---|---|
| 3,987,339 | A | * | 10/1976 | Wroblewski | 315/278 |
| 4,005,336 | A | | 1/1977 | Casella | |
| 4,009,387 | A | | 2/1977 | Nuver | |
| 4,189,664 | A | | 2/1980 | Hirschfeld | |
| 4,292,570 | A | | 9/1981 | Engel | |
| 4,434,388 | A | | 2/1984 | Carver et al. | |
| 4,442,382 | A | | 4/1984 | Fleck | |
| 4,475,065 | A | | 10/1984 | Bhalla et al. | |
| 4,501,994 | A | | 2/1985 | Spreadbury | |
| 4,686,424 | A | * | 8/1987 | Nuckolls et al. | 315/86 |
| 4,725,934 | A | | 2/1988 | Gordin | |
| 4,816,974 | A | | 3/1989 | Gordin | |
| 4,891,562 | A | | 1/1990 | Nuckolls et al. | |
| 4,924,109 | A | | 5/1990 | Weber | |
| 4,947,303 | A | | 8/1990 | Gordin et al. | |
| 4,994,718 | A | | 2/1991 | Gordin | |
| 5,075,828 | A | | 12/1991 | Gordin et al. | |
| 5,103,143 | A | | 4/1992 | Daub | |
| 5,134,557 | A | | 7/1992 | Gordin et al. | |
| 5,161,883 | A | | 11/1992 | Gordin et al. | |
| 5,229,681 | A | | 7/1993 | Gordin et al. | |
| 5,442,261 | A | | 8/1995 | Bank et al. | |
| 5,469,027 | A | | 11/1995 | Uchihashi et al. | |
| 5,475,360 | A | | 12/1995 | Guidette et al. | |
| 5,519,286 | A | | 5/1996 | Rodrigues et al. | |
| 5,600,537 | A | | 2/1997 | Gordin et al. | |
| 5,816,691 | A | | 10/1998 | Gordin et al. | |
| 5,856,721 | A | | 1/1999 | Gordin et al. | |
| 6,036,338 | A | | 3/2000 | Gordin | |
| 6,075,326 | A | | 6/2000 | Nostwick | |
| 6,150,772 | A | | 11/2000 | Crane | |
| 6,191,568 | B1 | | 2/2001 | Poletti | |
| 6,203,176 | B1 | | 3/2001 | Gordin | |
| 6,207,943 | B1 | | 3/2001 | Smelker | |
| 6,215,254 | B1 | | 4/2001 | Honda et al. | |
| 6,220,726 | B1 | * | 4/2001 | Gordin | 362/247 |
| 6,320,323 | B1 | | 11/2001 | Buell et al. | |
| 6,373,201 | B2 | | 4/2002 | Morgan et al. | |
| 6,376,996 | B1 | | 4/2002 | Olson | |
| 6,457,845 | B1 | * | 10/2002 | Collins et al. | 362/311 |
| 6,501,231 | B1 | | 12/2002 | Hyland et al. | |
| 6,502,965 | B1 | * | 1/2003 | Bradford | 362/346 |
| 6,515,430 | B2 | | 2/2003 | Kayser | |
| 6,545,433 | B2 | | 4/2003 | Beij et al. | |
| 6,577,075 | B2 | | 6/2003 | Romano et al. | |
| 6,583,574 | B2 | | 6/2003 | Ann et al. | |
| 6,833,675 | B2 | | 12/2004 | Gordin | |
| 2003/0025463 | A1 | | 2/2003 | Mattas et al. | |
| 2003/0090215 | A1 | | 5/2003 | Beasley | |
| 2003/0147240 | A1 | | 8/2003 | Gordin et al. | |
| 2005/0184681 | A1 | | 8/2005 | Gordin et al. | |

FOREIGN PATENT DOCUMENTS

| | | | |
|---|---|---|---|
| EP | 0 536 877 | A1 | 4/1993 |
| EP | 1 172 839 | A2 | 1/2002 |
| JP | 406163163 | A | 6/1994 |

* cited by examiner

SECTION A–A

SECTION A–A

VIEW D–D

SECTION E–E

SECTION C–C

SECTION A-A

FLAT PATTERN

FORMED VIEW

DETAIL "A"

FLAT PATTERN

FORMED VIEW

DETAIL "A"

FLAT PATTERN

FORMED VIEW

DETAIL "A"

FLAT PATTERN

FORMED VIEW

DETAIL "A"

FLAT PATTERN

FORMED VIEW

DETAIL "A"

FLAT PATTERN

FORMED VIEW

DETAIL "A"

FLAT PATTERN

FORMED VIEW

DETAIL "A"

FLAT PATTERN

FORMED VIEW

DETAIL "A"

FLAT PATTERN

FORMED VIEW

DETAIL "A"

SECTION A-A

SECTION C-C

SECTION D-D

SECTION B-B

SECTION E-E

DETAIL B

SECTION A-A

SECTION B-B

DETAIL A

DETAIL B

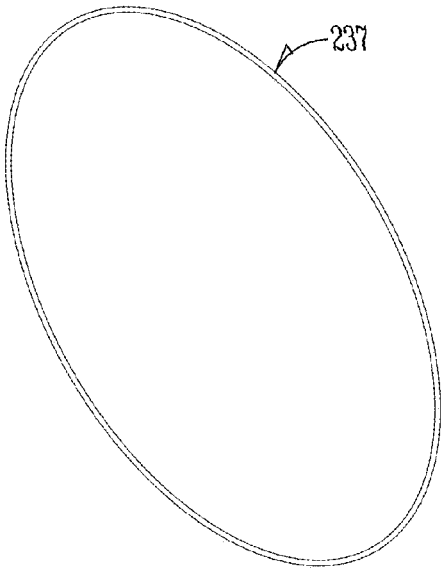
Fig. 50A
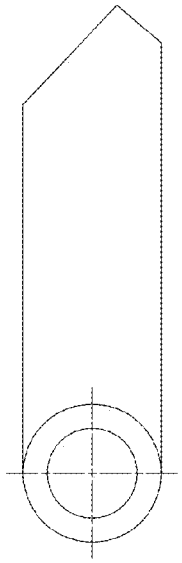
Fig. 50D
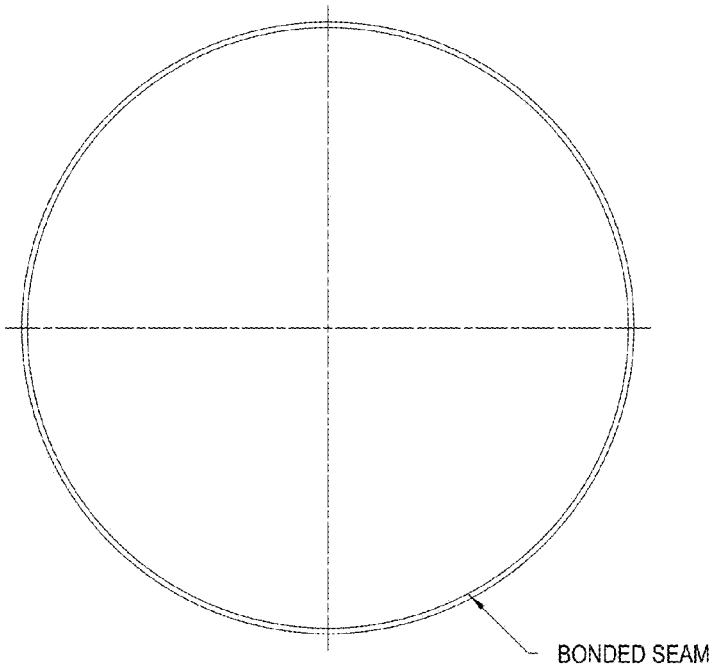
Fig. 50B
Fig. 50C

253

MATERIAL SPECIFICATION

1. NAME: PEM SELF CLINCHING NUT
2. THREAD SIZE: 8-32 UNC-2B
3. PART NUMBER: CLS-832-1
4. SHANK CODE: 1
5. MIN. SHEET THICKNESS: .040"
6. HOLE SIZE IN SHEET: ø.213 ±.003/.000
7. MATERIAL: 302/303 STAINLESS STEEL
8. FINISH: PASSIVATE AND / OR TESTED PER ASTM A380
   COAT PER MUSCO MS-1005

Fig. 76

ENERGY EFFICIENT HIGH INTENSITY LIGHTING FIXTURE AND METHOD AND SYSTEM FOR EFFICIENT, EFFECTIVE, AND ENERGY SAVING HIGH INTENSITY LIGHTING

CROSS REFERENCE TO RELATED APPLICATIONS

This application claims priority under 35 U.S.C. §119 of a provisional application U.S. Ser. No. 60/644,784 filed Jan. 18, 2005, herein incorporated by reference in its entirety. This application is also a non-provisional of the following provisional U.S. applications, all filed Jan. 18, 2005: U.S. Ser. No. 60/644,639; U.S. Ser. No. 60/644,536; U.S. Ser. No. 60/644,747; U.S. Ser. No. 60/644,534; U.S. Ser. No. 60/644,720; U.S. Ser. No. 60/644,688; U.S. Ser. No. 60/644,636; U.S. Ser. No. 60/644,517; U.S. Ser. No. 60/644,609; U.S. Ser. No. 60/644,516; U.S. Ser. No. 60/644,546; U.S. Ser. No. 60/644,547; U.S. Ser. No. 60/644,638; U.S. Ser. No. 60/644,537; U.S. Ser. No. 60/644,637; U.S. Ser. No. 60/644,719; U.S. Ser. No. 60/644,687, each of which is herein incorporated by reference in its entirety.

This application also claims priority to co-pending U.S. Ser. No. 10/785,867 filed Feb. 24, 2004.

INCORPORATION BY REFERENCE

The contents of the following U.S. Patents are incorporated by reference by their entirety:

U.S. Pat. No. 4,816,974
U.S. Pat. No. 4,947,303
U.S. Pat. No. 5,161,883
U.S. Pat. No. 5,600,537
U.S. Pat. No. 5,816,691
U.S. Pat. No. 5,856,721
U.S. Pat. No. 6,036,338

The contents of co-owned, co-pending U.S. Ser. No. 10/785,867 (published application US 2005/0184681) is incorporated by reference in its entirety.

I. BACKGROUND OF THE INVENTION

A. Field of the Invention

The present invention relates to lighting fixtures that produce high intensity, controlled, and concentrated light beams for use at relatively distant targets. In particular, the invention relates to such lighting fixtures, their methods of use, and their use in systems where a plurality of such fixtures are used in combination, usually elevated on poles, to compositely illuminate a target area energy-efficiently, with reduced glare and spill light, and with the capability to lower capital and/or operating costs. One primary example is illumination of a sports field.

B. Problems in the Art

Illumination of sports fields is generally called sports lighting. FIGS. 1A-1G illustrate one such sports lighting configuration. Football field 5 of FIG. 1A is illuminated by a set of arrays 1 of light fixtures 2 elevated on poles 6 (see FIG. 1A). As is well known in the art, there are known methods to design the number, type, and position of poles 6 and fixtures 2 to provide a desired or required amount and uniformity of light for the field. There are usually pre-designed lighting quantity and uniformity specifications to follow.

The most conventional form of sports lighting fixture 2 is a several feet in diameter bowl-shaped aluminum reflector with a transparent glass lens 3 suspended from a cross arm 7 fixed to a pole 6 by an adjustable knuckle 4 (see FIG. 1B). Each light fixture 2 has some adjustability both around vertical and horizontal axes. Each fixture 2 can therefore be uniquely aimed relative to the target area or field 5 by adjustment of knuckle 4 relative cross arm 7.

This general configuration of sports lighting fixtures 2 has remained relatively constant over many years because it is a relatively economical and durable design. It represents a reasonable compromise between the desire to economically control high intensity light to a distant target while at the same time minimizing wind load, which is a particularly significant issue when fixtures are elevated out-of-doors to sometimes well over 100 feet in the air. A much larger reflector could control light better. However, the wind load would be impractical. A significant amount of the cost of sports lighting systems involves how the lights are elevated. The more wind load, the more robust and thus more expensive, the poles must be. Also, conventional aluminum bowl-shaped reflectors are formed by a spinning process. Different light beam shapes are needed for different fixtures 2 on poles 6 for different lighting applications. The spinning process for creating aluminum bowl-shaped reflectors is relatively efficient and economical, even for a variety of reflector shapes and light controlling effects. The resistance of aluminum to corrosion is highly beneficial, particularly for outdoors lighting.

Economics plays a big part in most sports lighting. Prime sports lighting customers include entities such as school districts, municipal recreation departments, and private sports leagues. Such entities are particularly sensitive to cost. It would be easier, of course, to meet light quantity and uniformity specifications for a field if one hundred light fixtures on ten poles were erected. The lighting designer could make sure that more than required light is supplied to the field and the volume of space above the field. However, the cost would be prohibitive for most customers. As sports lighting is not usually a necessity, it likely would not be purchased.

Therefore, substantial efforts have gone into reducing sport lighting system costs. One approach is to minimize the number of light fixtures needed to adequately illuminate a target field. Computer programs have been developed towards this end. Programming can optimize the lighting to, in turn, minimize the number of poles and fixtures to meet lighting specifications for an application. Normally, the less light fixtures needed results in lower costs for fixtures but also in lower costs for the poles to elevate the fixtures.

Additional efforts have gone towards developing increasingly more powerful lamps for sports lighting. However, while producing more lumen output, they require more electrical power to operate. More light per fixture may reduce the number of fixtures and poles, but would increase the amount of electrical energy per fixture used. A typical sports light may be used only a couple of hours a day, on average. Several decades, at least, is the expected life of a sports lighting system. Therefore, energy costs become significant, particularly over those lengths of time.

In recent times, sports lighting has also had to deal with the issue of glare and spill light. For example, if light travels outside the area of the sports field, it can spill onto residential houses near the sports field. Also, the high intensity of the lamps can cause glare to such homeowner or create safety issues for drivers on nearby roads. Some communities have enacted laws regulating how much glare or spill light can be caused by sports lighting or other wide-area outdoors lighting. While a number of attempted remedies exist, many result in blocking, absorbing, or otherwise reducing the amount of light going to the field. This can not only increase cost of the lighting system because of the glare or spill control measures, but in some cases requires additional fixtures to meet minimum light quantity and uniformity specifications. More cost might therefore be incurred, to make up for the light lost in glare and spill control measures. In some cases, it can even require more costly and/or additional poles to support the additional fixtures.

Therefore, competing interests and issues provide challenges to sports lighting designers. Some of the interests and issues can be at odds with one another. For example, the need always remains for more economical sports lighting. On the other hand, glare and spill control can actually add cost and/or reduce the amount of light available to light the field. Designers have to balance a number of factors, for example, cost, durability, size, weight, wind load, longevity, and maintenance issues, to name a few. Attempts to advance the art have mainly focused on discrete aspects of sports lighting. For example, computerized design of lighting systems tends to minimize hardware costs and system installation costs but uses conventional lamp and fixture technology, with their weaknesses. Also, larger lumen output lamps produce more light, but are used with conventional fixture technology. A need, therefore, still exists for advancement in the art of sports lighting.

Current wide or large area lighting systems suffer from such things as energy lost in conversion of electricity to light energy; energy lost in the lighting fixture; and energy lost in light going to unintended or non-useful locations. The present invention addresses these issues.

II. SUMMARY OF THE INVENTION

The present invention relates to looking at sports lighting from the perspective of the amount of energy used to produce light from a fixture, in addition to controlling how light is directed to a target area. The invention pertains to apparatus, methods, and systems to effectively and more energy-efficiently deliver light to the target space, and reduce glare and spill light outside the target space.

Light energy has a cost. Each sport lighting system consumes a significant amount of electrical energy to produce light from each fixture. As illustrated in FIGS. 1B-1F, each fixture 2 receives electrical power from an electrical power source (commercial or residential service) via an electrical system 9, which normally distributes electricity first through a centralized junction box or cabinet for the particular system (FIG. 1C), then to a ballast box at each pole 6 (FIGS. 1B and C), and then via wiring to each fixture 2 (FIG. 1B, D-F). The typical components of sports lighting systems are designed to last for hopefully decades, with periodic replacement of lamps as needed. The present invention takes into account not only cost of hardware and its installation, but how effectively it produces light and uses electrical energy over its operating life.

The subtlety is that most sports lighting systems are operating a relatively small fraction of the time. For example, even if used every night, it might only be for 2-4 hours. However, over 10 years, this can mean thousands of hours of operation. Per fixture, the amount of energy cost per day or even year may not look significant. However, taking a wider view, energy costs for thirty fixtures, for example, over 10 years, is significant. This would be for just one sports field. Multiplied by the number of sports fields lighted in the world, reduction in energy consumption, while maintaining acceptable light at the fields, would be significant.

The present invention addresses more efficient production of light relative to amount of energy used in the design of the types of light fixtures used in sports lighting systems. This relates not only to just economic efficiencies (less cost to the system owner by less use of energy), but also, in a broader way, to society at large. The world is presently reminded that its conventional fossil fuel-based energy sources are neither unlimited nor exempt from disruption. The present invention therefore shifts the paradigm for designing sports lighting systems and related wide-area lighting in the direction of a more holistic integration of hardware and how much energy over the system's whole operating life will be consumed.

One issue addressed by the present invention is the efficient production of light. This has several connotations. One is reducing the amount of energy needed to achieve a certain light level and uniformity at a target. However, another can be increasing the amount of useful light for the target from a given amount of energy.

The present invention also addresses other environmental issues. Many lighting applications call for a certain amount or intensity of light at and above a target space, but also with a certain level of uniformity across the target space. In the example discussed above, lighting fixtures are elevated around the perimeter of the target space and their beams aimed to different locations to try to achieve the intensity and uniformity desired throughout the target space. It is difficult to achieve, especially at the margins of the target space, without some light falling outside the target space. Such spill and glare light can have environmental impact. It can cause "light pollution" of neighboring property. It can create safety issues, for example, by obscuring the vision of drivers or pedestrians on roads or paths around the lights. The present invention therefore addresses spill and glare light problems.

The present invention also provides the ability to select different configurations to meet different needs for a lighting application. For example, features of the lighting system can be selected to achieve lower capital costs for the lighting system. Features can be selected to lower operating costs. Features can be selected to reduce glare and spill light. Features can be selected to increase the quantity or quality of light at and above the target space and/or the performance of the system. The invention allows concentration on just one of the above-listed features or on combinations of them.

A. Objects, Features, or Advantages, of the Invention

It is therefore a principal object, feature, or advantage of the present invention to present a high intensity lighting fixture, its method of use, and its incorporation into a lighting system, which improves over or solves certain problems and deficiencies in the art.

Other objects, features, or advantages of the present invention include such a fixture, method, or system which can accomplish one or more of the following:

a) reduce energy use;

b) increase the amount of useable light at each fixture for a fixed amount of energy;

c) more effectively utilize the light produced at each fixture relative to a target area;

d) provide operating methodologies to both reduce operating costs and increase lamp life for each fixture;

e) improve operating characteristics of the fixture;

f) can reduce capital costs for a system by reducing number of fixtures needed for a given target area;

g) can reduce total costs of a system for a given field, but even if total cost is increased, offsets, or exceeds the difference in cost through reduction of energy use;

h) is robust and durable for most sports lighting or other typical applications for high intensity light fixtures of this type, whether outside or indoors;

i) benefit the world through reduction of energy usage;

j) can extend operating life of some components of the fixture;

k) can reduce glare and spill light relative a target space or area;

l) can reduce wind drag or effective projected area (EPA) of individual fixtures or sets of fixtures, which can allow smaller and/or less expensive elevating structures (e.g. poles), which in turn can materially decrease the capital cost of a lighting system.

B. Exemplary Aspects of the Invention

An apparatus according to one aspect of the invention comprises a high intensity lighting fixture apparatus with a high intensity discharge (HID) lamp with an arc tube that is altered from conventional HID lamps. An increased metal halide salt pool is added to the chemistry of the arc tube of the lamp. The conventional white oxide coatings at opposite ends of conventional arc tubes are removed. A yoke is adapted to hold the arc lamp so that its arc tube operates in a horizontal position, or as close as possible thereto, over most conventional operating positions for the fixture. In operation the lamp produces additional lumens for the same electrical energy as a lamp without the altered chemistry, with white oxide coatings, and which is not operated horizontally.

In another aspect of the invention, reflecting surfaces for controlling light from the lamp comprise very high reflectance material mounted to a framework in a form to create a controlled, concentrated beam useful for sports lighting or the like. The high reflectance material is mounted so that it surrounds most of the equator of the arc lamp. A main portion of the high reflectance material follows generally the shape of a surface of revolution. This main portion can produce a highly consistent, controlled, concentrated beam to a distance target. The high reflectance material decreases the light loss experienced by lower reflectivity spun aluminum reflectors used on conventional sports lighting fixtures, and also increases consistency and control of light to the target. Thus, additional light per energy unit used is made available at the target.

In another aspect of the invention, at least a part of the main reflecting portion has a shape and orientation different from the portion which follows a surface of revolution. One example is an angular section below the lamp that converges light less than the portion which follows the surface of revolution. This can be effective to place light on the target that otherwise would reflect from the bottom of the reflecting surface and spill outward and upward outside the target in the direction the fixture is aimed. A second example is an angular section placed to one side or the other of the lamp that converges light less than the portion that follows the surface of revolution. This can be effective to shift back onto the target area light that otherwise tends to spill outward outside the target area sideways in an opposite direction from that side of the fixture.

If appropriately used, each less converging part of the main reflecting surface can add light otherwise lost from the target, and thus increase the amount of light to the target per energy unit used. This can also allows minimization of number of fixtures. It can also reduce glare and spill light.

In another aspect of the invention, an additional reflecting surface extends forwardly from the general surface of revolution of the main reflecting surface and is also made of high reflectivity material. As opposed to conventional visors which are used primarily to block light, this reflecting surface can function not only to block light that could be glare or spill light, but efficiently and in a highly controllable manner redirect the otherwise wasted light to the target area. The framework supporting the additional reflecting surface can be connected to the framework for the main reflecting surface in an integrated manner that also minimizes wind drag for the entire fixture.

In another aspect of the invention, a lens over the main reflecting surface and lamp has anti-reflective properties to reduce light loss otherwise experienced when light passes through the entrance and exit surfaces of glass. This, too, can add light to the target for the same amount of energy used to produce it. Low iron glass can be used to increase transmissivity.

One or more of the above aspects of the invention can be used in a fixture or a combination of fixtures. However, the more of the above aspects used, generally the more profound the results. Such an apparatus can, for the same amount of energy as a conventional HID lamp and fixture, (a) produce more useable light from the light source, (b) more efficiently reflect, control, and convey light from the light source out of the fixture, and (c) redirect light otherwise tending to go off the target area back into the target area.

In another aspect of the invention, a plurality of these fixtures are used together in a lighting system designed for a specific target area. Cumulatively, more useable light, and more efficient and effective use of the additional generated light, for the same energy, can result, which can reduce the number of fixtures required to light a given target area. This can reduce the cost of the system and can further reduce the amount of energy required for operation of the system over substantial periods of time. It can also promote longer lamp life.

In another aspect of the invention, a method comprises (a) increasing the amount of useable light from the light source by operating an HID light source at or near horizontal with a larger metal halide salt pool and without white oxide coatings on the arc tube, especially in an enclosed fixture, (b) increasing the amount of useable light from the fixture by the efficient handling of light from the light source, including using high total reflectance reflecting surfaces and low light loss transmission surfaces at the fixture lens, and (c) increasing the amount of useable light at the target by placing a substantial portion of the high total reflectance reflecting surface generally in along a surface of revolution to create a controlled, concentrated light beam for use to a relatively distant target area, but with several other parts of the reflecting surface at different orientations and/or positions than the general surface of revolution to redirect what otherwise would be glare and spill light to the target.

An optional aspect of the invention comprises a method and apparatus for increasing the amount of electrical energy available to power the lamp without increasing the amount obtained from the electrical service. One example is use of a more energy efficient ballast circuit than is conventional. While such increases in efficiency are relatively small in absolute magnitude at any one time, over the several thousand hours of operation of such lamps, cumulatively they can be very significant.

Another optional aspect of the invention comprises a method and apparatus for supplying electrical energy to the arc lamp so that, over operational life of the arc lamp, energy usage is reduced. The method comprises operating the arc lamp at a lowered wattage than normally indicated for the lamp or lighting application, but not so low that it produces unacceptable amounts of light for the given application or substantially affects light characteristics or risk of lamp failure or damage. Operation at the lowered wattage is for a substantial part of the operation of the arc lamp. Over time, usually thousands of hours of lamp life, this can cumulatively represent a substantial savings in energy usage and cost.

In a further optional aspect of the invention, the energy to operate the lamp is reduced substantially but not enough to materially affect either characteristics or jeopardize life of the lamp, but at some later time in operational life, the amount of electrical energy to the lamp during operation is increased to compensate at least partially for lumen depreciation that occur in such arc lamps over time of operation. The increase in electrical energy is selected such that cumulatively the amount of electrical energy used over a good portion of the life of the lamp is still less than what conventionally would be used so that a net energy savings is realized. Length of operational life of the lamp can also sometimes be materially increased.

In a still further aspect of the invention, apparatus and methods reduce blockage or dispersion of light in or from the fixture which can result in more useable light at the target for a given amount of energy used. In one example, an apparatus and methods are utilized to reduce outgassing of the lighting fixture. The fixture is assembled in a controlled environment to reduce foreign substances from being inadvertently applied to any reflecting surface, the lamp, or the lens, and is sealed at the factory. Another example includes replacing one or more conventional HID fixture parts with those made of a material that does not outgas. Another example is exchanging air in the interior of the fixture through a filter. Another example is obscuring pieces that might outgas from light, particularly UV light. A reduction in outgassing and/or foreign substances on such surfaces or parts can increase the amount of light emanating from the fixture for the same amount of energy used by the fixture.

Another aspect of the invention, an apparatus, method, and system are provided which materially reduce glare or spill light from one or a plurality of fixtures for a given application or target space.

These and other objects, features, advantages and aspects of the present invention will become more apparent with reference to the accompanying specification and claims.

III. BRIEF DESCRIPTION OF THE DRAWINGS

The drawings illustrate details regarding one exemplary embodiment of a fixture according to the present invention. Some of the drawings illustrate principles regarding the fixture and its use in sports lighting systems. The sub-headings are intended to give a general idea of what certain groups of the drawings relate to.

A. General Sports Lighting Systems

FIG. 1A and FIGS. 1B-G illustrate generally a sports lighting system, and conventional components for a sports lighting system.

B. Modified Arc Tube 12

FIG. 2A and FIGS. 2B-E illustrate a high intensity discharge arc tube according to an embodiment of the present invention.

C. Z-Lamp™ 20

FIG. 3A and FIGS. 3B-D illustrate a high intensity discharge arc lamp that is used with an exemplary embodiment of the present invention.

D. General Parts of Fixture 10

FIG. 4 is a diagrammatic, partial exploded view of a light fixture 10 according to an exemplary embodiment of the present invention.

FIG. 5A and FIGS. 5B-C are various views of the fixture of FIG. 4 with a first exemplary embodiment of a visor (sometimes referred to as the short visor) according to the present invention.

FIG. 6A and FIG. 6B are similar to FIG. 5A and FIGS. 5B-C but with a second exemplary embodiment of a visor (sometimes referred to as the long visor) according to the present invention.

E. Total Tilt Factor Correction Mechanism

FIGS. 7A-D are diagrammatic illustrations of operation of an automatic tilt factor correction mechanism according to an exemplary embodiment of the invention.

F. High Reflectivity Reflecting Inserts Generally

FIG. 8A and FIGS. 8B-E are general illustrations of high reflectivity reflecting inserts that form the primary reflecting surface over an underlying reflector frame or support.

G. Reflector Frame 30 (Less converging Bottom and/or Side Shift)

FIG. 9A and FIGS. 9B-C are plan views of one example of a reflector frame according to an exemplary embodiment of the present invention.

FIG. 9D and FIGS.4E-Z and FIG. 9AA following it are more detailed views of the reflector frame of FIGS. 9A-C.

FIG. 10A and FIGS. 10B-F are similar to FIG. 9A and FIGS. 9B-9AA but show an alternative embodiment of a reflector frame, adapted to include a right side beam shift according to one aspect of the invention.

FIG. 11A and FIGS. 11B-E are similar to FIG. 10A and FIGS. 10B-F but show an alternative left side beam shift reflector frame.

FIG. 12A and FIGS. 12B-F are views of an alternative embodiment to the reflector frame of FIG. 9A and FIGS. 9B-9AA.

FIG. 12G and FIGS. 12H-I that follow is an alternative reflector frame to the right shift reflector frame of FIG. 10A and FIGS. 10B-F.

FIG. 12J and FIGS. 12K-L is an alternative left shift reflector frame to that of FIG. 11A and FIGS. 11B-E.

FIG. 13A and FIGS. 13B-F is an alternative reflector frame to that of FIG. 9A and FIGS. 9B-9AA.

FIG. 13G and FIGS. 13H-I is an alternative right side shift reflector frame to that of FIG. 10A and FIGS. 10B-F.

FIG. 13J and FIGS. 13-K-L is an alternative left side shift reflector frame to that of FIGS. 11A-C.

FIGS. 14A-C are illustrations of a centering ring is assist positioning of a lamp at the base of the reflector frame.

FIGS. 15A-D are illustration of a hold-down ring for clamping the centering ring of FIGS. 14A-C to the reflector frame.

FIGS. 16A-B are illustrations of a vent/filter positionable in an opening to the reflector frame to facilitate air exchange for interior of the reflector frame.

H. Specific Reflecting Inserts 120

FIG. 17A and FIGS. 17B-C illustrate one style of reflector insert that can be removably positioned into a reflector frame.

FIGS. 18A-C, 19A-C, 20A-C, 21A-C, 22A-C, 23A-C, 24A-C, and 25A-C, are alternative embodiments for a reflector insert.

I. Lamp Cone 40

FIG. 26A and FIGS. 26B-T are various plan, sectional, and isolated views of a lamp cone according to an aspect of the invention.

J. Knuckle Plate 60

FIG. 27A and FIGS. 27B-I are a perspective view, various plan views, sections, and isolated views of a knuckle plate according to an aspect of the invention.

FIG. 28A and FIG. 28B are various views of finger-safe electrical connectors for installable into the knuckle plate of FIG. 27A FIGS. 27B-I.

FIG. 29A and FIGS. 29B-G are various views of an electrical wire strain relief installable into the knuckle plate of FIG. 27A and FIGS. 27B-I.

FIG. 30A and FIGS. 30B-D is a perspective view and various views of a knuckle gasket for the knuckle of FIG. 36A and its sub-parts.

FIG. 31A and FIGS. 31B-C are various views of a bolt for holding a knuckle of FIG. 36A to the lamp cone of FIG. 26A.

FIG. 32A and FIGS. 32B-C are various views of an O-ring the seal the knuckle bolt of FIG. 31A.

FIG. 33A and FIGS. 33B-C are various views of a washer useable with the knuckle bolt.

FIG. 34A and FIGS. 34B-C are various views of a washer useable with the knuckle O-ring of FIG. 32A.

FIG. 35A and FIGS. 35B-D are various views of a knuckle cone strap bolt useable with the knuckle of FIG. 36A and the lamp cone of FIG. 26A.

K. Knuckle 50

FIG. 36A and FIGS. 36B-K are various views of a knuckle connectable between the knuckle plate of FIG. 27A and the lamp cone of FIG. 26A.

FIG. 37A and FIGS. 37B-D are perspective, plan, and isolated enlarged views of aspects of a pinion gear positionable between the knuckle of FIG. 36A and a lamp yoke of FIG. 44A.

FIG. 38A and FIGS. 38B-E are various views of a bushing for the pinion gear of FIG. 37A.

Figure 26A:
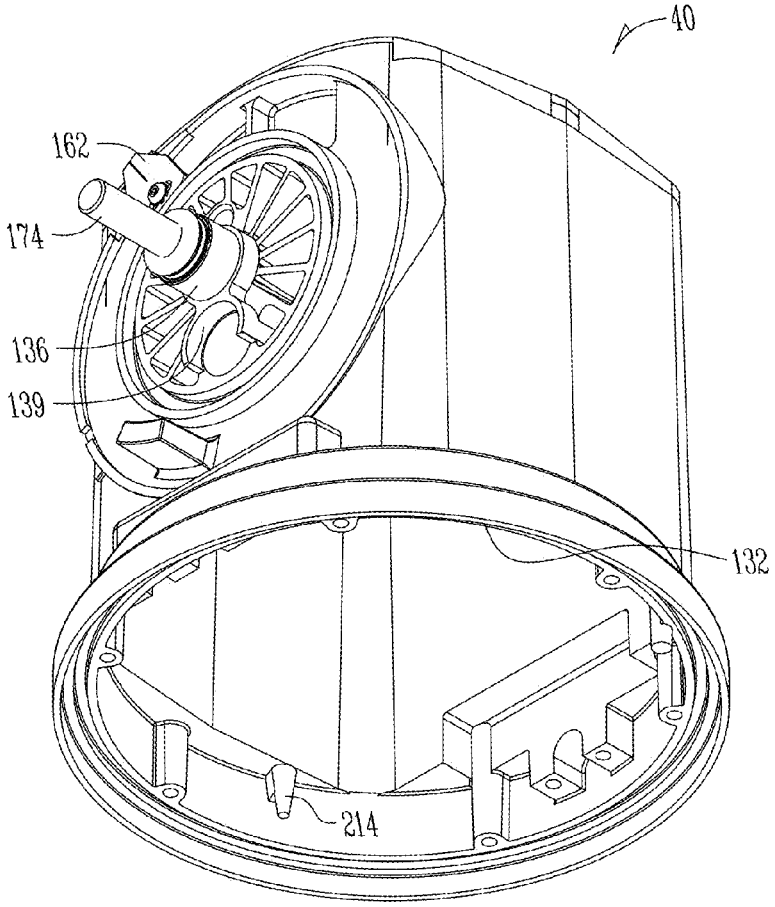
Figure 26B:
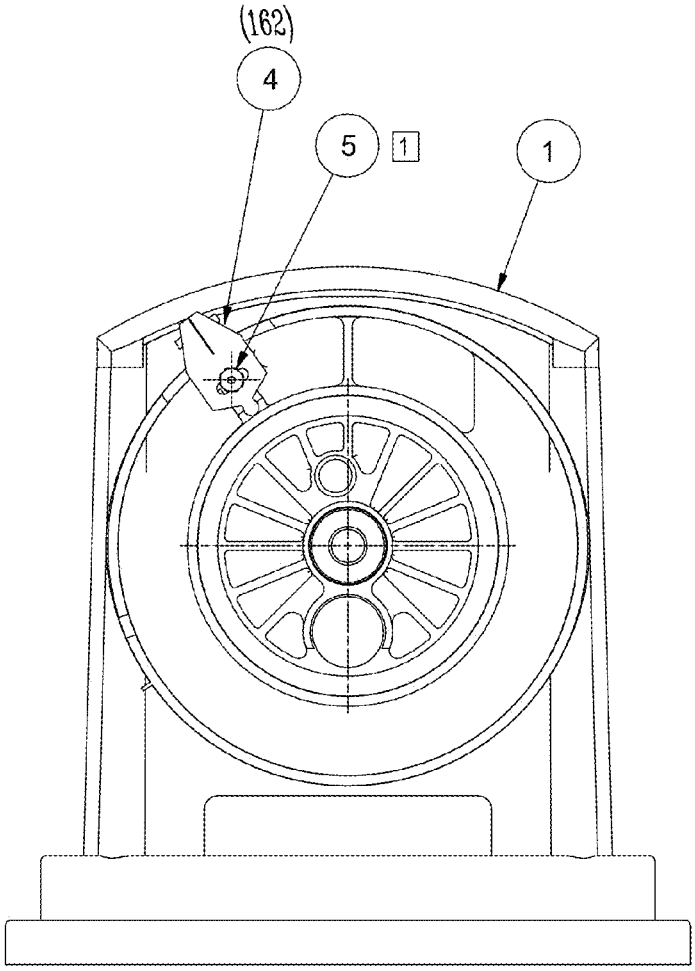

FIGS. 41A-C, 42A-F, and 43A-F, are various views, respectively, of an inside strap, outside strap, and inside stop strap useable with lamp cone of FIG. 26A to provide for accurate repositioning of the lamp cone if moved from factory alignment, for example, for maintenance purposes.

L. Yoke 80

FIG. 44A and FIGS. 44B-J are various views of a yoke adaptable to hold the socket for the arc lamp inside the lamp cone of FIG. 26A, including structure for automatic tilt factor correction by maintaining lamp orientation over a range of fixture aiming angles.

Figure 44A:
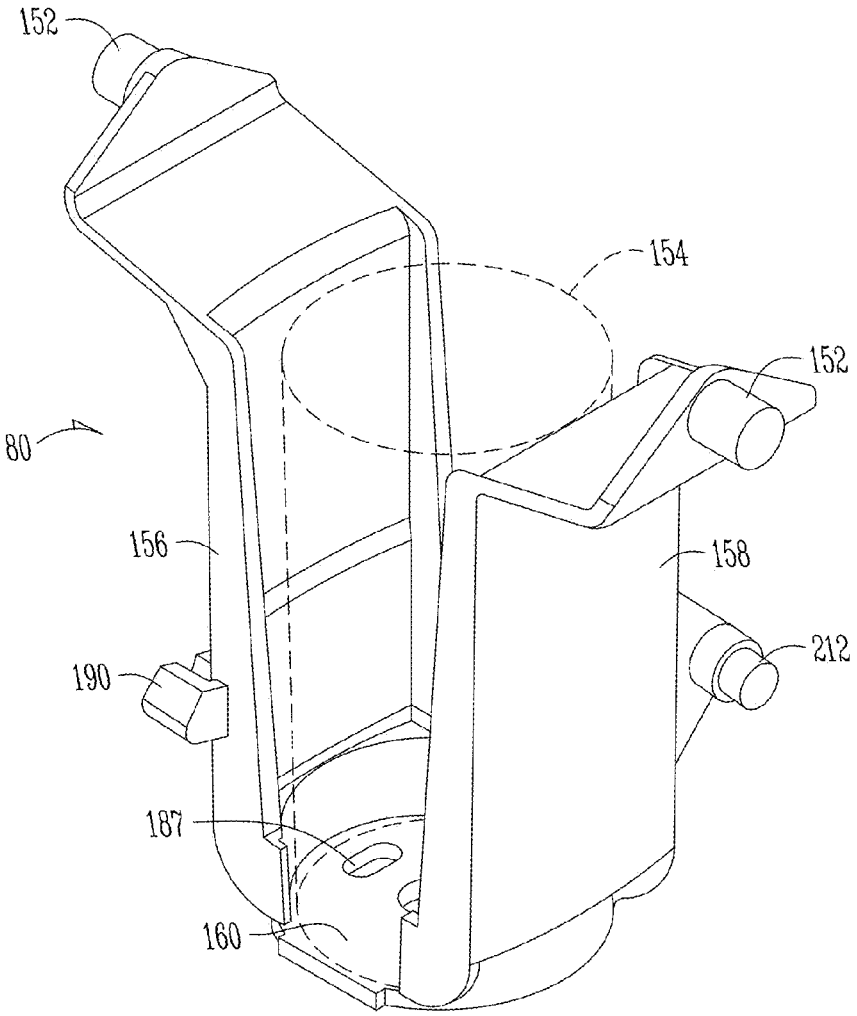
Figure 44B:
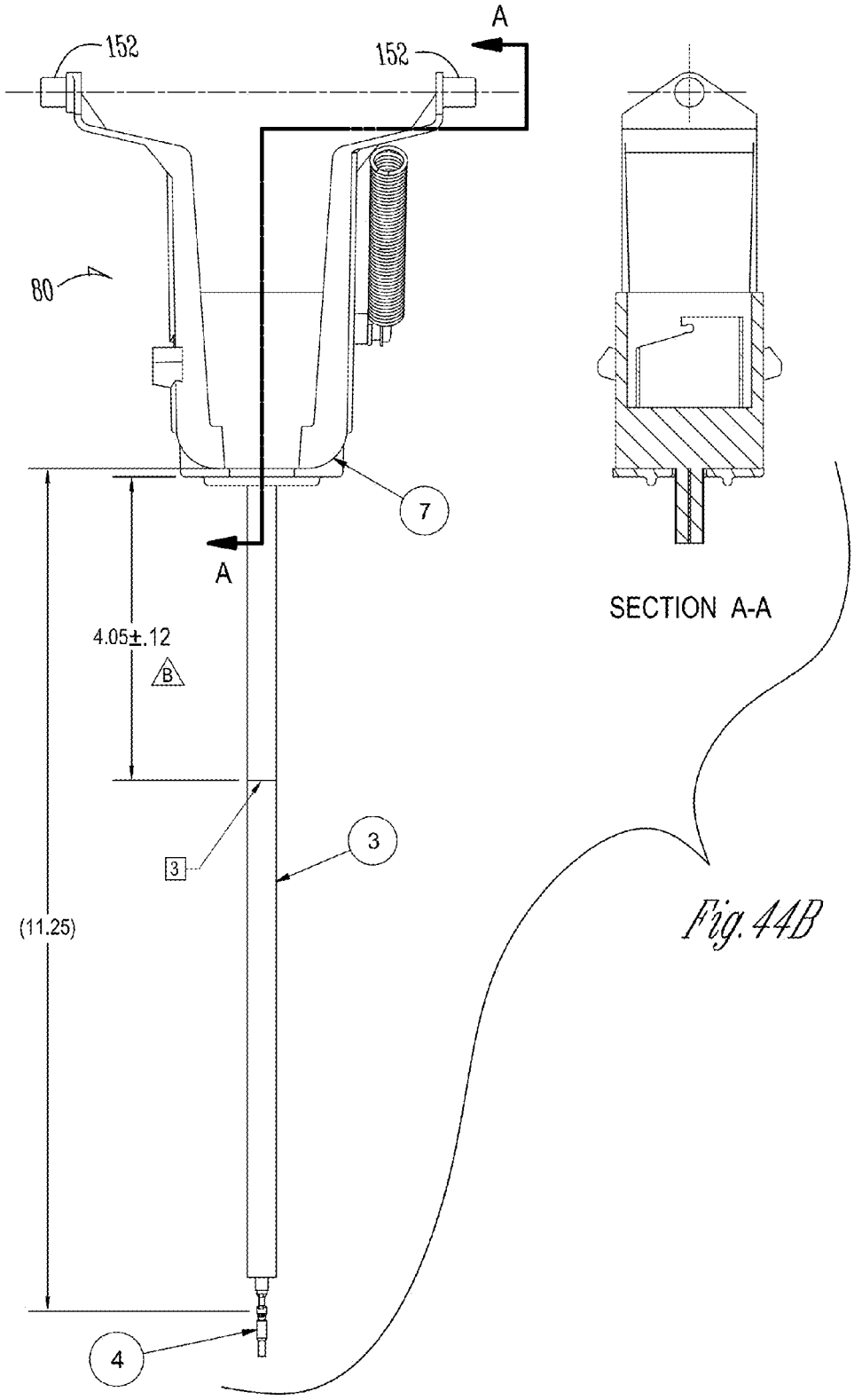
Figure 44C:
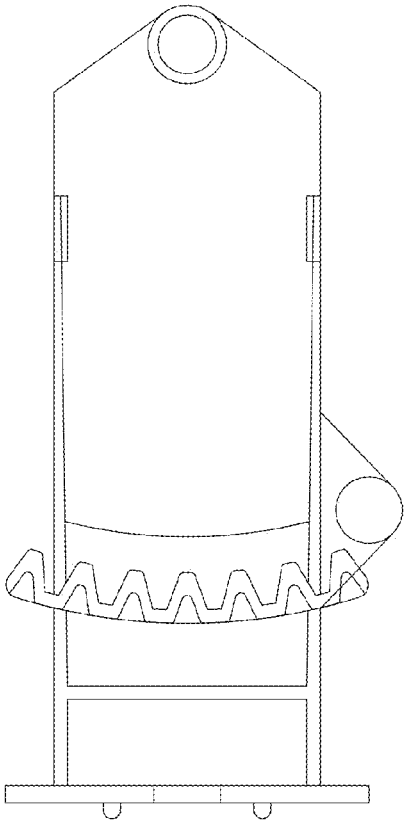
Figure 44D:
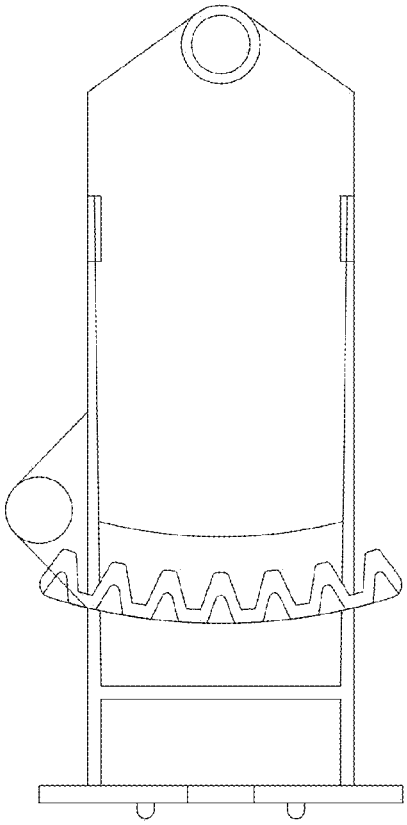
Figure 44E:
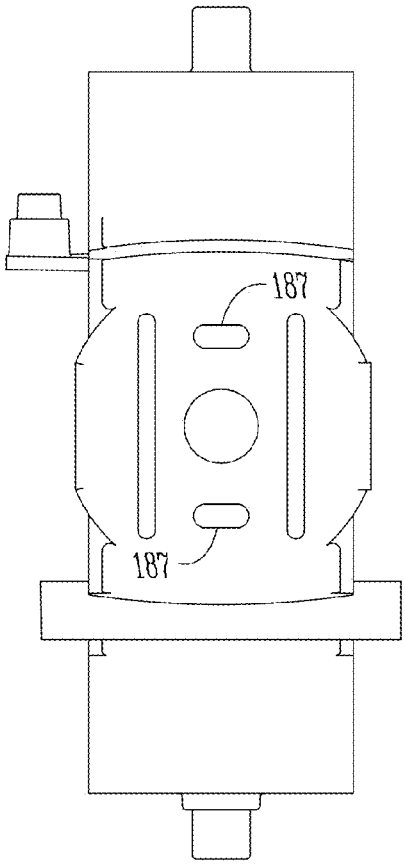
Figure 44F:
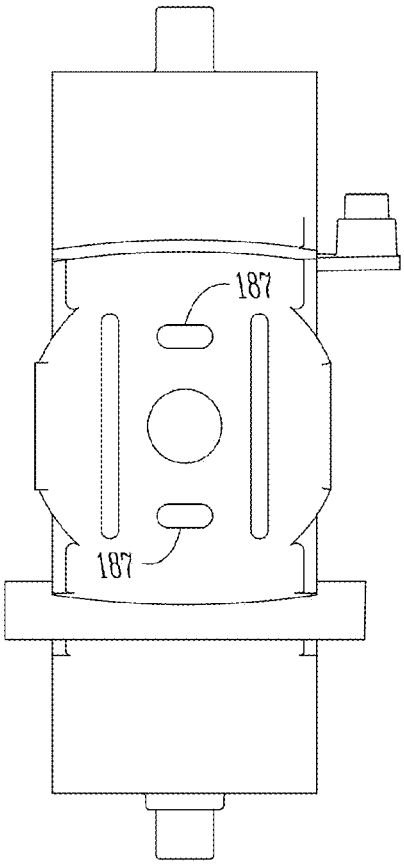
Figure 44G:
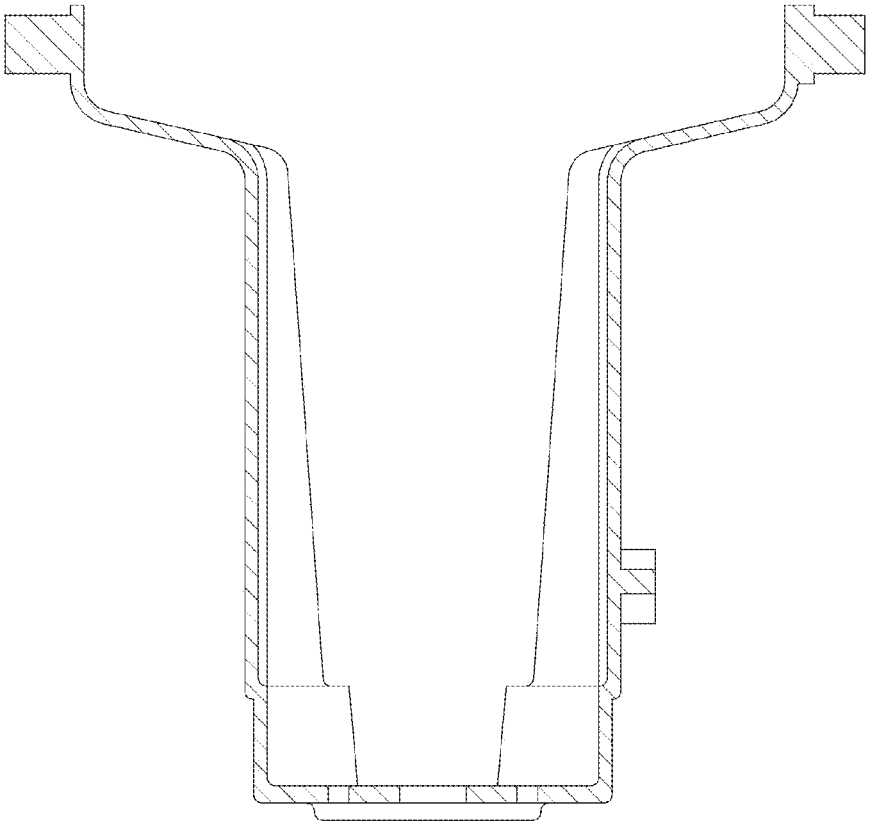

FIG. 45A and FIGS. 45B-D depict a yoke retainer to hold the yoke of FIG. 44A in pivotable position in the lamp cone of FIG. 26A.

M. Short and Long Visors 70 Generally

Figure 5A:
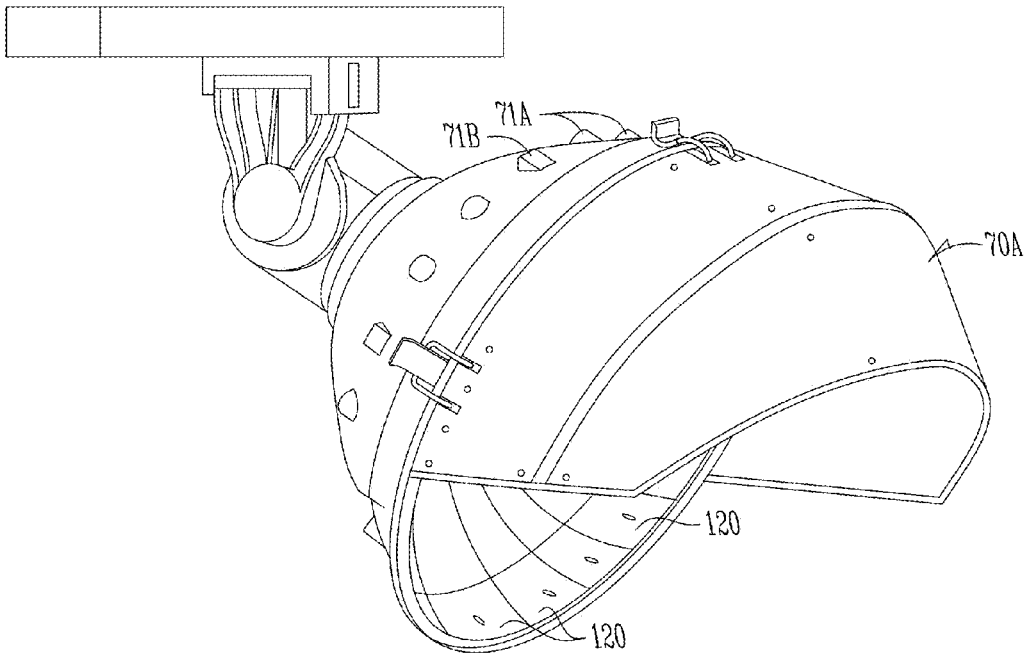
Figure 5B:
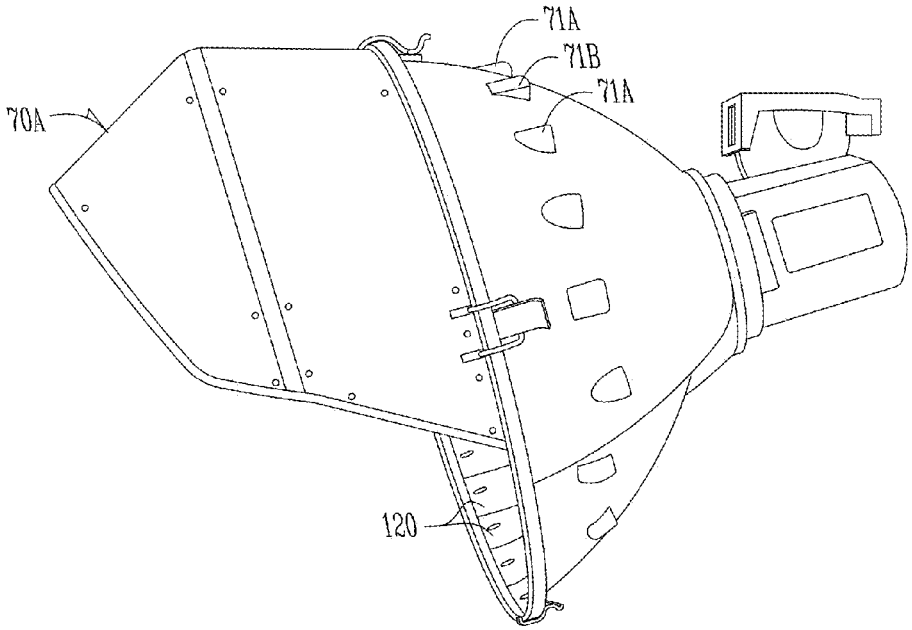
Figure 6A:
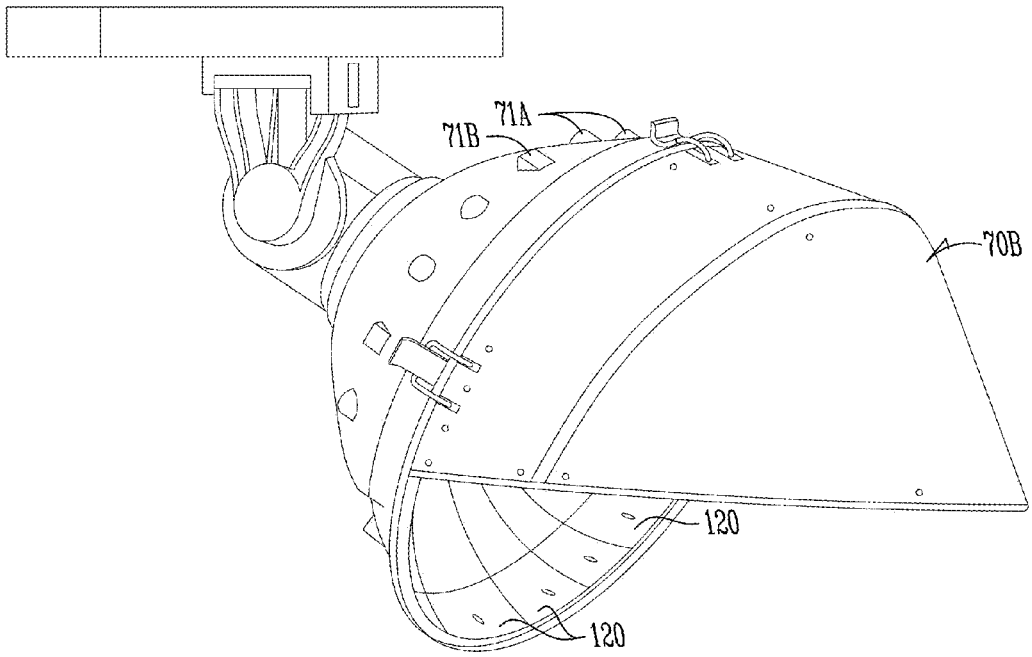
Figure 6B:
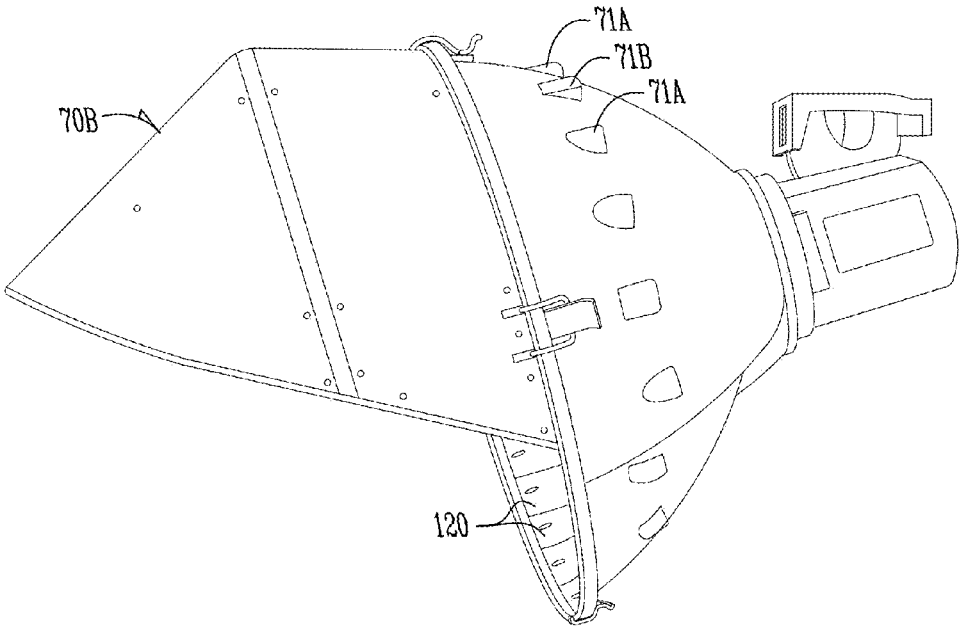
Figure 7A:
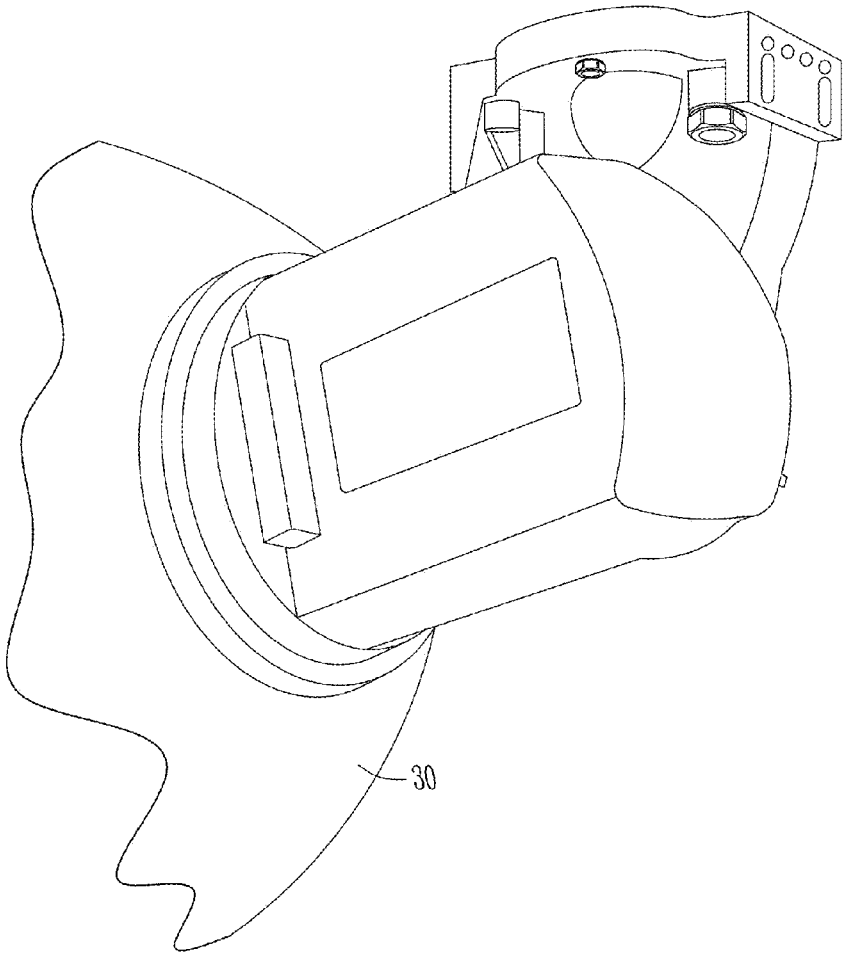
Figure 7B:
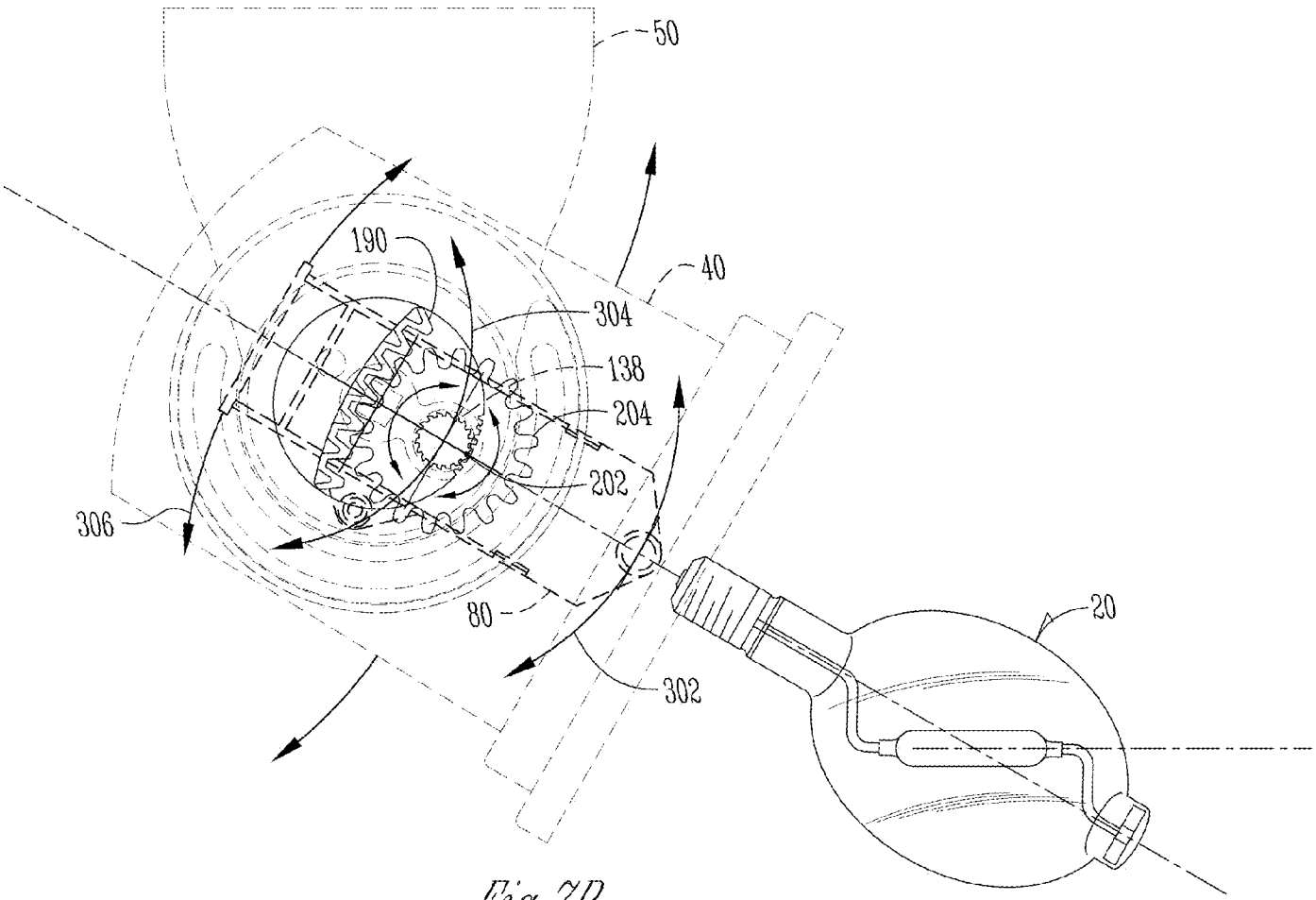
Figure 7C:
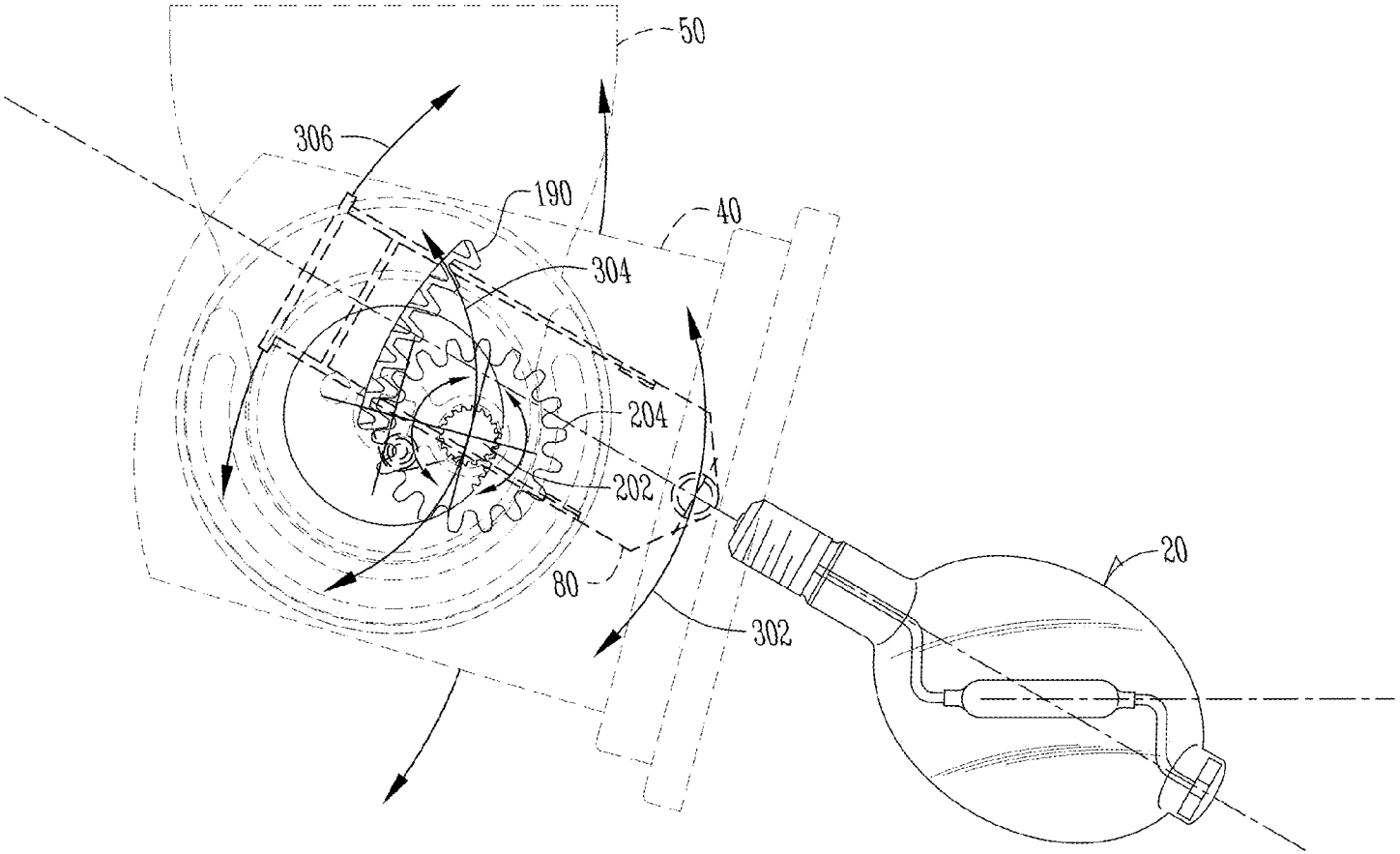
Figure 7D:
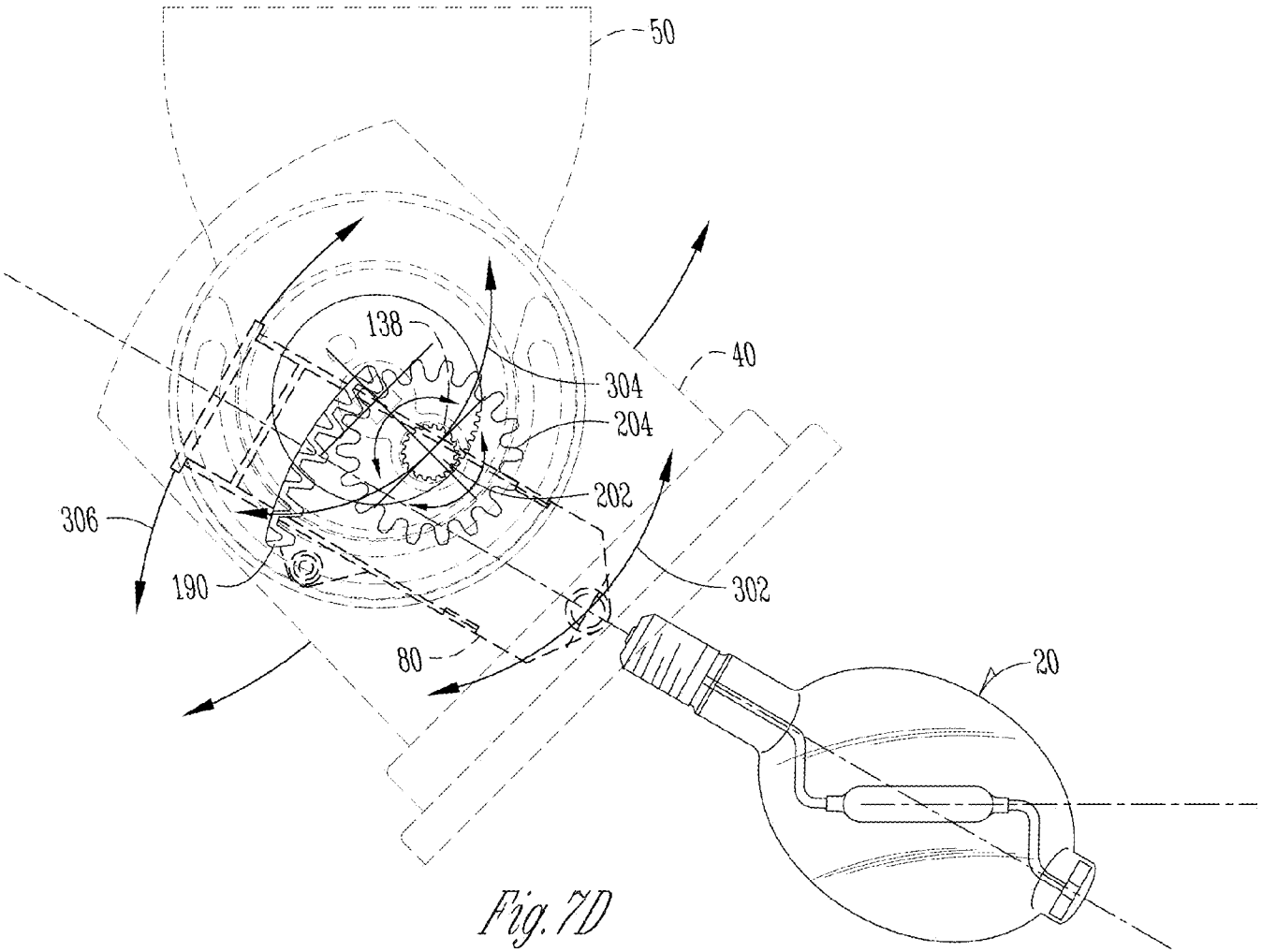
Figure 8A:
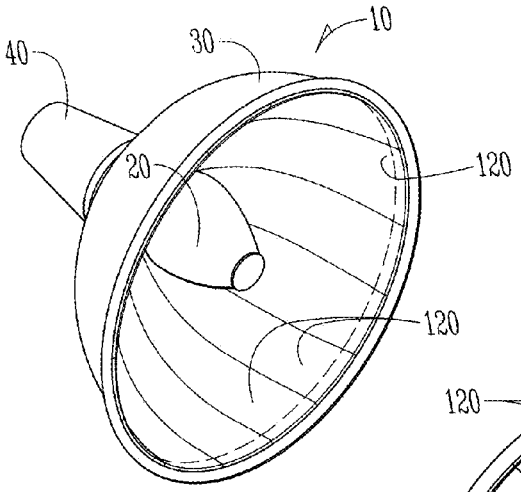
Figure 8C:
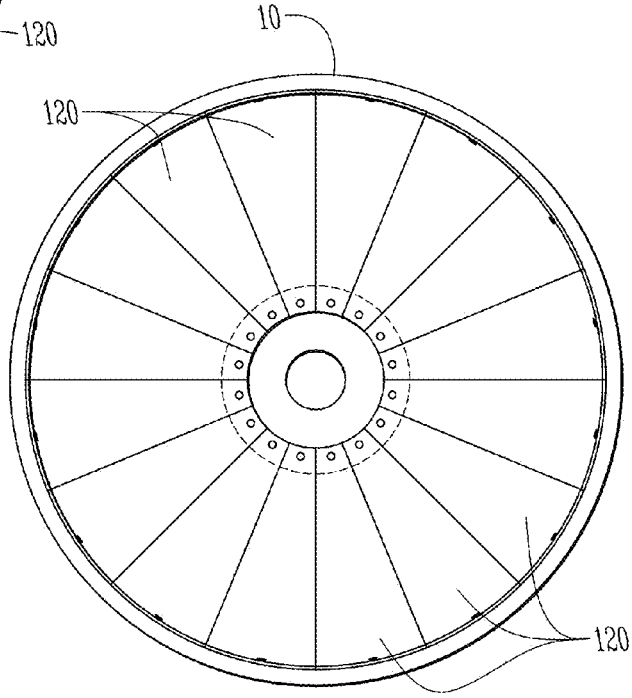
Figure 8B:
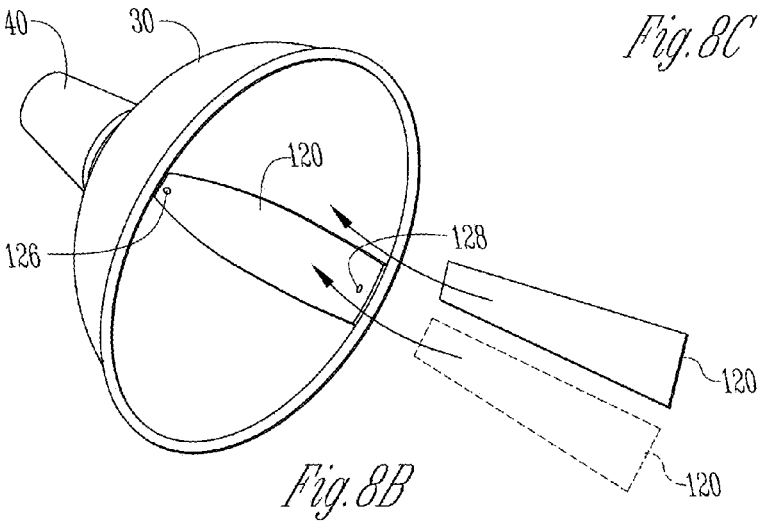
Figure 8D:
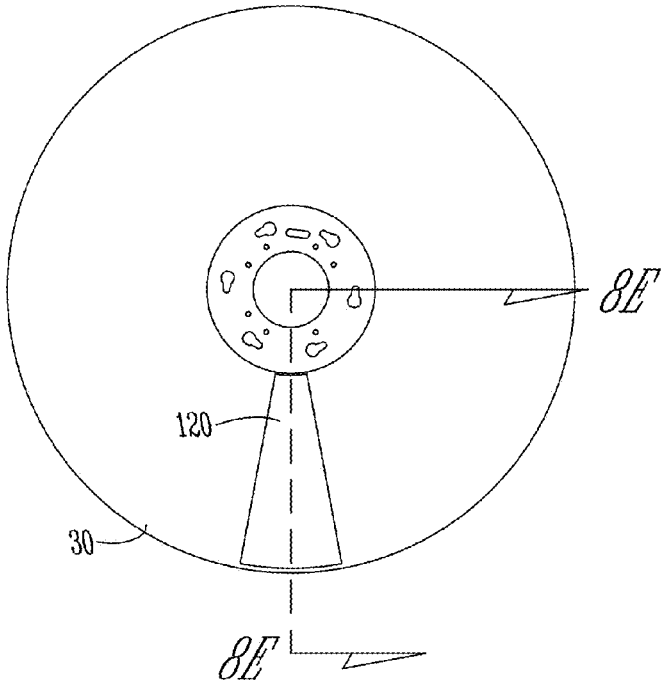
Figure 8E:
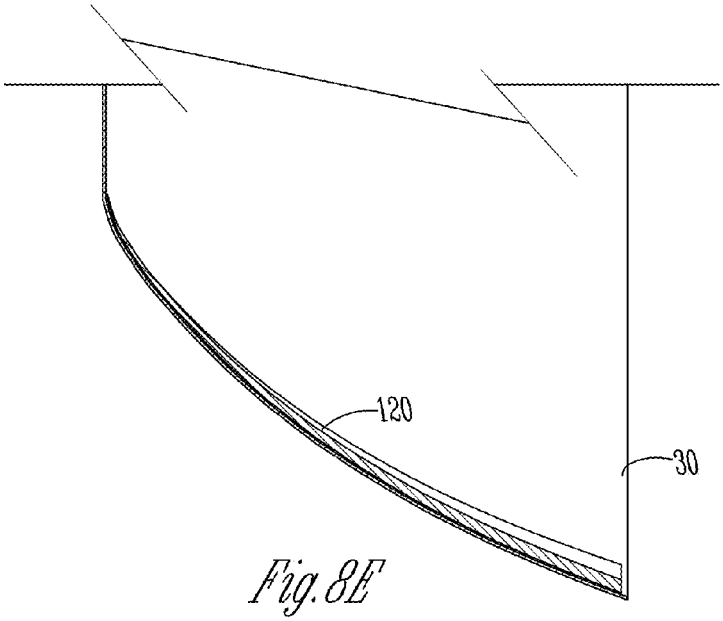
Figure 46A:
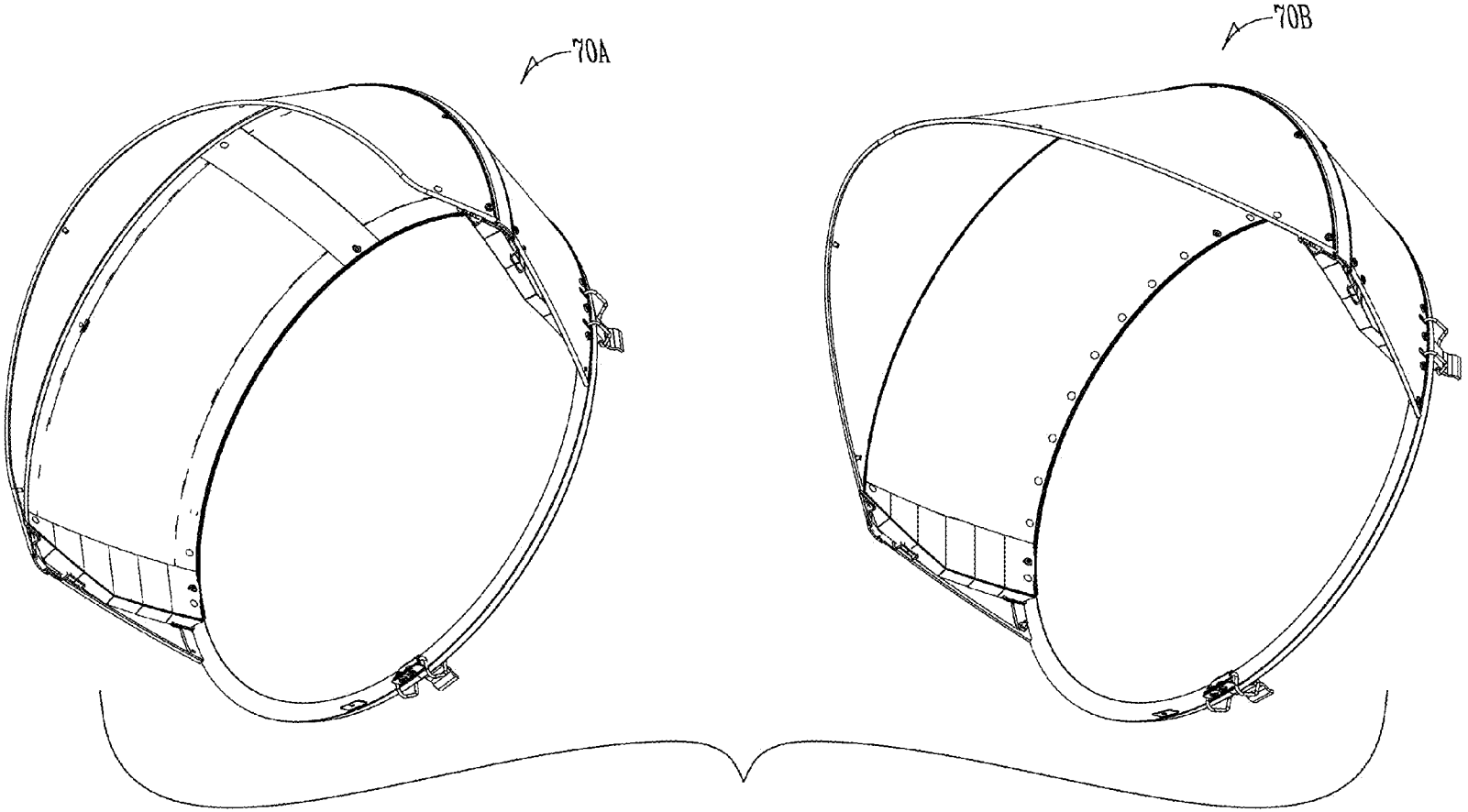

FIG. 46A is a side-by-side perspective view of the two visors of FIGS. 5A and 6A attached to the reflector frame and also showing examples of high reflectivity reflecting strips mounted on the underside of the visors.

Figure 46B:
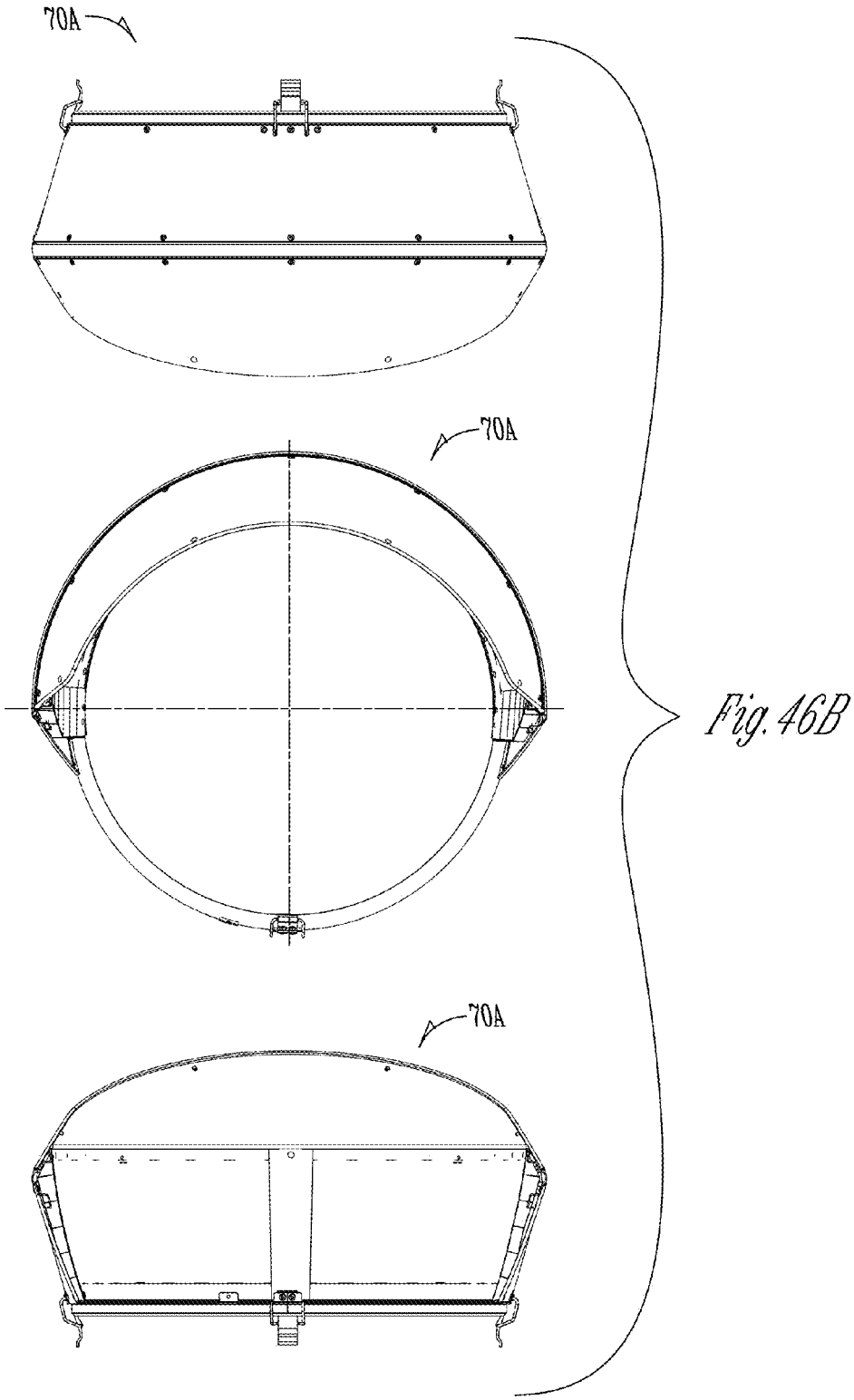

FIG. 46B is plan views showing the left-most visor of FIG. 46A.

Figure 47A:
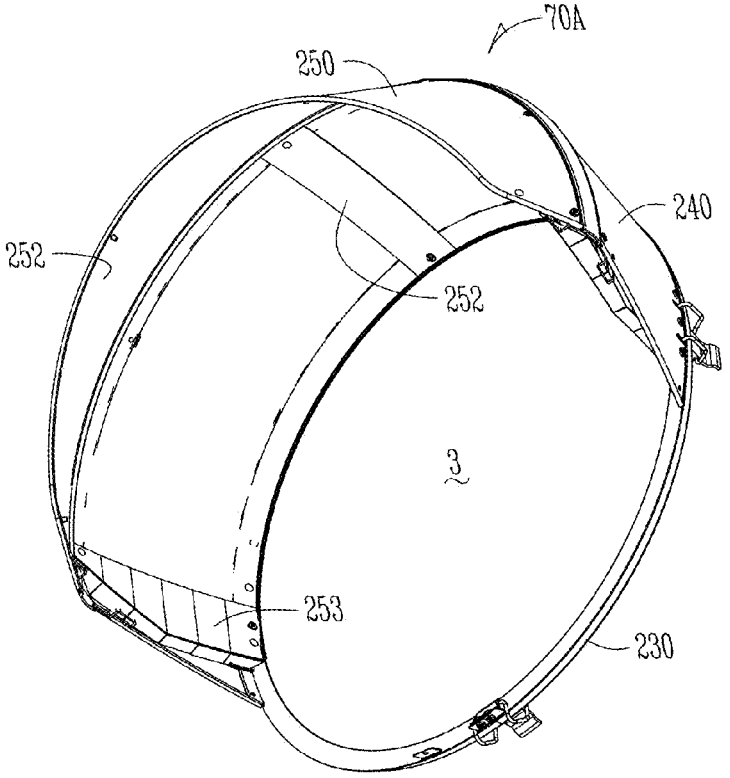
Figure 47B:
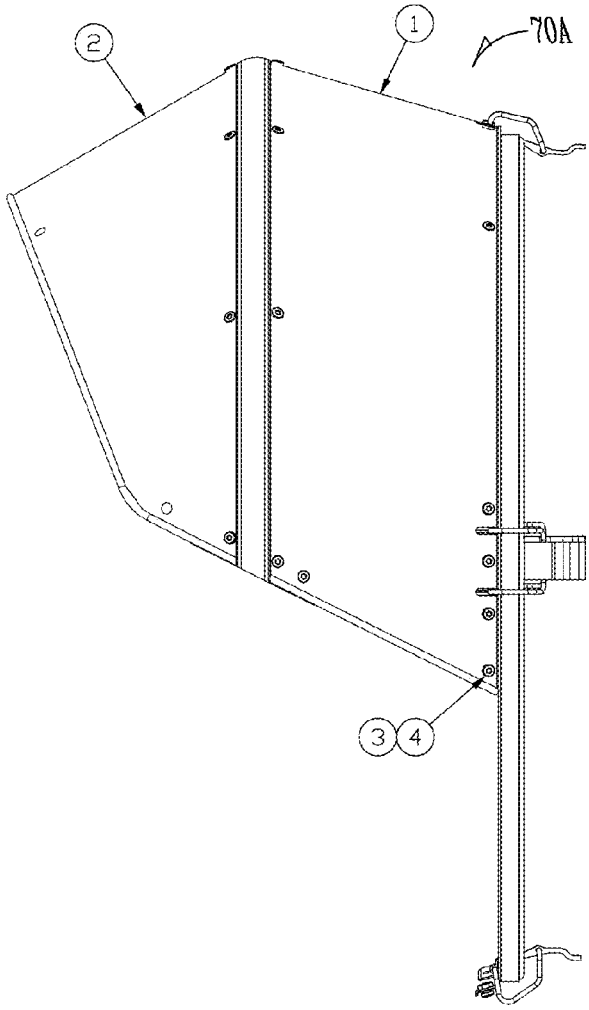

FIGS. 47A and 47B are additional views of the left-most reflector of FIG. 46A.

Figure 48A:
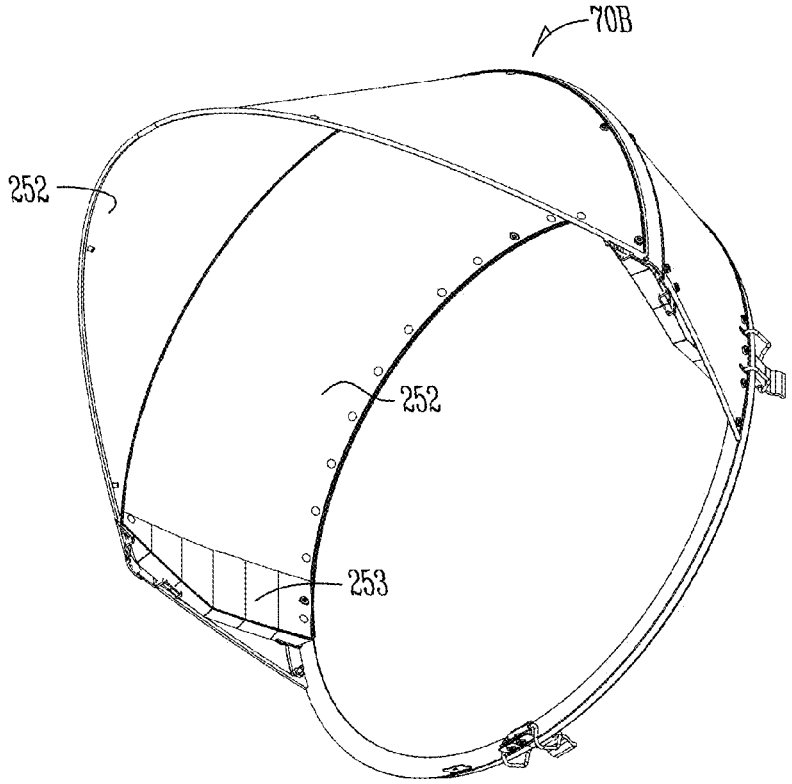
Figure 48B:
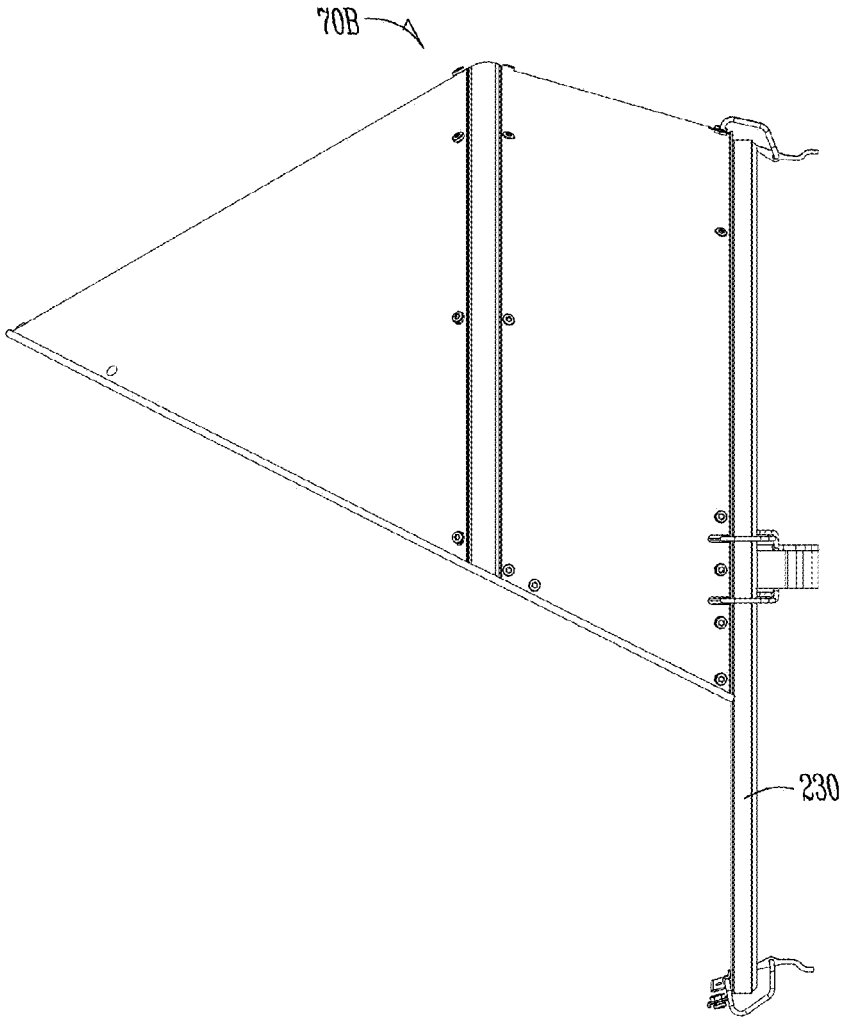

FIGS. 48A and 48B are additional views of the right-most reflector of FIG. 46A.

N. Glass Lens

FIG. 49A and FIGS. 49B-E are various views of a lens rim adapted to hold a glass lens for the light fixture and to which a visor can be attached.

Figure 49A:
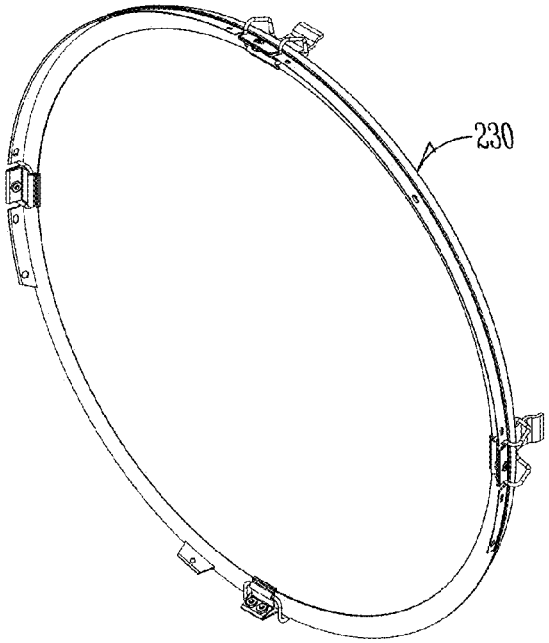
Figure 49B:
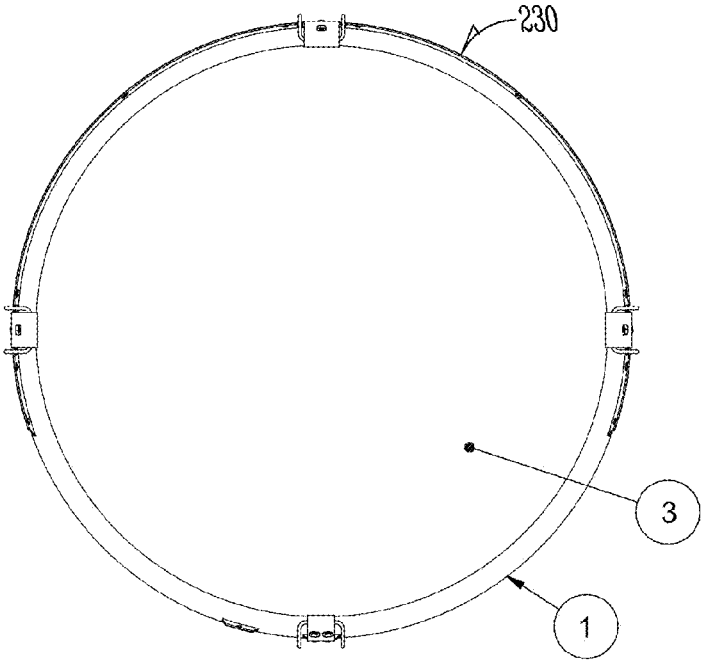
Figure 49C:
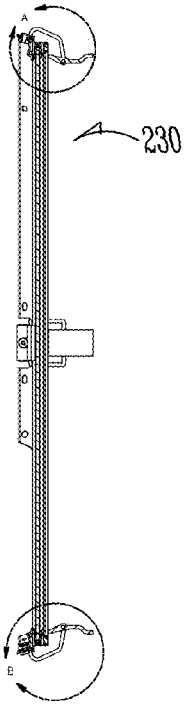
Figure 49D:
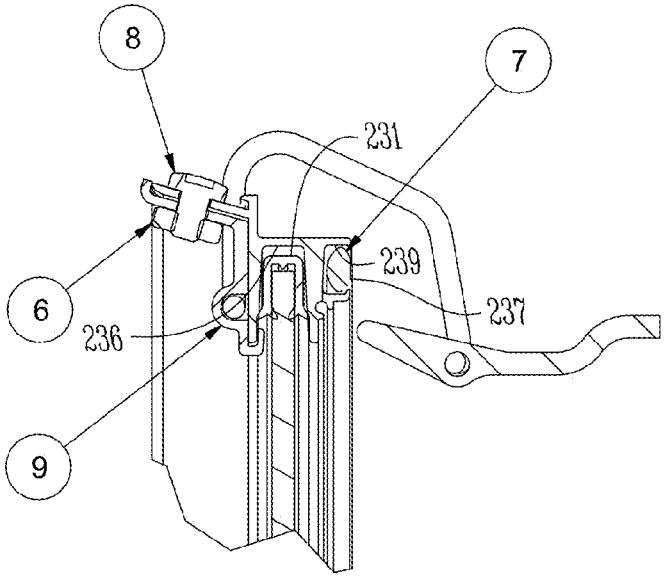
Figure 49E:
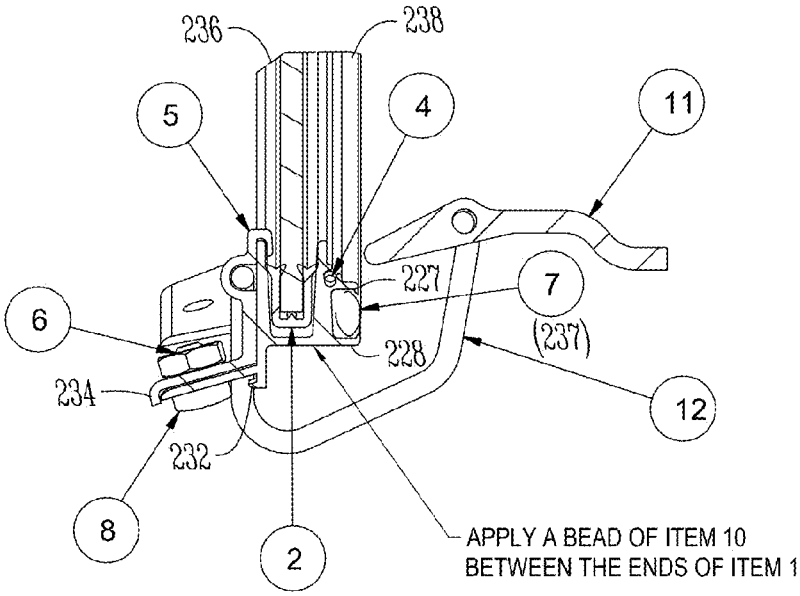

FIG. 50A and FIGS. 50B-D are views of a glass rim gasket to seal the lens rim of FIG. 49A to the reflector frame.

Figure 51A:
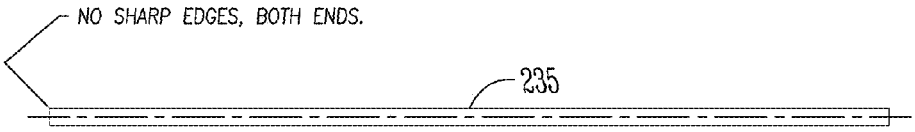
Figure 51B:
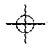

FIG. 51A and FIG. 51B are side and end views of a lens rim alignment pin to ensure correct rotational assembly of the lens rim of FIG. 49A to the reflector frame.

Figure 52A:
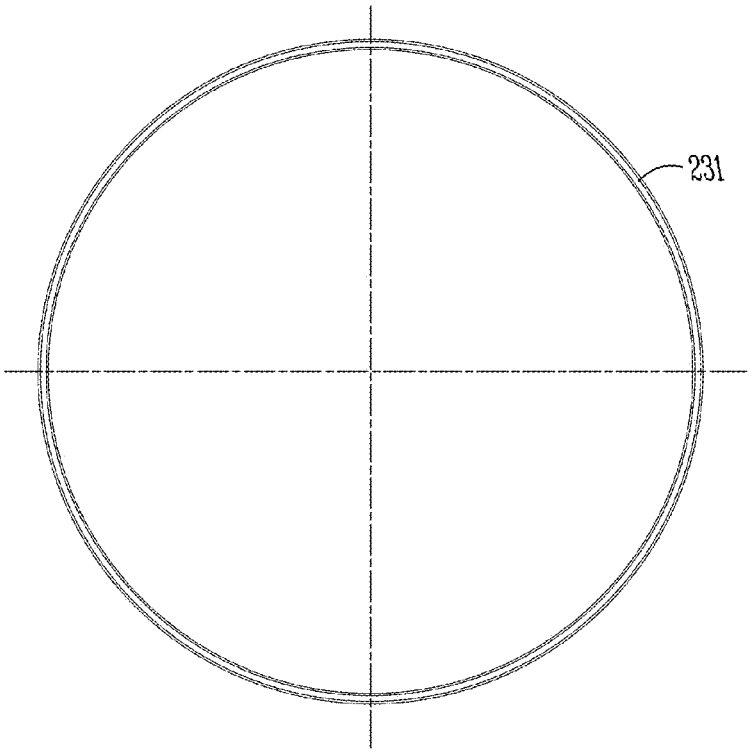
Figure 52B:
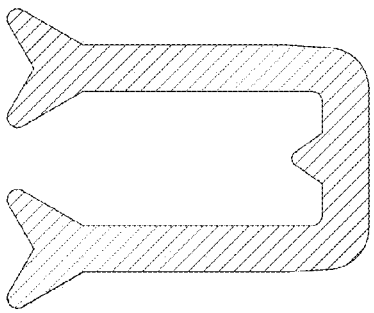
Figure 53A:
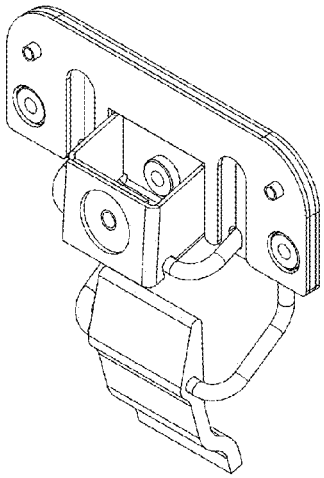
Figure 53C:
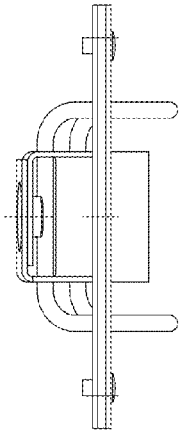
Figure 53B:
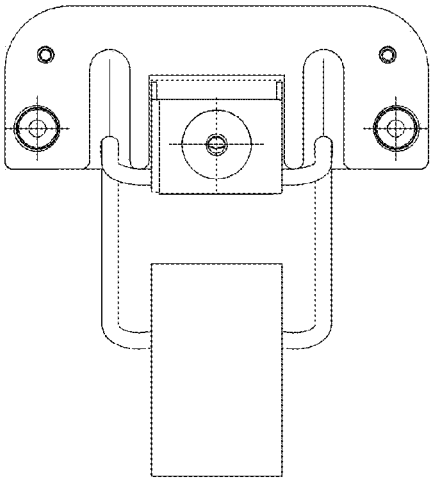
Figure 53D:
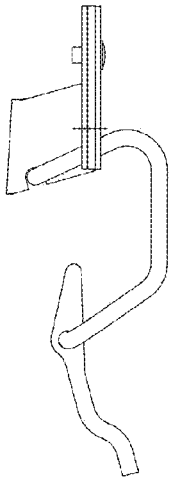
Figure 53E:
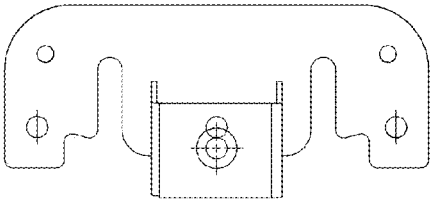
Figure 54A:
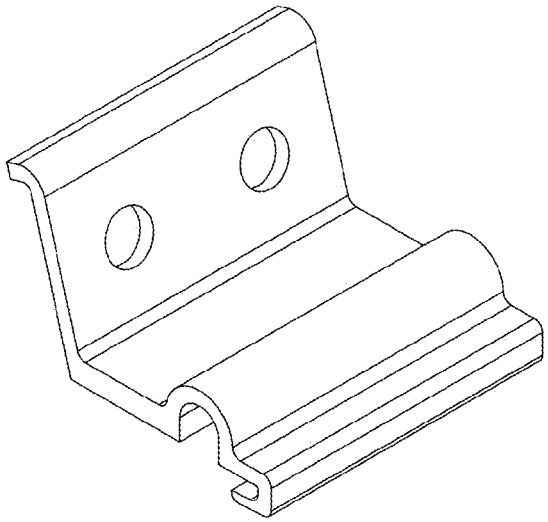
Figure 55A:
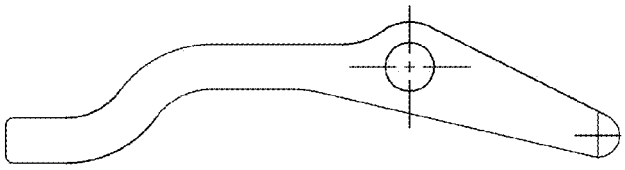
Figure 55B:
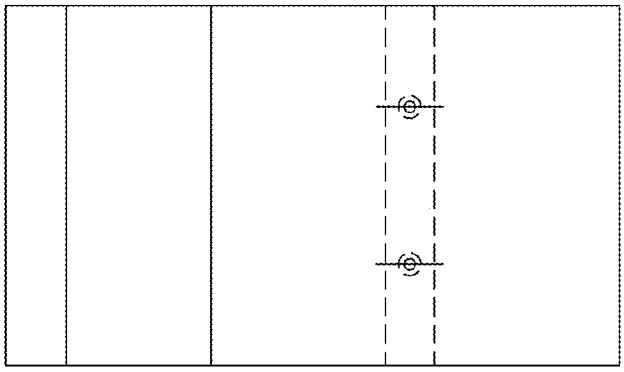
Figure 55C:
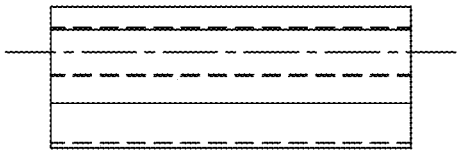
Figure 56A:
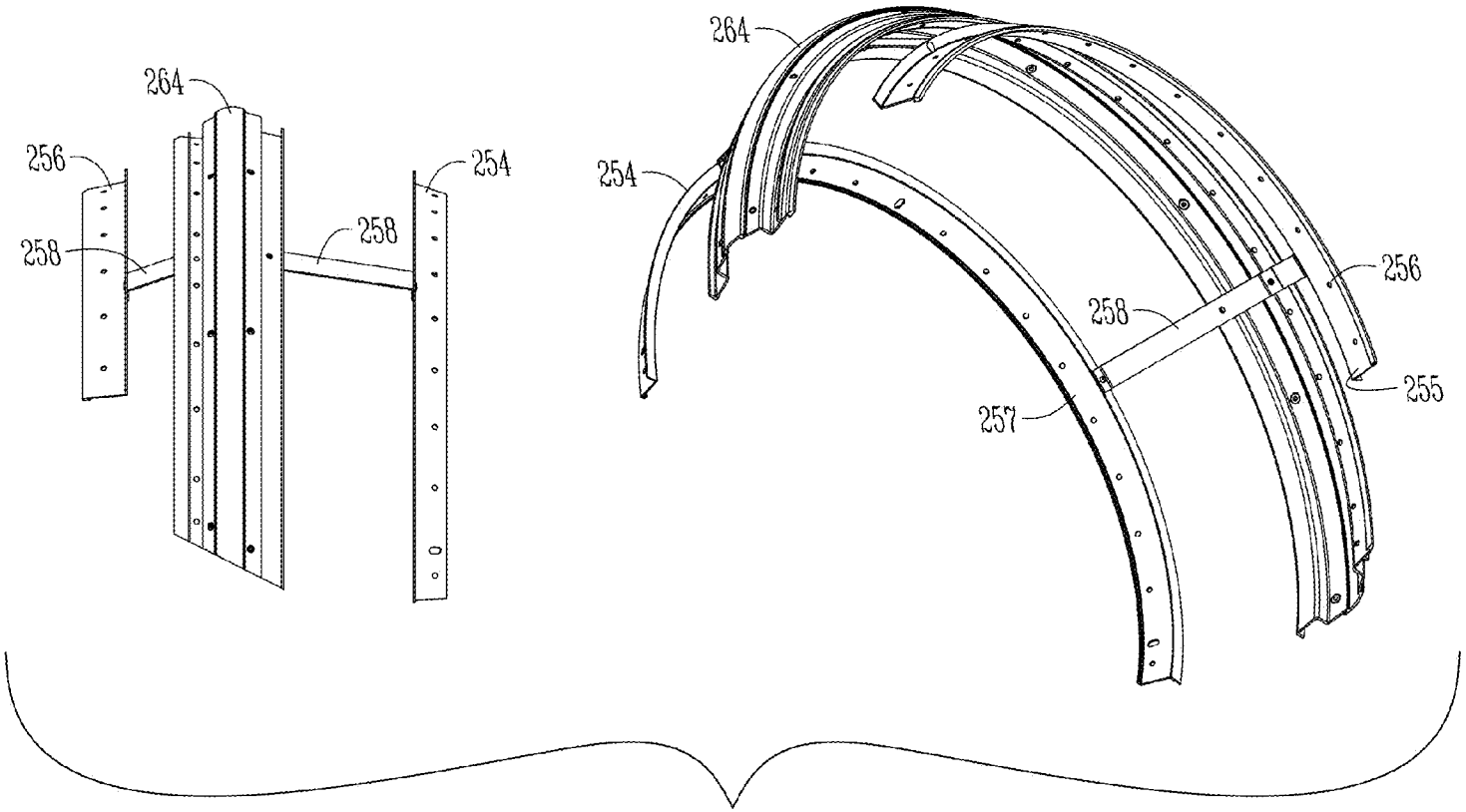
Figure 56C:
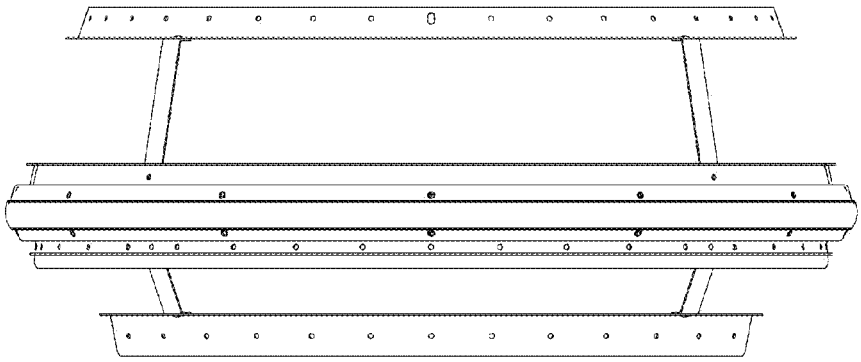
Figure 56B:
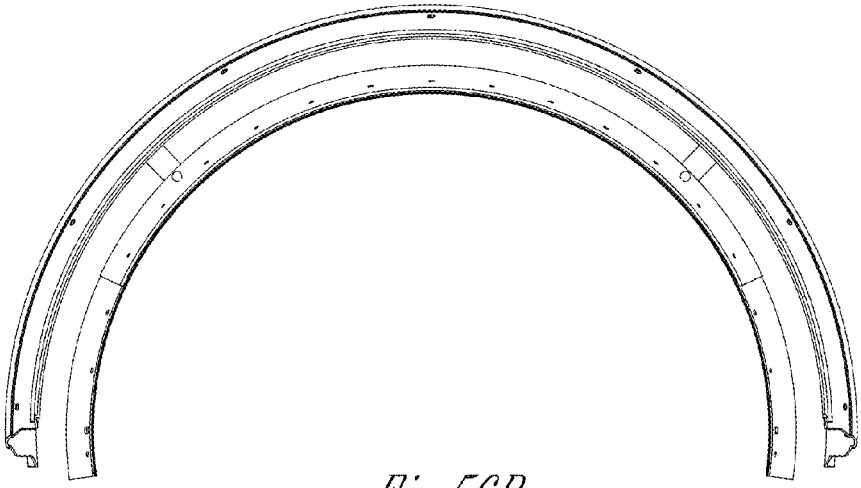
Figure 56D:
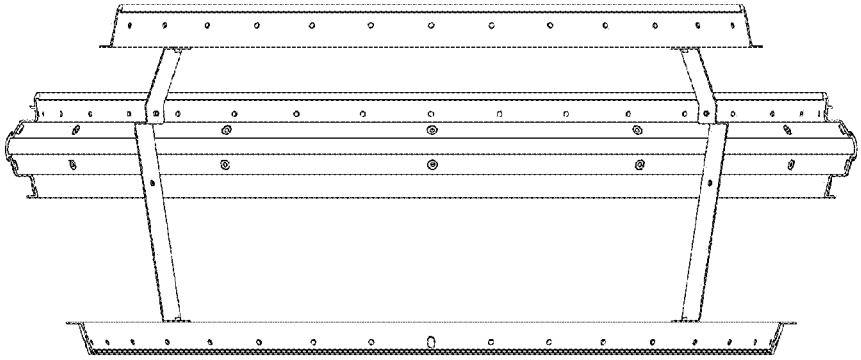
Figure 57A:
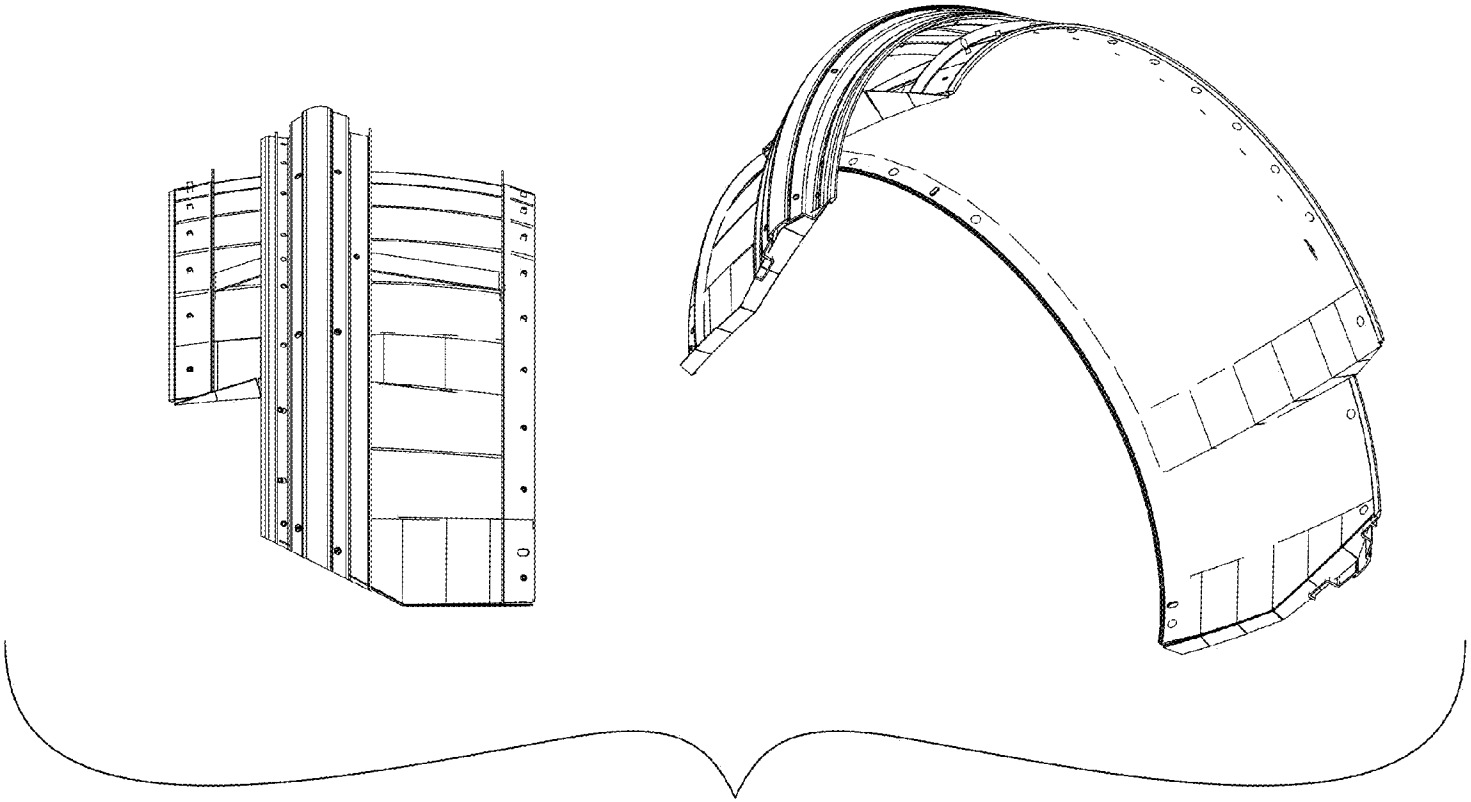
Figure 57C:
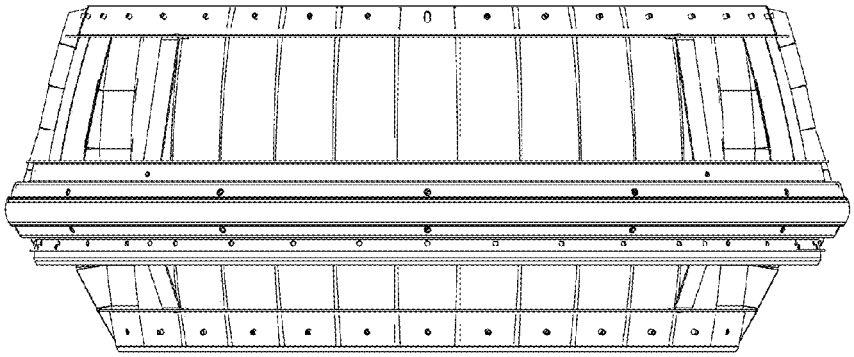
Figure 57B:
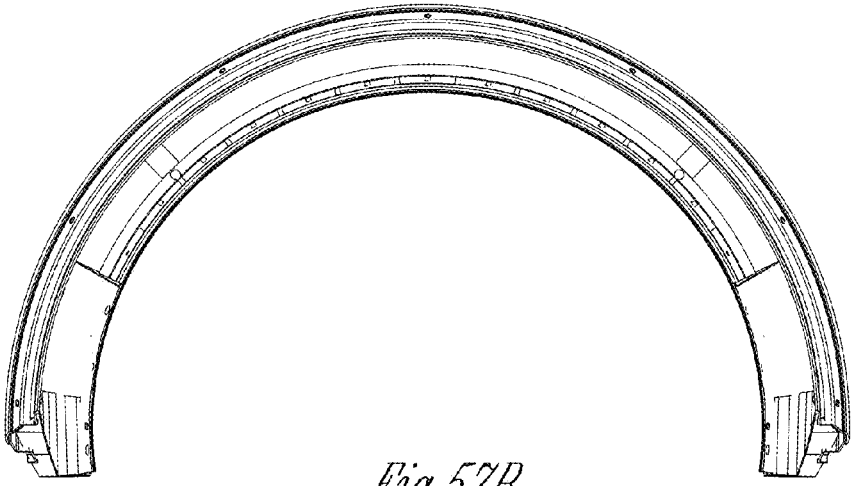
Figure 57D:
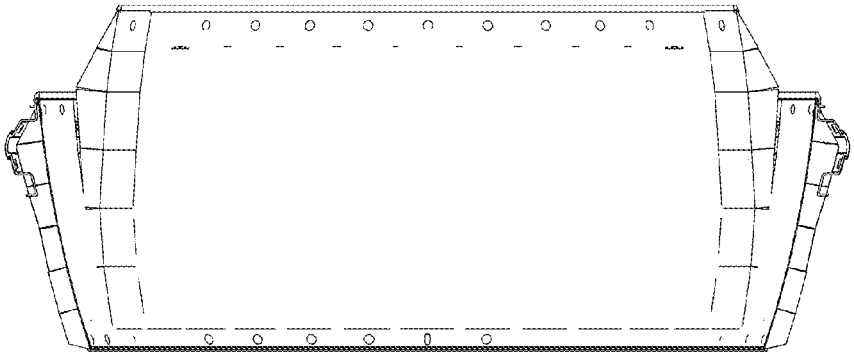
Figure 58A:
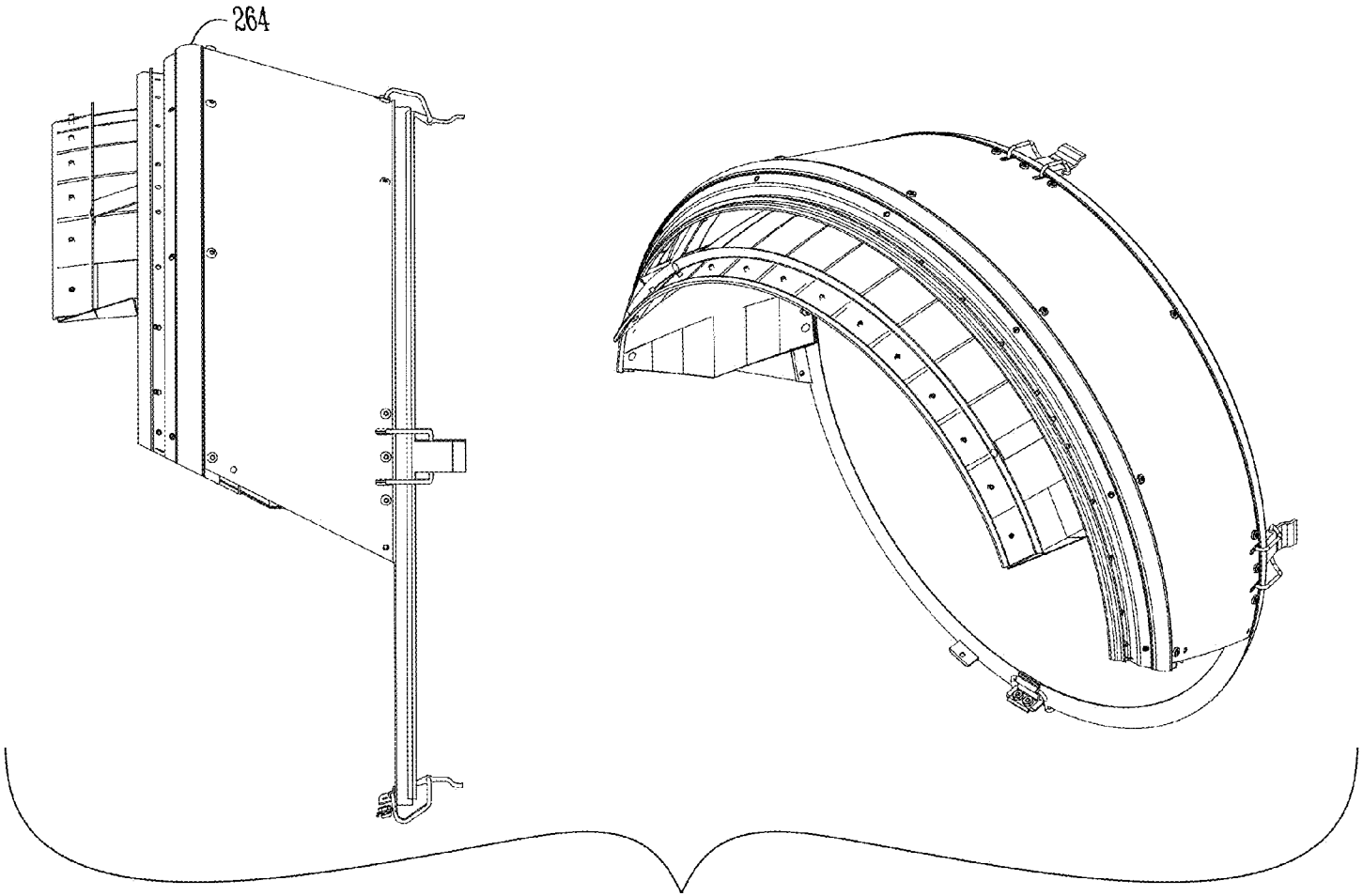
Figure 58C:
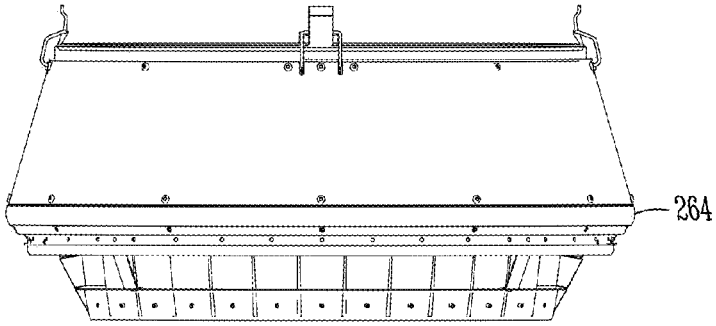
Figure 58B:
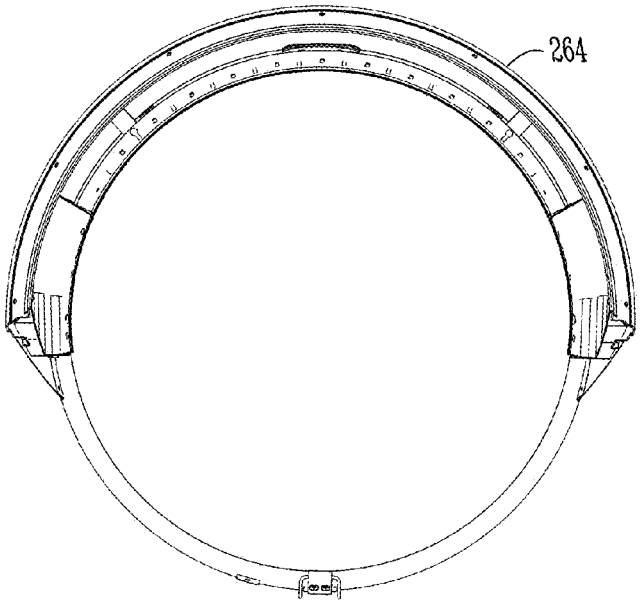
Figure 58D:
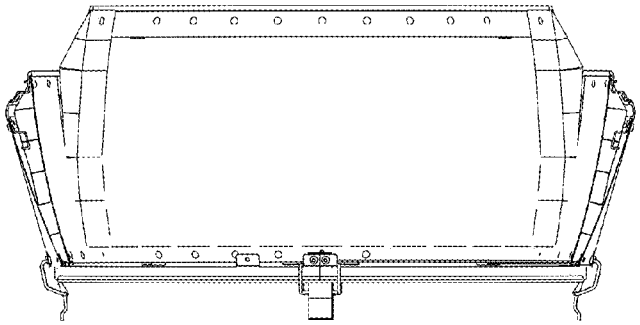

FIG. 52A and FIG. 52B are plan and enlarged cross-section views of a lens gasket to hold and seal the glass lens in the lens rim of FIG. 49A.

FIGS. 53A-E, 54A, and 55A-C are isolated views of a pivot block, a connector, and a lever for a latch for releasably latching the lens rim of FIG. 49A, with glass lens and visor, to a front opening of a reflector frame.

O. Mounting Rails and Supports for Visor Inserts

FIGS. 56A-D and 57A-D are views of a visor reflective insert upper rail and lower rail respectively, mountable on the inside of a visor to which can be attached high reflectance reflective insert strips such as shown in FIGS. 46A, 47A, and 48A.

FIG. 58A and FIGS. 58B-D show a visor transition clip securable to the inside of a visor for a transition between different sets of reflective inserts at different levels.

P. Base and Extension Parts of Short and Long Visors 70

Figure 59:
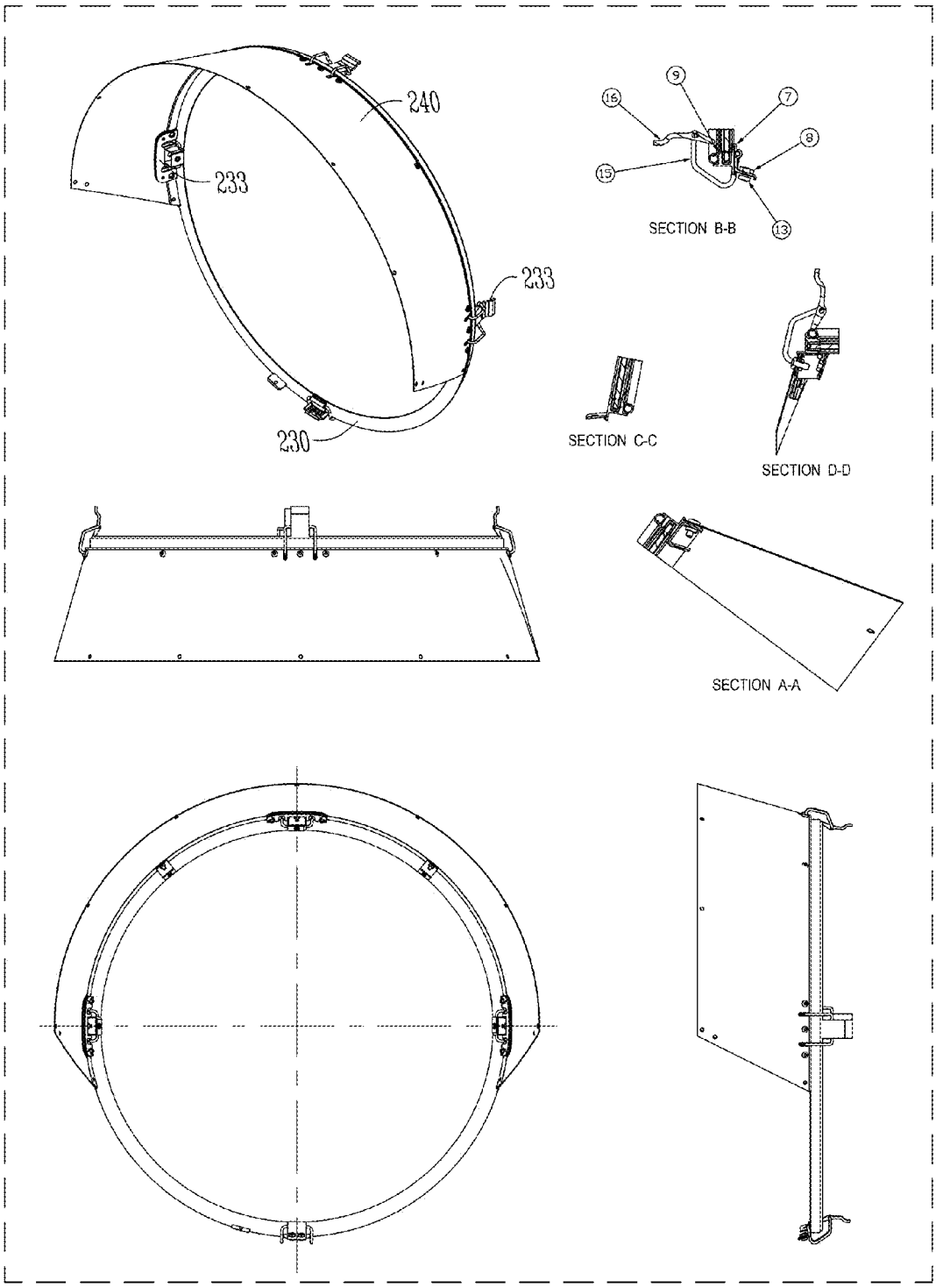

FIG. 59 are perspective and other views of a base visor attachable to the lens rim of FIG. 49A.

Figure 60:
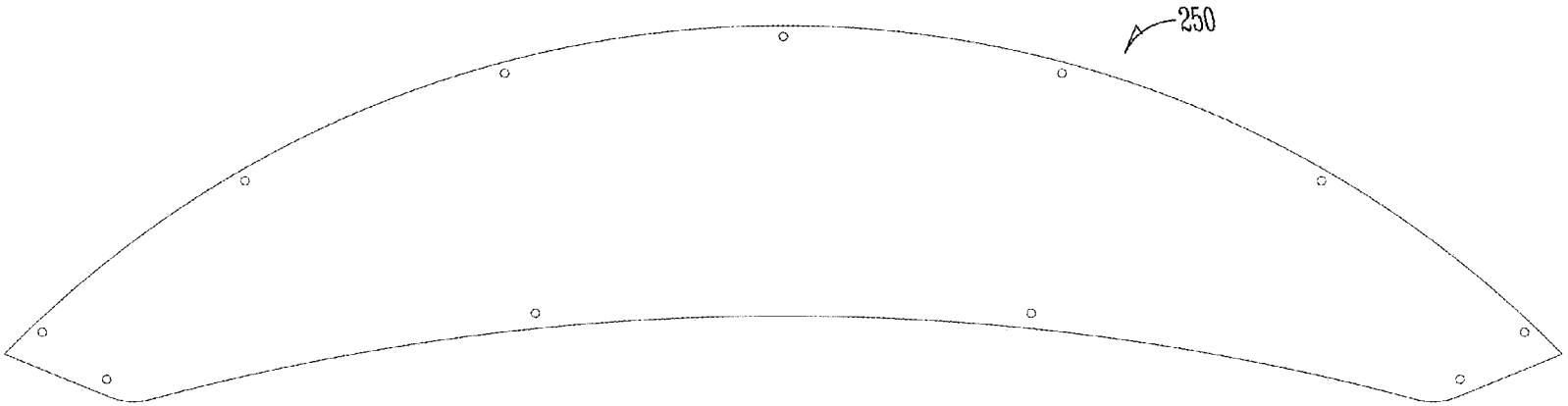

FIG. 60 is a plan view of a visor extension attachable to the base visor of FIG. 59 to form the short visor of FIG. 46A.

Figure 61:
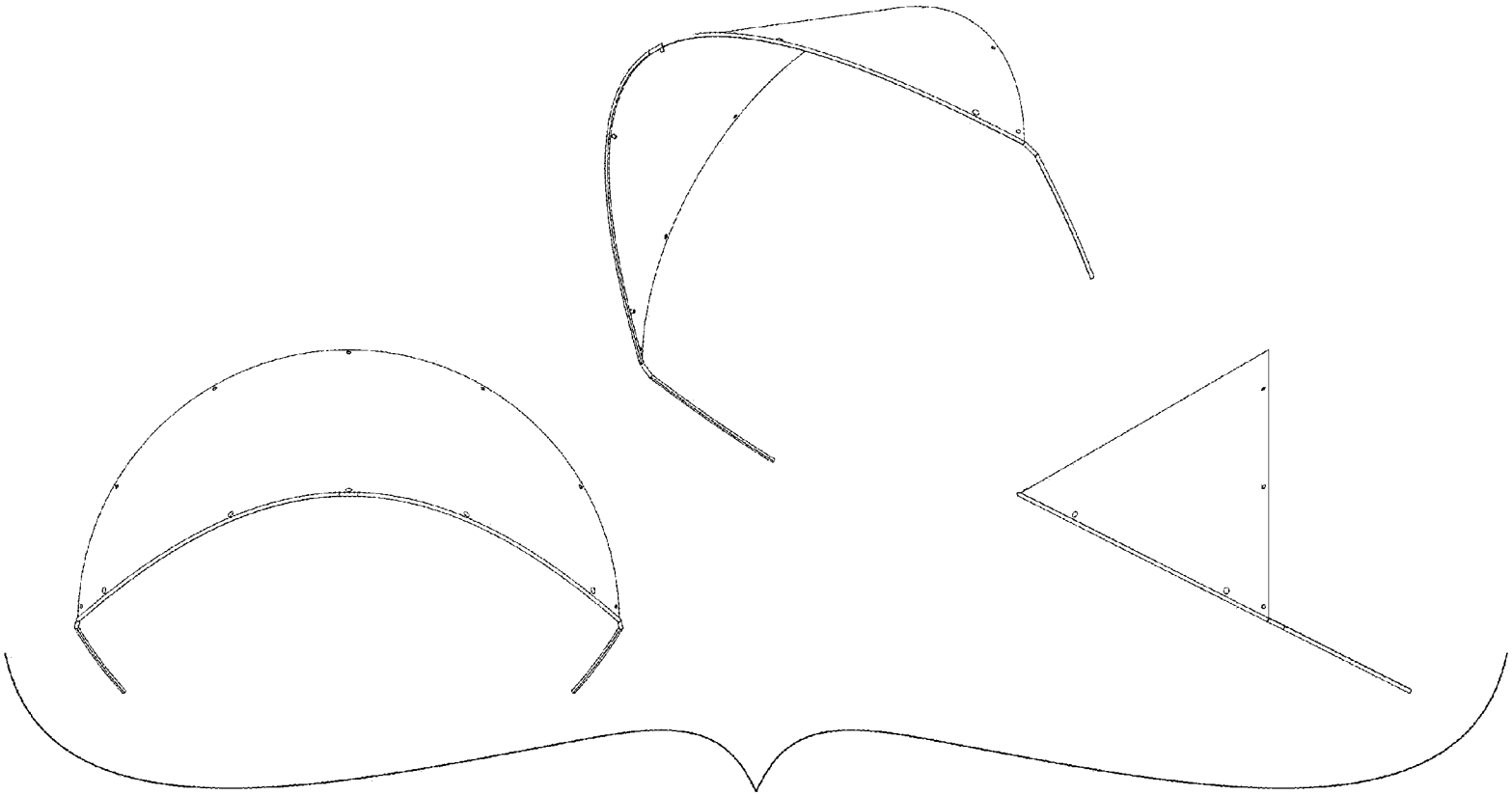

FIG. 61 are perspective and other views of an alternative visor extension connectable to the base visor of FIG. 59 to form the long visor FIG. 48A.

Q. High Reflectivity Visor Inserts

Figure 62A:
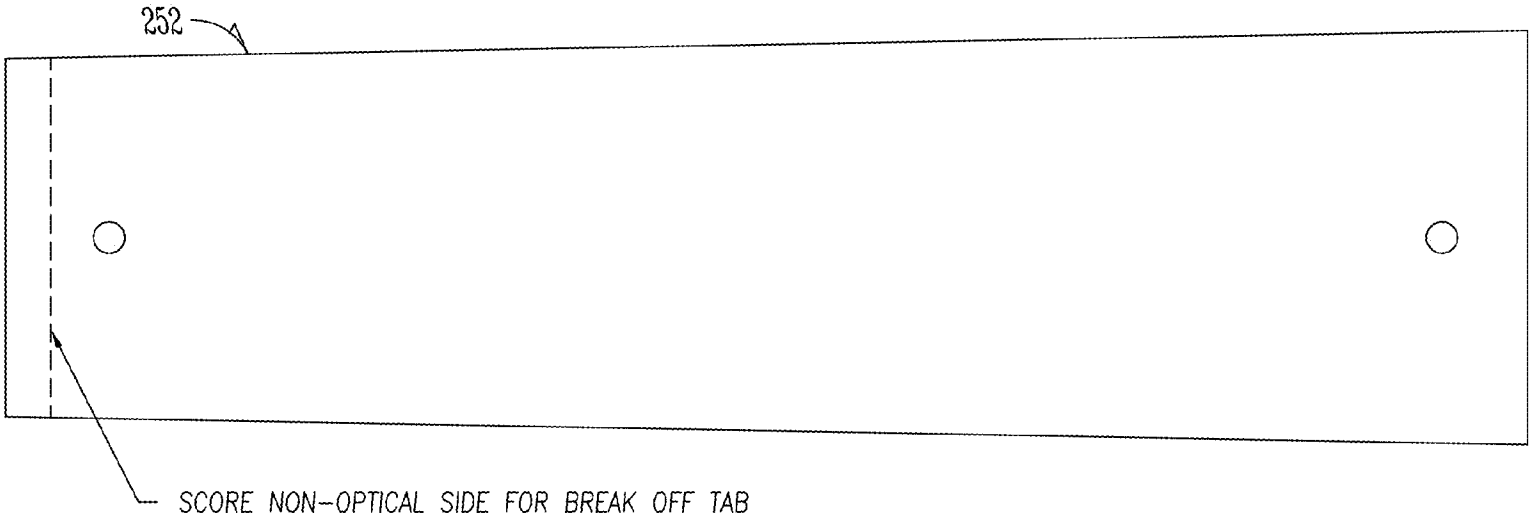
Figure 62B:
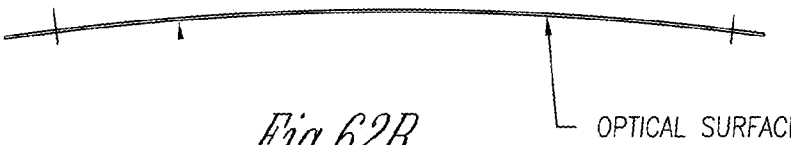

FIG. 62A and FIG. 62B illustrate one example of longer visor inserts.

Figure 63C:
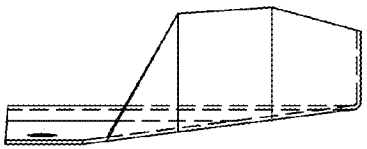
Figure 63A:
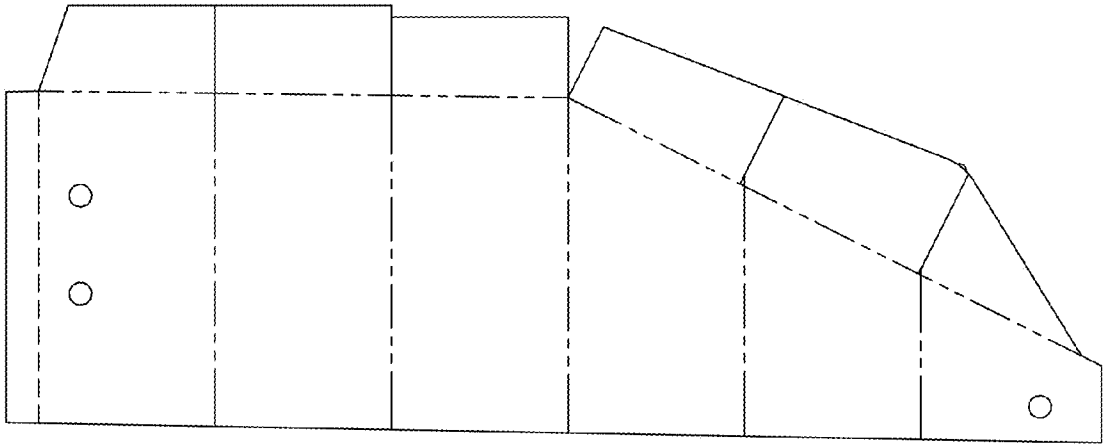
Figure 63B:
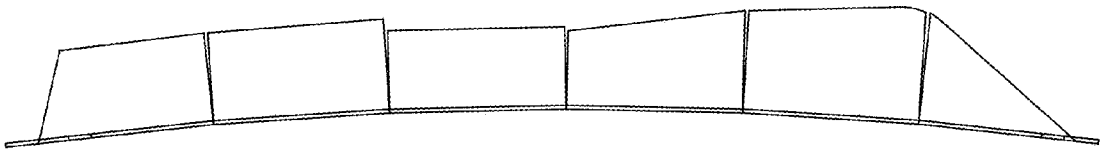

FIG. 63A and FIGS. 63B-C are various views of a specially configured end reflective visor insert positionable at opposite lateral sides of a visor.

Figure 64A:
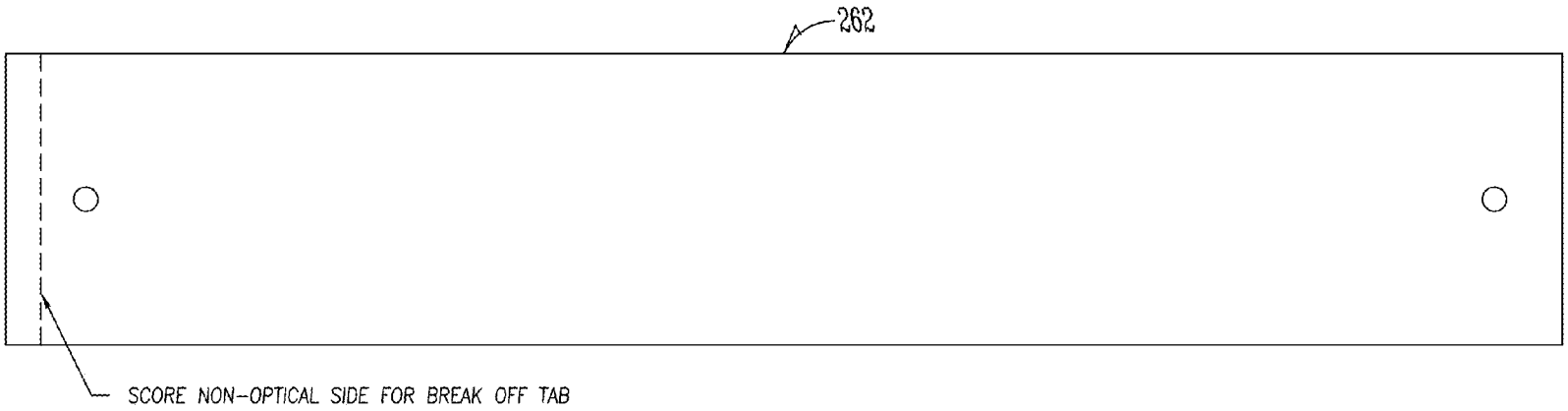
Figure 64B:
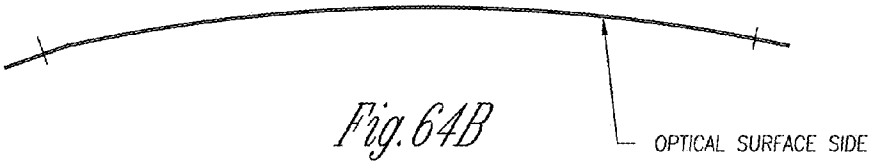

FIG. 64A and FIG. 64B is an alternative embodiment of a reflective visor insert.

Figure 65C:
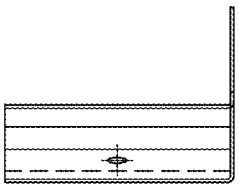
Figure 65A:
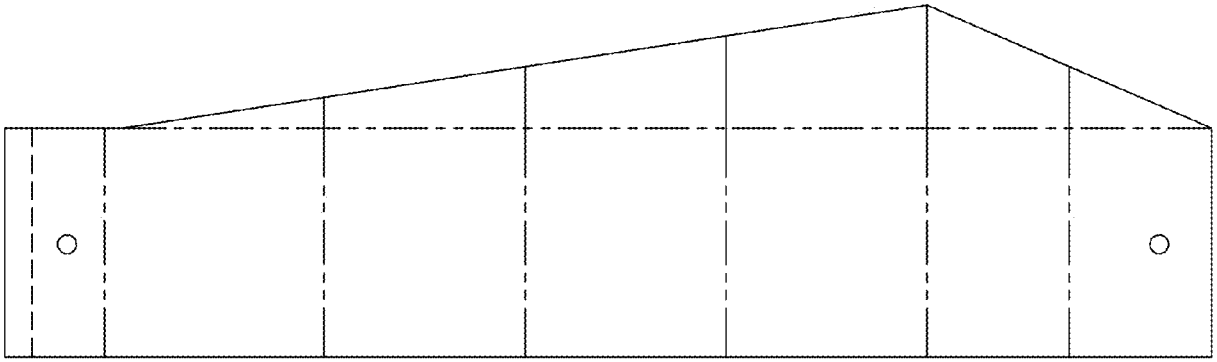
Figure 65B:
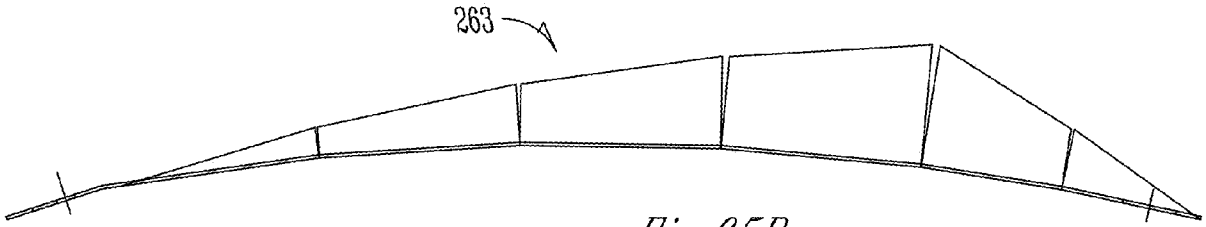

FIGS. 65A-C are alternative embodiments of the opposite end reflective visor insert useable with the reflective inserts of FIG. 64A.

Figure 66A:
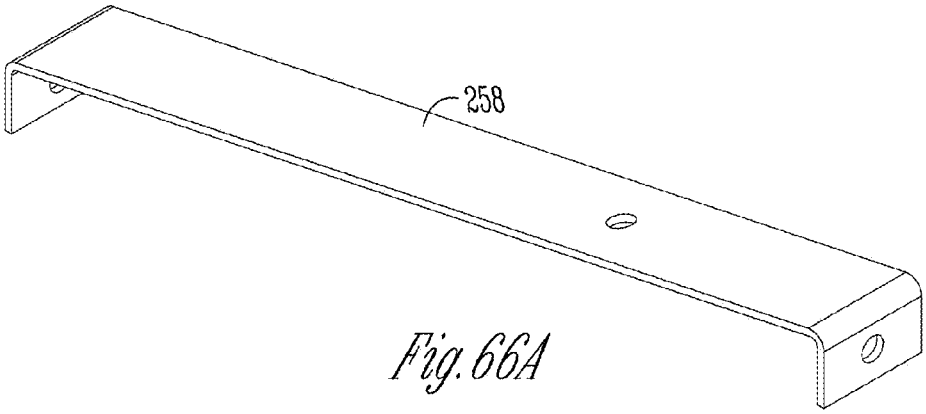
Figure 66B:
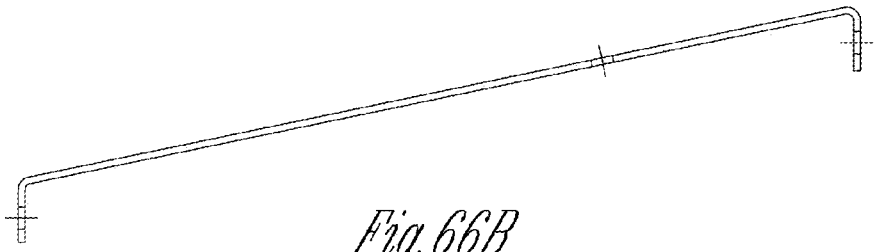
Figure 66C:
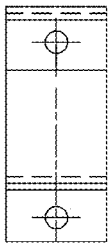

FIG. 66A and FIGS. 66B-C are views of a visor insert support for visor inserts of FIGS. 62A and 63A.

Figure 67A:
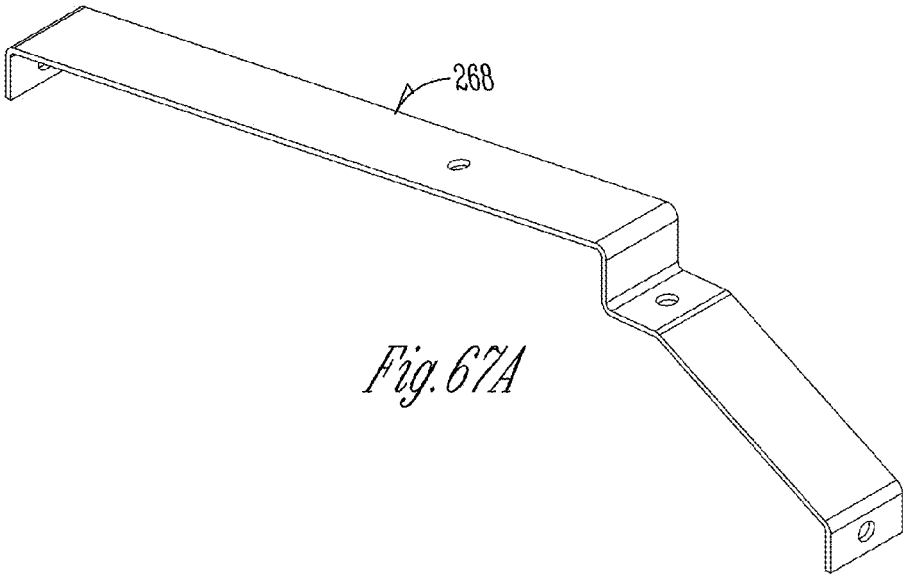
Figure 67B:
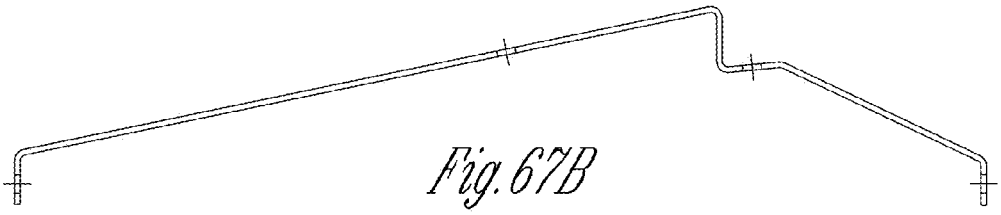
Figure 67C:
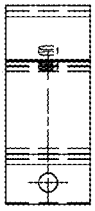

FIG. 67A and FIGS. 67B-C are views of a visor insert support useable with the reflective inserts of FIGS. 64A and 65A.

Figure 68A:
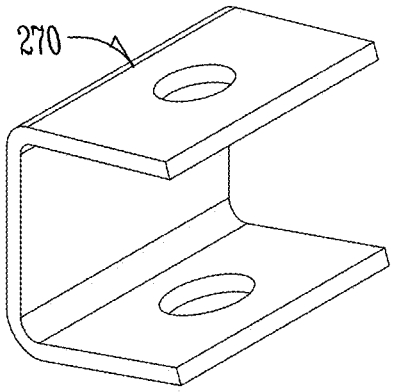
Figure 68B:
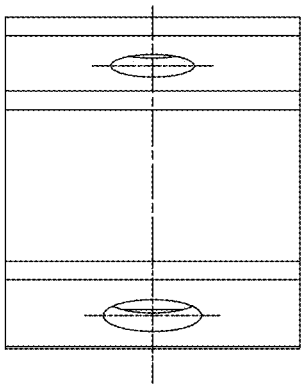
Figure 68C:
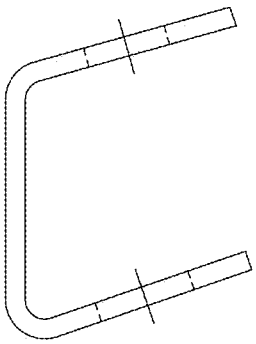
Figure 69A:
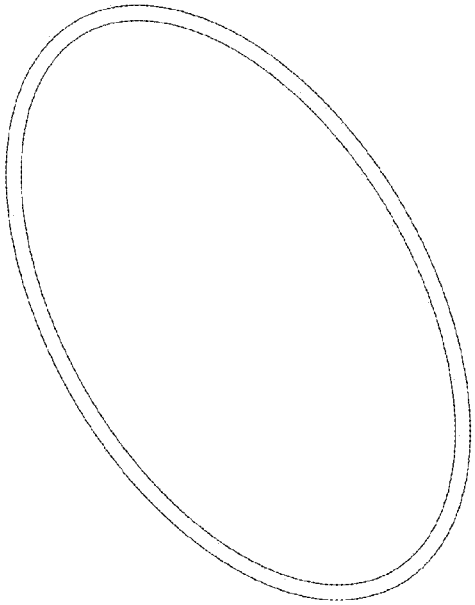
Figure 69D:
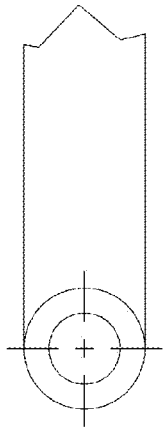
Figure 69B:
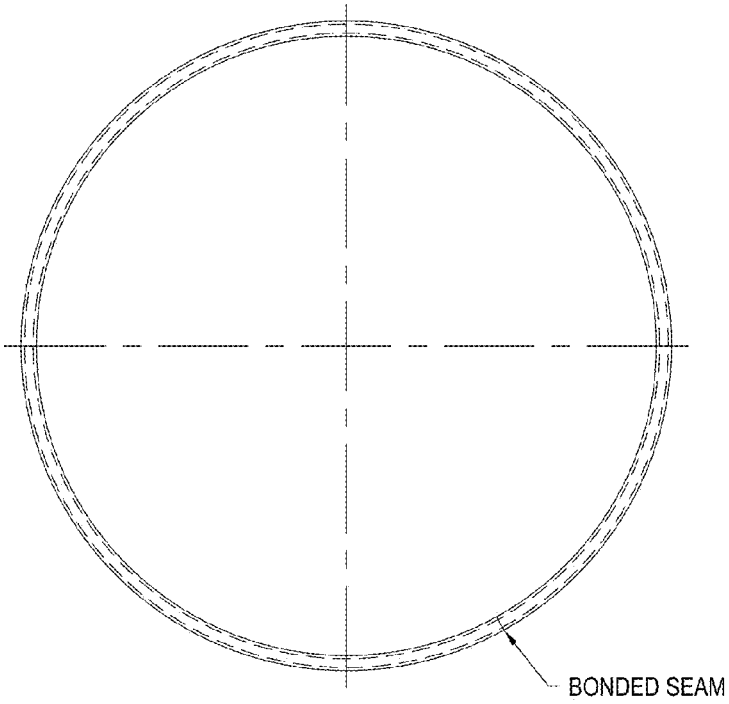
Figure 69C:
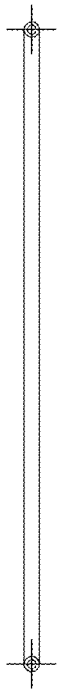
Figure 70A:
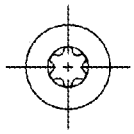
Figure 70B:
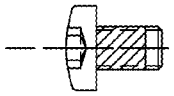
Figure 71A:
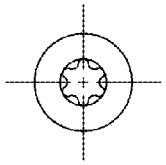
Figure 71B:
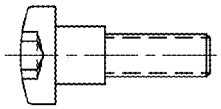
Figure 71C:
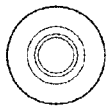
Figure 72A:
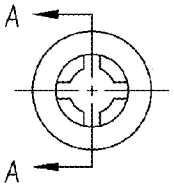
Figure 72B:
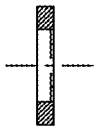
Figure 73A:
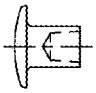
Figure 73B:
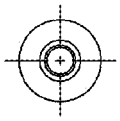
Figure 74A:
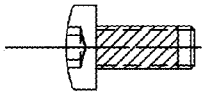
Figure 74B:
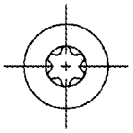
Figure 75A:
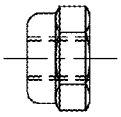
Figure 75B:
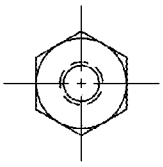
Figure 77A:
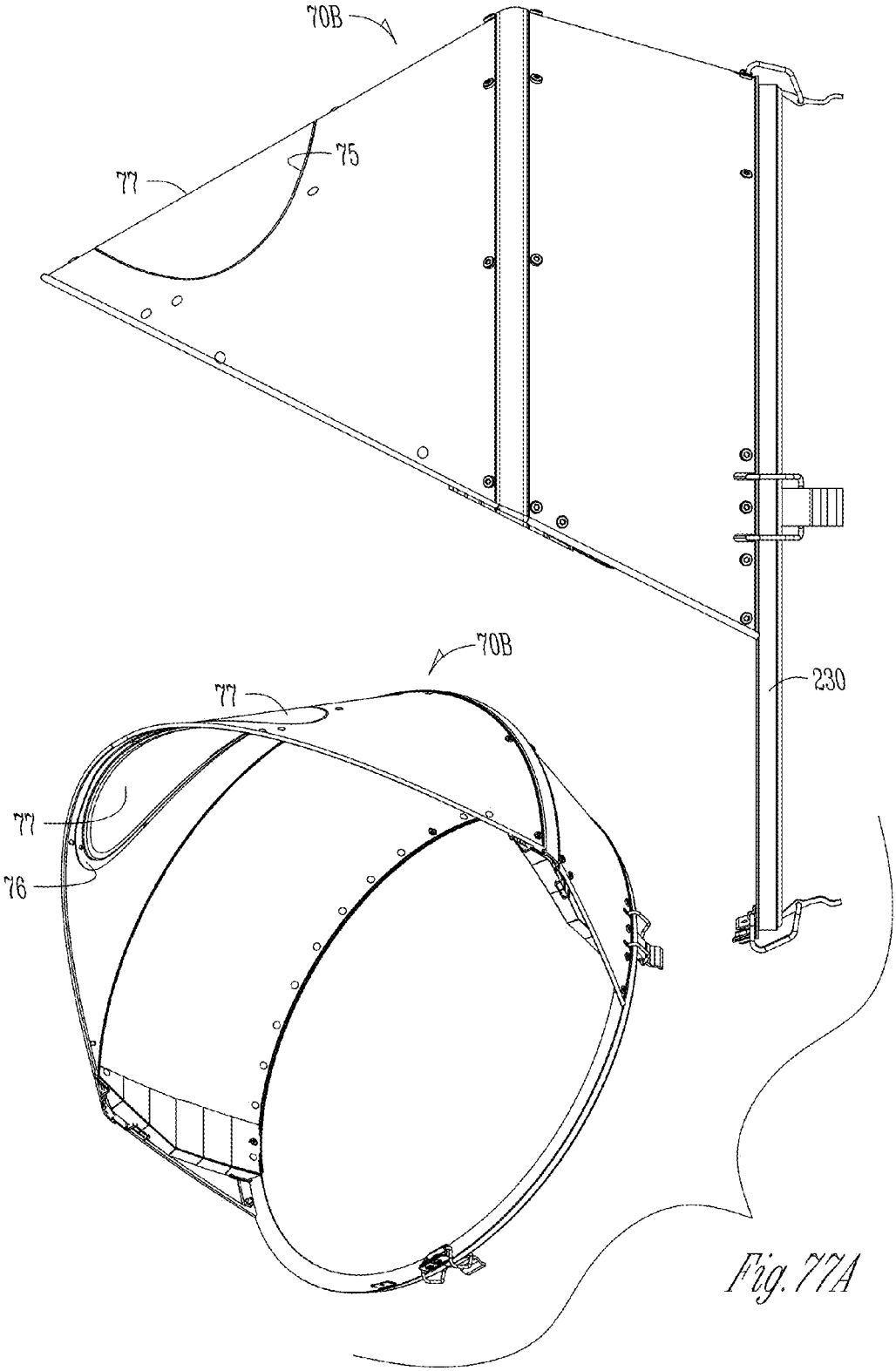
Figure 77B:
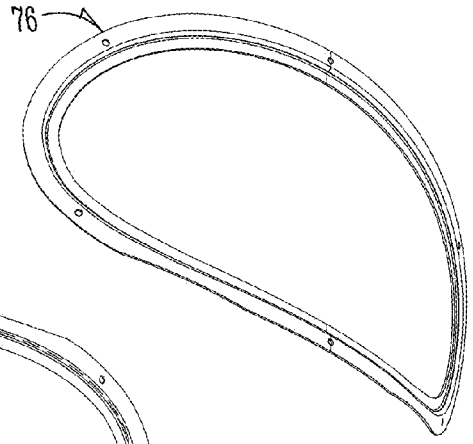
Figure 77C:
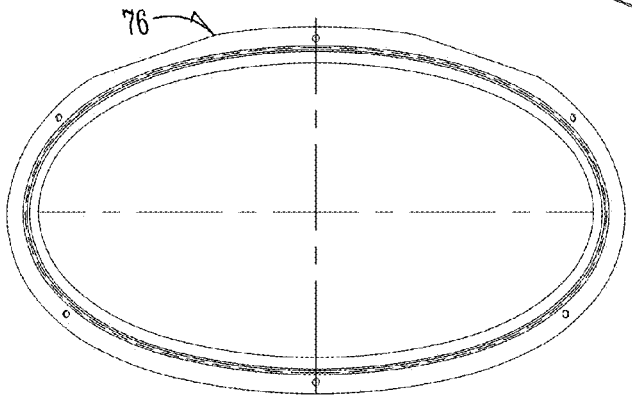
Figure 77D:
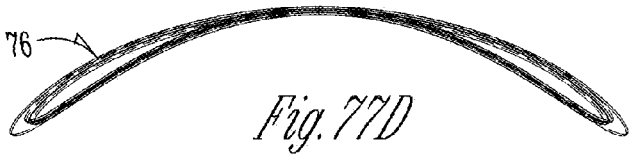
Figure 77E:
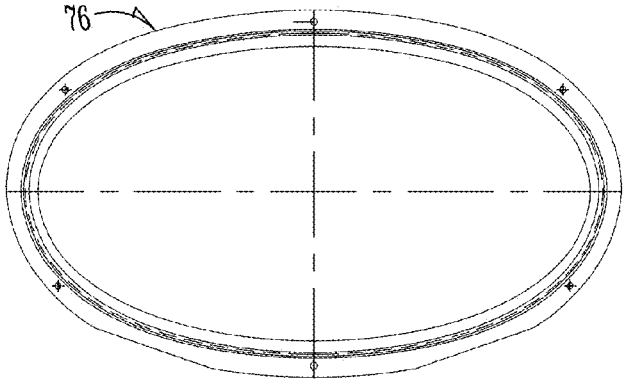
Figure 77F:
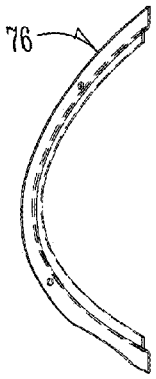
Figure 77G:
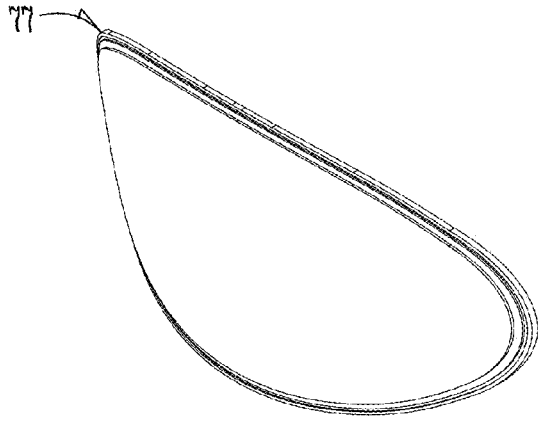
Figure 77H:
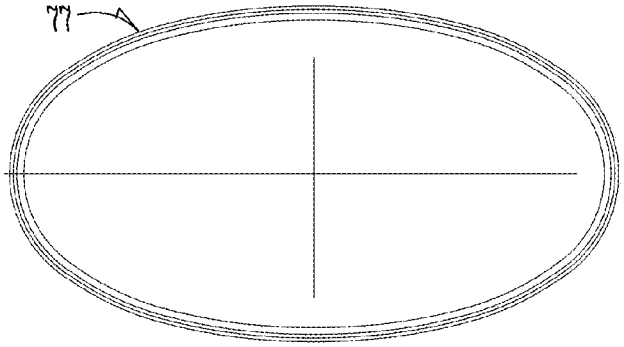
Figure 77J:
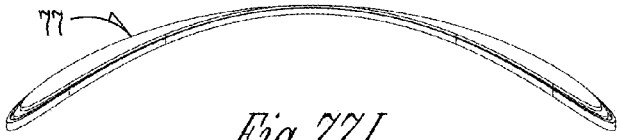
Figure 77I:
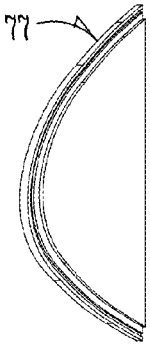

FIG. 68A and FIGS. 68B-C are views of a visor insert assembly alignment bracket.

R. Miscellaneous Parts

FIG. 69A and FIGS. 69B-D are various views of a reflector gasket to seal the reflector frame at its connection to the lamp cone.

FIGS. 70A-B, 71A-C, 72A-B, 73A-B, 74A-B, 75A-B and 76, are various views of fasteners useable with various components illustrated in the other drawings.

S. Visor with Uplighting Feature

FIGS. 77A-J are various views of a visor with an aperture (FIG. 77A) into which a frame (FIGS. 77B-F) can be mounted. A translucent insert (FIGS. 77G-J) is, in turn, mounted in the frame. This combination can provide "uplighting" from the fixture to provide some additional illumination above the target space (e.g. for improved playability of a sports field).

T. D-Shape Cross Arm

FIGS. 78A-B and FIGS. 78D-W illustrate a cross-arm to which one or more fixtures can be mounted. The cross arm has a "D" shape profile or cross-section, which improves EPA.

Figure 78A:
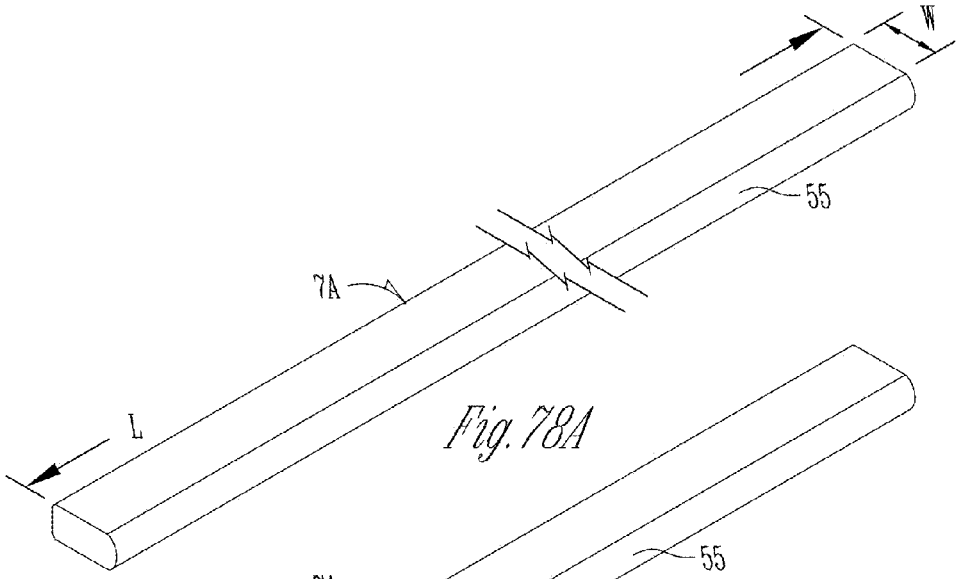
Figure 78B:
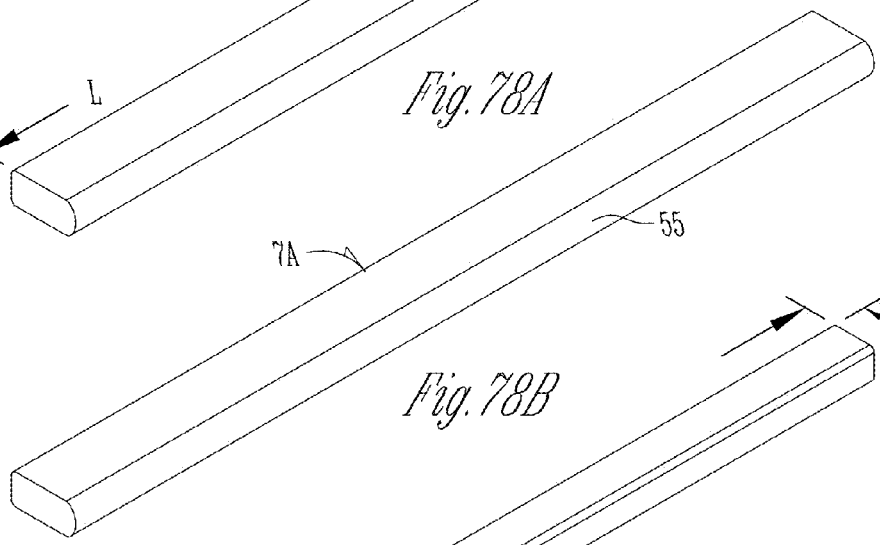
Figure 78C:
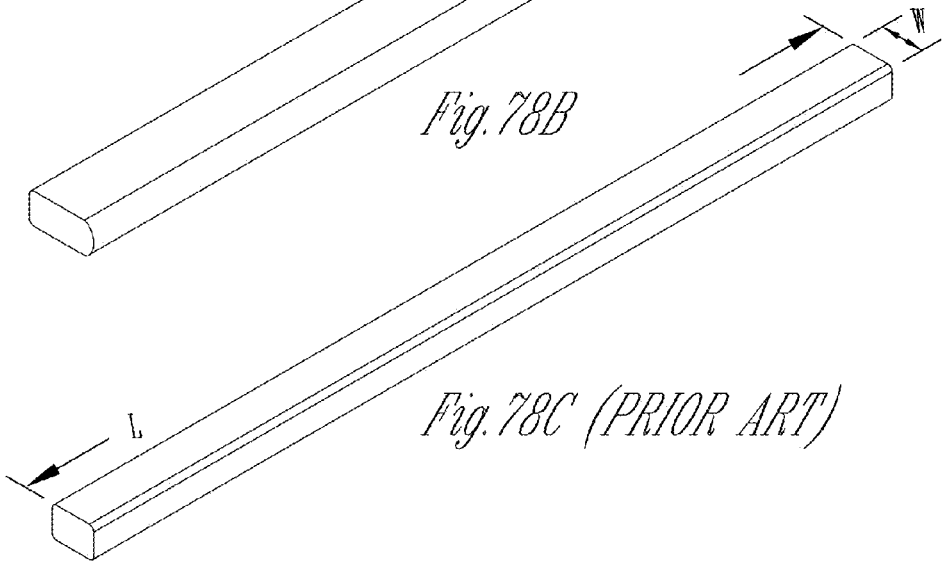
Fig. 78C (PRIOR ART)
Figure 78D:
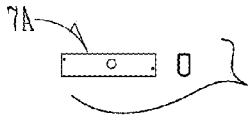
Figure 78E:
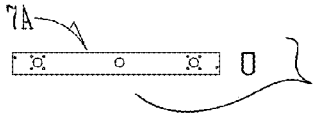
Figure 78F:
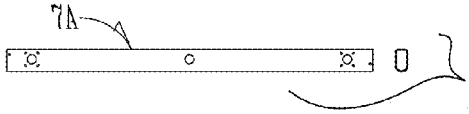

FIG. 78C is a perspective view of a prior art cross arm for comparison.

IV. DETAILED DESCRIPTION OF EXEMPLARY EMBODIMENTS

A. Overview

For a better understanding of the invention, exemplary embodiments will now be described in detail. Frequent reference will be made to the accompanying drawings. Reference numerals and letters will be used to indicate certain parts and locations in the drawings. The same reference numerals or letters will be used to indicate the same parts and locations throughout the drawings unless otherwise indicated.

Figure 1A:
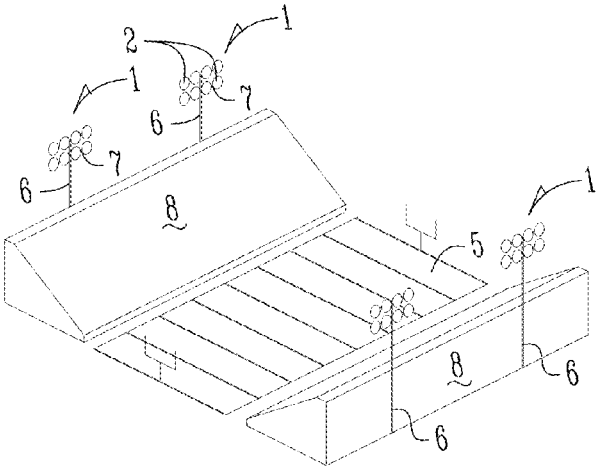
Figure 1B:
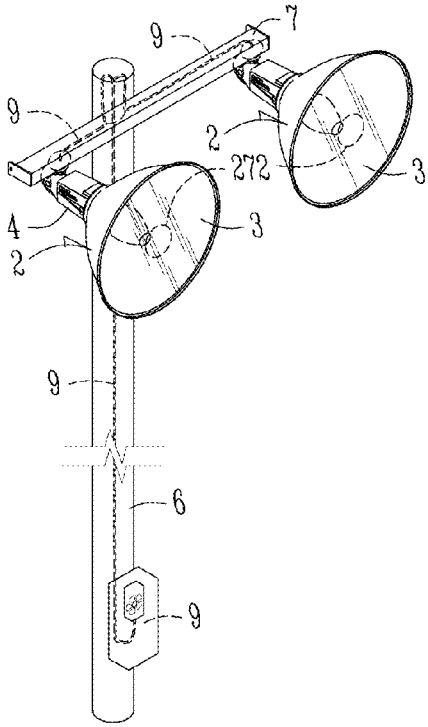
Figure 1C:
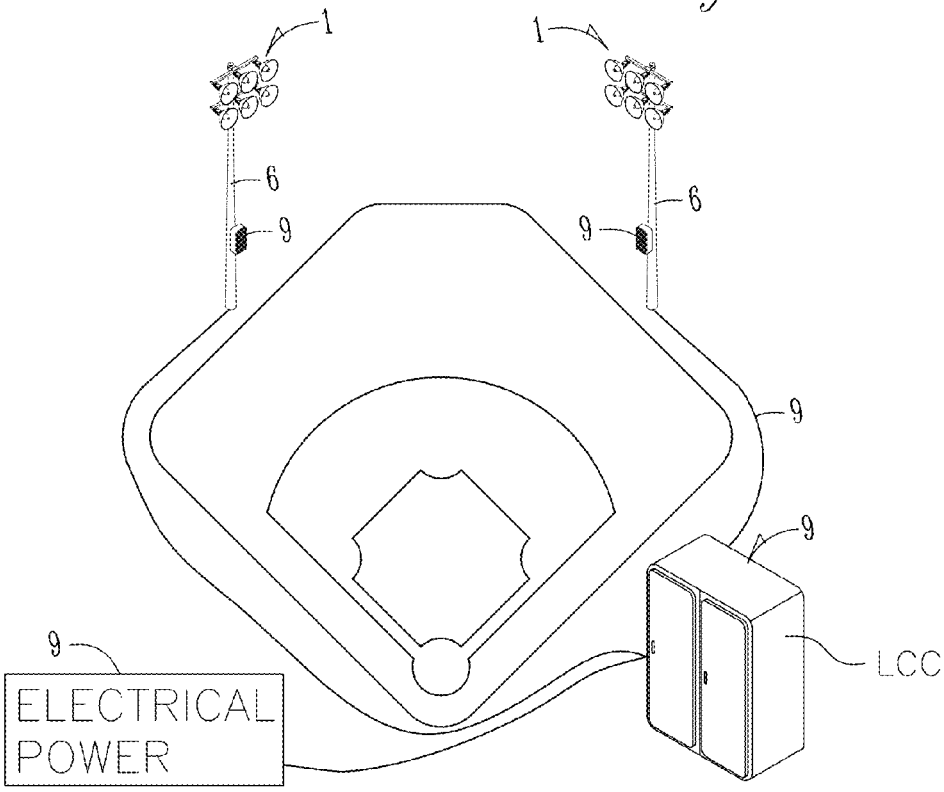
Figure 1D:
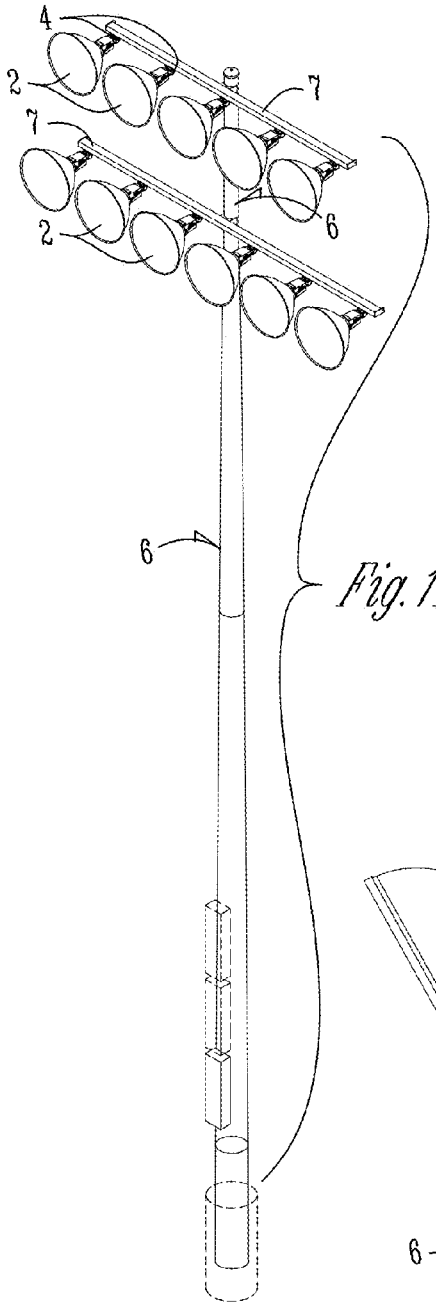
Figure 1G:
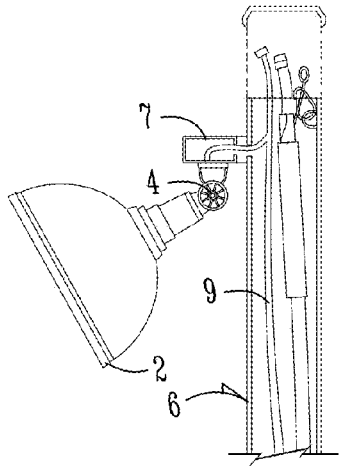
Figure 1E:
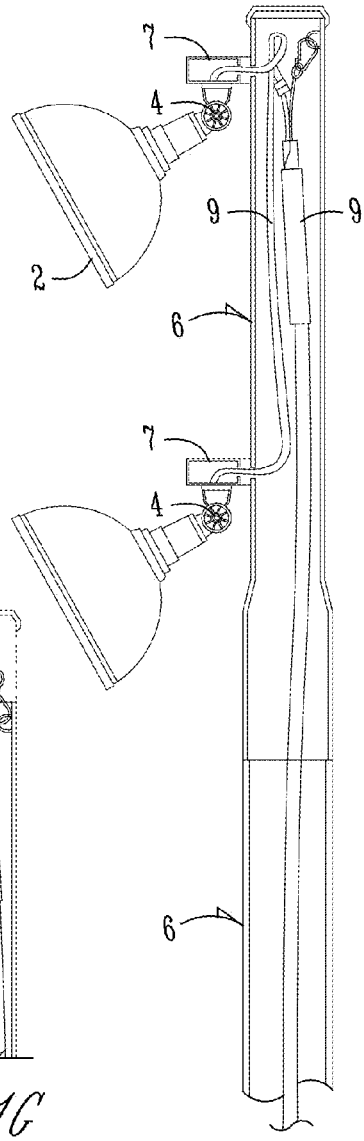
Figure 1F:
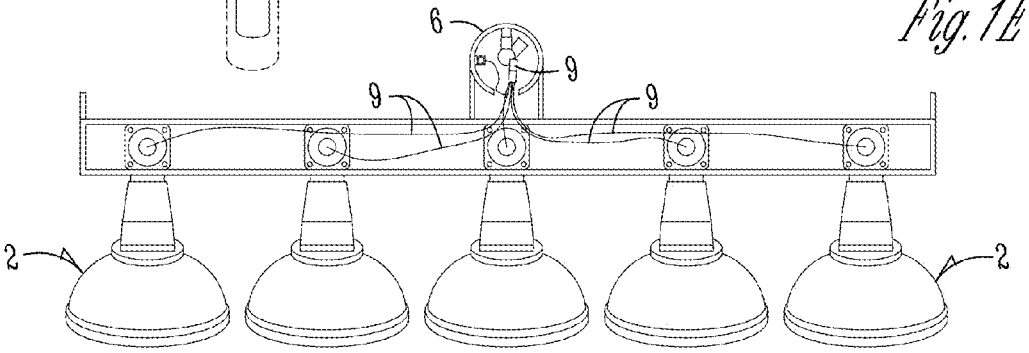

An embodiment of a light fixture will be described in the context of sports lighting, sports lighting fixtures, and sports lighting systems for the illumination of athletic fields such as shown in FIGS. 1A and 1C. The lighting must light the field and a volume of space above the field (collectively sometimes called the target area or target space), according to predetermined lighting level and uniformity specifications. The embodiment relates to fixtures that utilize high intensity discharge (HID) lamps, presently normally 1,000 watts or higher, of the metal halide type. Such installations generally have several arrays of fixtures usually elevated on two or more relatively tall poles (35 feet to 100 or more feet). Electrical power to the systems normally comes from commercial service to a control cabinet. Electrical power is then distributed out to individual poles having individual ballast boxes which, with wiring, distribute electrical power to each light fixture at the top of each pole (see, e.g., FIGS. 1A-1E).

In this context, the athletic field is therefore the target area or space. There could be more than one target area per sports facility. It is to be understood, however, that the present invention has applicability to other applications utilizing these or other HID lamps, and is not limited just to these types of HID lamps or to sports lighting.

B. Exemplary Apparatus

1. Lighting Fixture 10 Generally

Figure 4:
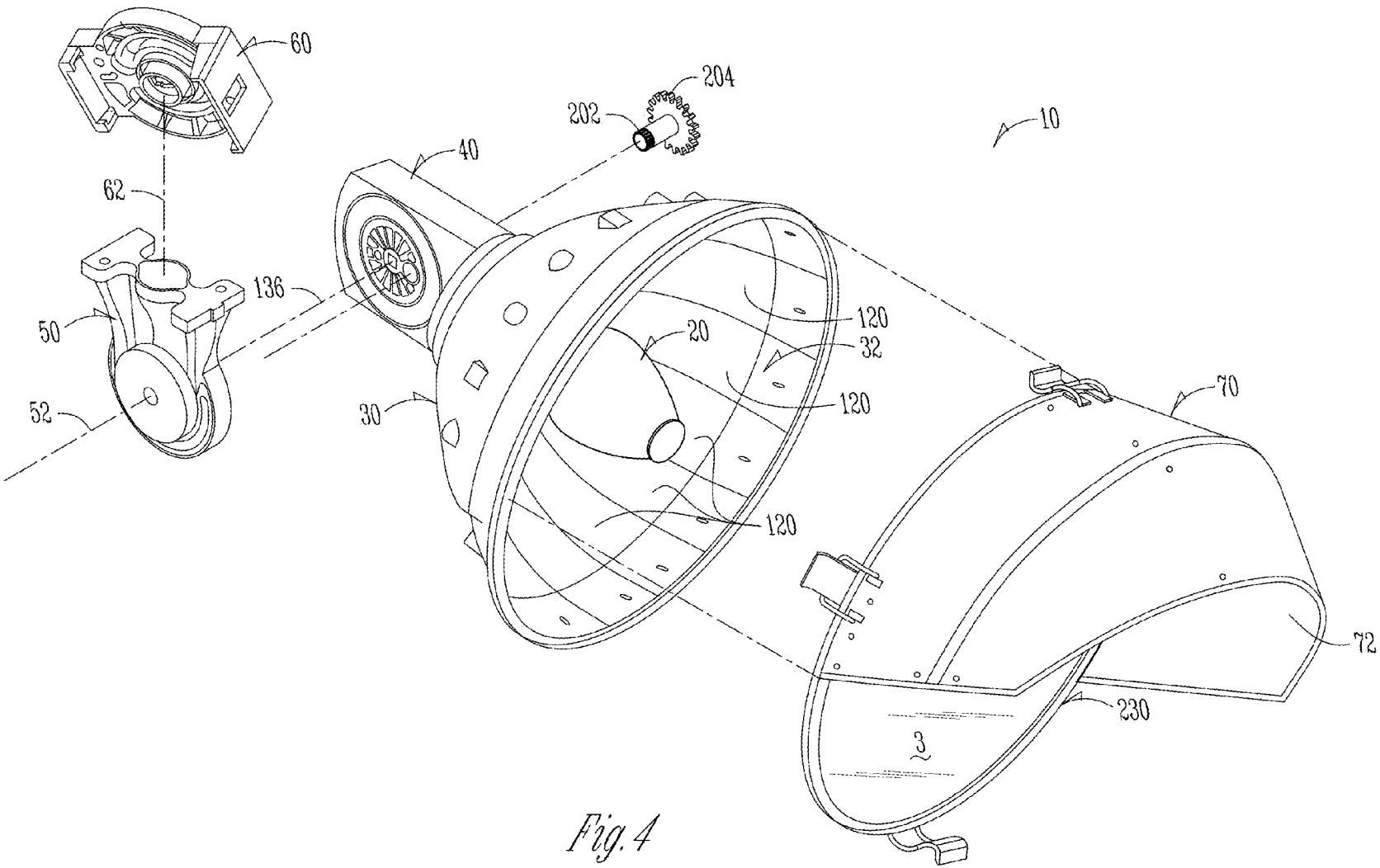

FIG. 4 shows generally the basic components of sports lighting fixture 10 in exploded form. FIGS. 5A and B show it in perspective form. Fixture 10 has some similar general components to state-of-the-art sports lighting fixtures, but introduces some different structural components and concepts. Mounting or knuckle plate 60 (360 Aluminum with polyester powder coat) bolts to the underside of a cross arm 7. It has adjustability around vertical axis 62 (see FIG. 27). Knuckle 50 (360 Aluminum with polyester powder coat) bolts at one end to the bottom of knuckle plate 60 and extends to a pivot connection to lamp cone 40 along axis 52 at its other end (See FIG. 4). It should be appreciated that knuckle 50 essentially supports the remainder of fixture 10 and does so with essentially one arm extending from a cross arm down to one side of lamp cone 40. Knuckle 50 is a relatively non-complex structure.

Lamp cone 40 (360 Aluminum with polyester powder coat) pivots around axis 52 relative to knuckle 50. It contains a threaded socket 154 (see FIG. 44A, similar to commercially available) or threaded socket 42 (FIG. 44H) which is bolted to the flat web 160 between the arms 156 and 158 of yoke 80 (see FIG. 44). Lamp 20 (Musco Corporation Z-Lamp™) has a threaded base that can be screwed in and out of socket 154 (shown screwed into operating position in FIG. 4) to install or remove lamp 20.

Reflector frame 30 (cast aluminum type 413—see FIGS. 9A-C) bolts to lamp cone 40. Primary reflecting surface 32, here comprising a number of high total reflectance rated side-by-side strips 120 (see FIGS. 17A-25A) is mounted inside reflector frame 30. Reflector frame 30 has a main portion that follows a surface of revolution, but at least one differently oriented portion. Frame 30 is thus pre-designed to shift part of the light beam that will be generated by the reflecting surface once applied to frame 30. The frame 230 (FIG. 49A) for glass lens 3 is removably latched to the front of reflector frame 30. Visor 70 is mountable to the lens frame and extends from the upper front of reflector frame 30 when in place. It includes high reflectivity strips 72 on its interior.

As indicated by comparing FIGS. 5A and B with FIGS. 6A and B, visor 70 can take different shapes and forms. A first style of visor 70A (FIGS. 5A and B) is shorter and does not extend forwardly and downwardly as much as second visor style 70B (FIGS. 6A and B). Both have an identical base section that extends initially at a less converging angle from reflector frame 30. A distal extension section connects to the base section and angles back inwardly toward the central axis of reflector frame 30. The shorter visor 70A uses a shorter extension section than the longer visor 70B. Visor 70B is useful, for example, when fixture 10 is aimed at angles closer to horizontal. It would block and redirect more light that would otherwise go off the target area, as compared to visor 70A.

2. Lamp 20

Figure 2A:
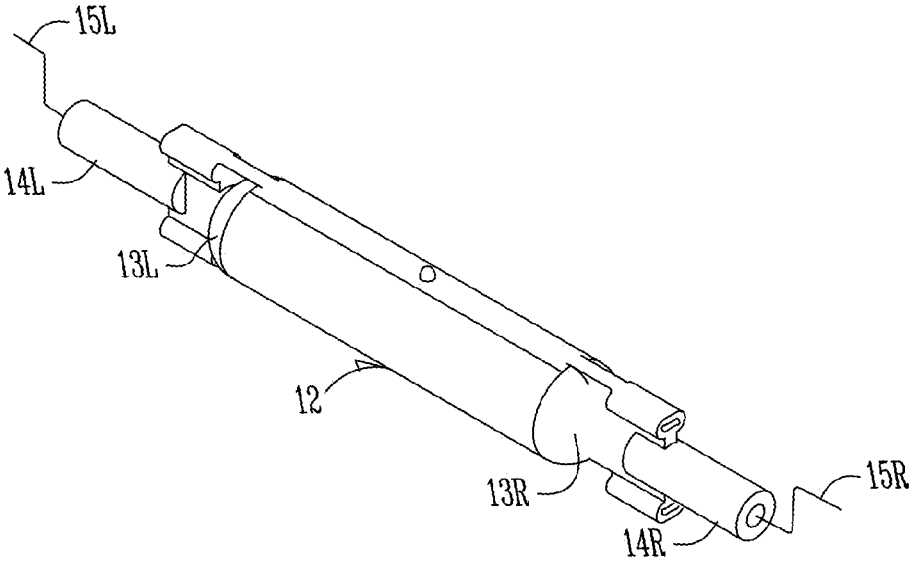
Figure 2C:
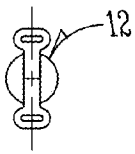
Figure 2E:
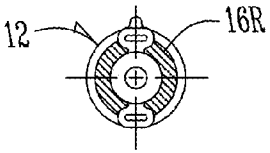
Figure 2B:
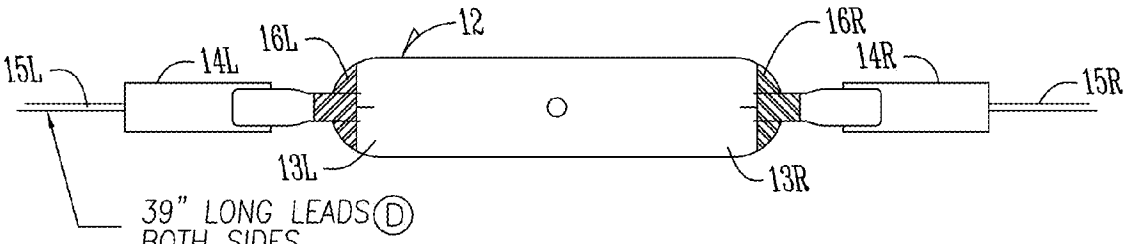
Figure 2D:
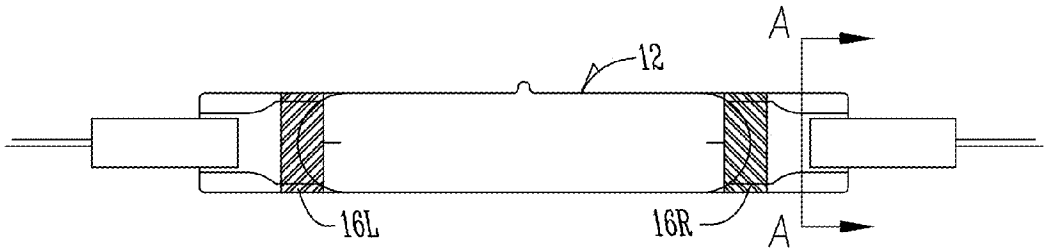

Arc lamp 20 is of the general type disclosed in Musco Corporation U.S. Pat. No. 5,856,721, incorporated by reference herein, with certain modifications. These types of lamps are used by Musco Corporation under the trademark Z-Lamp™ and typically are 1000 watt or greater metal halide (MH) HID lamps. Its arc tube 12 is tilted obliquely across the longitudinal axis of the arc lamp 20. In operation, it is rotationally positioned in fixture 10 such that the longitudinal axes of the arc tube and the lamp define a vertical plane, and the longitudinal axis of arc tube 12 is as close to a horizontal plane as possible. Conventional HID lamps for sports lighting have white oxide coatings around opposite ends of the arc tube (see cross-hatched areas of FIGS. 2B-E). As illustrated in FIG. 2A (by the absence of cross-hatching), arc tube 12 of lamp 20 is modified to leave off or remove the conventional white oxide coatings 16L and 16R from its opposite ends 13L and 13R.

In conventional metal halide HID lamps, including those used for sports lighting, light is generated in a high-pressure mercury discharge to which other light-emitting species are added to improve the spectrum of the lamp. See, W. van Erk, "Transport processes in metal halide gas discharge lamps", Pure Appl. Chem., Vol. 72, No. 11, pp. 2159-2166, 2000, which is incorporated by reference herein. Some of these other light-emitting species are sodium-scandium mixtures, sometimes called metal halide salts. Arc tube 12 of metal halide lamp 20 of this exemplary embodiment is modified to have an increased amount of the sodium-scandium salt mixture pool. It is approximately doubled over that of conventional HID lamps of this type. For example, one 2,000 watt HID metal halide lamp for sports lighting conventionally has approximately 31 milligrams of such salts. This is increased to approximately 61 milligrams. This provides a bigger "salt pool" over operation life of the lamp.

3. Reflector Frame 30 Generally

FIGS. 4, 5A-B, and 9A-AA, illustrate details of reflector frame 30. It is die-cast aluminum (e.g., aluminum alloy type 413). It could be made of other materials (e.g. powder-coated steel). Unlike state-of-the-art bowl-shaped spun aluminum reflectors, it does not have any surface that is intended for controlled reflection of light to the target area. Therefore, it does not require much post-casting processing (the exterior can be painted). It provides the basic framework or support for primary reflecting surface 32, which shapes and controls most of the light beam of fixture 10. It does have basically a bowl-shape with an external surface that is substantially closed and smooth.

Reflector frame 30 is thicker and stronger than a conventional spun aluminum reflector (an estimated 2 to 3 times stronger). Die-casting makes it economical and possible to create different forms of reflector frame 30. Ironically, while being much more robust (able to withstand things such as hail, baseballs, and other forces) than typical spun aluminum reflectors, it can be formed into more configurations and can result in smoother, more controlled lighting to the field.

As shown in FIGS. 5A-B and 6A-B, bumps or projections 71A and B extend from the outside of reflector frame 30. These are ejector pins for die-casting so that the casting is not distorted once done and removed from the die. Die-casting provides for a very precise way to form the framework for the main fixture reflecting surface in an economical fashion.

When assembled, lamp 20 extends through opening 110 at the bottom or center of reflector frame 30 and is substantially centered in reflector frame 30. High reflectivity reflecting surface 32 surrounds a substantial part of the glass envelope of lamp 20 which encloses arc tube 12. An orthogonal plane laterally across the middle of arc tube 12 (its equator) projects substantially to reflecting surface 32, but since arc tube 12 is tipped up relative the center aiming axis of reflector frame 30 (the longitudinal axis of lamp 20 is generally along the center axis of reflector frame 30), part of its projected equator extends obliquely out the front opening of reflector frame 30.

Figure 14A:
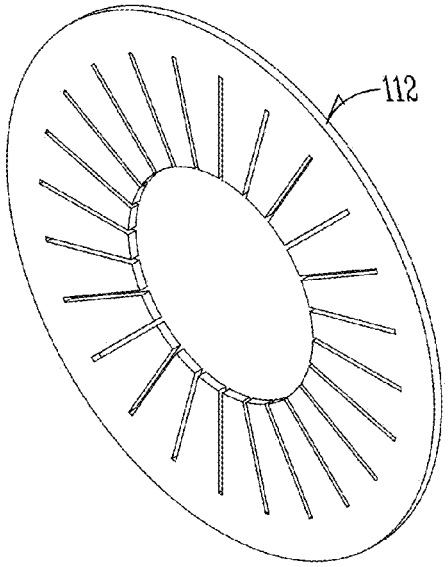
Figure 14B:
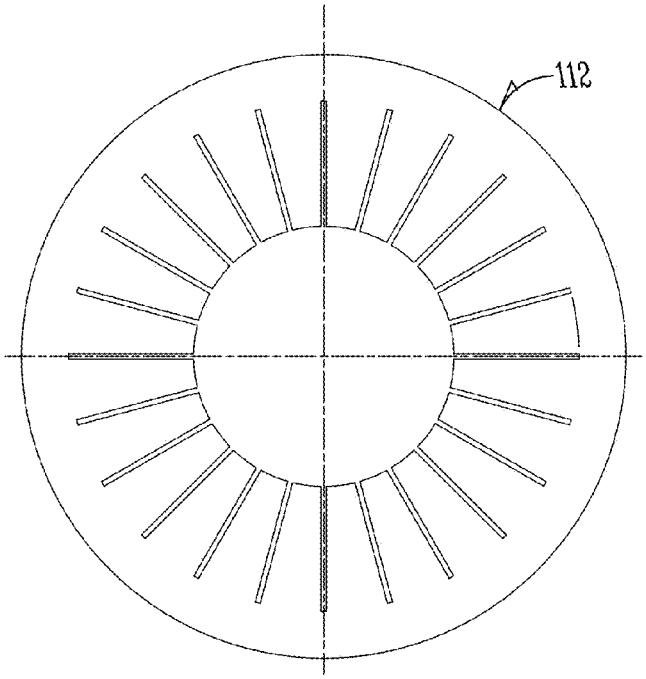
Figure 14C:
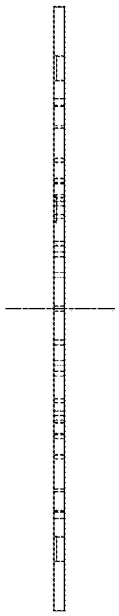
Figure 15A:
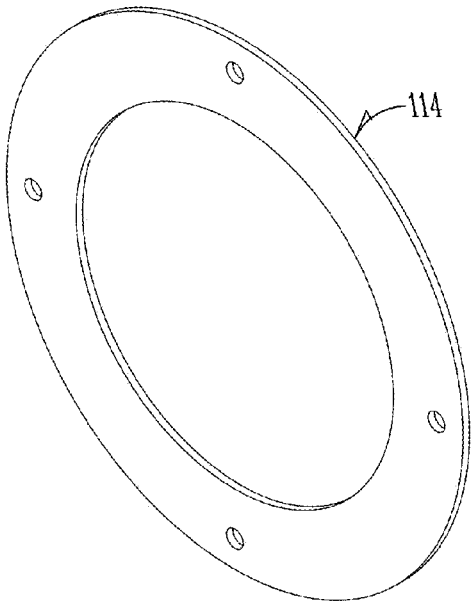
Figure 15D:
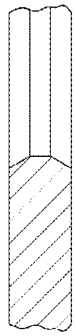
Figure 15B:
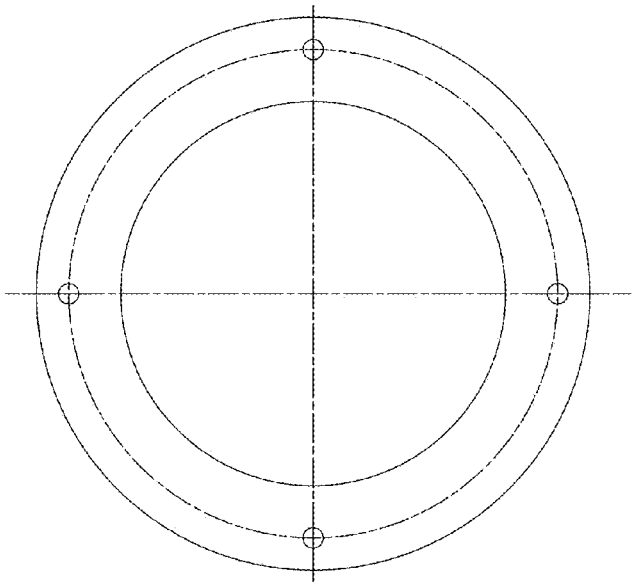
Figure 15C:
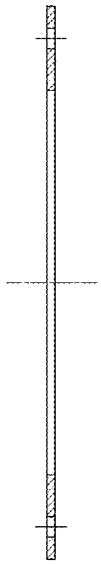
Figure 16A:
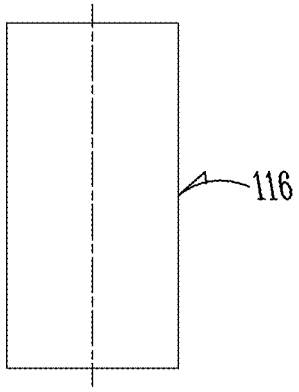

A gasket 112 (e.g. 0.060 thick Teflon™ (PTFE) mechanical grade—see FIGS. 14A-C) is clamped around opening 110 by hold down ring 114 (1/16 inch thick Aluminum 5052-H32, anodized with even etch—see FIGS. 15A-D) by bolts or screws that mount reflector frame 30 to lamp cone 40. A reflector vent 116 (see FIGS. 16A and B) (e.g., Great Lakes Filter Part No. ACF-F-30 PPI-.75-75 or equal) is insertable in vent opening 118 of reflector frame 30 (see FIG. 9D) for filtered air exchange into its interior, which is basically sealed at the factory.

Figure 9A:
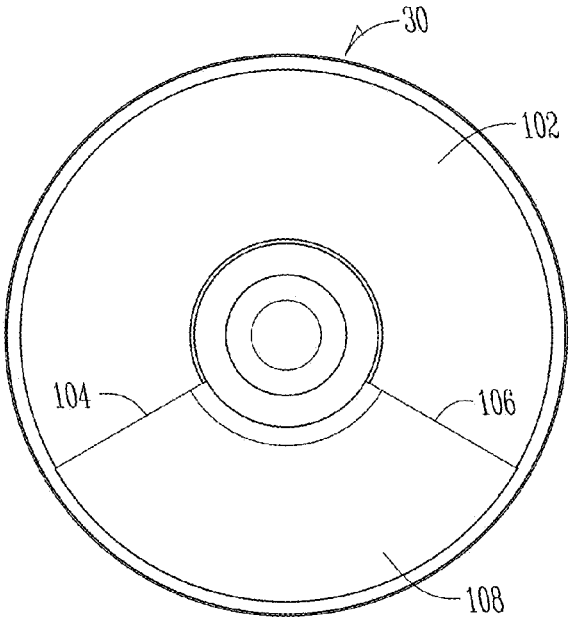
Figure 9C:
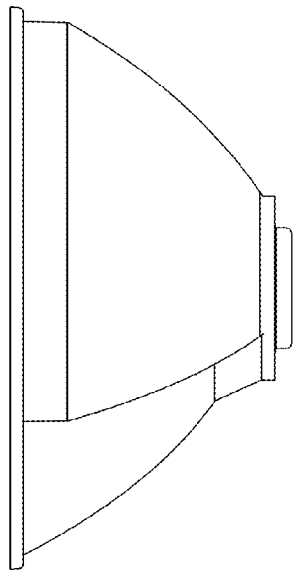
Figure 9B:
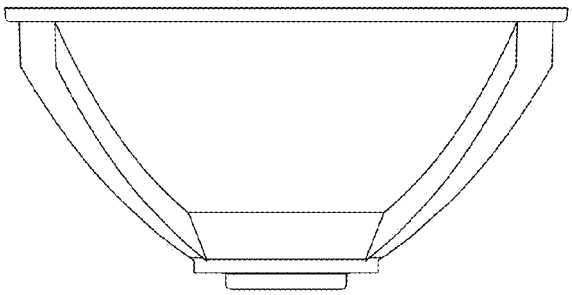
Figure 9D:
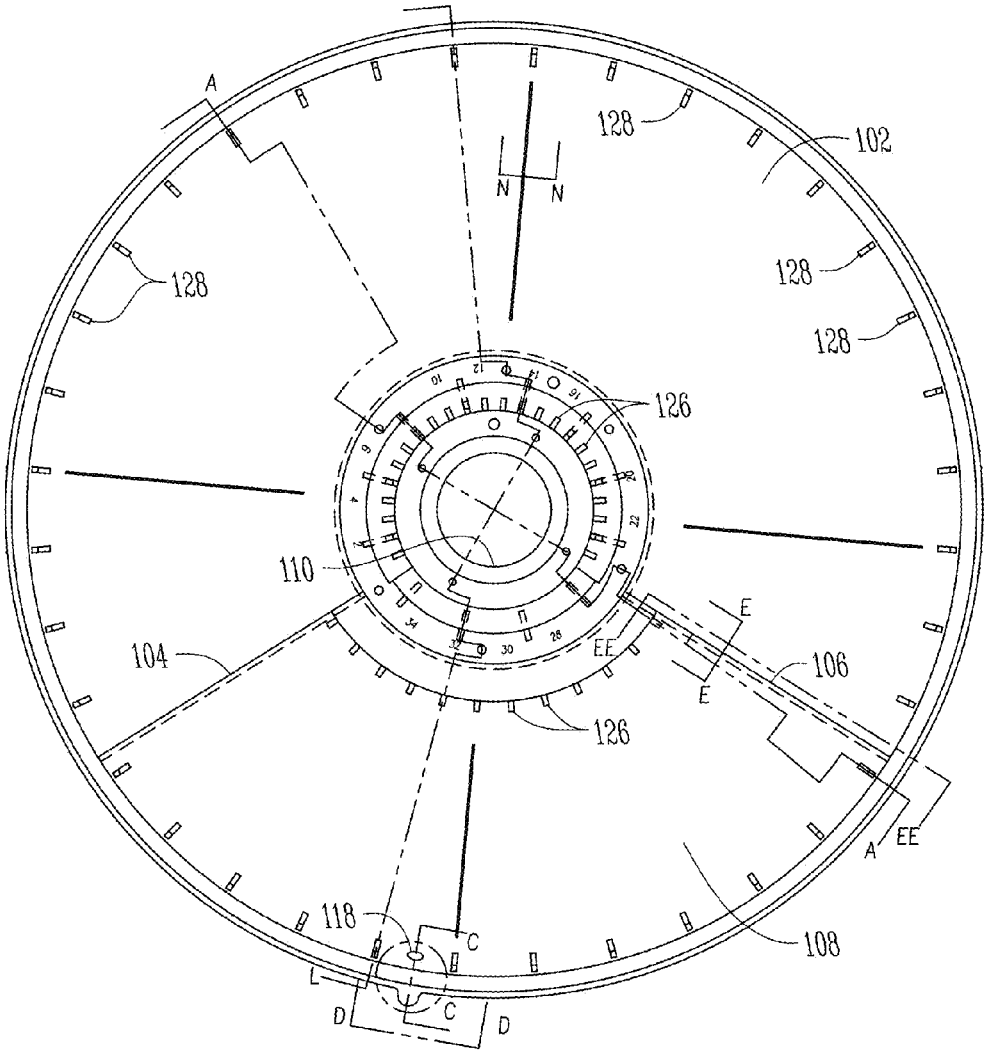
Figures 9E, 9H:
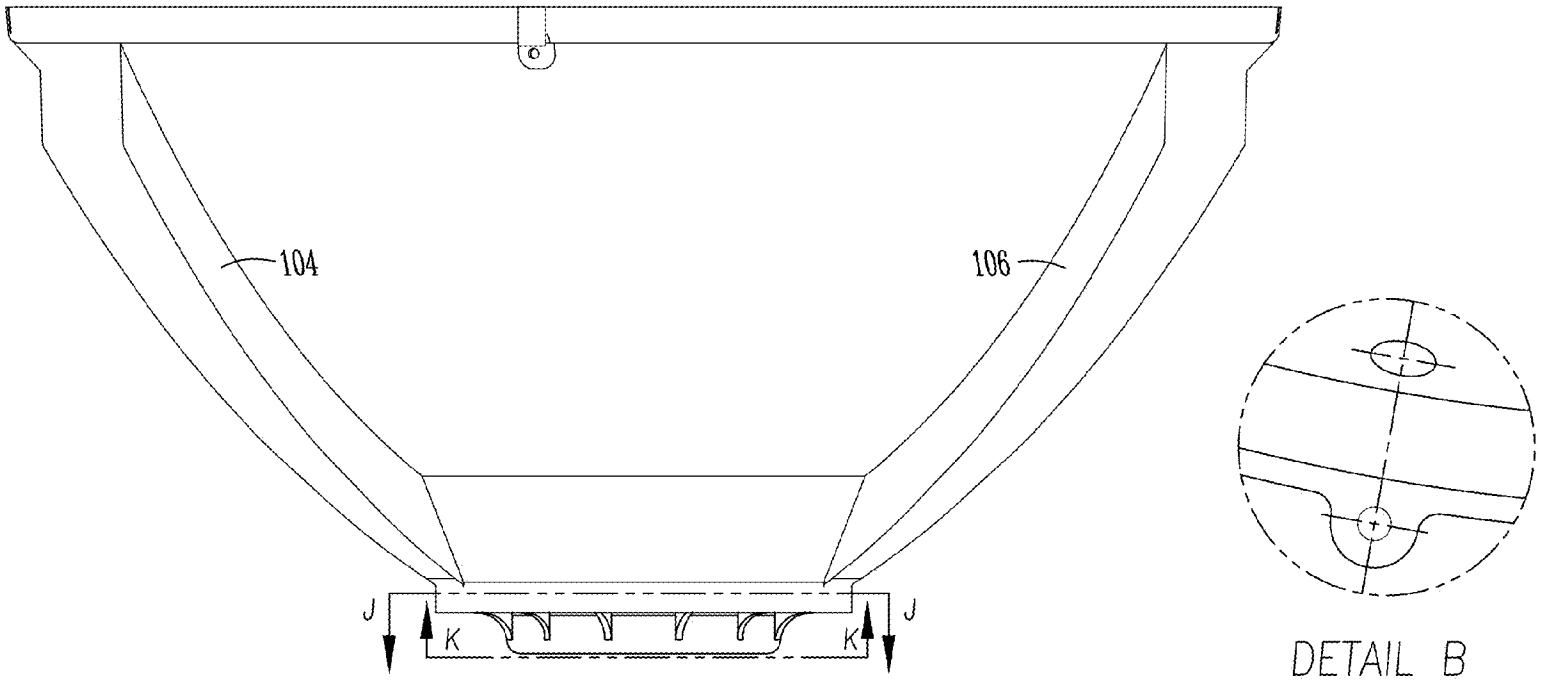

Reflector frame 30 is generally in the shape of a common sports lighting surface of revolution (parabola or hyperbola or combinations thereof) because it supports a main reflecting surface 32 that produces a controlled, concentrated beam. Such a beam needs to be controlled in both vertical and horizontal planes. As shown at FIGS. 9A and 9D, a majority of reflector frame 30 (see reference numeral 102) follows a basic surface of revolution (e.g., parabolic or hyperbolic shape) between transition points 104 and 106—approximately the upper 244° of the frame 30. When reflecting surface 32 is overlayed over this section 102 of frame 30, fixture 10 captures and precisely controls a substantial part of the light energy from lamp 20 and concentrates it into a shape useful for sports lighting.

4. Lower Less Converging Section 108 of Reflector Frame 30

Figure 9F:
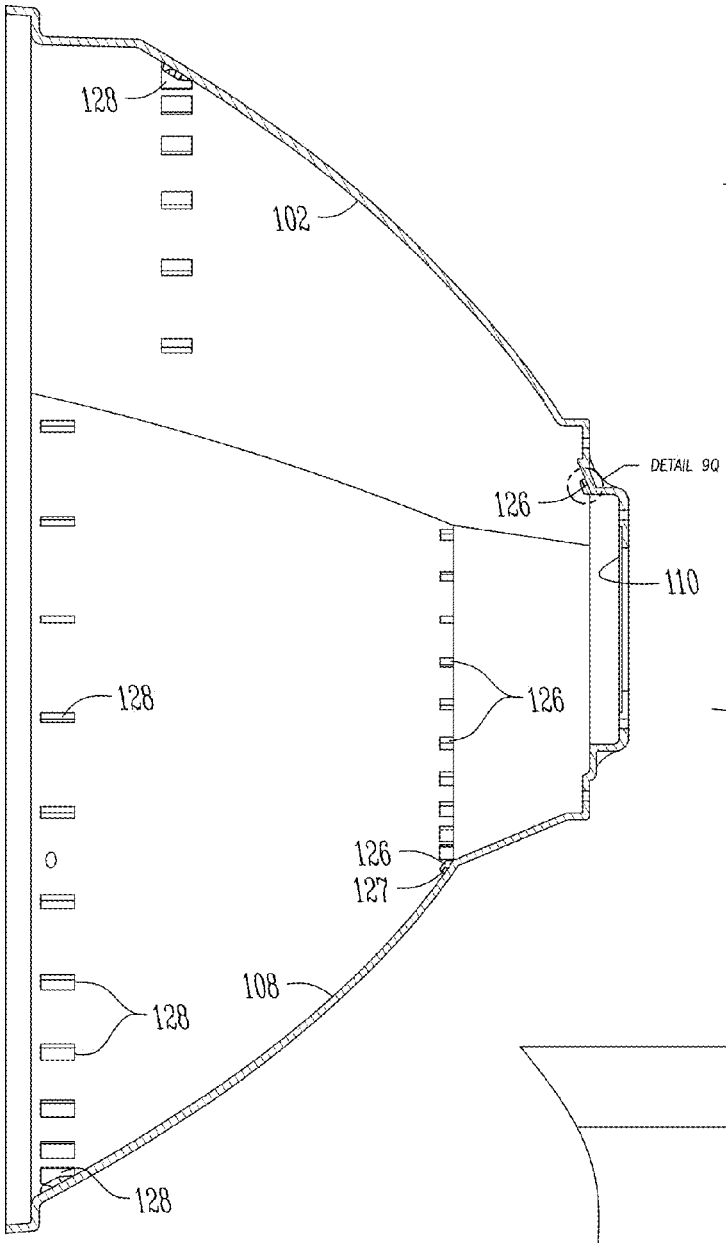
Figure 9J:
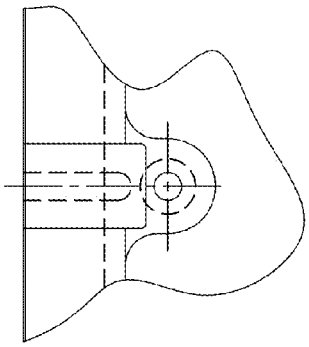
Figure 9K:
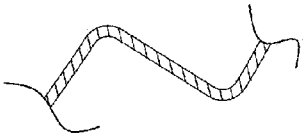
Figure 9I:
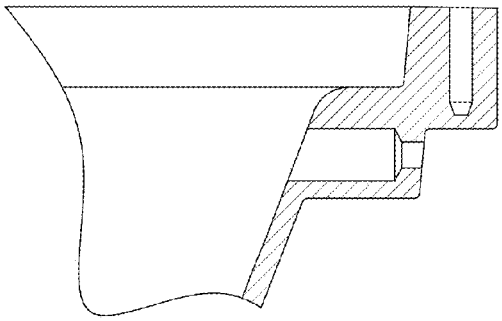
Figure 9G:
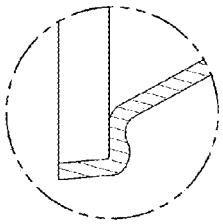
Figure 9L:
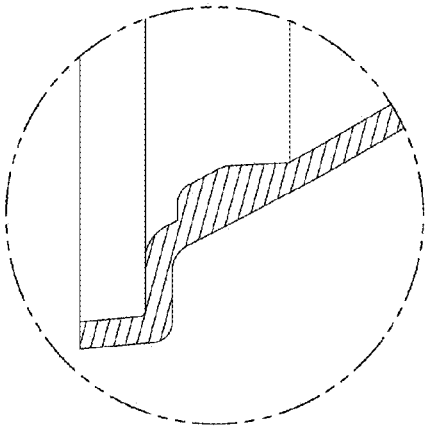
Figure 9M:
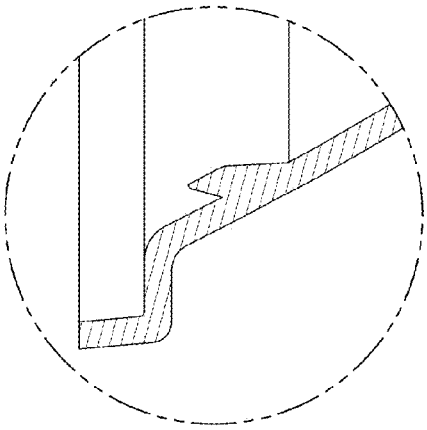
Figure 9N:
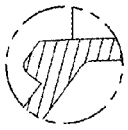
Figure 9O:
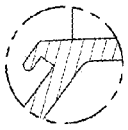
Figure 9U:
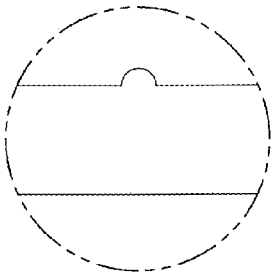
Figure 9P:
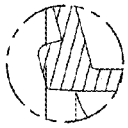

But reflector frame 30 includes another portion (see FIG. 9A and subparts, reference numeral 108) of a different nature. It is not in the same shape as the surface of revolution of portion 102. In the version shown in FIGS. 9A, 9D and 9F, section 108 is approximately 116° and centered in the lower hemisphere of the interior of reflector frame 30. When high reflectivity, primary reflecting surface 32 is applied over it, light is reflected in a less converging manner than from section 102, the section which follows a consistent surface of revolution.

Thus, reflector frame 30 is intentionally cast to include at least one section which supports high reflectivity material at a different, and less converging, orientation to the light source 20 and is not part of the general surface of revolution simulated by the rest of the reflecting surface 32, which is generally converging. This less converging part is easily designed and manufactured into fixture 10, because reflector frame 30 is cast and the reflecting surface added to it. Less converging section 108 is designed to redirect light from fixture 10 that otherwise would go off the athletic field and place it in a useful position for lighting the field. In essence, for normal aiming angles for sports lighting fixtures, light striking lower hemisphere less converging section 108 will be useable for lighting the field, as opposed to traveling horizontally or above horizontally and "spilling" off the field.

Musco Corporation has previously altered part of the surface of revolution of ordinary conventional bowl shaped spun reflectors to alter the direction of light from that portion of the reflector. See for example Musco U.S. Pat. No. 4,947,303, incorporated by reference herein. However, that method involved adding a separate insert piece over the spun reflector reflecting surface or mechanically peening or etching that part of the spun reflector to alter the reflecting properties of that part of the reflector. In fixture 10 of the embodiment of the invention, use of a cast reflector frame 30 allows nonreflecting supporting structure, separate from the reflecting surface, to be built into the reflector supporting framework. It avoids having a separate overlay piece or alteration of reflective surfaces.

5. Side Shift Sections 109 of Reflector Frame 30

Optionally, reflector frame 30 can have additional areas that can be modified to support reflecting surface 32 to diverge light like the less converging section 108 described above. Section 109R or L differs in that it is on a lateral side of reflector frame 30 (and thus lateral to, or to one side of lamp 20 when in place). Its function is the same, however, to pull light that otherwise would go off field back onto the field. As indicated in the Figures, these side shift portions could be on either side reflecting frame 30 and could take different configurations. See FIGS. 10A-E, 11A-E, 12A-L, and 13A-L for a variety of examples of different side shift configurations for fixture 10.

Thus, this "side shift" or generally horizontal shifting of light, can be particularly useful in sports lighting. It can allow light that otherwise might be glare or spill light to be "pushed" or shifted back onto the field. It also allows either placement of additional light onto a certain area of the field without added more fixtures or, conversely, removing some light from a certain area.

As can be appreciated, the ability to reduce glare and spill from one fixture can be significant. Substantially eliminating what otherwise would be light that spills outside the field (e.g. onto a neighbor's property) or causes glare (e.g. to a driver on an adjacent street), even for one fixture, can be very beneficial. But moreover, shifting light from a plurality of fixtures in a given lighting system can cumulatively significantly cut down on glare and spill light. Furthermore, shifting light in combination with reduced intensity from the fixture(s) (at least during an initial operational period for the lamps of the fixtures) can produce a substantial reduction in glare and/or spill light.

The die cast reflector, and the ability to precisely form a wide variety of shapes (and thus wide variety of light shifting functions), allows much flexibility to "push" light to locations where it is beneficial for the lighting application and/or "pull" light away from where it would not be considered beneficial.

An on-field example would be to shift more light just behind second base in a baseball field. Another example would be to decrease spill light from the end zone corner of a football field. Or both on-field and off-field light shifting could take place. It could be to either increase or decrease light at some part of the sports field, or redirect light that otherwise would go off the field so that it is added to the light going on the field. A designer can select the location and intensity of light virtually anywhere in a target space. While such things as beam width, distance to target, etc. have some bearing on the amount of light shift, the benefits described above can be enjoyed. Thus, a single fixture or a plurality of fixtures for a given lighting application can have a beam shifting or light shifting component such that a lighting application can be customized.

6. High Reflectivity Primary Reflecting Surface 32 (Reflector Inserts 120)

Reflecting surface 32 is independent of reflector frame 30. In this exemplary embodiment, reflecting surface 32 is made up of a set (e.g. thirty-six every ten degrees or so around reflecting surface 32) of elongated strips of high reflectivity sheet material which will be called reflector inserts 120. The shape (e.g. width), specularity (e.g. more diffuse or more shiny), and surface (e.g. smooth, stepped, peens, texture) can be varied from insert 120 to insert 120, or they all can be similar.

Figure 17A:
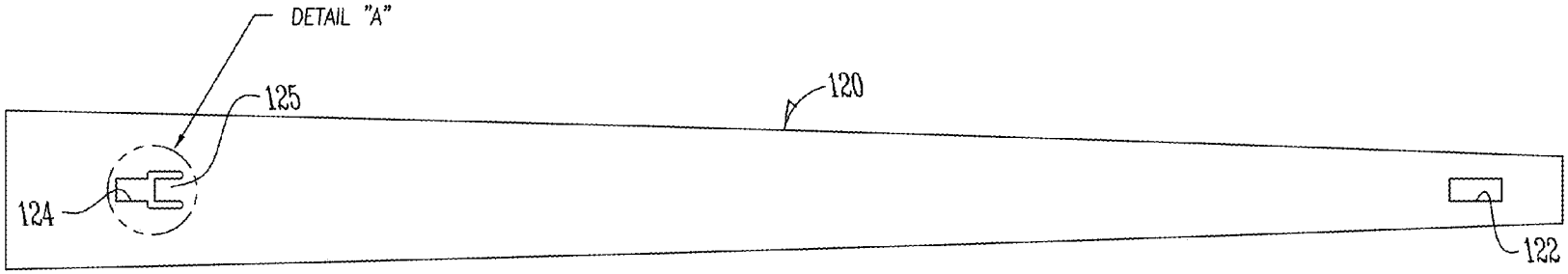
Figure 17B:
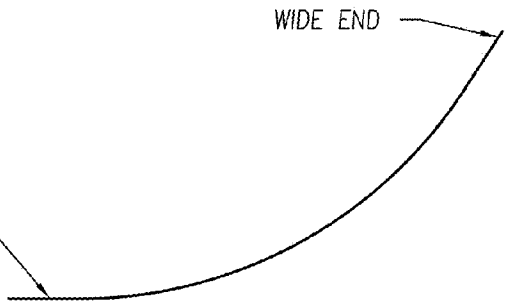

One example of a reflector insert 120 is illustrated at FIG. 17A. It is made from 0.020 thick Anolux MIRO® IV anodized lighting sheet material (available from Anomet, Inc. of Brampton, Ontario, CANADA). It has high total reflectance (at least 95%). It can be formed into curved shapes. FIG. 17B shows one formed profile which can be installed on pins 126 and 128 of reflector frame 30 (see also FIGS. 9F and 26J). The material has a base layer of high purity aluminum chemically brightened to form a hard clear surface of oxide, with a super reflective vapour deposited outer thin film outer layer. This results in a relatively hard, durable surface that reflects a minimum of 95% of visible light rays incident upon it. The material comes in flat sheet form. Inserts 120 are cut out to desired shape and are flat. A thin plastic, self-adhering releasable protection sheet is added over the reflecting side to keep fingerprints or other foreign substances from the reflecting surface during handling.

The temporary protective release sheet can be placed over the reflective side of the strips 120 when manufactured. A score line can be manufactured into the sheet to allow "break and peel" removal of the release sheet. When a fixture 10 is assembled, the worker can install each strip 120 without worrying about fingerprints or other substances attaching to strip 120 (he/she can grasp an insert 120 and even touch both front and back sides without leaving fingerprints on the reflecting side. But at the appropriate time during assembly, release sheet can be quickly and easily removed by peeling it off.

When installed in position on reflector frame 30, reflector insert 120 is basically captured between inner and outer pins 126 and 128. It does not have to rely precisely on the solid surface of reflector frame 30 behind it to define its form, but reflector frame 30 does provide the basic support and shape for reflector inserts 120 because each insert is suspended on two pins on the bowl-shaped reflector frame 30.

The material for inserts 120 has high consistency from piece to piece because it is made in large sheets under stringent and highly controllable manufacturing conditions. A subtlety of the material is that it is more efficient in reflecting light (thus more light that can be used to go to the field), but also its very high reflectivity results in much more precise control of the reflected light (it mirrors the light source more precisely). This adds greatly to the effectiveness and efficiency of fixture 10 in a sports lighting system for a sports field.

Alternatives for reflecting surface 32 is a silver coated aluminum are available from commercial sources (e.g. Alanod Aluminum, Ennepetal, Germany). This type of material can achieve higher reflectivity (perhaps 3 percent higher) than the previously described material, but is not as durable.

FIGS. 17A-C to 25A-C illustrate various examples of reflector inserts 120 that can be mounted to the interior surface of reflector frame 30. The pre-manufactured, high reflectivity strips 120 do not need polishing or other processing steps that are many times required of spun aluminum reflectors. Therefore, another cost of conventional spun aluminum fixtures is avoided. And the color separation or striations that plague spun aluminum reflectors after polishing are avoided because strips 120 are flat in one plane (although mounted along a curve in another plane) and are not polished after manufacture.

In one exemplary embodiment, thirty-six inserts 120 (when 2 inches at base) are mounted on reflector frame 30. The nature of each insert selected, and its position on frame 30 depends on the type of light beam desired for the fixture. Width, curvature when installed, and surface characteristics of inserts 120 can all be designed to produce the type and characteristics of a beam needed for that particular fixture for a particular field. Inserts 120 can be custom designed for a fixture. Alternatively, an inventory of a limited number of styles, all capable of being installed on a pair of pins 126 and 128 of reflector frame 30, and capable of producing many of the standard beam types needed for sports lighting, could be created. Specific reflective inserts 120 for each fixture for a lighting system for a field can be determined according to computerized programs and/or specifications for the field. Workers can therefore easily select and install the appropriate inserts 120 for a given fixture without experimentation or expertise in lighting design. They basically have to match an inventory item to the specification for that fixture.

Each insert has an formed openings 122 and 124 towards opposite ends that are adapted to cooperate with a set of inner and outer mounting pins 126 and 128 on the interior of reflector frame 30. The spacing and configuration of each set of openings 122 and 124 on each reflector insert 120, and the corresponding set of inner and outer pins 126 and 128 on reflector insert frame 30, allow quick and easy securement or removal of inserts 120. They are positioned and secured without any fasteners. There is no need for tools.

Figure 9Q:
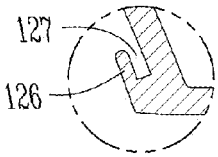
Figure 9V:
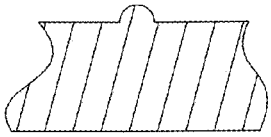
Figure 9W:
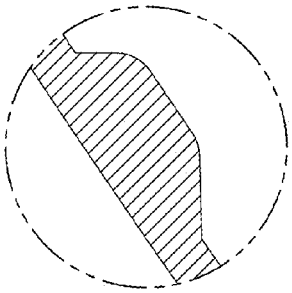
Figure 9X:
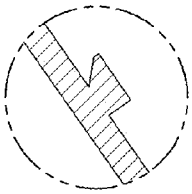
Figure 9R:
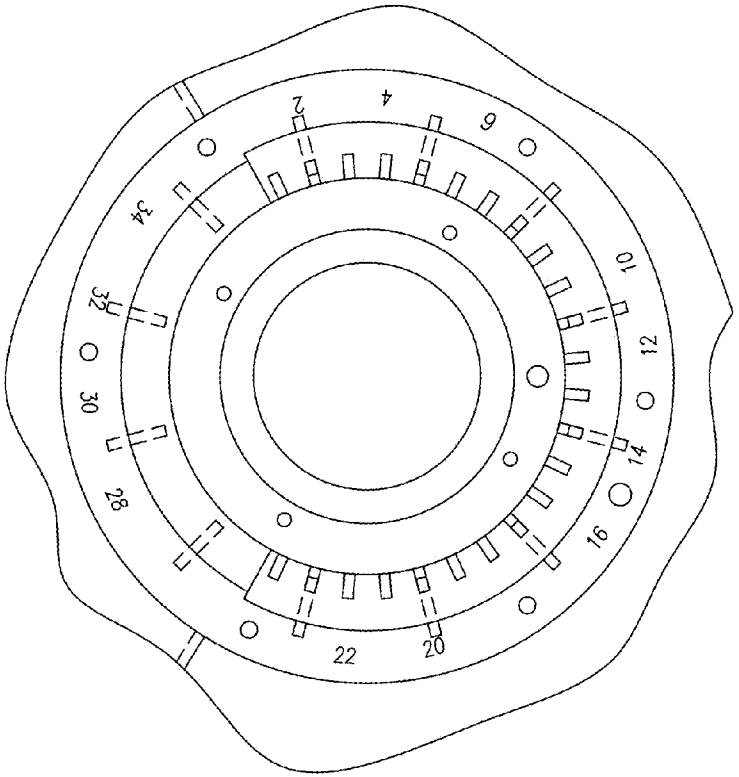
Figure 9S:
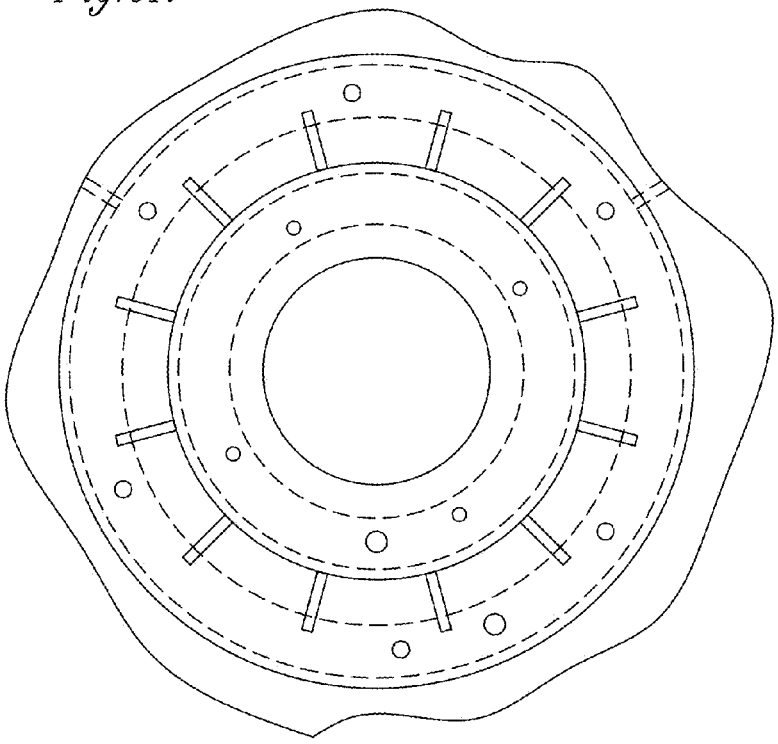
Figure 9T:
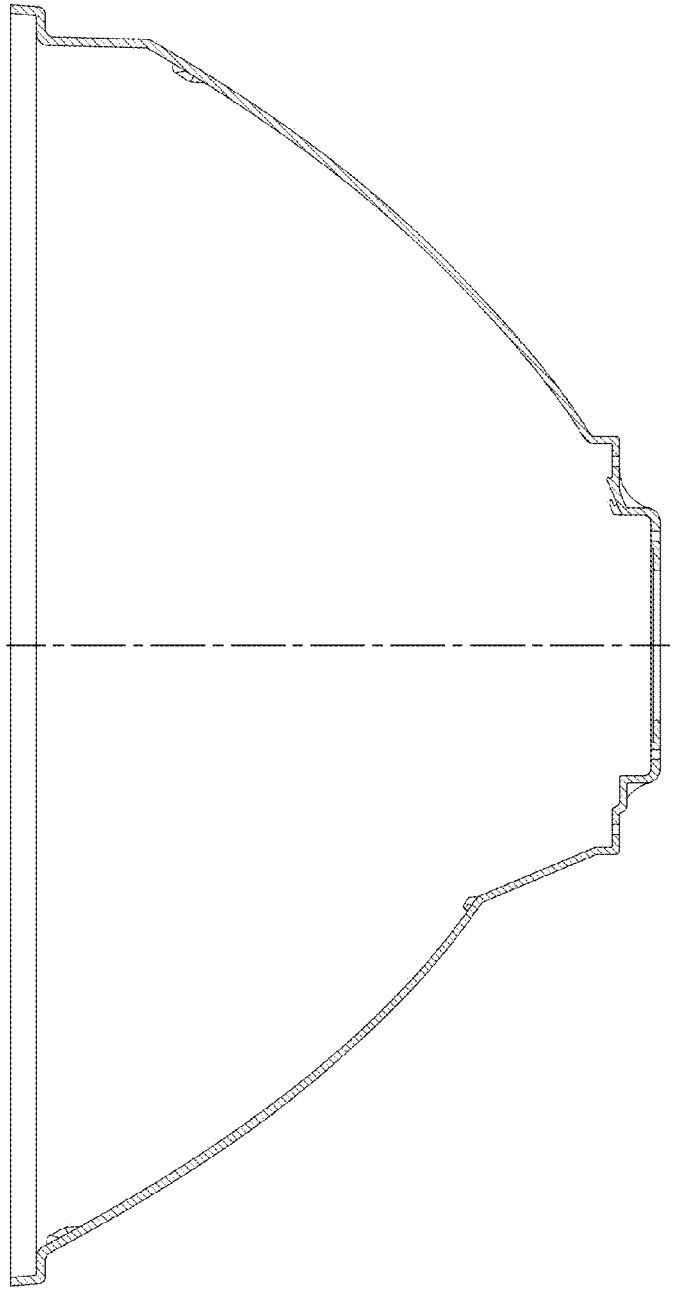
Figure 9Y:
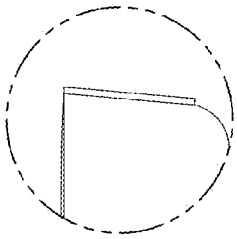
Figure 9Z:
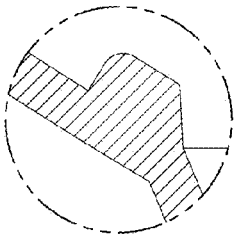
Figure 9A:
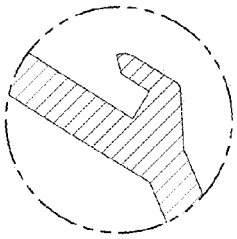
Figure 10A:
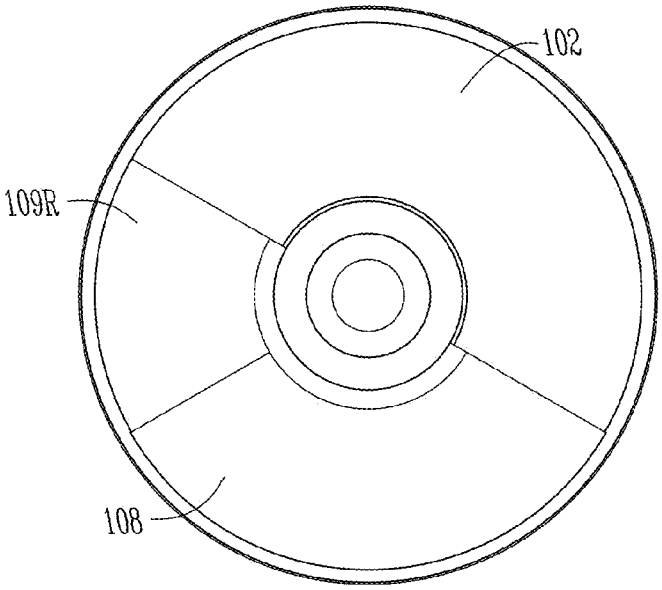
Figure 10C:
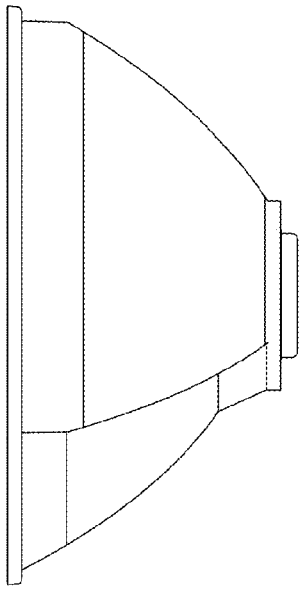
Figure 10B:
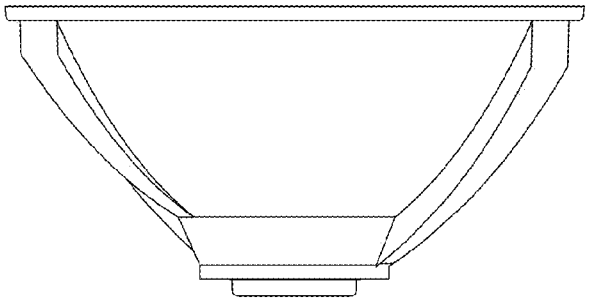
Figure 10D:
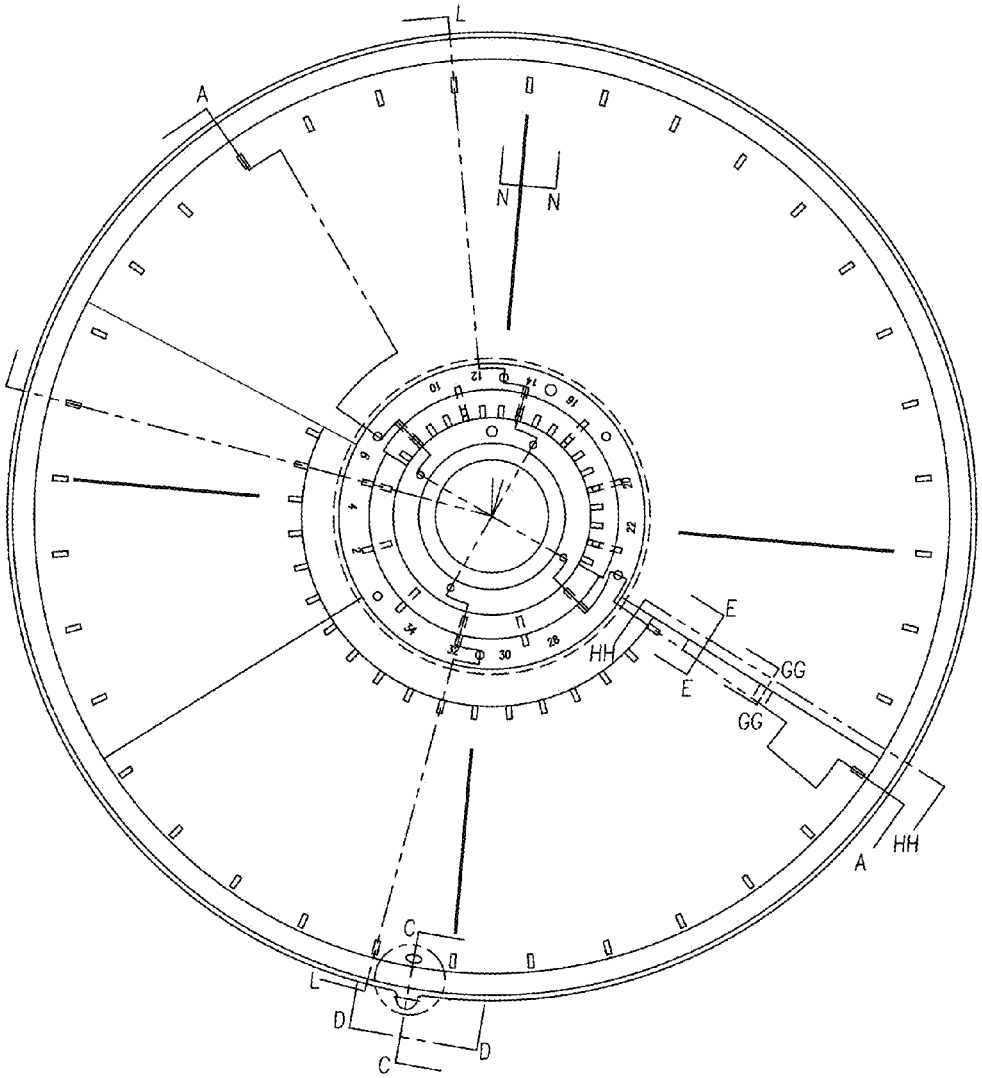
Figure 10E:
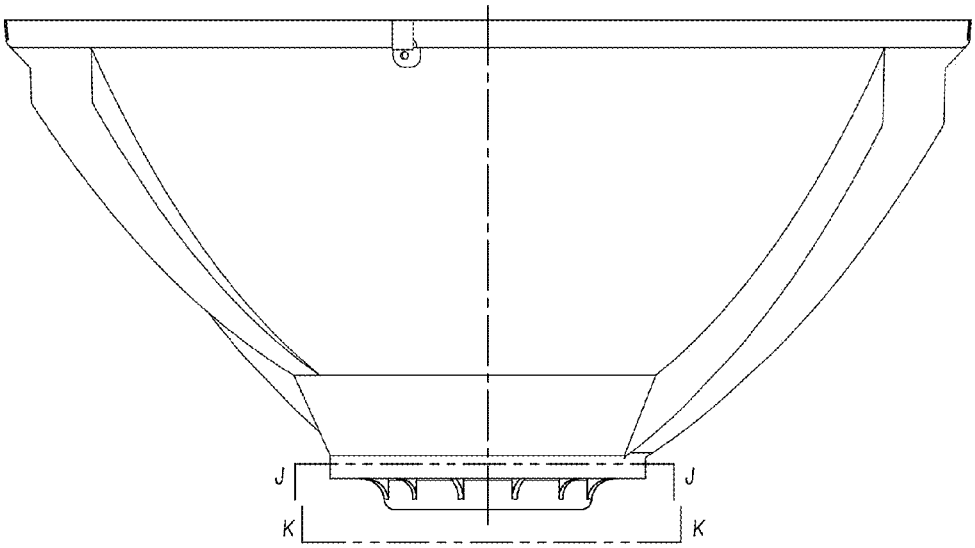
Figure 10F:
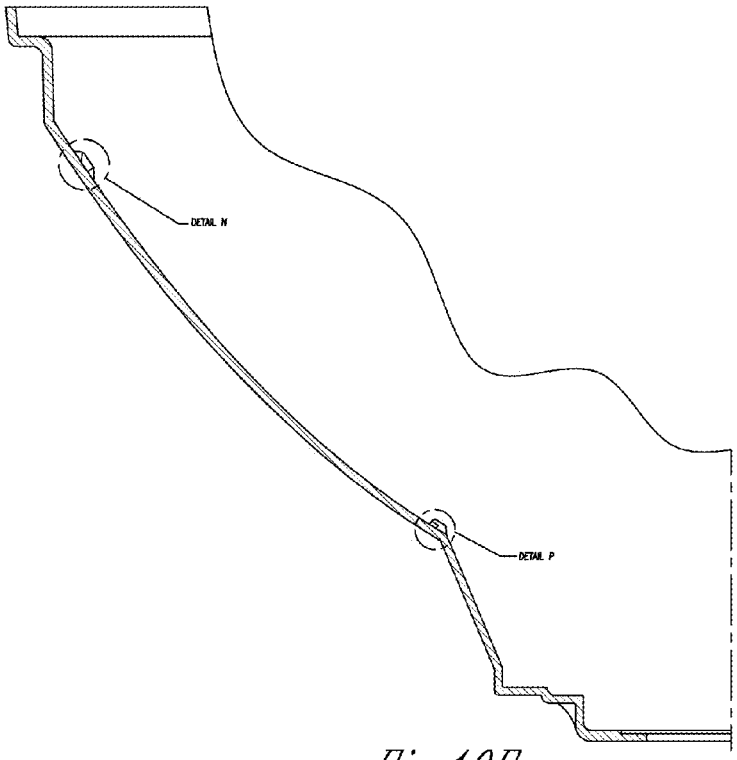
Figure 11A:
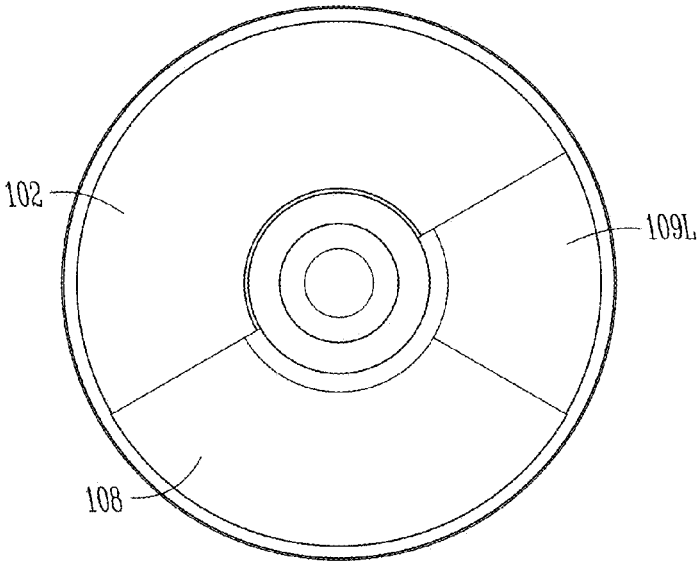
Figure 11C:
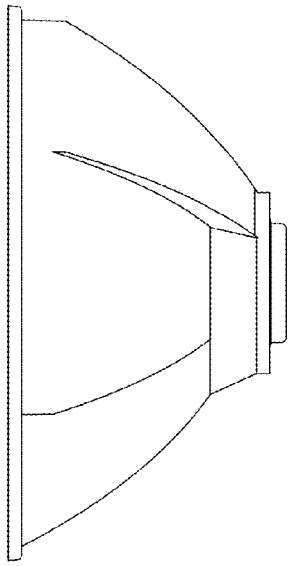
Figure 11B:
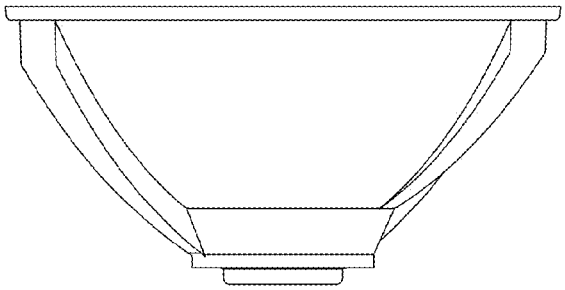
Figure 11D:
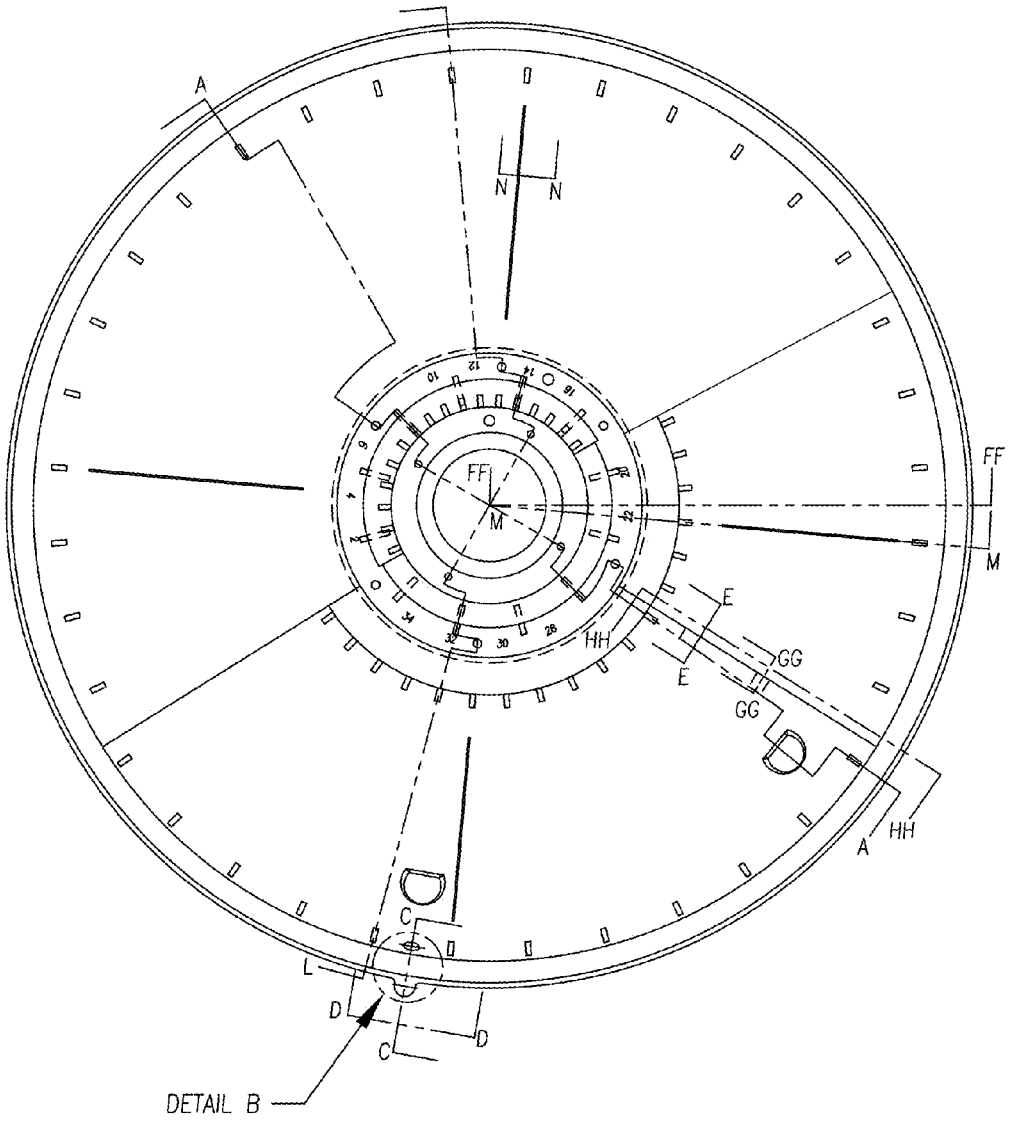
Figure 11E:
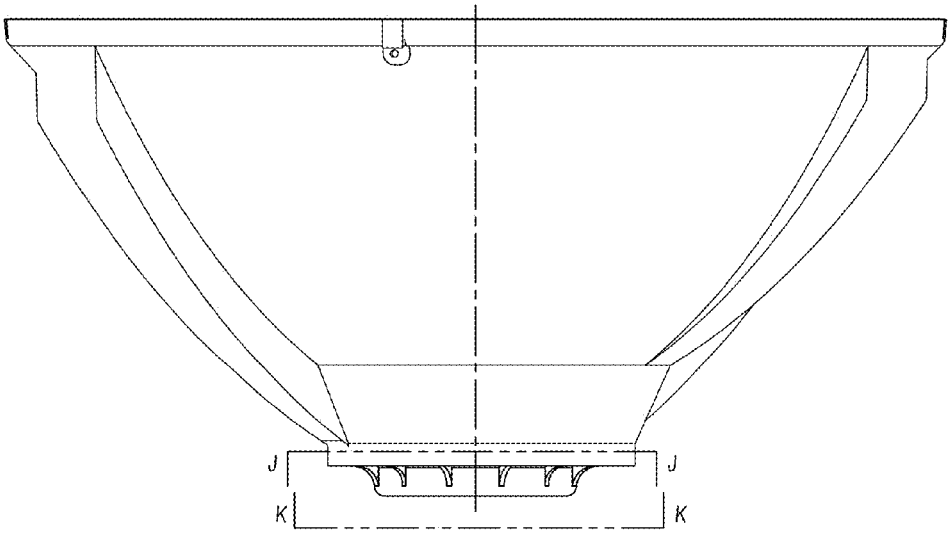
Figure 12A:
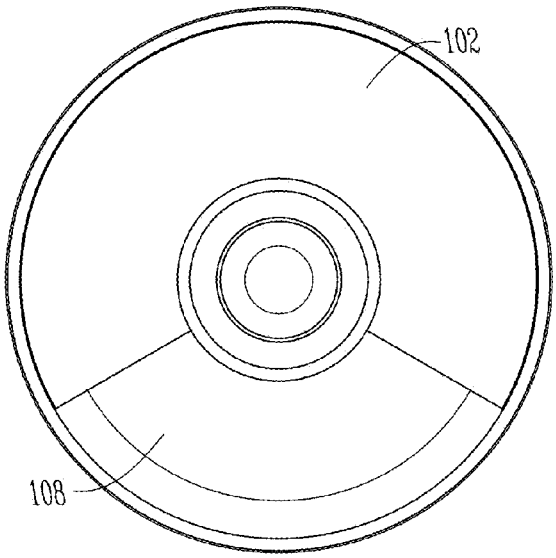
Figure 12C:
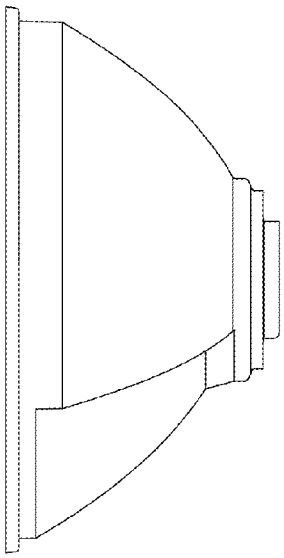
Figure 12B:
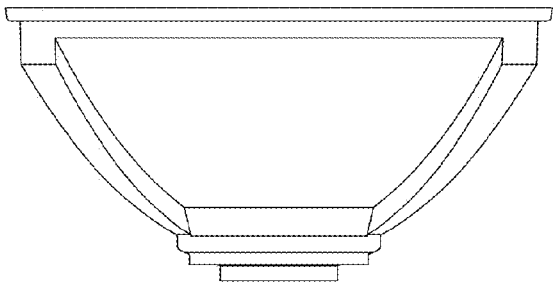
Figure 12D:
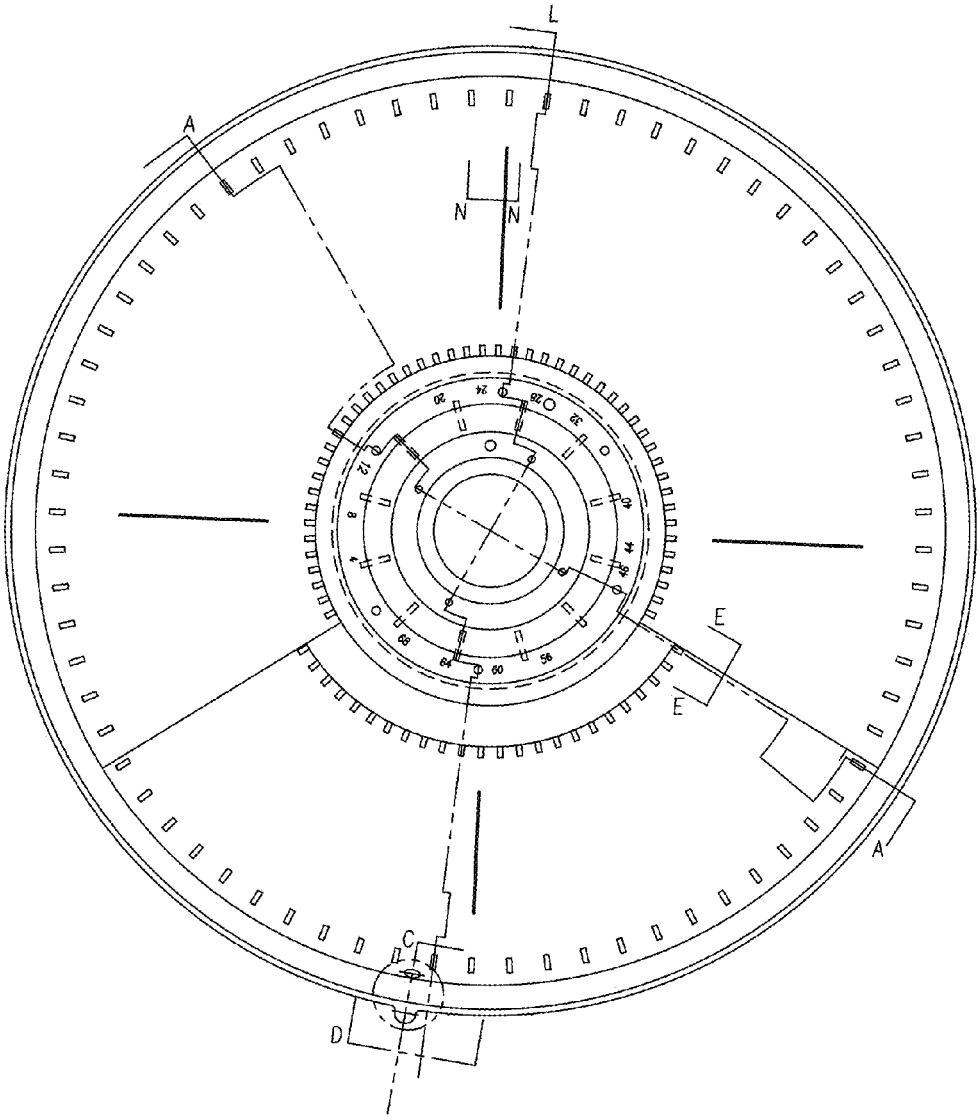
Figure 12E:
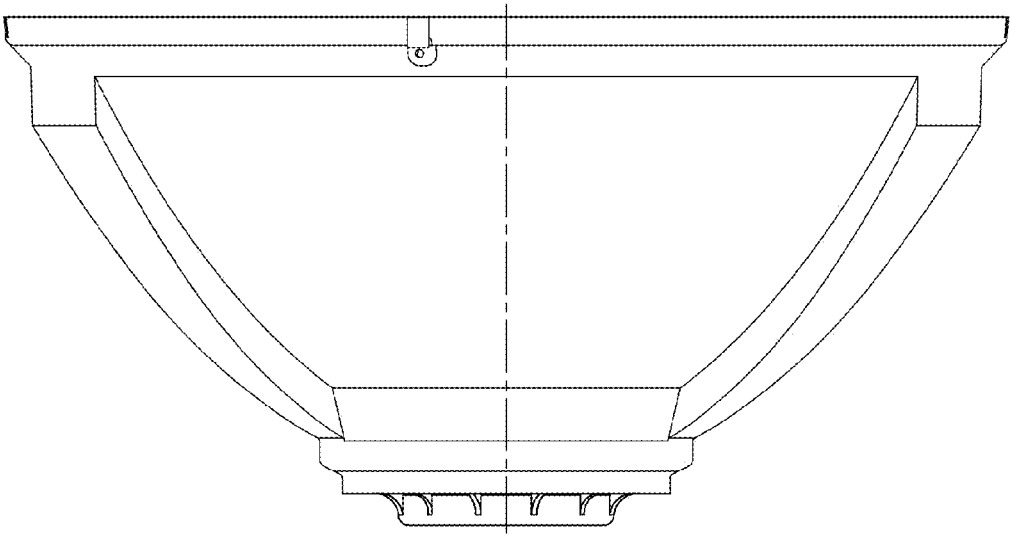
Figure 12F:
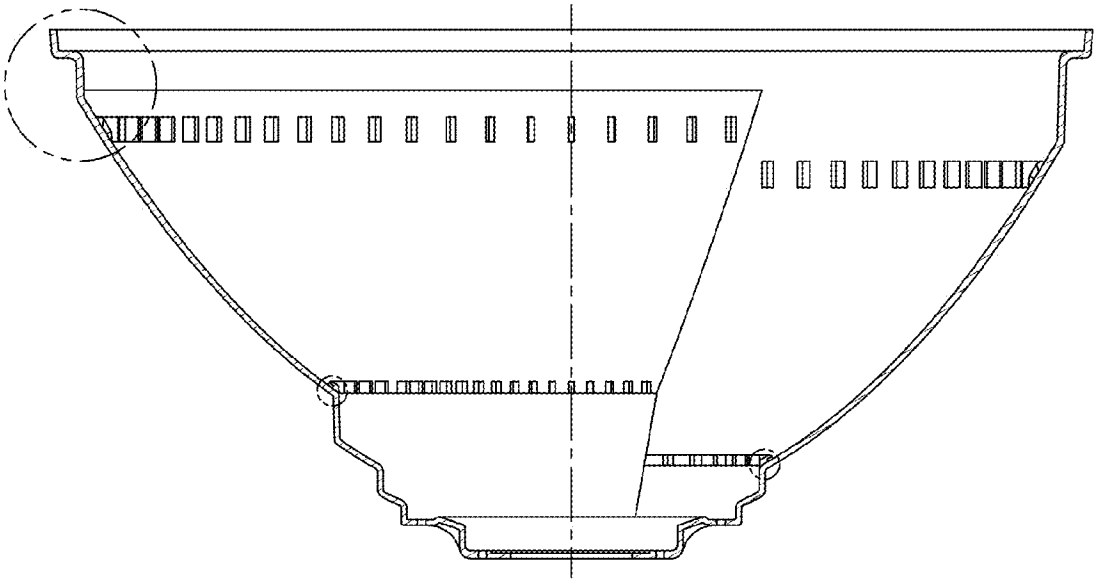
Figure 12G:
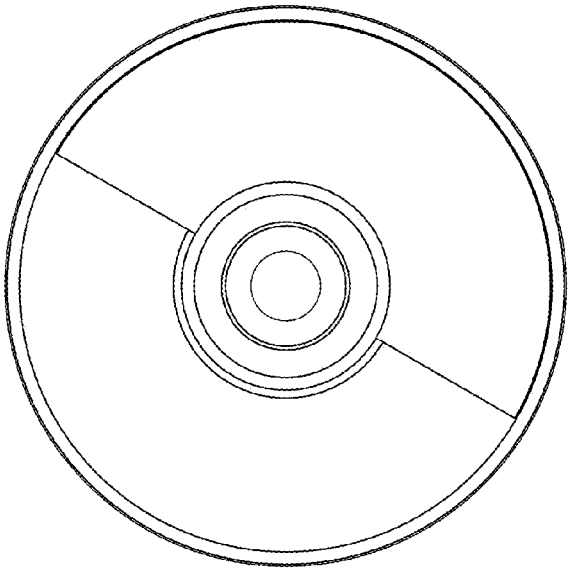
Figure 12H:
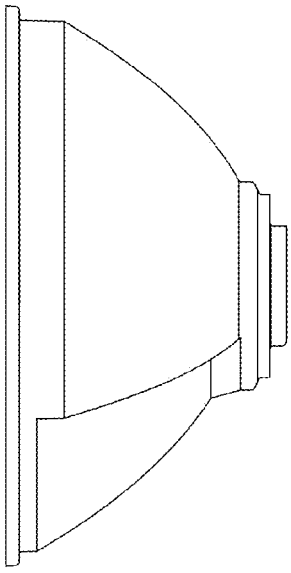
Figure 12I:
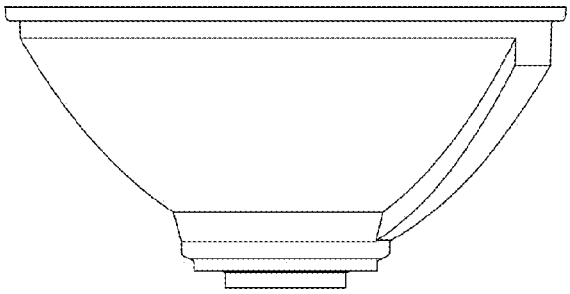
Figure 12J:
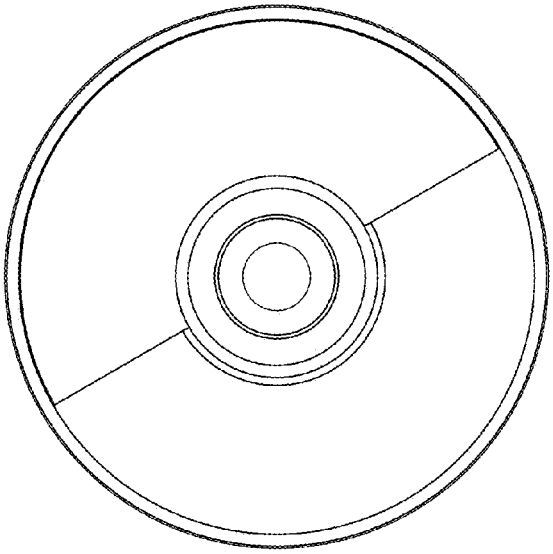
Figure 12K:
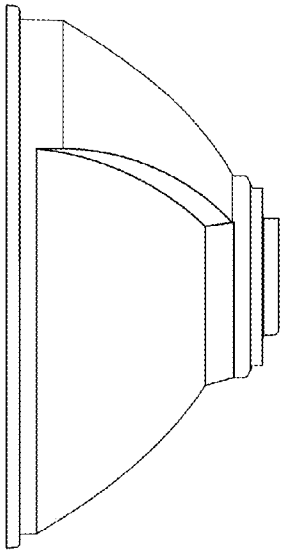
Figure 12L:
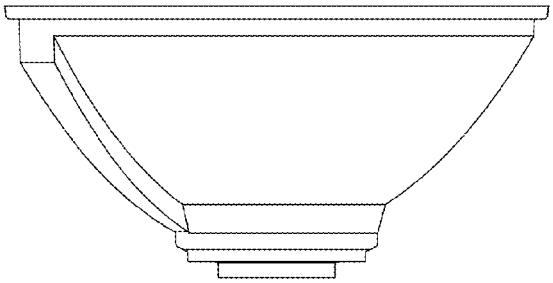
Figure 13A:
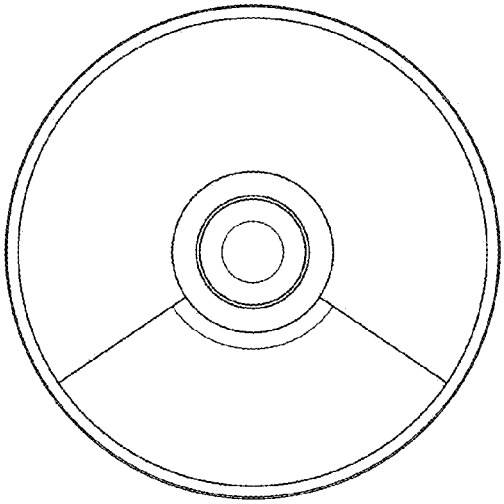
Figure 13C:
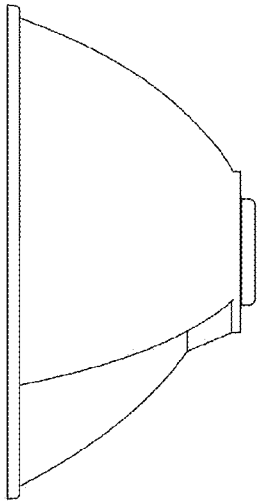
Figure 13B:
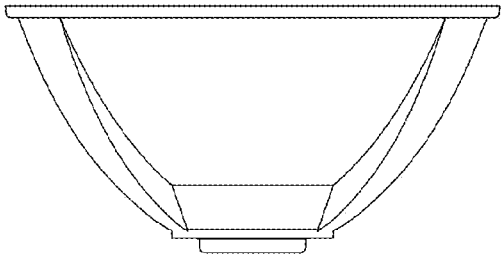
Figure 13D:
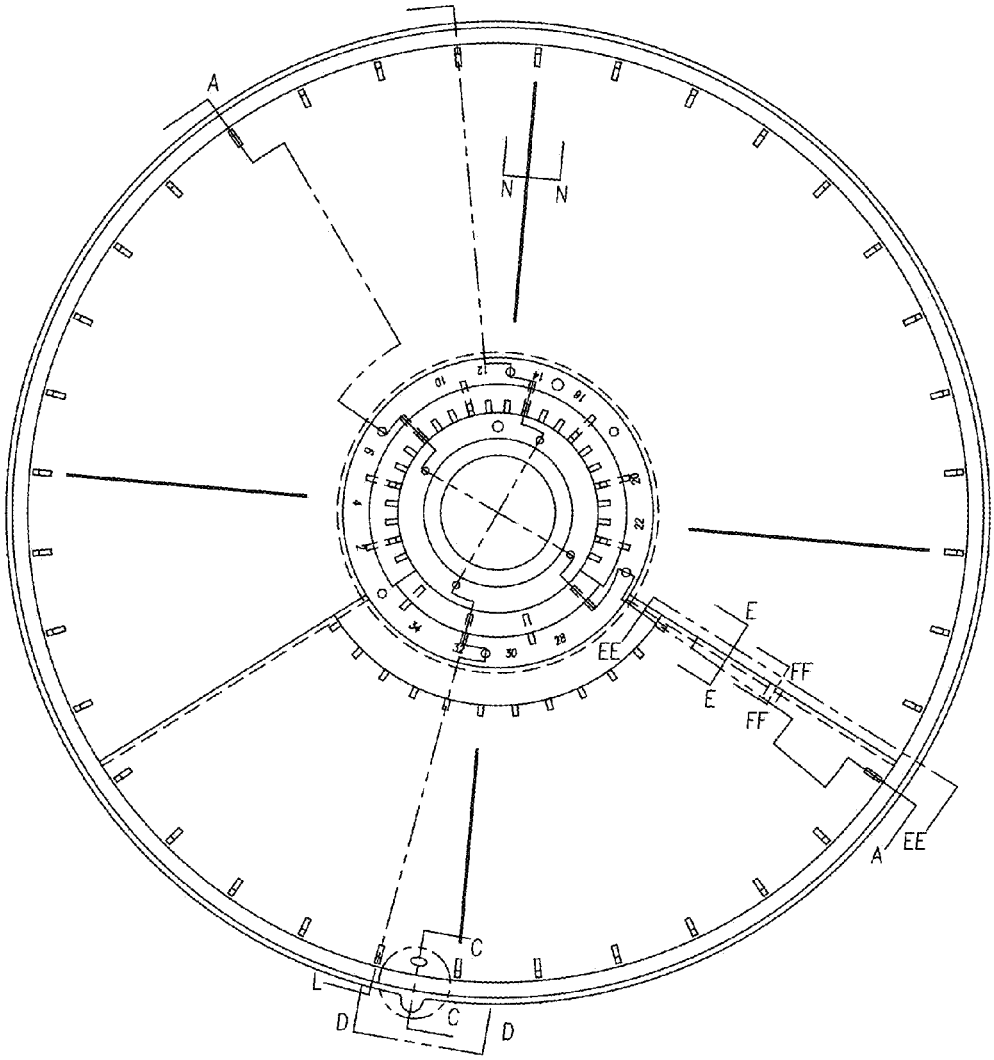
Figure 13E:
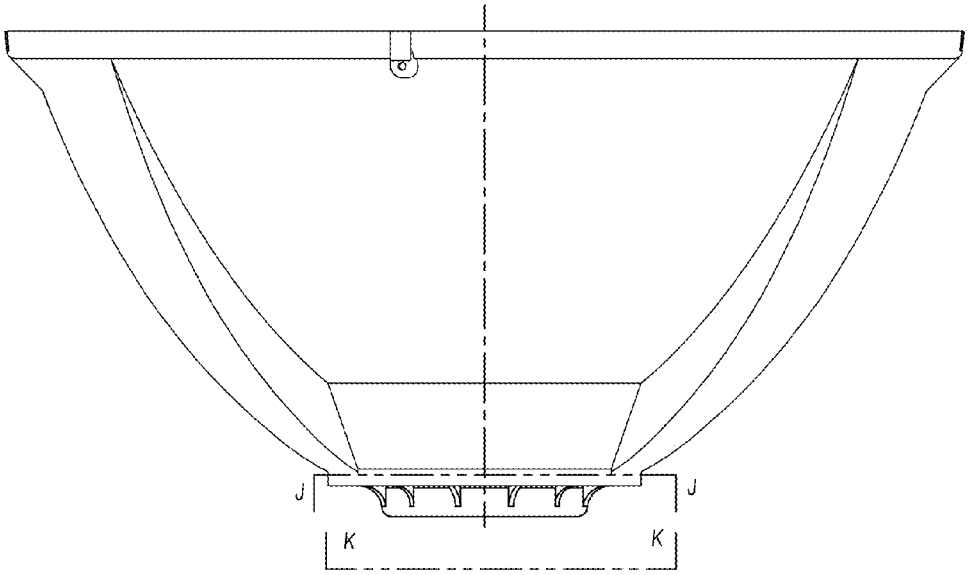
Figure 13F:
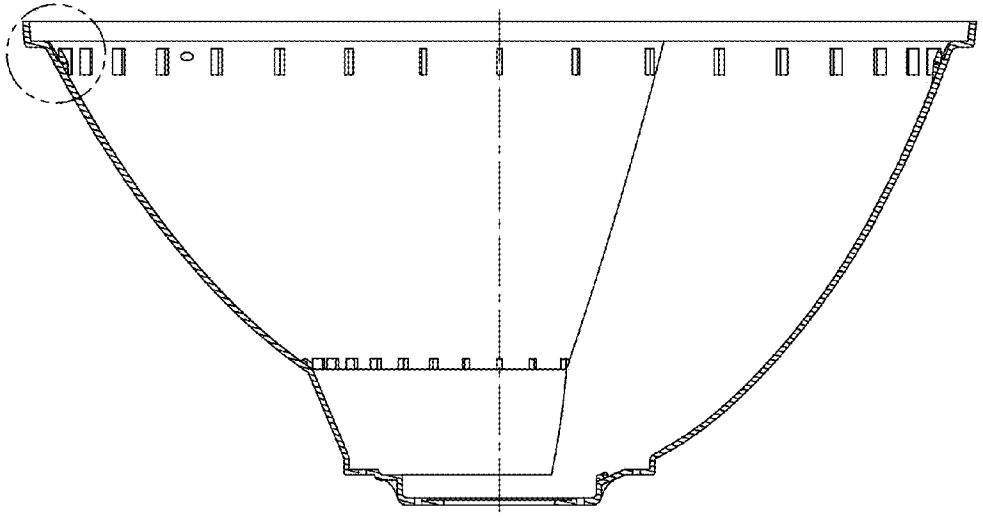
Figure 13G:
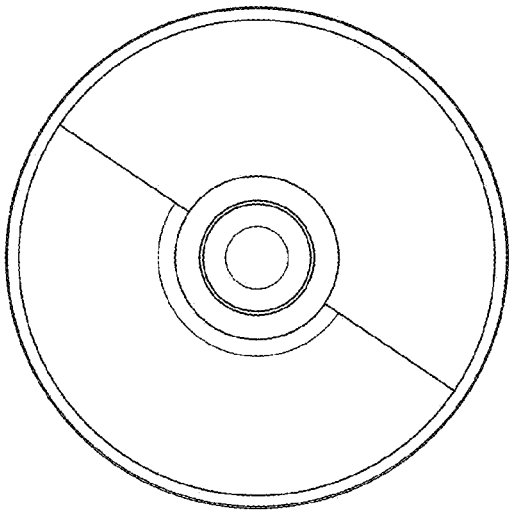
Figure 13H:
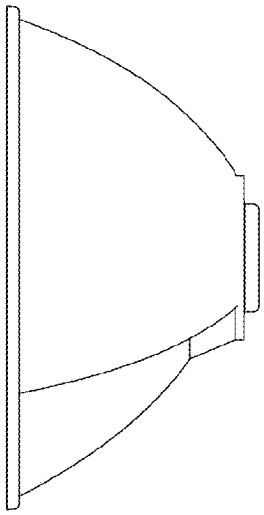
Figure 13I:
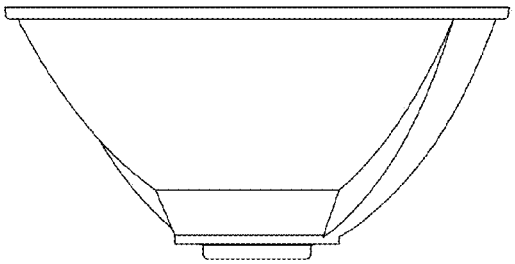
Figure 13J:
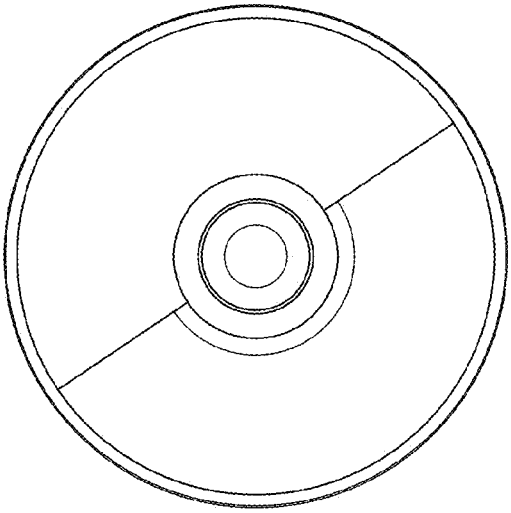
Figure 13K:
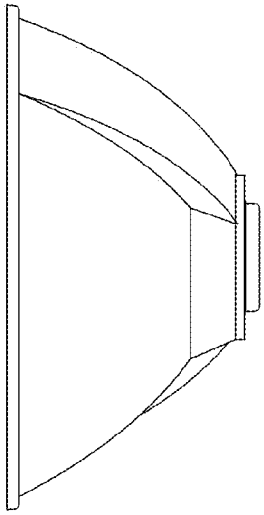
Figure 13L:
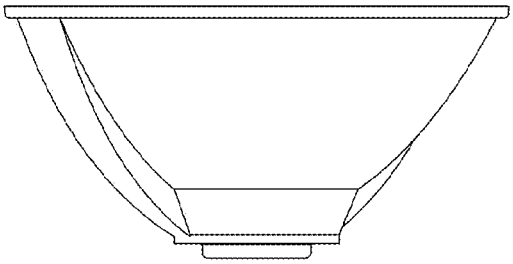

FIGS. 9A-9AA illustrate details about inner and outer pins 126 and 128 and how insert 120 can be mounted. The rectangular opening 122 of a reflector insert 120 (FIG. 17A) is brought vertically over inner pin 126 until the plane of reflector insert 120 is at the level of slot 127 of inner pin 126 (see Detail in FIG. 9Q). Reflector insert 120 is then slid slightly forward relative to inner pin 126 so that the inner end of reflective insert 120 is held against movement. The outer wider end of reflector insert 120 is basically then snap fit over outer pin 128. The small tongue 125 extending into formed opening 124 of reflector insert 120 (FIG. 17A) can deflect slightly but frictionally bites into pin 126 a bit and acts as a resilient force to hold reflector insert 120 into position on inner and outer pins 126 and 128. Once mounted on a set of pins 126 and 128, the curved shape of insert 120, and the inherent resiliency of the material it is made of, resists further bending or movement back to a flat configuration, including a tendency to want to draw towards lamp 20, a heat source, during operation.

Each reflector insert 120 essentially forms an individual small reflector of the light source (arc tube 12 and lamp 20). To create a highly controlled composite beam from a fixture 10, accuracy of installation and position in reflector frame 30 is important. The pin-mounting method for reflector inserts 120 allows accurate placement and deters change of shape or position of inserts 120 once in place. But further, it makes assembly of inserts 120 into fixture 10 quick and easy.

As can be appreciated, different styles and configurations of reflector inserts 120 can be created for different lighting effects. This is not easily possible with spun reflectors. As indicated in FIGS. 17A-C to 25A-C, not only the precise curved profile, but also the width of reflector insert 120 can determine characteristics of the composite beam coming out of fixture 10. The principles involved are described in the Musco Corporation U.S. Pat. No. 6,036,338, incorporated by reference herein. Note that wider reflector strips 120 (for example see FIGS. 19A-C) can include two pairs of inner and outer formed openings 122 and 124 and utilize two sets of inner and outer pins 126 and 128.

As can be seen in FIGS. 9A-AA, pairs of inner and outer pins 126 and 128 are spaced differently for different parts of reflector frame 30. For example, in the main portion 102 of reflector frame 30, all pin pairs 126/128 are spaced equally apart a first distance. Pin pairs 126/128 in less converging portion 108 or side shift portion 109, have shorter but equidistant spacing, because reflector inserts 120 for those sections are shorter and different in curvature.

Figure 17C:
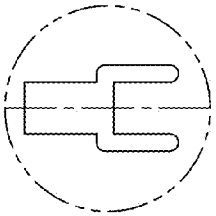
Figure 18A:
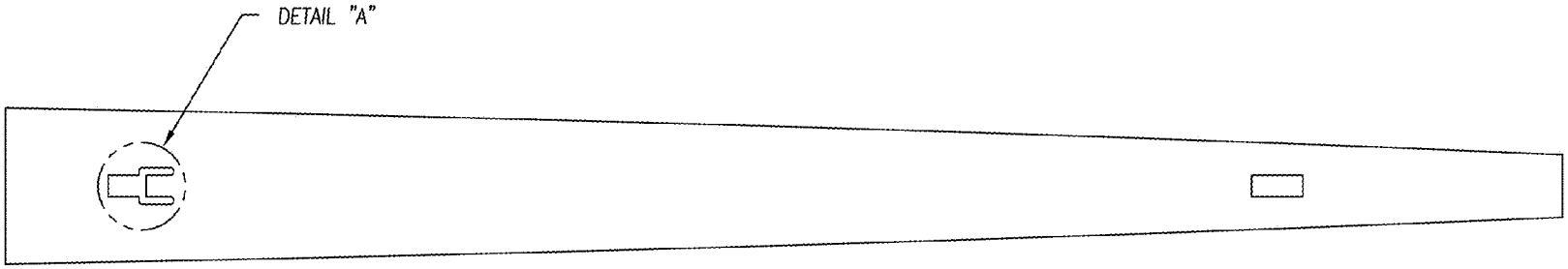
Figure 18B:
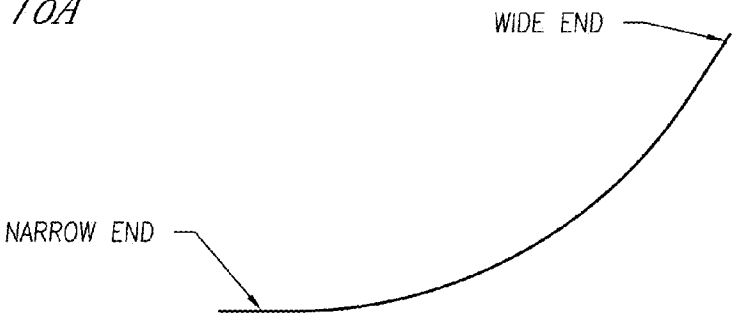
Figure 18C:
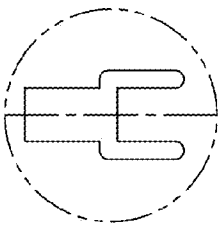
Figure 19A:
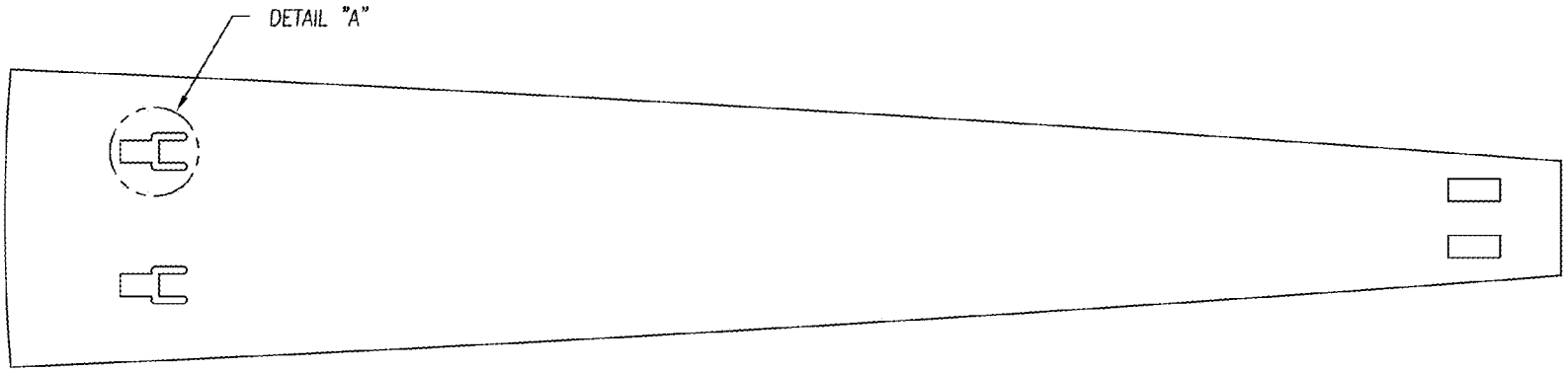
Figure 19B:
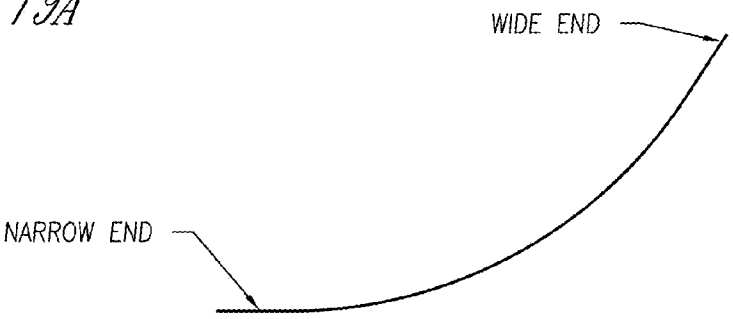
Figure 19C:
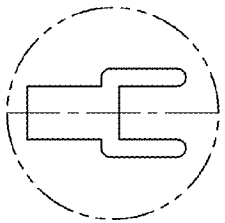
Figure 20A:
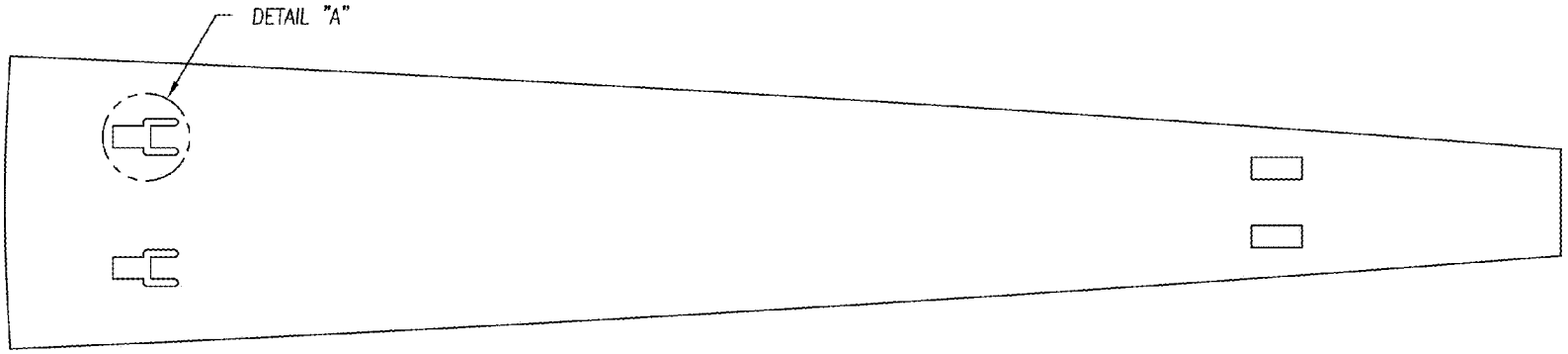
Figure 20B:
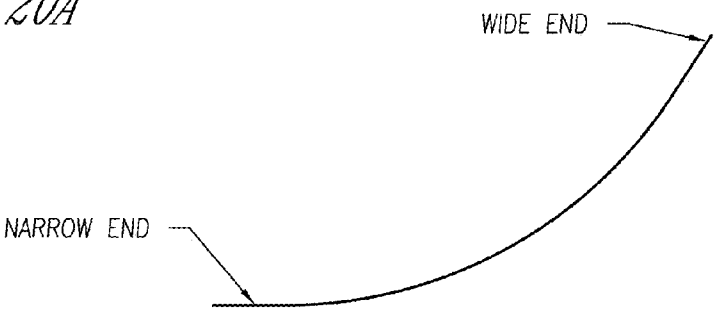
Figure 20C:
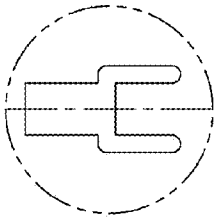
Figure 21A:
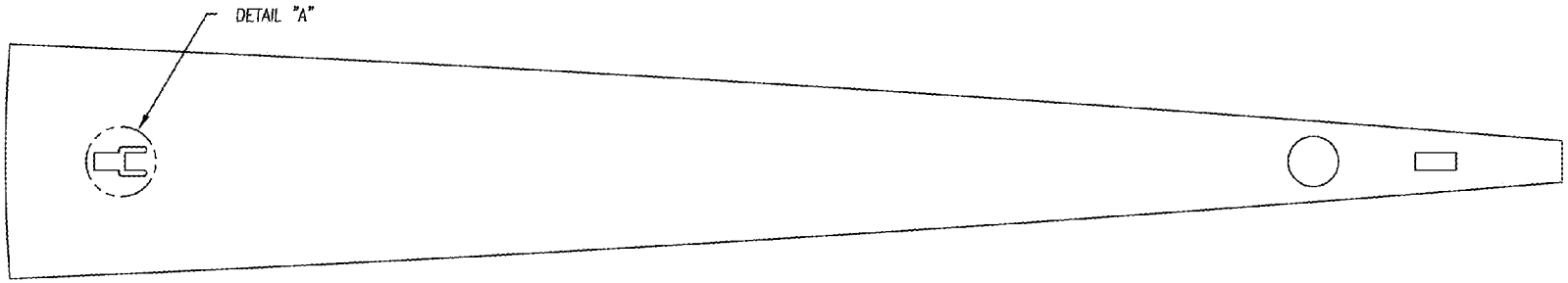
Figure 21B:
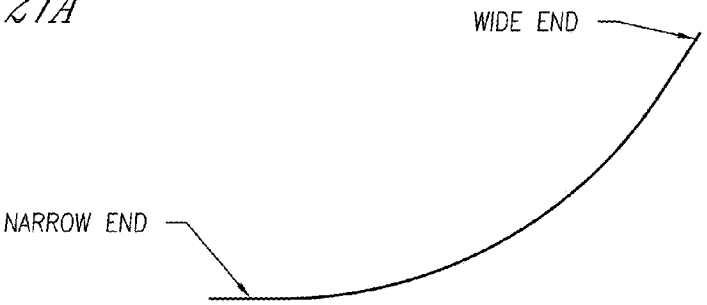
Figure 21C:
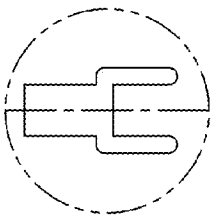
Figure 22A:
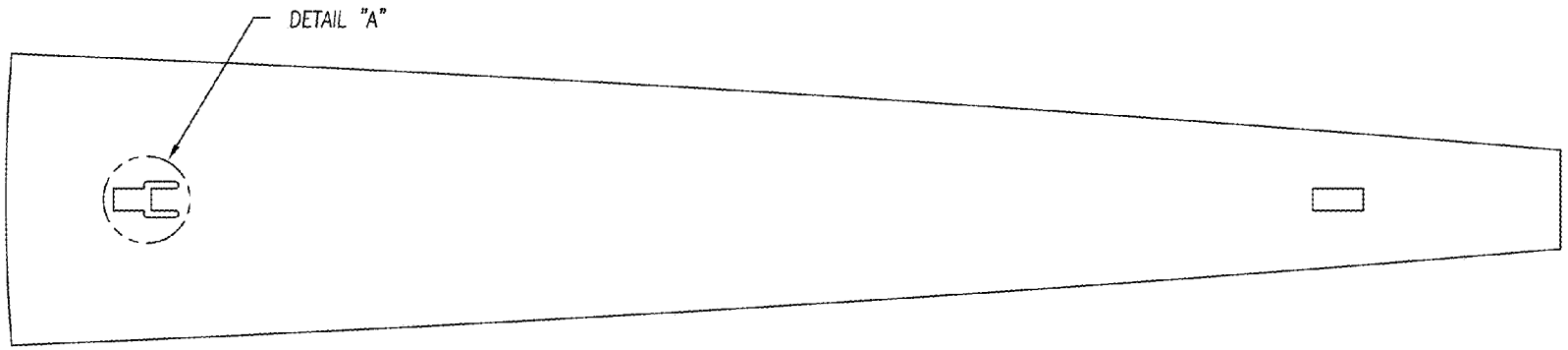
Figure 22B:
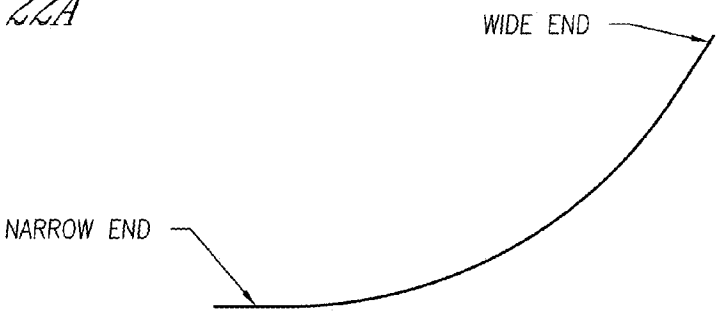
Figure 22C:
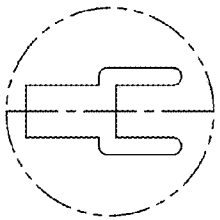
Figure 23A:
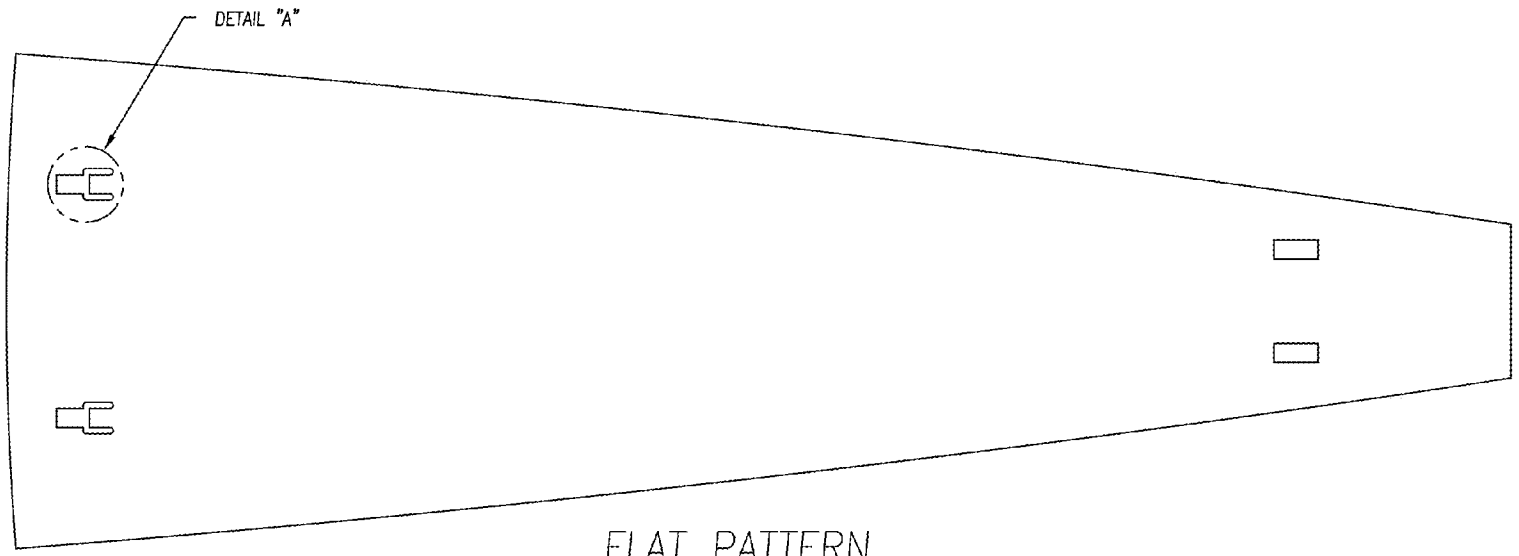
Figure 23B:
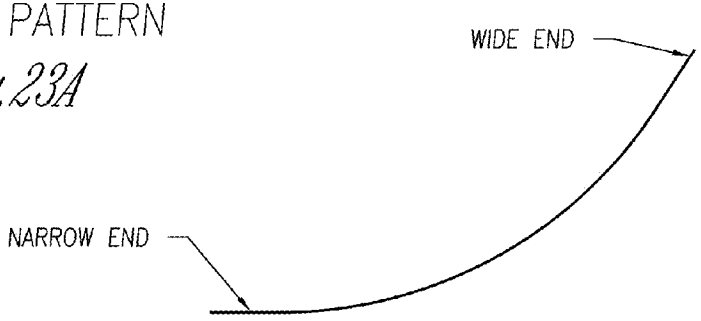
Figure 23C:
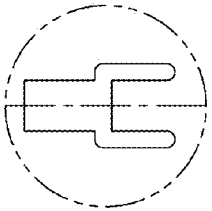
Figure 24A:
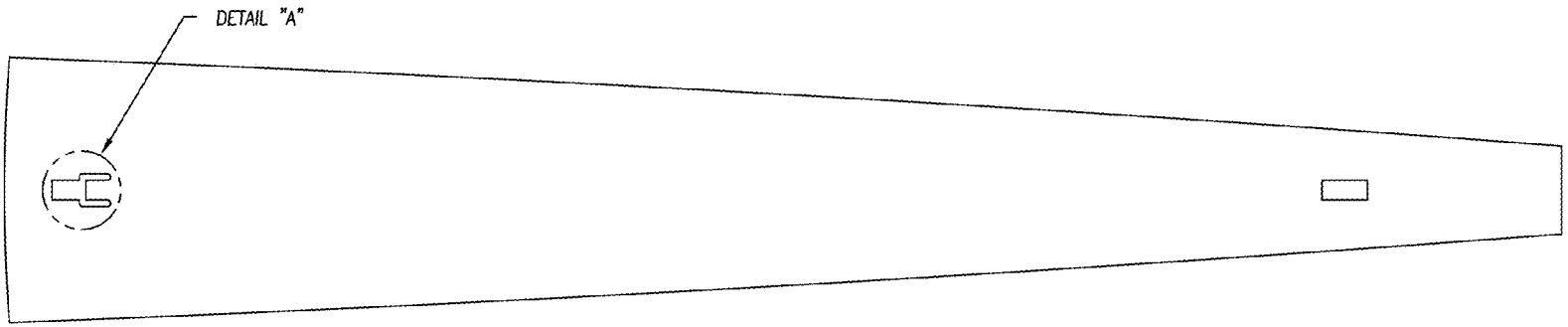
Figure 24B:
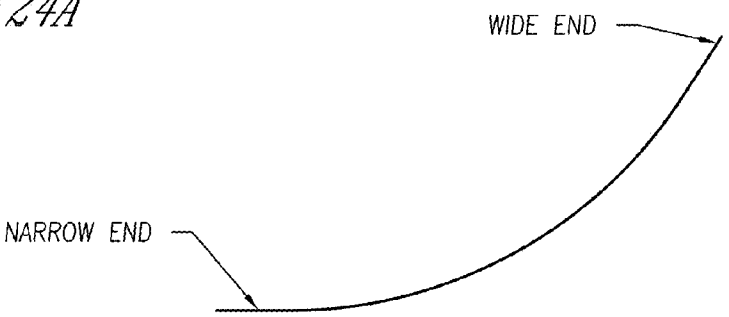
Figure 24C:
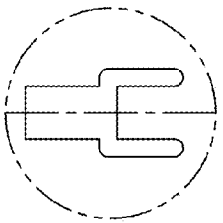
Figure 25A:
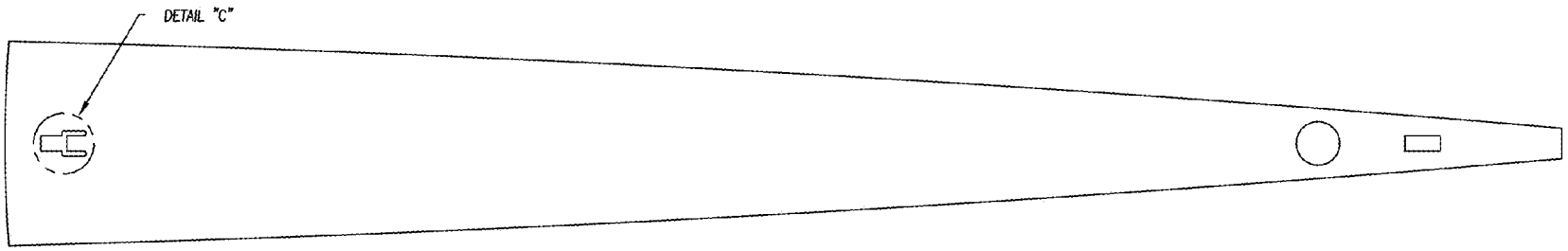
Figure 25B:
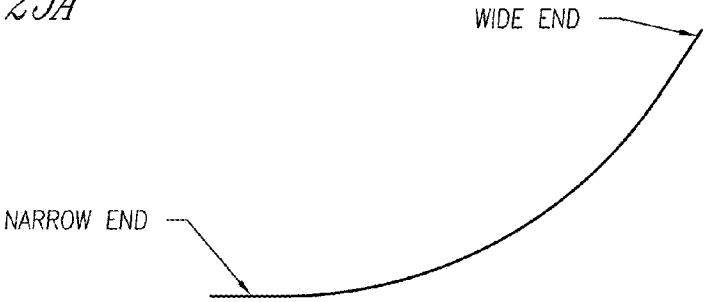
Figure 25C:
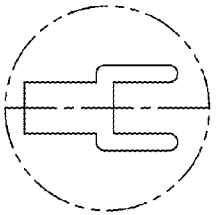

Different beam characteristics from the same reflector frame 30 can be created by using different reflector inserts 120. Examples of inserts 120 are shown in the drawings. These examples fall into three broad categories: (a) two inches wide at the lens end for a medium width beam (FIGS. 24A-C); four inches wide (lens end) for wider horizontal beam spread (FIGS. 22A-C and 23A-C, where lighting is accomplished with less fixtures), and one inch (lens end) for quite narrow spread (usually for fixtures far away from target) (FIGS. 17A-C). Other configurations are, or course, possible. Different widths, specularity, shape, and reflecting surfaces can be designed for different lighting effects. Inserts 120 can be the same for a whole fixture 10, or can vary.

On the other hand, the same reflector inserts 120 could be applied to differently shaped reflector frames 30, without modification, and produce a different beam shape for fixture 10. FIGS. 9A-9AA illustrate a reflector frame and reflector inserts which would produce a medium reflector type 3 beam, such as is well-known in the art. As can be appreciated by those skilled in the art, other types of beams can be created with different shaped reflector frames 30 (e.g., wide reflector type 4, narrow reflector type 2, etc.) with the use of appropriate reflector inserts.

Additionally, less converging lower section 108 or less converging side shift section 109 can change the nature of the beam from fixture 10. Different configurations for less converging section 108, with or without a left or right side shift section 109 for a reflector frame 30 are illustrated in FIGS. 10A-F, 11A-E, 12A-L, and 13A-L. FIGS. 9A-C, 13A-C, and 12A-C illustrate variations on a less converging lower hemisphere portion 108 such as previously described. FIGS. 10A-F, 12G-I, and 13G-I add what will be called a right side shift section 109 in addition to a downward less converging section 108. Portion 109R, on a lateral side of reflector frame 30, has a shape different from the main portion 102. It can also be different from the less converging portion 108. As can be appreciated, by election of that shape, light incident upon primary reflecting surface 32 placed over side shift portion 109R can be made less converging than main portion 102. Such light would therefore tend to be directed more directly out of the page relative to FIG. 10A, as opposed to the right in FIG. 10A. For fixtures at aiming orientations to the target that otherwise would project light from that side off of the target, section 109 can shift a substantial amount of that light back to the target. The typical side shift is approximately 60% of the 360 degrees of the main reflector surface 32.

Similarly, FIGS. 11A-E, 12J-L, and 13J-L illustrate variations of a left side shift. Section 109L is added to reflector frame 30 to shift light that would otherwise converge towards the aiming axes of the reflector and then cross at axes to an off target site, and instead shift that portion of the light back to the target.

Note that FIGS. 10A-F to 13A-L illustrate but a few examples of configurations for portions 108 and 109. Others are, of course, possible.

Beam customization is possible by taking advantage of the ability to easily build in variations to reflector frame 30, such as less converging section 108 or side shift section 109L or R. These sections of frame 30 can be readily manufactured with no or nominal extra cost because of the ability to cast frame 30. Almost infinite beam shape possibilities exist also because of the ability to form any number of different reflective inserts 120 (with any number of reflective characteristics) that can be interchanged on frame 30.

In addition to width of inserts 120, other features may be modified to produce different reflective characteristics. For example, facets or other surface variations could be added to any insert 120 or portions thereof. One example is facets on inserts 120 used on side shift section 109L or R. Another example is a stepped reflective surface. Another is a combination of facets or steps with smooth surfaces. Another is paint over a part of the reflective surface. Any of these could allow more customization and flexibility with regard to the shape and nature of the beam from fixture 10. Examples of these types of surfaces for strip or sheet like high reflectivity material are described in Musco U.S. Pat. No. 6,036,974.

Facets tend to diffuse light. Some inserts could have facets and some not in the same fixture 10. This allows mixing and matching of light from each fixture, or relative to other fixtures in the system. An example a use for faceted or stepped inserts is to remedy what is known in the art as "B pole phenomenon". Stepped inserts in the upper 40%-60% of the fixture can be used to eliminate this problem.

The high reflectivity inserts not only increase the amount of light from the fixture over lower reflectivity reflecting surfaces like spun aluminum reflectors, but reduce glare and put more light on the field because of the precise control of light available with such efficient reflection. The reflector inserts 120 can be selected and mounted on the die cast reflector frame. The die cast reflector frame does not have to be changed for every desired change in light output. Although several different reflector frame styles can be made (e.g. left shift, right shift, no shift, etc.), it is not like spun aluminum reflectors where each beam shape requires specific manufacturing steps for each reflector.

An optional feature of inserts 120 is that they be stepped from inner end to outer end. One or more steps could serve to spread light in one direction (or take light away—e.g. reduce glare or spill). Each step can be formed over a die. They are a very efficient way to change the direction of light. They could be used instead of the side-shift version of the die cast reflector frame. They even could be put into conventional spun aluminum reflectors to shift light.

Just one insert could shift some of the light output of a fixture. For example, one stepped insert could spread light from one portion of the composite beam of a fixture (i.e.

create a relatively small bump out from the perimeter of a generally circular beam. Multiple stepped inserts could spread a larger portion, or all of the beam. Conversely, different shape stepped inserts could decrease the perimeter of a small, substantial, or whole beam. Steps would likely be no more than ¼ inch. More commonly they would be on the order of 0.080 or 0.160 per linear inch. Steps do not have to be constant in placement or height.

It can therefore be seen that selective use of inserts 120 can shift light from the beam of a fixture. This can be very useful for glare or spill light control.

It will be appreciated that inserts 120, including the ability to change them out, provides substantial flexibility to fixture 10. Using the same die cast or other reflector frame or main body, future modifications can be made. For example if the glare and spill light requirements for a certain lighting application become more severe after initial installation, inserts 120 could be changed to meet the new requirements. Die casting allows the formation of both the large, non-symmetrical and small complex (e.g. pins 126/128) shapes and features without the need for significant post-processing steps.

7. Lamp Cone 40, Knuckle 50, and Knuckle Plate 60

Lamp cone 40, knuckle 50, and knuckle plate 60 form the adjustable joint between cross arm 7 and reflector frame 32. Lamp cone 40 also supports lamp 20. FIGS. 26A-T illustrate details about lamp cone 40. Lamp cone 40 is basically enclosed except for front openings 132 to which reflector frame 30 is bolted and sealed with a gasket, and several openings in the side (e.g., for the knuckle bolt and a pinion gear).

Figure 36A:
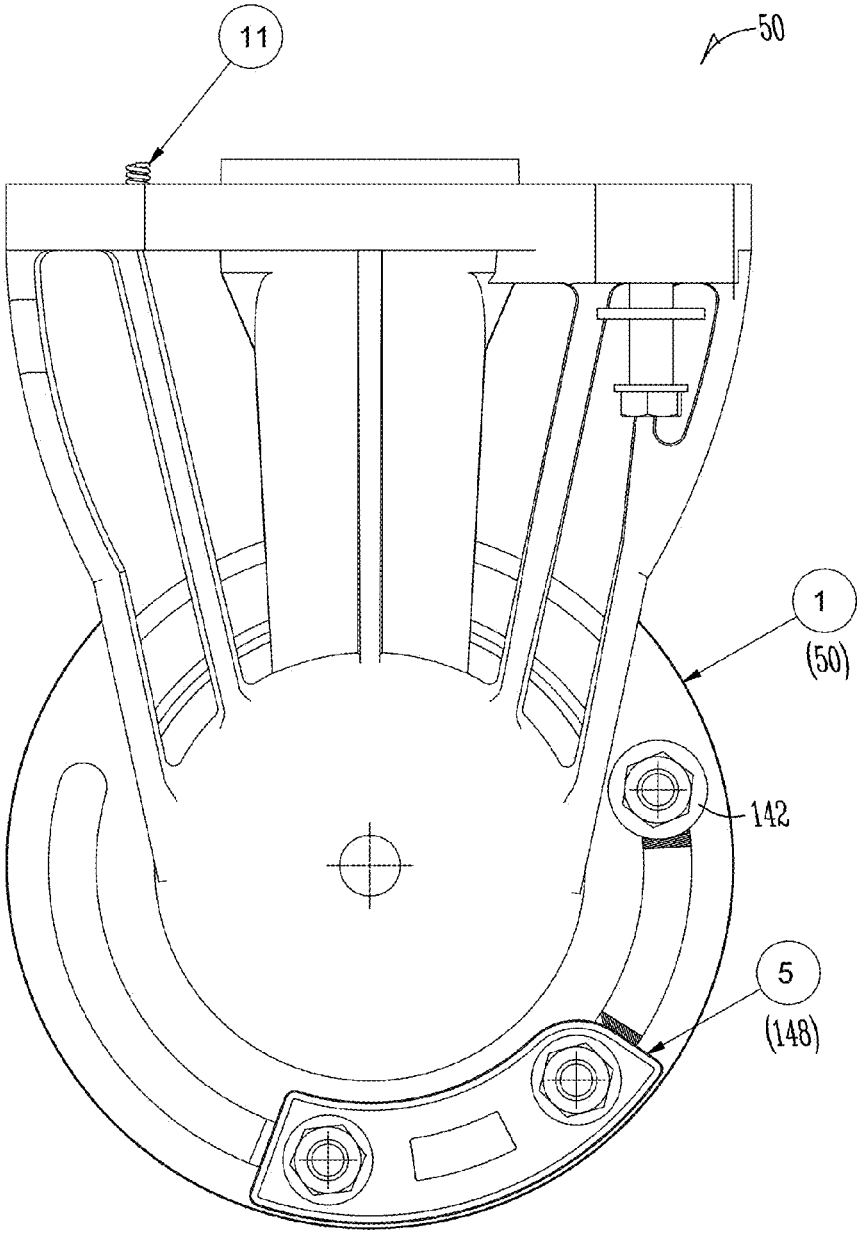
Figure 36B:
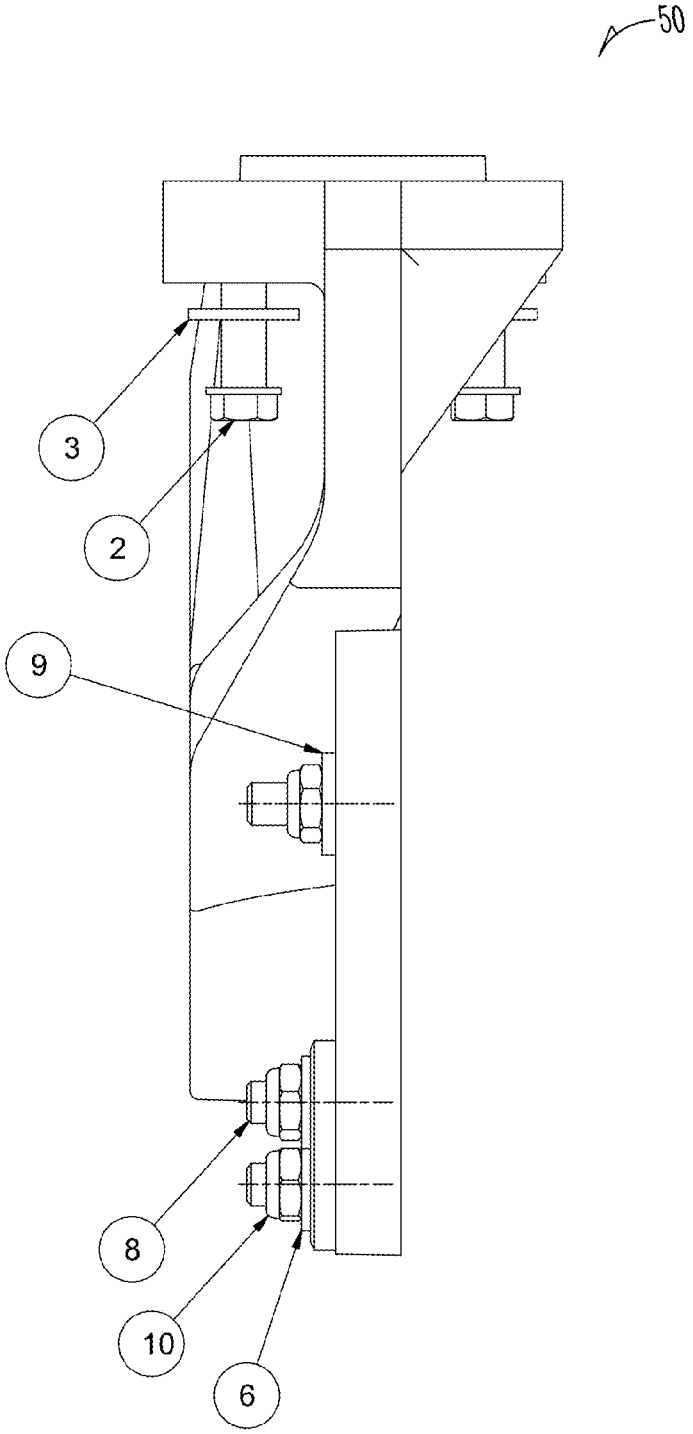
Figure 36C:
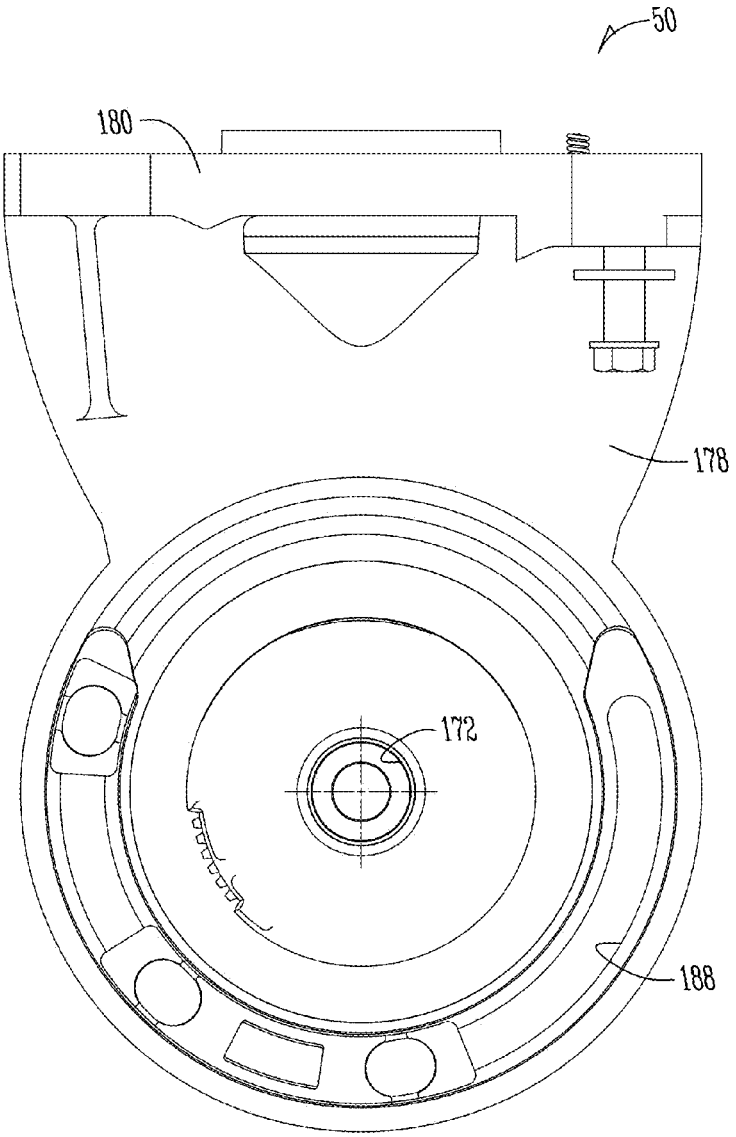
Figure 36D:
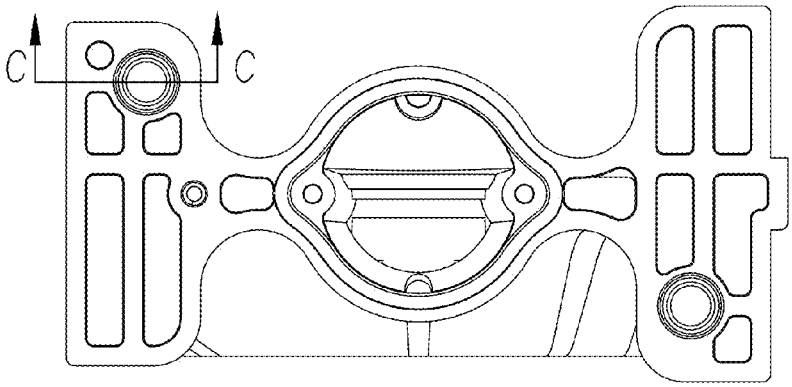
Figure 36E:
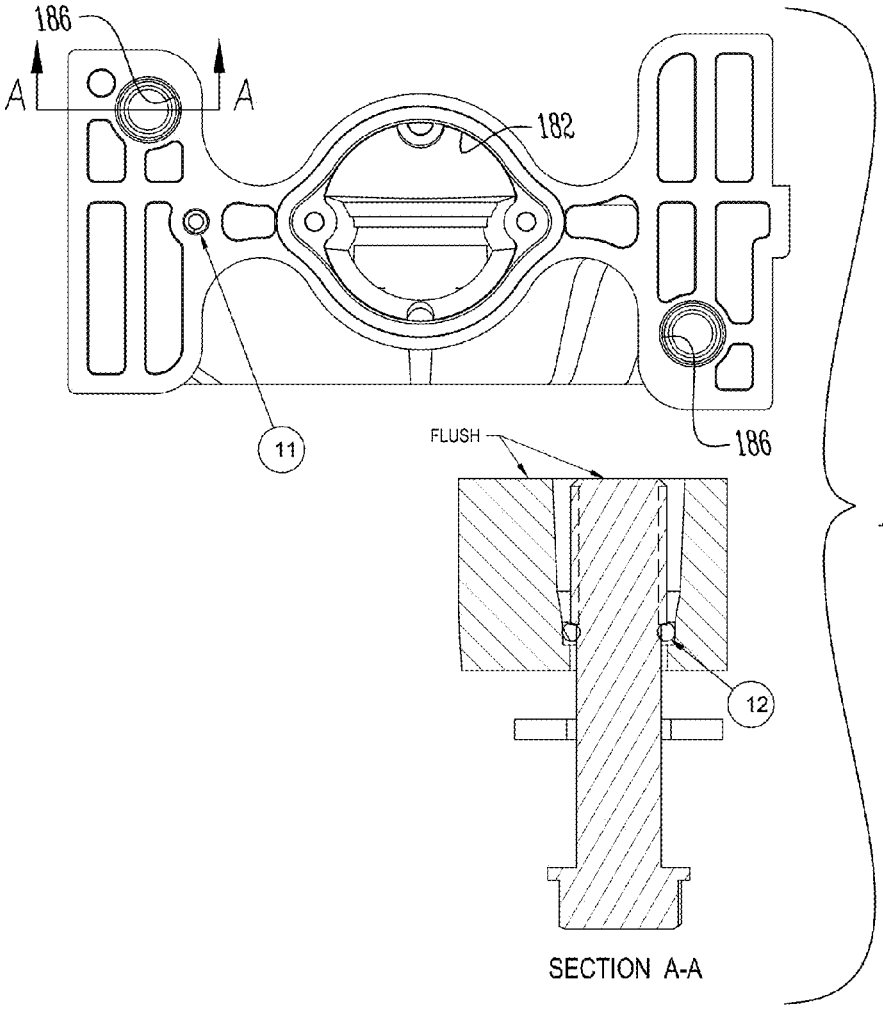
Figure 36F:
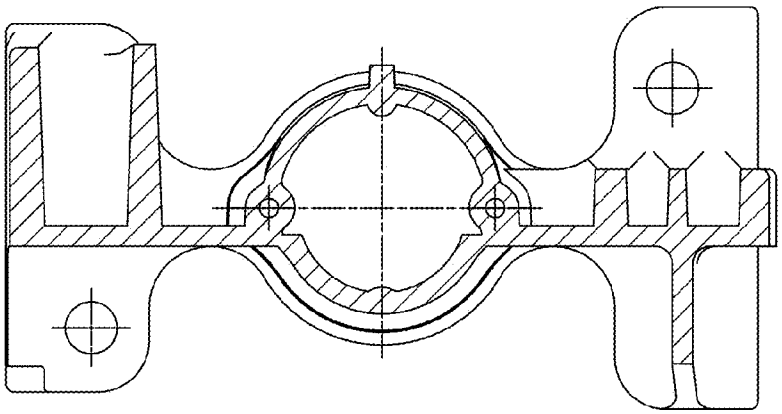
Figure 36G:
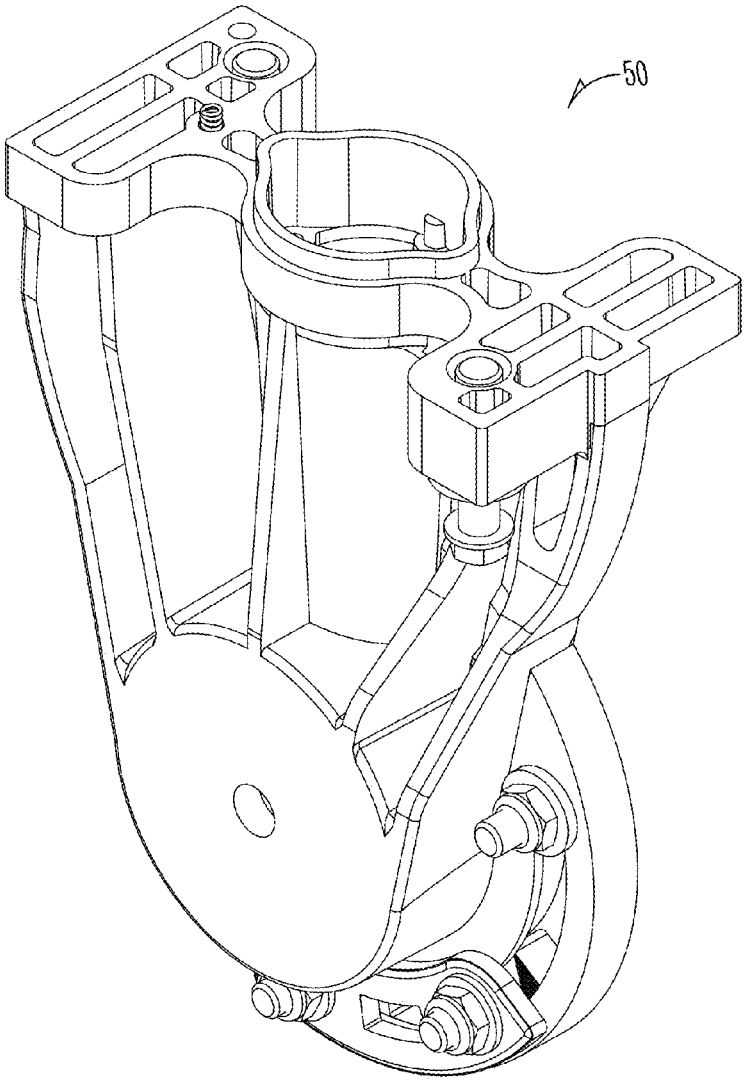
Figure 36H:
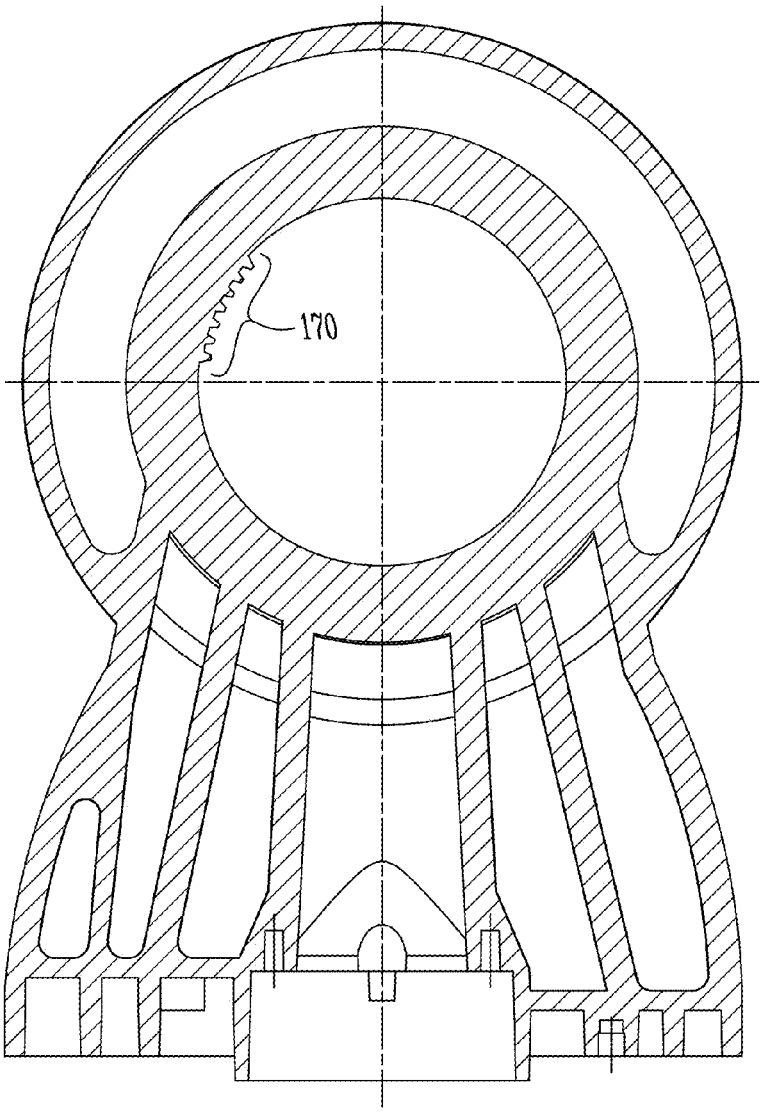
Figure 36I:
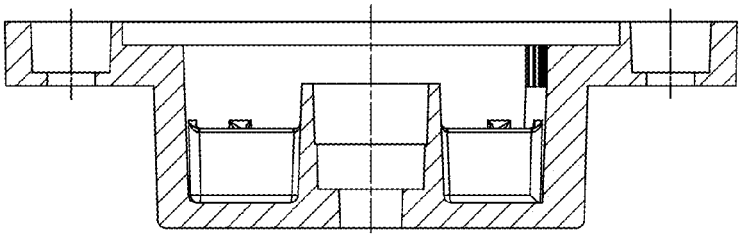
Figure 36J:
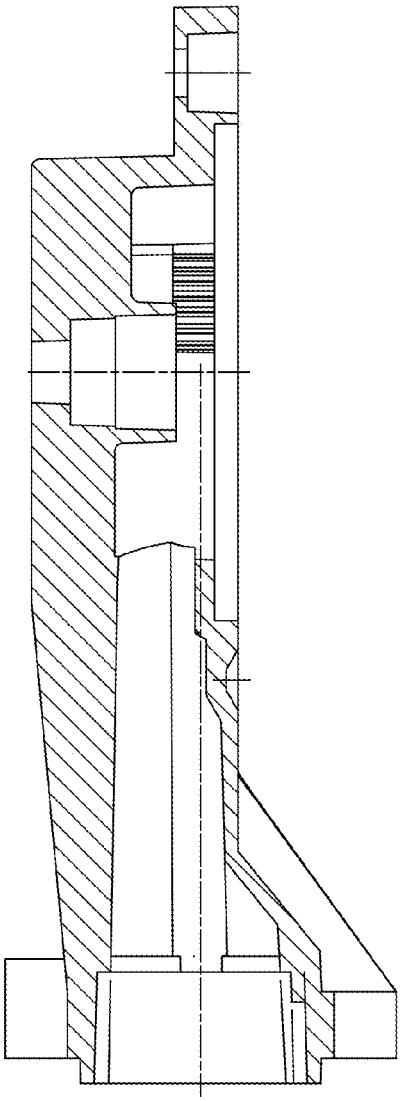
Figure 36K:
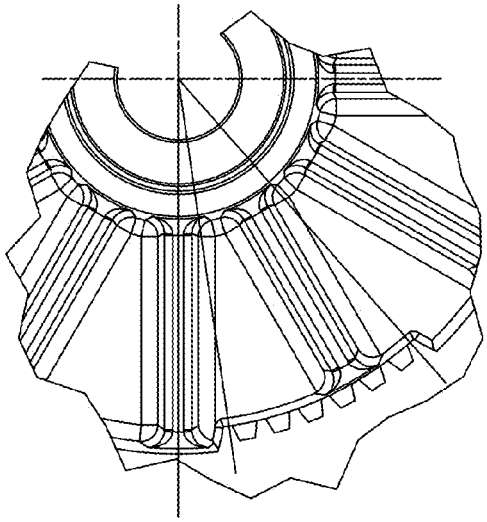
Figure 37A:
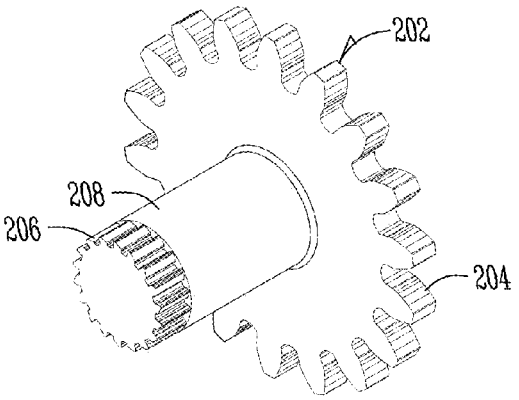
Figure 37B:
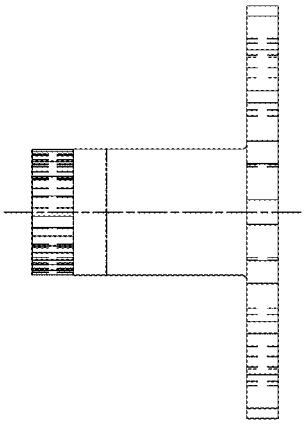
Figure 37C:
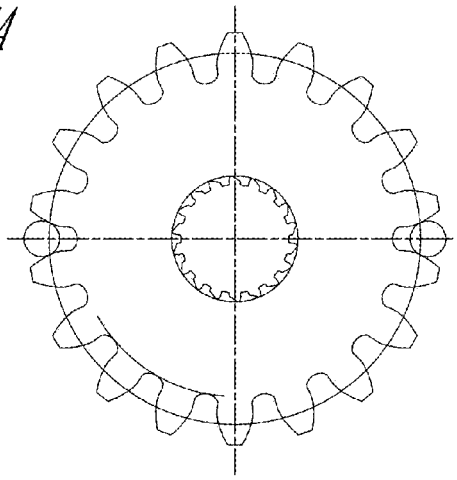
Figure 37D:
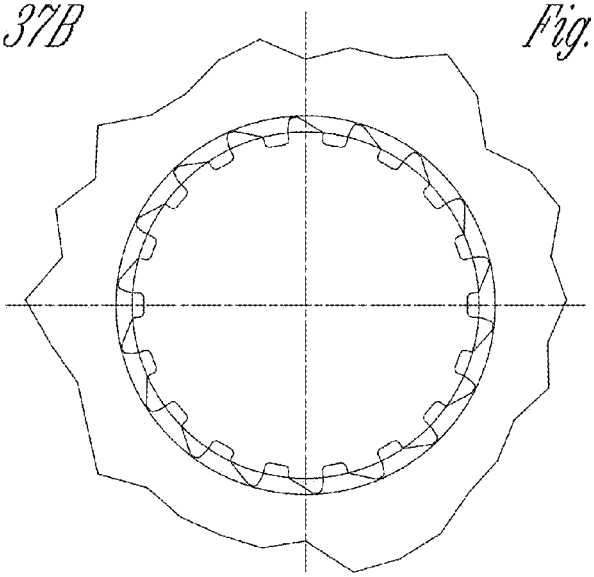
Figure 38A:
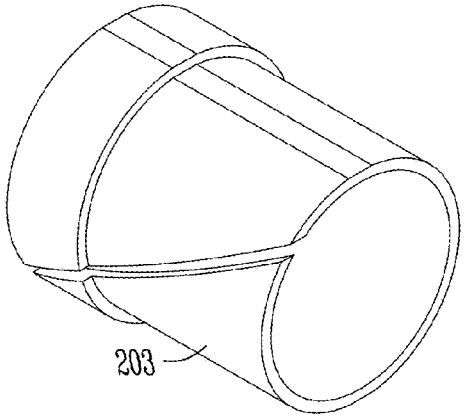
Figure 38B:
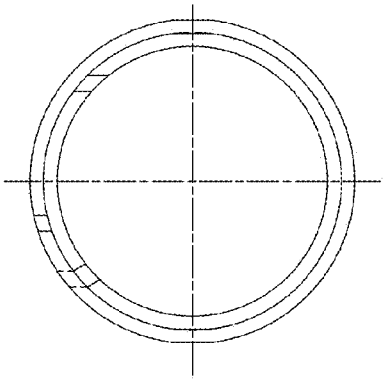
Figure 38C:
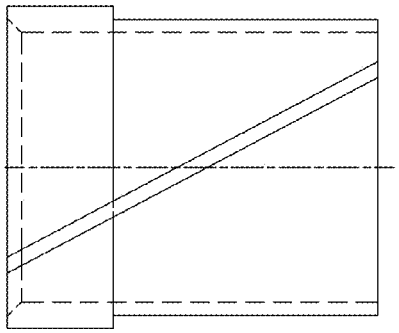
Figure 38D:
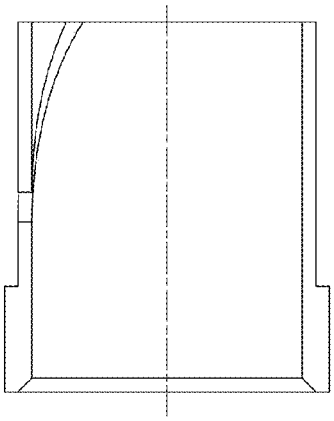
Figure 38E:
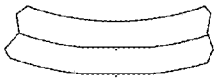

Lamp cone 40 pivotally attaches to knuckle 50 by inserting laterally projecting boss or pivot 136 on the side of lamp cone 40 into a complimentary circular cut-out or receiver 172 in one lateral side of knuckle 50 (see FIG. 36C). Knuckle bolt 174 (see also FIGS. 31A-C, 32A-C and 34A-C), with appropriate nut and washers, holds lamp cone 40 from separation from knuckle 50 when assembled together. Gasket 176 (FIGS. 30A-D) fits between lamp cone 40 and knuckle 50 concentrically about pivot receiver and opening 172 in knuckle 50 to deter water, insects, or dirt from entering into knuckle 50. As can be seen in FIGS. 26A-T and 36A-K, when these parts are assembled, complimentary structure on the interfaces of lamp cone 40 and knuckle 50 act as bearing surfaces and retaining structure to provide for smooth, accurate rotation of lamp cone 40 relative to knuckle 50.

Figure 27A:
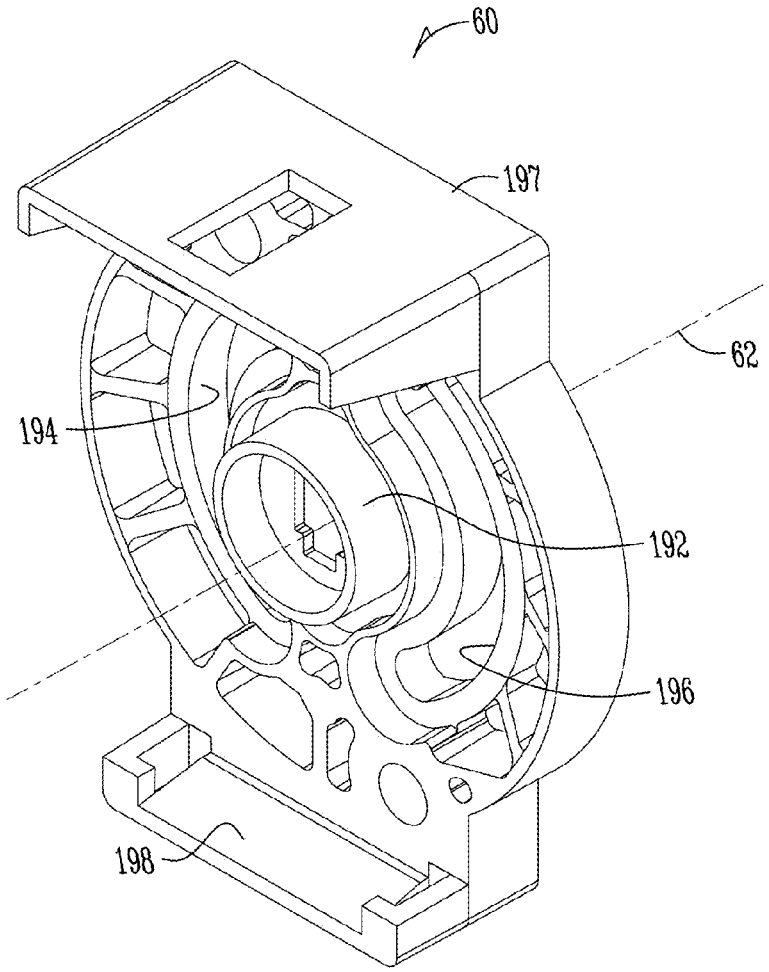
Figure 27B:
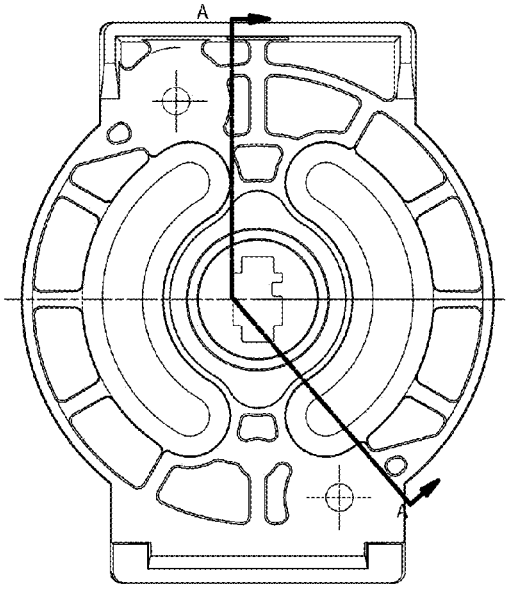
Figure 27C:
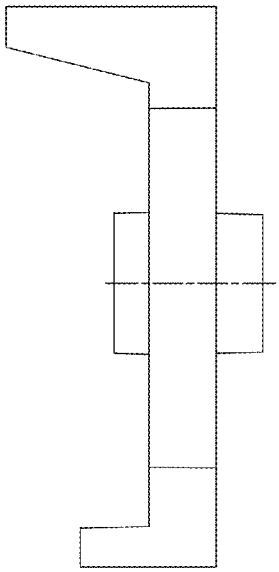
Figure 27D:
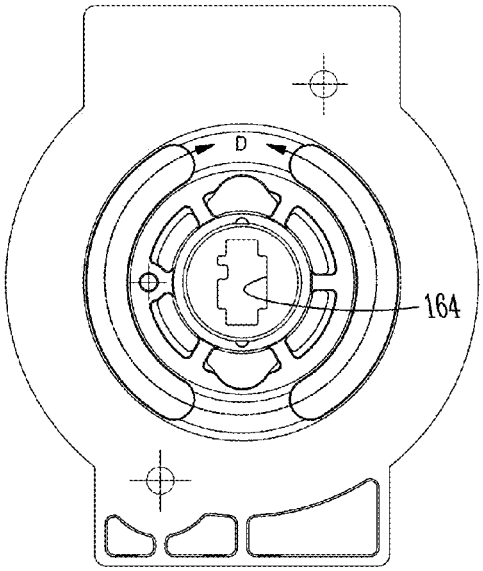
Figure 27G:
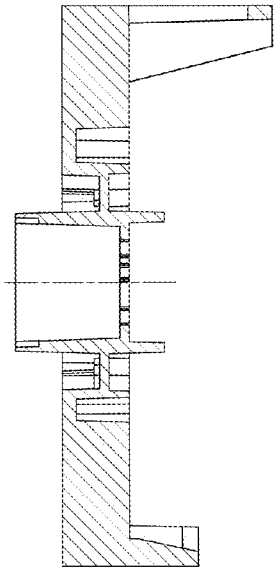
Figure 27E:
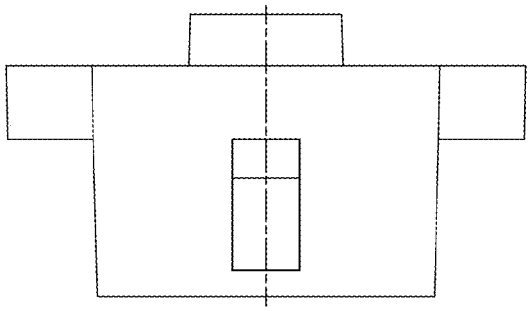
Figure 27F:
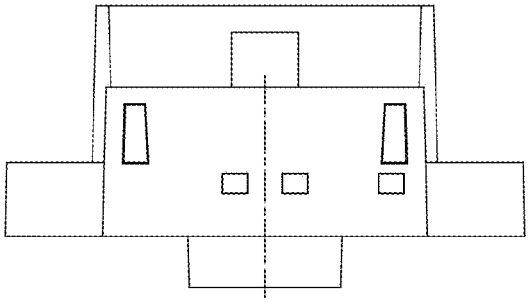
Figure 27H:
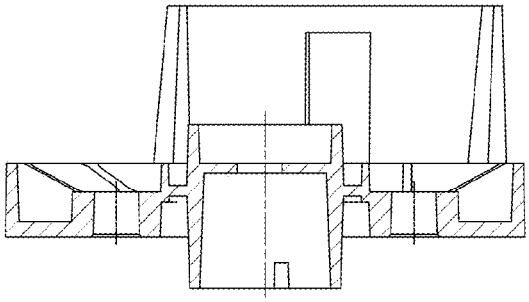
Figure 27I:
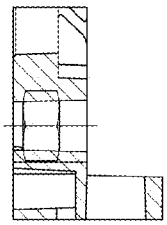

As shown in the drawings, knuckle 50 connects to knuckle plate 60 (see FIGS. 27A-I) which in turn is fixedly mounted to cross arm 7. Arm portion 178 of knuckle 50 extends to a mounting end 180 (FIG. 36C). Knuckle plate 60 bolts to the bottom of cross arm 7 by one bolt into each curved slot 194 and 196. This allows rotational adjustment of knuckle plate 60 relative to cross arm 7 over the range of curved slots 194 and 196 (FIG. 27A).

It should be noted that knuckle 50 is essentially a single arm suspending most of fixture 10 by its pivotal connection along the side of lamp cone 40. Unlike some existing fixtures which have the knuckle extend directly into the back of the lamp cone, and a pivot joint between the cross arm and the lamp cone, knuckle 50 provides certain functional advantages. First, although fixture 10 might be somewhat heavier than a spun aluminum reflector fixture, by placing the pivot point along the side of lamp cone 40, there is less moment caused by lamp cone 40, reflector frame 30, lamp 20, visor 70 and the other components on the distal side of that connection point. It is believed the moment is cut approximately in half. This is beneficial for long-term durability, especially for fixtures experiencing a variety of outdoors forces and conditions, including high winds. Less moment for the connection also deters slippage or change in relationship between the lamp cone and cross arm, which could affect aiming. Secondly, it allows for a shorter fixture, in the sense the fixture is pulled closer to the vertical plane of the cross arm. This helps present a lower EPA. Third, knuckle 50 provides for minimum exposure of power wires to the environment. The wires pass through knuckle plate 60 (from the interior of cross arm 7), through the interior of knuckle 50, and into the interior of lamp cone 40, completely enclosed by structure. Fourth, it is part of a relatively non-complex structure for the support and aiming of the fixture.

Round opening 182 (FIG. 36E) at the mounting end of 180 of knuckle 50 fits around downwardly extending tube 192 (FIG. 27A) on the bottom of knuckle plate 60. Bolts through bolt holes 186 (FIG. 36E) of mounting end 180 of knuckle 50 extend into curved slots 194 and 196 in knuckle plate 60. This combination allows a range of rotational adjustment of knuckle 50 relative to knuckle plate 60 (over the range defined by curved slots 194 and 196 of knuckle plate 60). In this manner, there is some adjustability of knuckle 50 around a vertical axis, once knuckle plate 60 is mounted to the underside of cross arm 7. Sealing members (e.g. O-ring around bolt 174—See FIGS. 32A-C; O-ring in groove concentric to bolt 174—See FIGS. 30A-D. Also see FIG. 26E).

Curved slot 188 (FIG. 36C) in knuckle 50 provides a limit for pivoting of lamp cone 40 about knuckle 50. Knuckle 50 can therefore be used for aiming fixtures 10 to either side of cross arm 7. Additionally, lamp cone 40 can be set to a given aiming angle relative knuckle 50 as follows. An inside stop strap 142 (FIG. 36A) can be fixed to boss 144 (FIG. 26F) in the face of lamp cone 40. Inner and outer stop straps 146 (FIG. 41A) and 148 (FIGS. 36A and 42A) can be bolted on opposite sides of curved slot 188 (FIG. 36C) of knuckle 50 in a position so that when lamp cone 40 is rotationally adjusted relative to knuckle 50 for its intended aiming angle, inner and outer straps 146 and 148 would come into abutment with either stop strap 142 or a boss (see FIG. 26A—the generally rectangular boss or projection below #136) extending from cone 40 into slot 194 or 196, (see also FIGS. 26K-M). Thus, the installer of the light system can have a factory-preset stop at the correct aiming angle for each fixture 10. This avoids individual aiming of each fixture when the system is installed at the field. Additionally, it allows easier maintenance. Bolt 174 holding lamp cone 40 to knuckle 50 can be loosened, lamp cone 40 and reflector frame 30 etc. can be swung down. Maintenance can be performed. Without realigning or re-aiming, the worker then only has to swing that reflector frame 30 etc. back up until the cone boss hits stop strap 142 and retighten lamp cone 40 to knuckle 50. Knuckle 50 can be die cast and removable mounted to die cast reflector frame 30 with gaskets or other structure to prevent leaks at that interface of parts. Stop strap 142 is left in place, and thus the worker knows the fixture will be back in exact aiming position, and doesn't have to re-aim or verify aiming.

8. Yoke 80

Figure 26C:
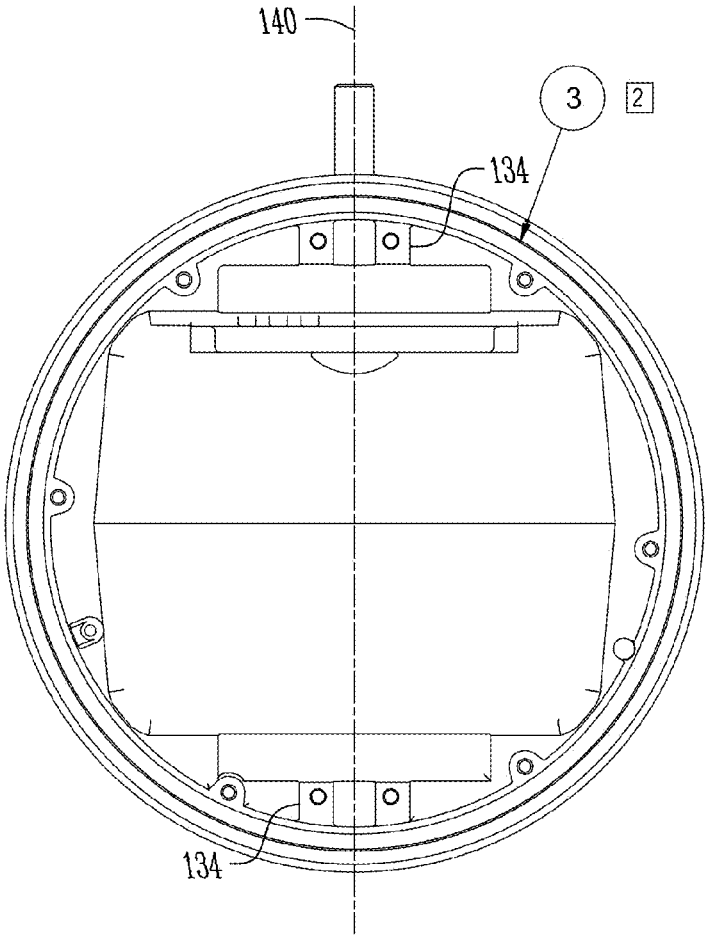
Figure 26D:
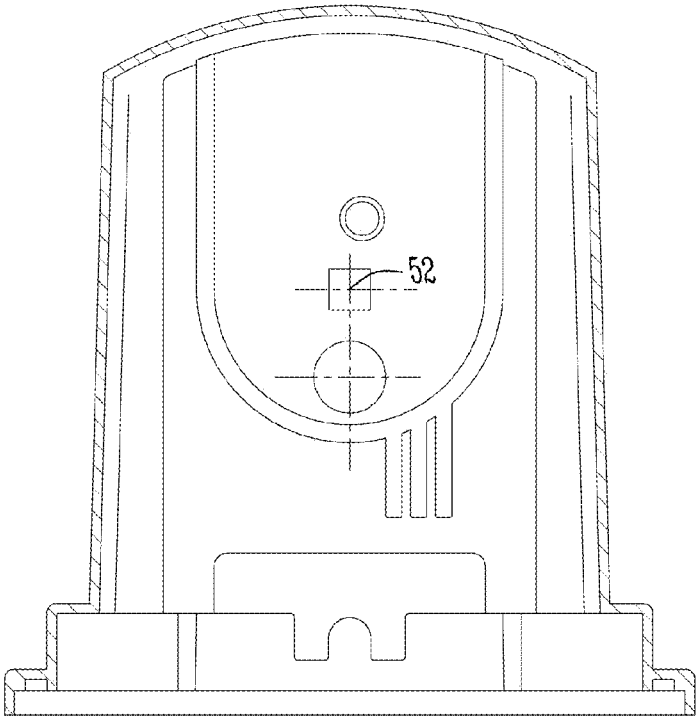
Figure 26E:
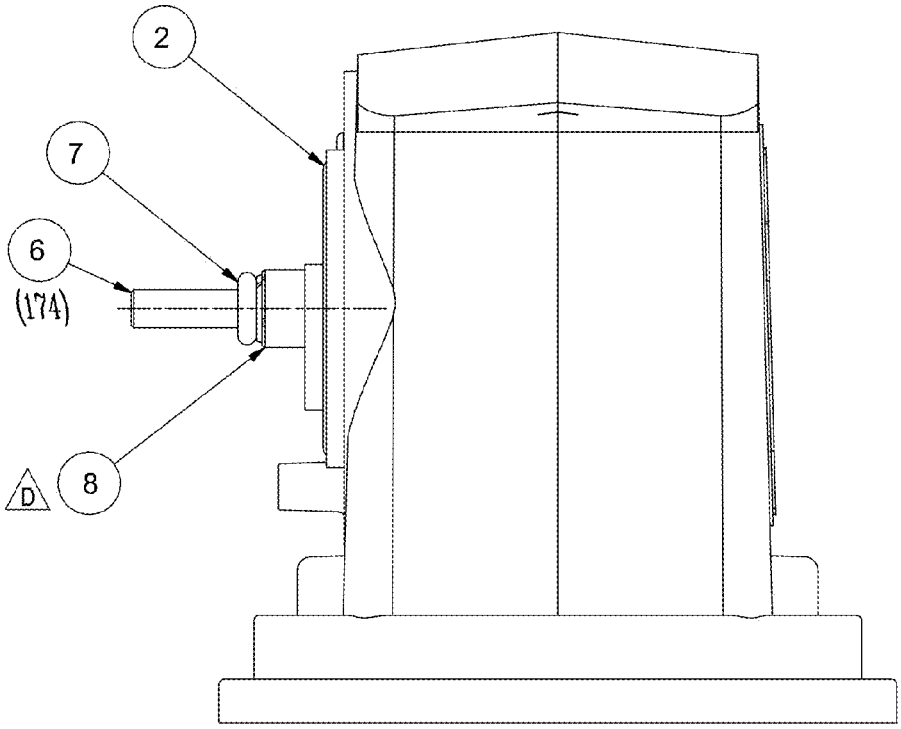
Figure 26F:
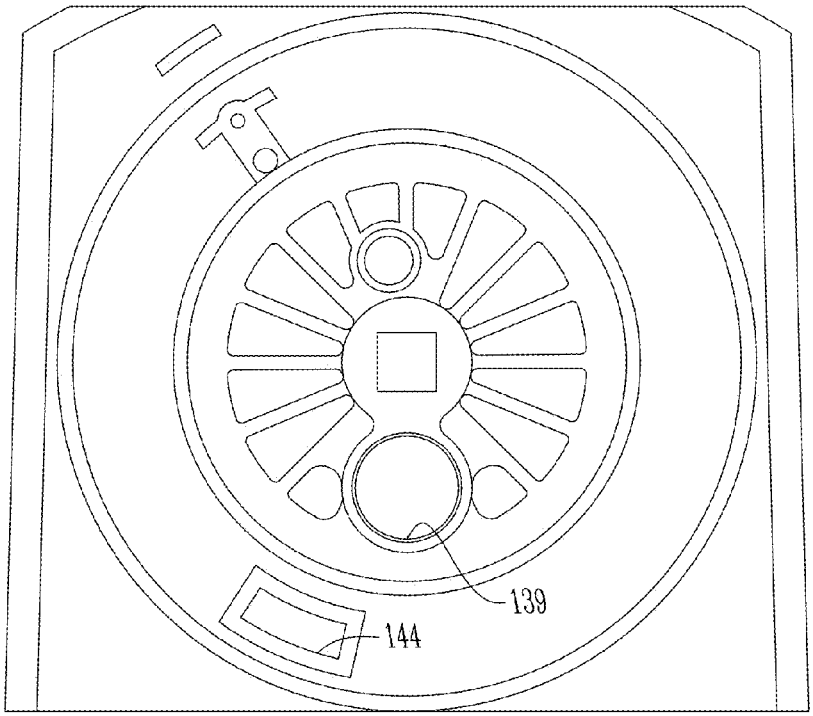
Figure 26G:
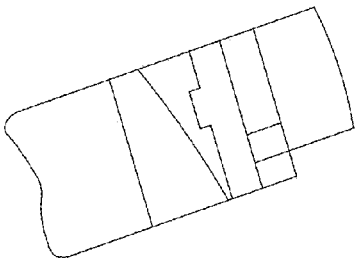
Figure 26H:
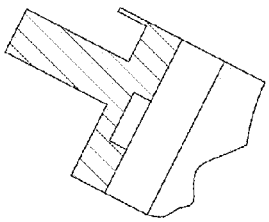
Figure 261:
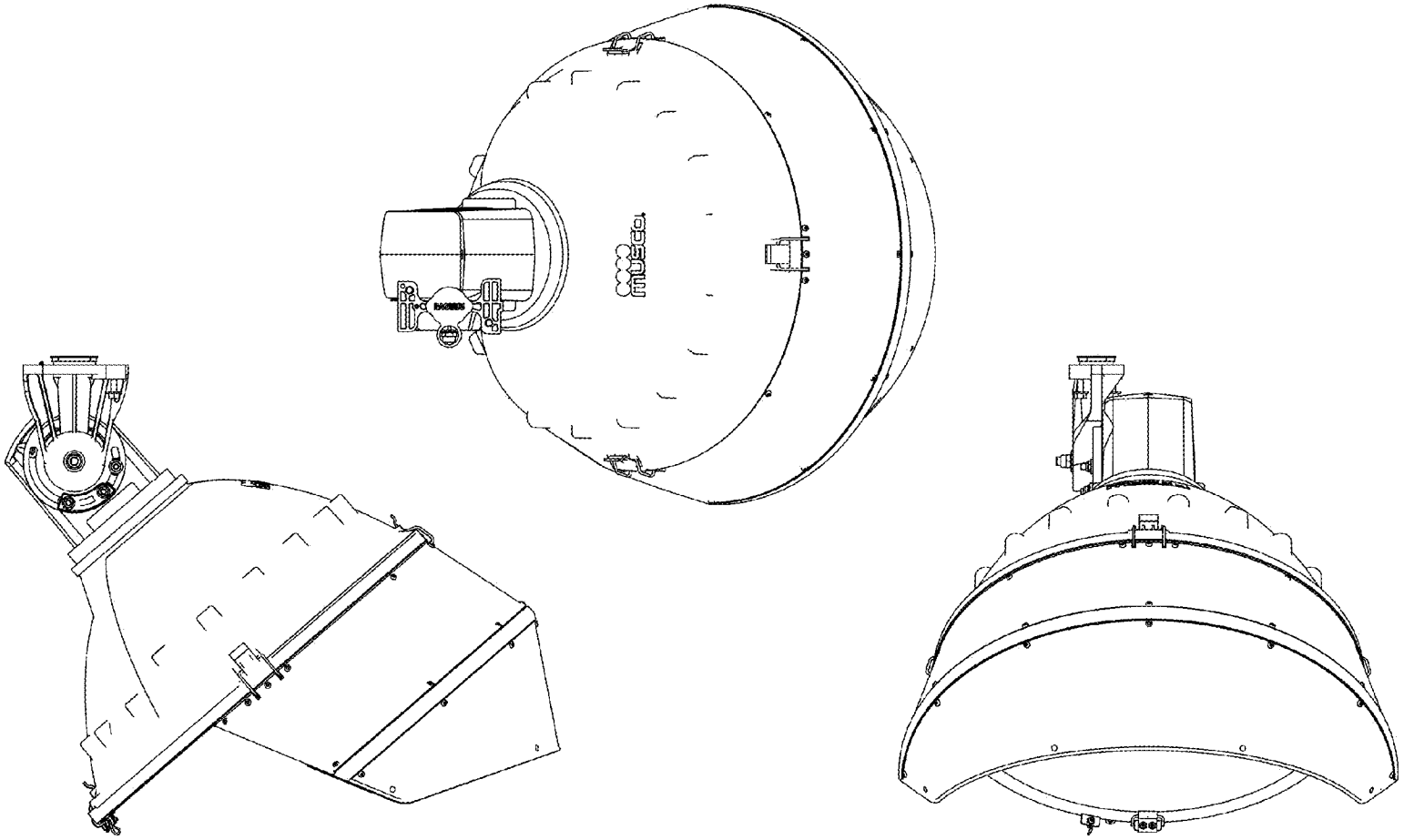
Figure 26J:
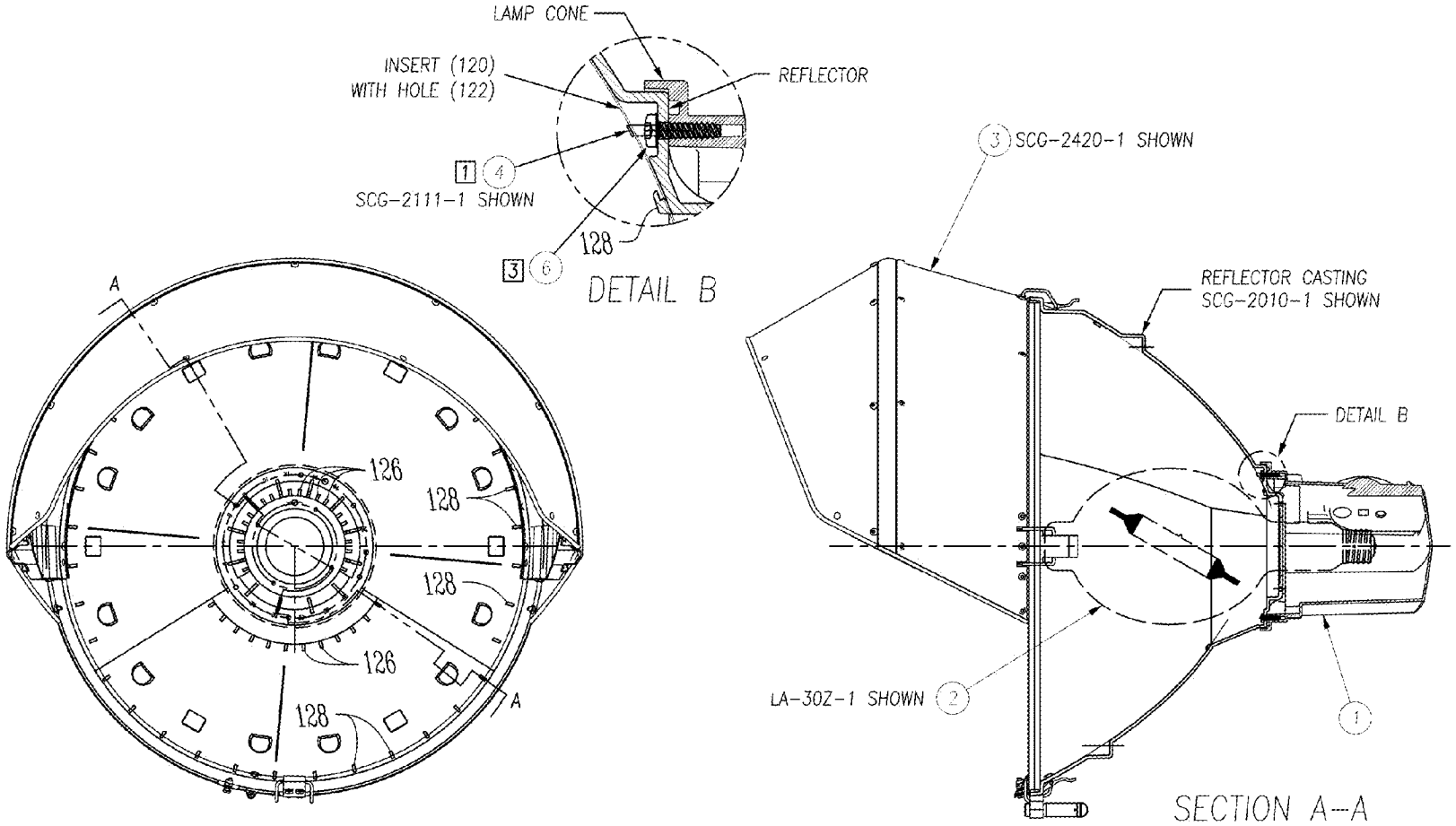
Figure 26K:
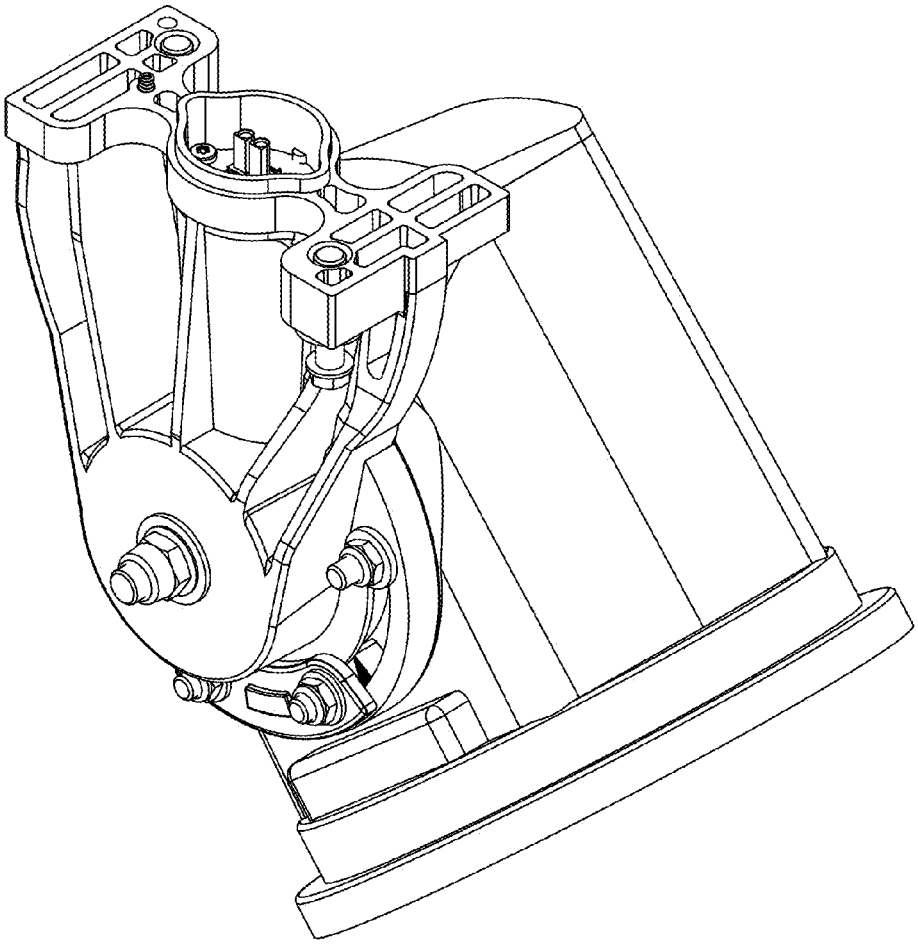
Figure 26L:
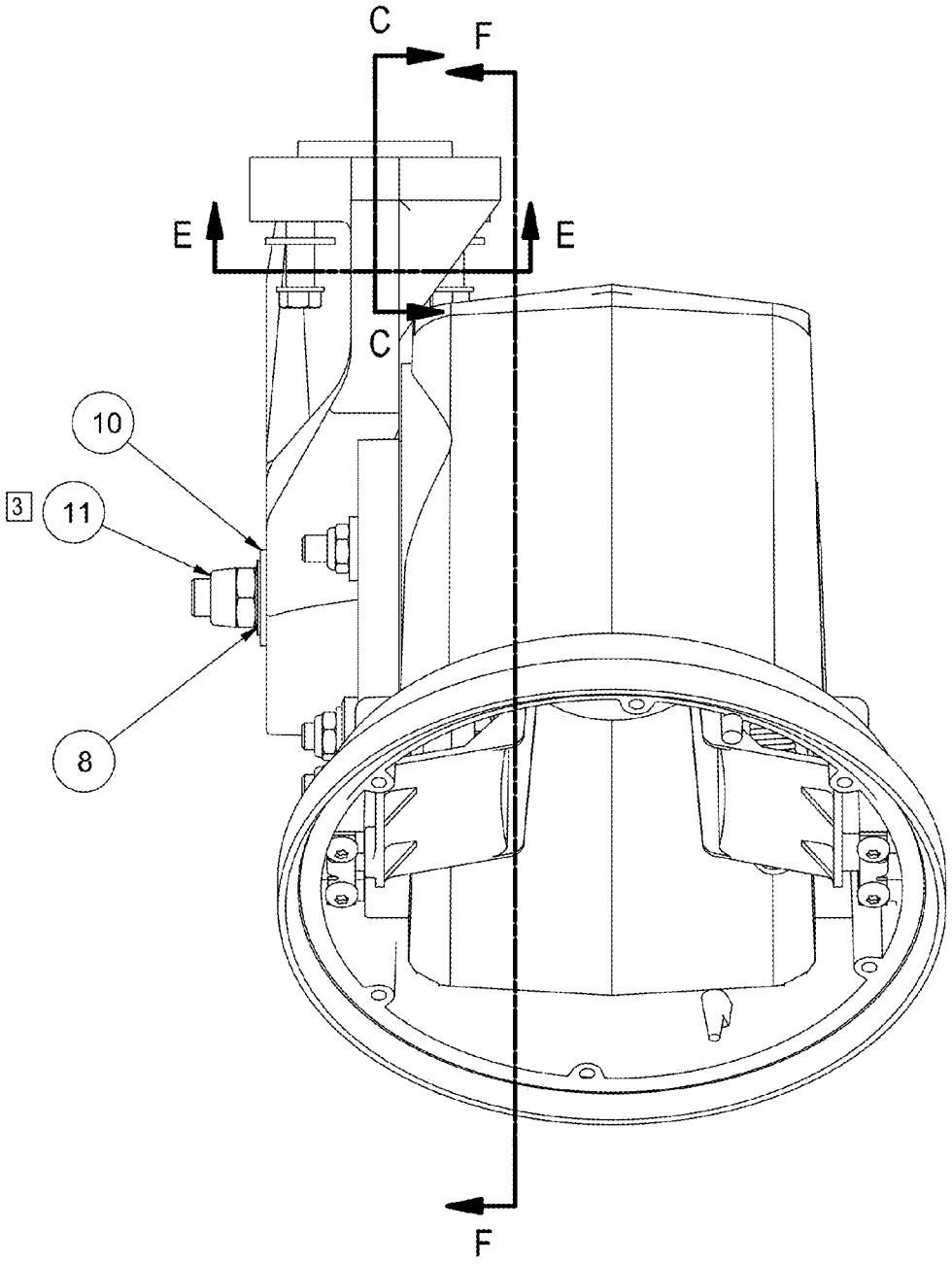
Figure 26M:
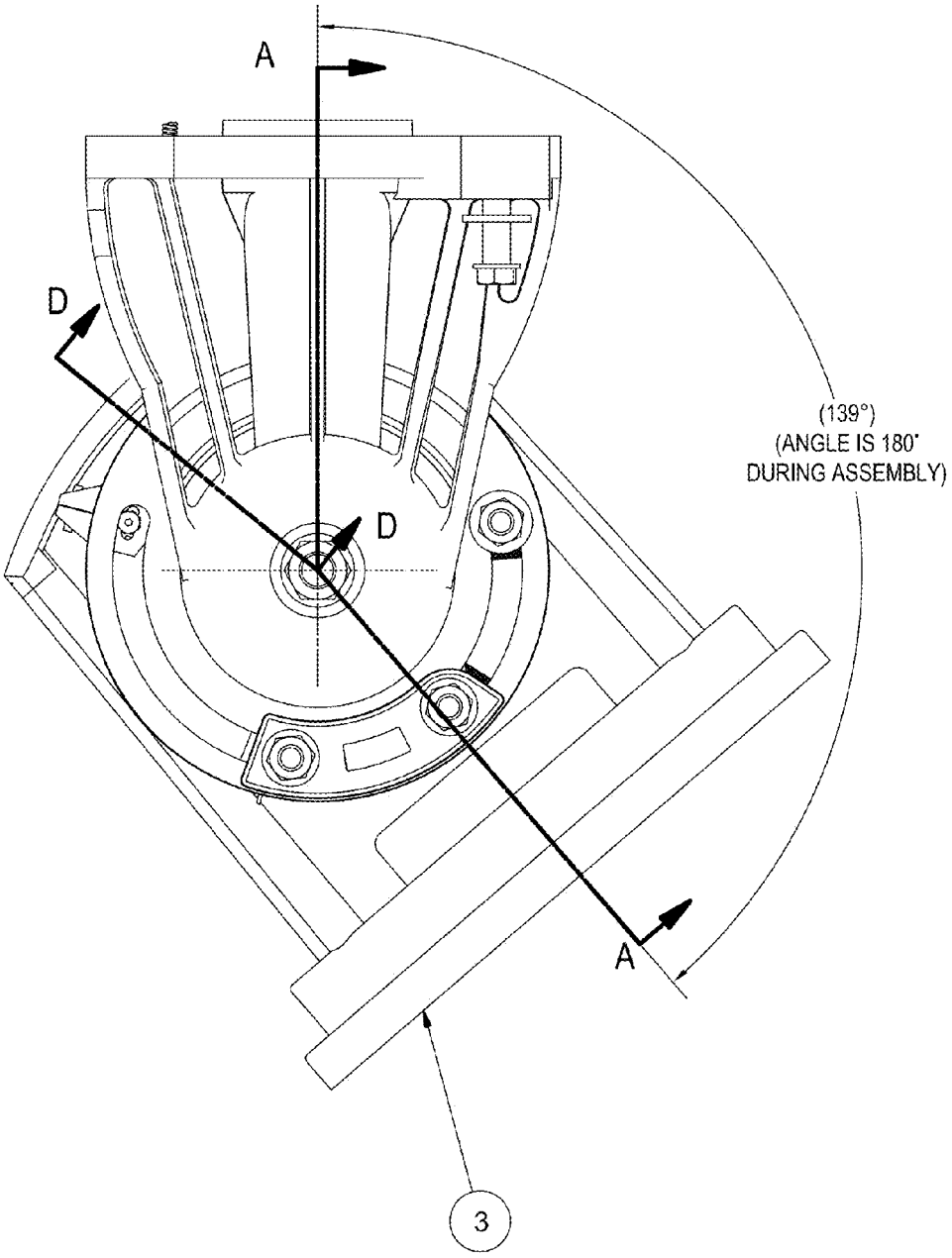
Figure 26N:
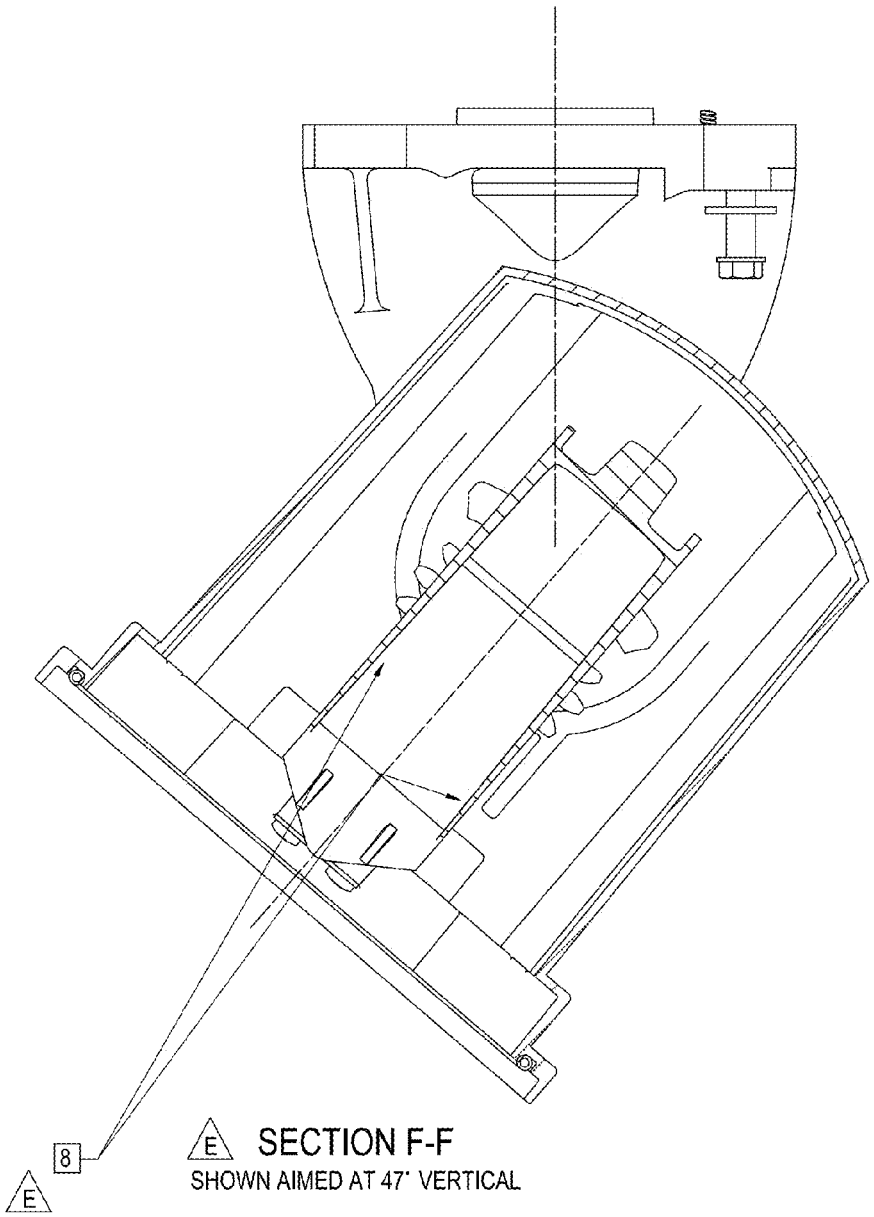
Figure 26O:
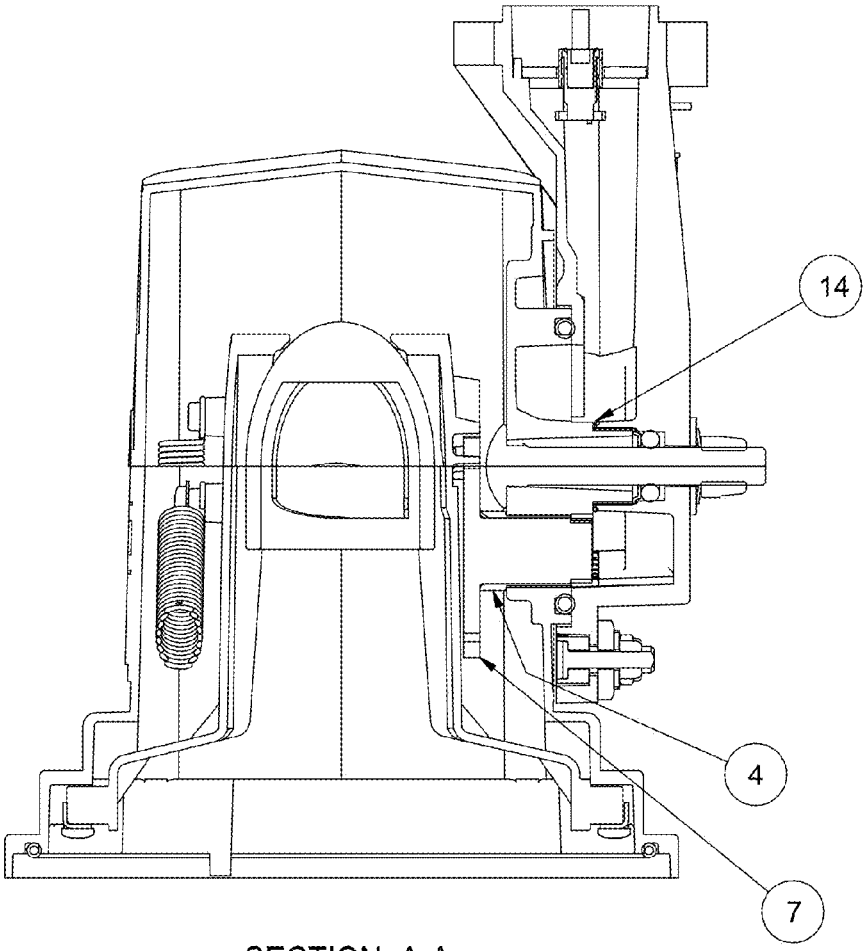
Figure 26P:
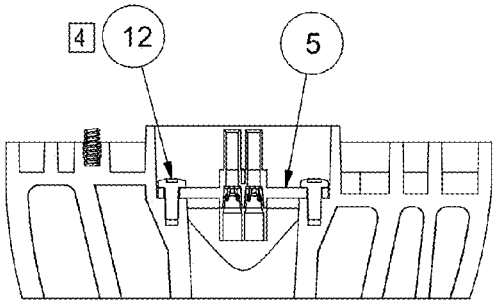
Figure 26Q:
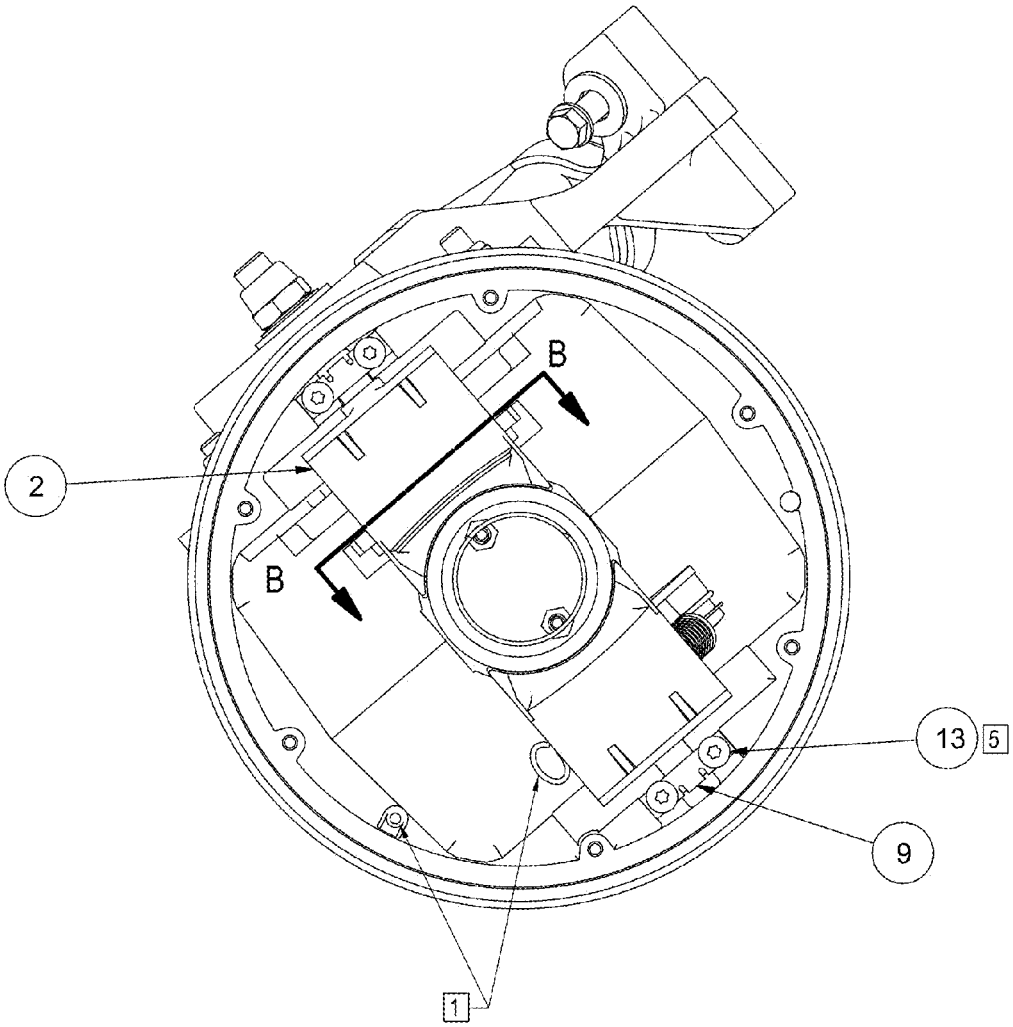
Figure 26R:
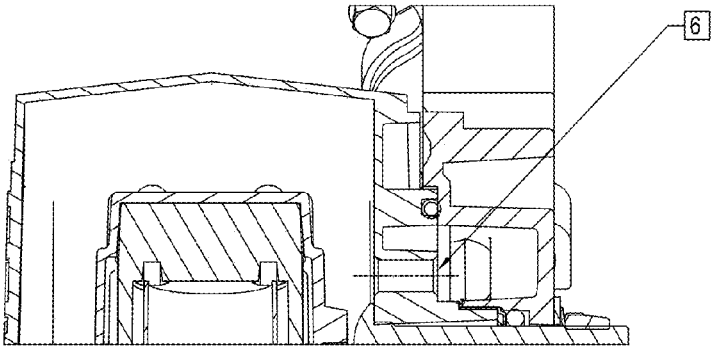

Yoke 80 is pivotally supported at the front of lamp cone 40 at pivot axis 140 (see FIG. 26C). Pivot pins 152 of lamp yoke 80 (see FIG. 44A—and described in more detail below) slide longitudinally into mating receivers 134 (which define pivot axis 140) on opposite sides of opening 132 to lamp cone 40 and are retained in place by yoke retainers 175 (FIGS. 45A-D) by machine screws in the pair of threaded bores on opposite sides of receivers 134.

Lamp socket 154 is mounted between arms 156 and 158 of yoke 80 via bolts, screws or other means through the back end 160 of yoke 80. Yoke 80 therefore can pivot around an axis 140 defined by receivers 134 in lamp cone 40. In combination with a setting of gearing, pivotable yoke 80 allows arc tube 12 of arc lamp 20, which is supported by yoke 80, to be maintained in a horizontal position independent of tilt of lamp cone 40. FIGS. 7A-D, along with FIGS. 26A-T and 44A-J, illustrate this total tilt factor correction feature of fixture 10.

Pinion gear 202 (FIGS. 37A-D) has a large gear portion 204 spaced parallel from a small gear portion 206 by shaft 208. Shaft 208 is rotatably journaled in opening 138 in the side of lamp cone 40 (offset from the rotational axis of lamp cone 40 relative to knuckle 50). A bushing 203 (plastic sleeve/bushing—FIGS. 38A-D), provides a bearing surface for shaft 208 of gear 202 in opening 139 (FIGS. 26A and 26F) of lamp cone 40.

When fixture 10 is assembled, small gear 206 engages gear rack 170 (see FIG. 36H) formed in knuckle 50. Large gear 204, in turn, engages gear rack 190 fixed on one side of yoke 80 (see FIG. 44A). Lamp cone 40 can rotate in a vertical plane around its pivot axis 136 relative to knuckle 50 to allow for different aiming angles for fixture 10 relative the target. Because the front of yoke 80 (at its pivot axis 140) is fixed relative to lamp cone 40, yoke 80 also rotates in a vertical plane when lamp cone 40 does. If yoke 80 were completely fixed relative to lamp cone 40, the longitudinal axis of lamp 20 would also rotate in a vertical plane. However, this would conflict with the preference to operate arc tube 12 in a horizontal plane regardless of aiming angle of the fixture.

Thus, fixture 10 compensates for this as follows. Gear rack 170 is fixed on knuckle 50. Knuckle 50 is fixed relative to cross arm 7. The gearing and the parts involved with it are selected so that pivotal movement of lamp cone 40 around axis 140 causes a proportional pivoting of yoke 80 around its different pivot axis 136. Placement of yoke pivot axis 140 is intentionally chosen to be at or near the front plane of lamp cone 40. When lamp cone 40 is rotated upward, the front of yoke 80 and pinion gear 202 raise with it, but large gear 206, at the same time, lifts the back free end of yoke 80 a proportional amount so that the orientation of lamp 20 and its arc tube 12 remains the same relative to horizontal.

When assembled, the longitudinal axis of yoke 80 is aligned or parallel with the longitudinal axis of lamp cone 40. Thus, when lamp 20 is appropriately mounted on yoke 80, its longitudinal axis would be oblique by the same angle to the longitudinal axes of lamp 20, yoke 80 and lamp cone 40. This is basically a reference position. If lamp cone 40, for example, were tilted 30° down from horizontal relative to cross arm 7 when pole 6 is erected, yoke 80 would also have its longitudinal axis tilted down 30° from horizontal. This would put arc tube 12 in a horizontal plane.

This relationship allows a lamp such as Z-lamp 20 to be utilized and operated at a horizontal position, so long as the angular offset of the arc tube relative to the longitudinal axes of the arc lamp is equal to the amount of tilt of lamp cone 40 from horizontal. Thus, if arc tube 12 is tilted 30° to the longitudinal axis of lamp 20, and lamp 20 is rotated into the socket of yoke 80 such that the arc tube axes and lamp axes are in a vertical plane, arc tube 12 will be horizontal when lamp cone 40 is tilted 30° down from horizontal. As previously described, operation of arc tube 12 at horizontal will correct tilt factor.

However, because not all fixtures will be aimed at 30° down from horizontal, yoke 80 automatically adjusts to maintain the orientation of yoke 80 relative to horizontal for a selected range (e.g. 15 degrees up to 17 degrees down in steps in the plane of knuckle 50) of pivoting of lamp cone on either side of the reference position (e.g., 30° down).

This automatic tilt factor correction is further illustrated at FIGS. 7A-D. If lamp cone 40 is tilted up several degrees from its 30° reference position relative to horizontal, pinion gear 202 will rotate in opening 138 of lamp cone 40 in a counter-clockwise direction as viewed in FIG. 7D. Gear track 170 is fixed with respect to knuckle 50, and with respect to space. The tilting of lamp cone 40 is about its rotational axis 136 (see FIG. 4), which is also stationary in space. The front of lamp cone 40, and thus the front of yoke 80, will move upward in an arc (see reference number 302, FIGS. 7B-D). Pinion gear 202 likewise will move upward in an arc (ref. no. 304). However, the counter-clockwise rotation of pinion gear 202 means large gear 204 will concurrently rotate counter-clockwise. Because large gear 204 is fixed relative to lamp cone 40, the counter-clockwise rotation of large gear 204 will cause gear rack 190 to move in an a still third arc (ref. no. 306) inside lamp cone 40 vertically upward separately from the vertical upward movement of lamp cone 40. Thus, the back of yoke 80 will pivot upwardly along with gear track 190 an amount proportional to the amount lamp cone 40 is pivoted upwardly because gear rack 190 is fixed to yoke 80. A similar proportional downward movement of the back of yoke 80 will be automatic when lamp cone 40 is pivoted downward. However, the amount of movement of the back of yoke 80 is less then the amount of movement of lamp cone 40 because the back of yoke 80 is closer to the pivot axis of lamp cone 40.

An alternative would be to hold the lamp position fixed relative to any pivoting of lamp cone 40. However, this would result in substantial change of position of arc tube 12 relative to the reflecting surfaces of fixture 10. This would require substantial recalculation of aiming angles for each aiming direction of fixture 10. It is preferable to change the position of arc lamp 12 as little as possible relative the reflective surfaces of fixture 10 for the different aiming angles for fixture 10. Therefore, fixing the front of yoke 80 to the front of lamp cone 40 means the front of yoke 80 moves with the front of lamp cone 40 and retains basically the same position of lamp 20 to reflecting surfaces of fixture 10. Thus, all that remains is to lift or drop the back of yoke 80 in a proportional amount relative the amount the front of yoke 80 is moved to keep the yoke, and thus lamp 20, in the same angular orientation as the reference position and to the ground.

In this embodiment, the range of tilt up and below horizontal (the arc tube reference position) is approximately +15 to −60°. This covers most conventional sports lighting aiming angles (95% of them at 30 degrees from beam or reference axes). It is noted that the guiding factor for operation of the automatic tilt factor correction is the pivot location of yoke 80. It works as described because it is basically in the same plane as the junction between lamp cone 40 and reflector frame 30. It would be more difficult to get precise correction if the yoke was pivoted to lamp cone 40 nearer the back of lamp cone 40. While some change between the position of arc lamp 12 and the reflecting surfaces of fixture 10 occurs, it is relatively small. Thus minor re-aiming, if any is needed.

The gear ratios (large and small gears 204 and 206 have the same number of teeth) are carefully selected such that there will be precise compensation for any upward or downward tilting of lamp cone 40 to maintain the same downward angular orientation of yoke 80. In other words, despite yoke 80 being attached to, and moving with lamp cone 40 when it is pivoted away from its reference position, the gearing causes yoke 80 to pivot to maintain the same orientation relative to horizontal. Because lamp cone 40 pivots about a different axis than yoke 80, selection of the gearing is critical to cause the right proportional movement of yoke 80. Although the actual physical position of yoke 80 relative to lamp cone 40 will change somewhat, the orientation of yoke 80 stays parallel to its reference position. This will allow arc tube 12 of Z-lamp 20 to stay horizontal regardless of whether lamp cone 40 is in the reference position or some degree off of the reference position (within the range of the gearing).

Figure 39A:
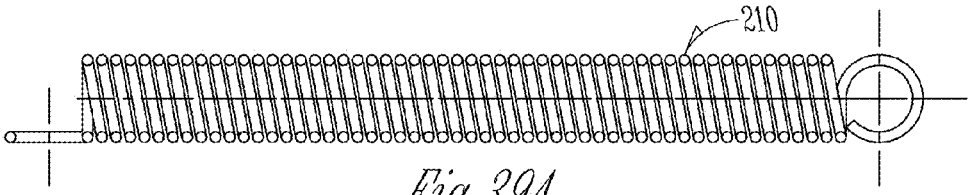
FIG. 39A and FIG. 39B are top and side plan views of a spring connectable between the yoke of FIG. 44A and the lamp cone of FIG. 26A.
Figure 39B:
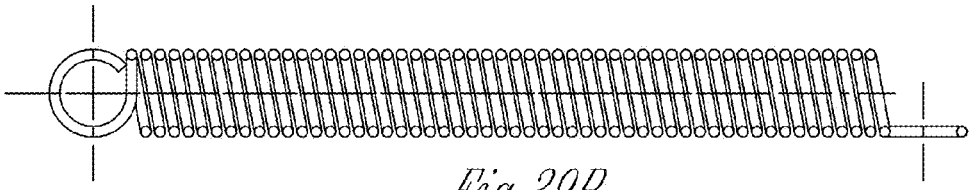

To provide against play and to inject a biasing force relative to yoke 80, an extension spring 210 (see FIGS. 39A-B), attaches between post 212 (FIG. 44A) of yoke 80 and post 214 (FIG. 26A) at the front of lamp cone 40. The spring is selected to maintain a suitable biasing force. It essentially pre-loads the gearing so there is not play in the gears or backlash. This increases the accuracy of the aiming. When maintenance on lamp 10 is performed, spring 210 can be easily disengaged by pulling it off of post 214. The pitch diameter of the last few teeth on large gear 204 are cut off slightly greater than the pitch diameter of the other teeth. This makes that combination less sensitive to reengagement.

Figure 26S:
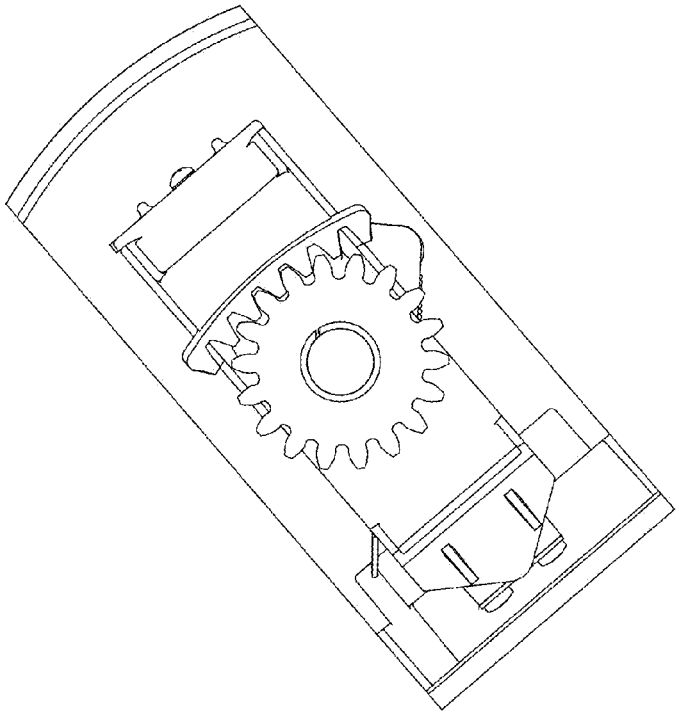
Figure 26T:
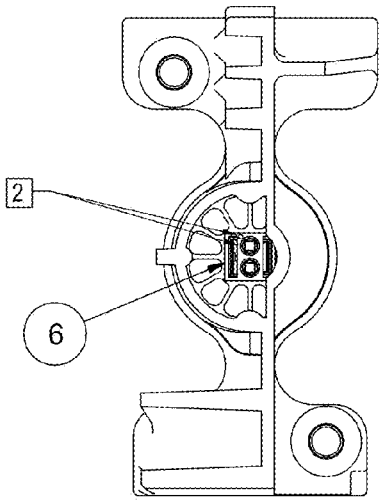

Therefore, the design allows automatic tilt factor correction over the described range. It also allows for easy maintenance of the fixture by allowing large gear 204 to disengage (below 55½ degrees down) from gear rack 190 of yoke 80. Lamp cone 40 and the remainder of fixture 10 attached to it can be swung down and then backwards to perform maintenance (e.g. take lens off and clean, replace lamp, etc.) and is thus pivoted outside of that range. At approximately 60 degrees down no part of any gear holds the fixture at all, although spring 210 will provide some resilient force. Once the gears are disengaged, lamp cone 40 and the associated remainder of light fixture 10 freely pivots down to a vertical position without having to fight the gear engagement. When re-aiming the fixture, it pivots back into place and large gear 204 engages in the gear rack 190. Sections A-A of FIG. 26 "O" and B-B of FIG. 26S illustrates the gearing in cross-sections as well as attachment of the spring.

Figure 28A:
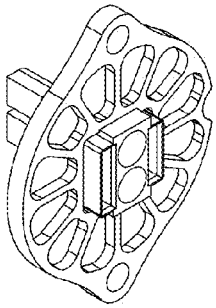
Figure 28B:
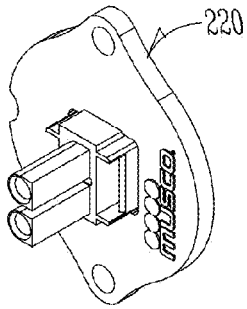
Figure 29A:
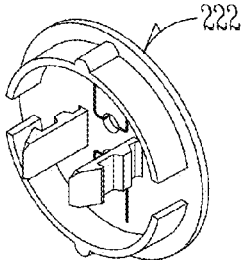
Figure 29B:
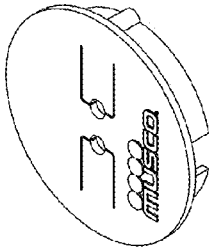
Figure 29C:
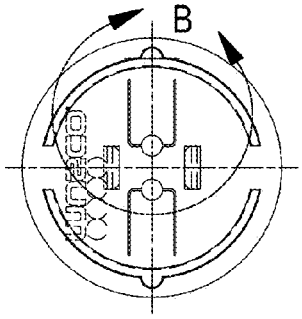
Figure 29D:
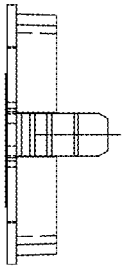
Figure 29E:
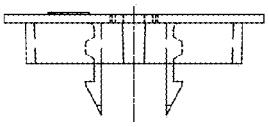
Figure 29F:
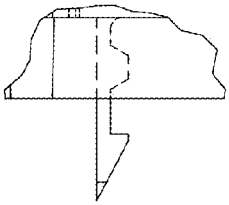
Figure 29G:
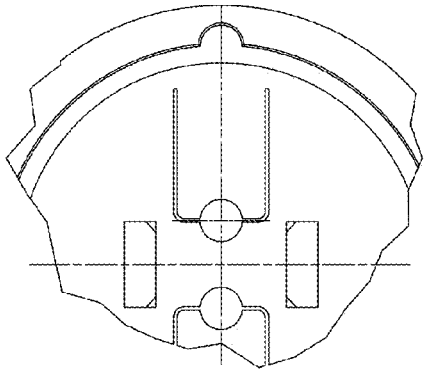
Figure 30A:
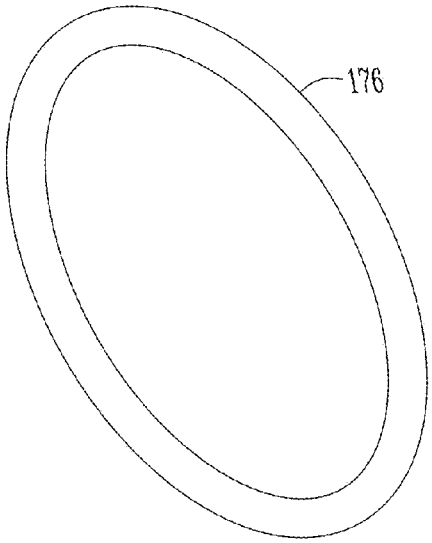
Figure 30D:
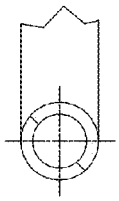
Figure 30B:
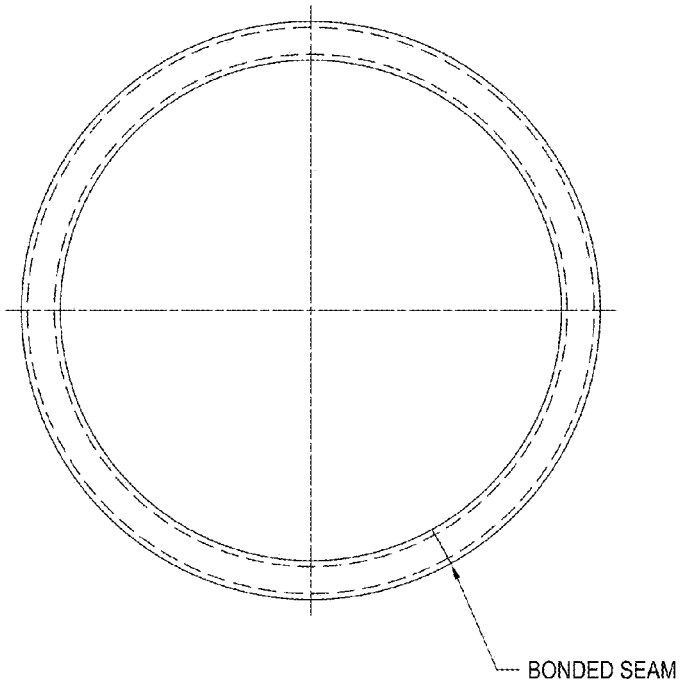
Figure 30C:
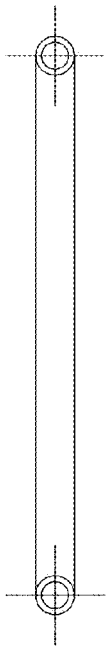
Figure 31A:
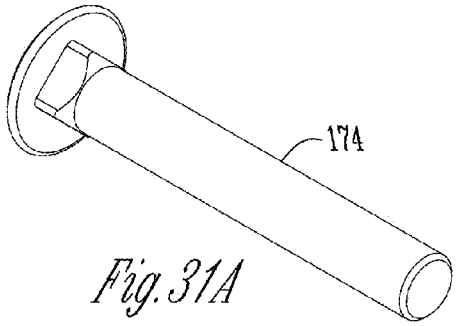
Figure 31B:
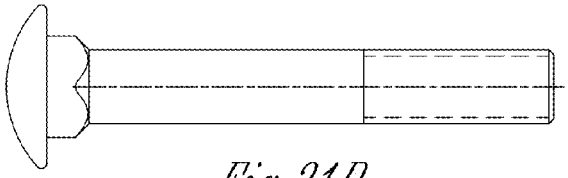
Figure 31C:
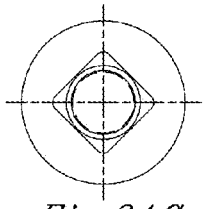
Figure 32A:
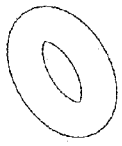
Figure 32B:
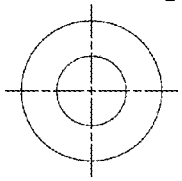
Figure 32C:
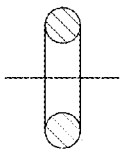
Figure 33A:
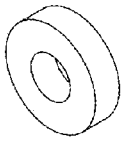
Figure 33B:
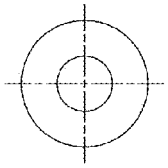
Figure 33C:
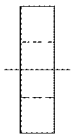
Figure 34A:
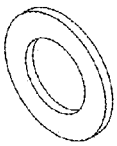
Figure 34B:
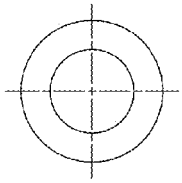
Figure 34C:
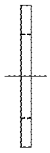
Figure 35A:
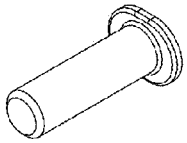
Figure 35B:
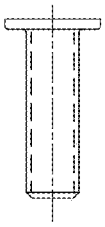
Figure 35C:
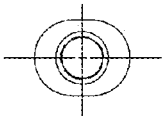
Figure 35D:
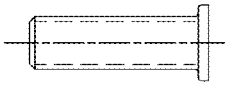

Electrical power to lamp 20 is through finger safe connector 220 (FIGS. 28A-B). The connector can be mounted in 164 (FIG. 27B) in knuckle plate 60. Strain relief member 222 (FIGS. 29A-G) can snap fit in around opening 164 to provide a strain relief for electrical wires communicating with the finger safe connection 220. This allows easy and safe electrical connection of electrical power wires to each fixture 10. Two captured bolts hold it in place after it snaps into a complementary shaped opening the center of knuckle plate 60. It is installed at the factory, as is lamp 20. There is no risk of contractor mistakes. AMP™ brand (Tyco Electronics, Harrisburg, Pa.) finger safe ferrules/connections make connection of electrical wires safe for the installer.

Figure 44H:
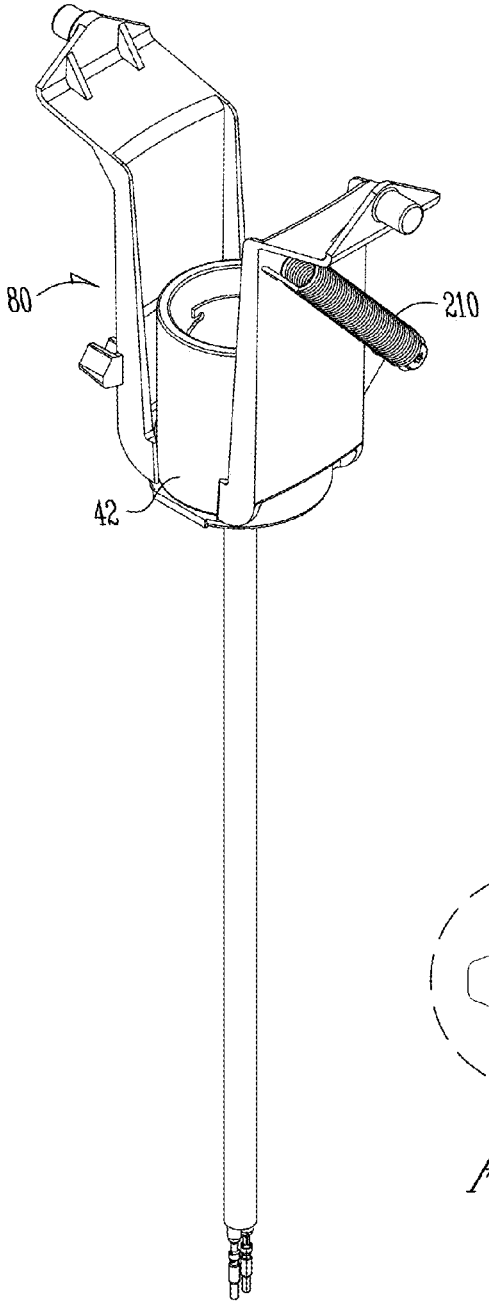
Figure 44I:
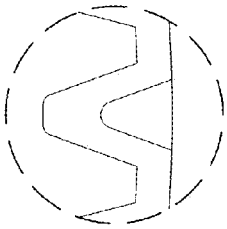
Figure 44J:
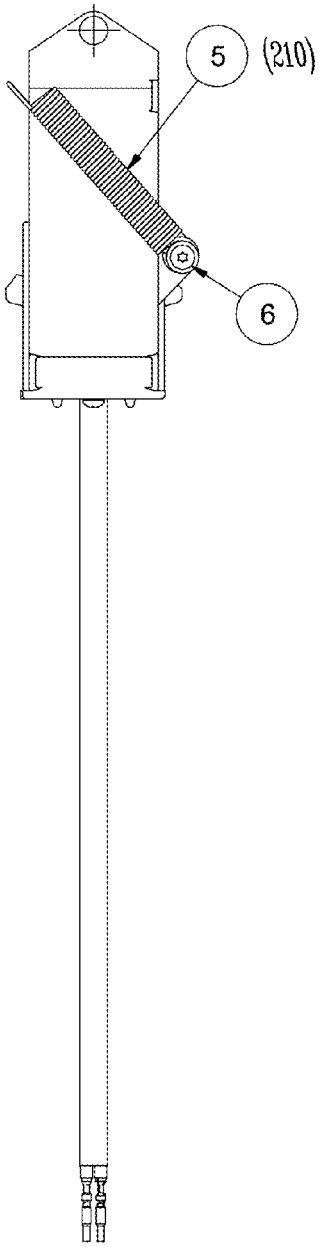
Figure 45A:
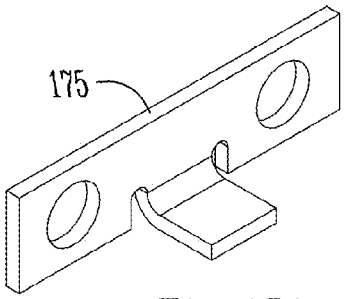
Figure 45B:
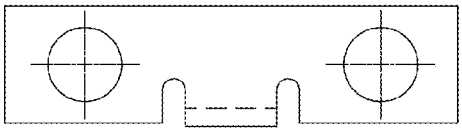
Figure 45C:
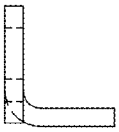
Figure 45D:
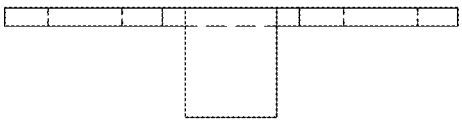

The socket 154 for lamp 20 mounts to two slots 187 (can be arcuate) in the bottom of yoke 80 (FIGS. 44A and F) (see also reference numeral 42 in FIG. 44H). These correction slots allow, if needed, slight rotation of the socket in case arc tube 12 does not end up in correct rotational orientation relative to horizontal. Lamp 20 can have a pin extending laterally from its base and socket 154 in a spiral groove (see Musco U.S. Pat. No. 5,856,721). The end of the groove can be designed as an end stop to rotation of the base of lamp 20 into socket, and at a lamp rotational position that is correct for horizontal operation of arc tube 12. However, it is difficult to manufacture a groove in the socket within very precise tolerances. Presently, this means the lamp may end up ±5° or 6° from correct rotational position. Slots 187 allow the socket to be rotationally adjusted to compensate, if needed, because even a few degrees of rotational misalignment of the lamp could result in increased tilt factor or other issues. Also sometimes there is pin misalignment on the lamp base or in the slot in the socket. There can also be some misalignment of the glass envelope of lamp 20 relative to its threaded base or its arc tube 12. The correction slots allow the lamp assembler to check for correct Z-Lamp™ rotational orientation and if, for some reason, it is not correct, the worker can rotate the socket to compensate. Also, the flat mounting surface at the bottom of yoke 80 makes it easier to ensure correct alignment, in comparison, for example, with lamp mounts for spun reflectors. It is difficult to get a flat mounting surface for the lamp cone on a spun reflector. This can create misalignment of lamp 20 relative to both the spun reflector and to horizontal. But since lump 20 in fixture 10 is mounted to a flat surface and is adjustable, precise positioning is available.

An alternative to yoke 80 would be to manually adjust the position of lamp 20 relative to horizontal for each fixture aiming angle. This would be labor intensive and subject to assembler or installer error.

Yoke 80 could be fixed in position relative lamp cone 40 if tilt factor is not to be corrected. This could be done by leaving pinion gear 202 out. One such situation would be if lamp 20 is a sodium HID lamp, such as are well known in the art. They do not exhibit tilt factor.

As mentioned previously, the automatic tilt factor correction components moves arc tube 12 of lamp 20 slightly relative the reflecting surface of fixture 10 if the aiming angle is other than the reference position. This changes the beam shape. Small changes between the light source (the arc in arc tube 12 of lamp 20) can result significant beam shape changes.

Based on the geometry of the components of this embodiment, the light center of the beam moves one degree for every ⅔ of a degree movement of arc tube 12 on yoke 80 (i.e. you only have to move the reflector ⅔ of amount needed for 1 degree movement of center of the beam). A multiplier (in this example 1.5) has been found to characterize the beam shift. A 10 degree reflector movement gets 15 degree beam movement.

This allows the fixture's overall size to be smaller, along with other benefits of this relationship. It allows one set of photometry to be run (used to characterize the beam shape of the fixture when designing a lighting system) at the reference position for a given fixture 10. Without having a known multiplier to characterize a correction angle, multiple sets of photometry would have to be run for each lamp position for each fixture. This would be extremely expensive, labor intensive and burdensome.

The multiplier can be used to compute any change of lamp cone position from the reference position to adjust the lighting specifications. For example, if the light beam is indicated to be set at 27 degrees down from horizontal (a 3 degree difference from the 30 degrees reference position), the worker will know to set the lamp cone by using the formula, e.g. [reference angle (reference angle−beam shift) ×0.67=fixture aiming angle, or 30°−(30°−3°) ×.67=(3°×0.67) =2°. Therefore, although the beam is dropped 3°, the fixture only has to be tilted 2°.

One set of photometry can be used in software programming to characterize the fixture's beam, and the formula can be programmed in to compensate for the shift in arc position. This simple but satisfactorily accurate technique saves having to produce photometry for each possible aiming angle of the fixture, and for every beam type.

It is to be understood that practical or structural limitations usually limit the range of adjustment of cone 40 in a vertical plane. However, yoke 80 keeps the lamp at a relatively consistent orientation relative to same reference plane but does move slightly relative to the cone 40 and its attached reflector. This can change the configuration of the beam from the fixture. This can be advantageous, however, because it could allow greater flexibility for the lighting designer. For example, if cone 40 can be adjusted, e.g., no more than 15° up because it hits against other structure, in this embodiment the beam shifts an extra few degrees up.

9. Visor 70

As indicated at FIG. 4, a visor 70 is attachable to fixture 10. High total reflectivity material 72 is mounted on its inner or downward-facing side. Essentially the exterior of visor 70 is a protective cover over the high reflectivity material it supports. FIGS. 5A-5B, 6A-B, 46A-B, 47A-B, and 48A-B illustrate two general forms visor 70 can take.

Either form of visor 70 actually is larger in size than many existing visors, and increases the overall size of fixture 10. However, their shape and configuration has been designed to actually decrease wind load by on the order of 40% over conventional fixtures. The length, shape, and edges of visors 70 are designed to improve the EPA of the whole fixture 10. They are cost effective with excellent reflection efficiency.

The two general forms for visor 70 are illustrated in the drawings (see, e.g., short visor 70A of FIGS. 5A-B and 46B and 47A-B and long visor 70B of FIGS. 6A-B and FIGS. 48A-B). Both start with a base visor section 240 (FIG. 59) that is attached to lens rim 230 by rivets, bolts or other means. A second or outer visor section, either short visor section 250 (FIG. 60) or long visor section 260 (FIG. 61), is attached by rivets, bolts or otherwise to base visor 240.

Base visor section 240 is attached to lens rim 230 (with glass lens 3 installed). FIGS. 53A-E, 54A, and 55A-C illustrate the specifics of the parts for lens rim clips 233 (FIG. 59) that can latch lens rim 230 to the reflector frame 30. Lens rim 230 (FIGS. 49A-E) generally matches the perimeter opening to reflector frame 30. Base visor section 240 is welded or riveted into slot 232 of lens rim 230 and supported by arm 234. Slot 236 holds glass lens 3. Slot 238 allows connection to reflector frame 30. Lens gasket 231 (FIGS. 52A-B) cushions and seals glass lens 3 in slot 236.

Glass rim gasket 237 (FIGS. 50A-D) fits within slot 239 of lens rim 230. Alignment pin 235 (FIGS. 51A-B) fits through apertures in lens rim 230 and reflector frame 30, when aligned, to confirm correct rotational orientation of rim 230 on reflector frame 230.

A built-in extrusion on the outside of lens rim 230 provides a mounting flange for visor 70. Base visor section 240 is at an angle (20 degrees) to lens rim 230 and to reflector frame 30 when mounted on it. Lens rim dips or latches 233 (see FIGS. 5 and 6 showing latches 233 in a latched state and FIGS. 53-55 for some of the pieces that make up a latch) allow secure but easy removal and reattachment of the lens 3/visor 70 combination to reflector frame 30.

As can be seen in FIGS. 47A-M, a plurality of side-by-side, high reflectivity reflector inserts (e.g., reflective inserts 252 of FIGS. 62A-B) are riveted or otherwise secured to the inside of base reflector 240 and attached visor extension 250 (FIG. 60). Alternatively, upper and lower rails 254 and 256 (FIG. 56A) can be attached to proximal and distal positions on the inside of visor combination 240/250, and the reflective visors installed into slots 255 and 257 respectively, and then riveted or bolted into place. One or more radial support brackets 258 (see also FIGS. 66A-C), can be connected back to front of visor combination 240 and 250 to provide more rigidity for upper and lower visor reflective insert rails 254 and 256.

Reflective inserts 252 on visor 70 can be the same type of material as reflector inserts 120 for primary reflecting surface 32 described above. Alternatively, they can be flat reflective sheet portions with surface variations that create diffusion for a mix of light. For example, they could have facets or steps (e.g. peens or dots). They also could have low or no reflectivity areas that simply block or absorb light (e.g. painted flat black) (see Musco U.S. Pat. No. 6,036,338 for additional detail).

Specially shaped end reflective inserts 253 (FIG. 47A) can be positioned at the lateral edges of opposite sides of visor 70 (see also FIGS. 63A-C). End reflective inserts 262 can be placed on the underside of the longer visor combination 240/260 (see FIGS. 64A-B). End inserts 263 would be similar to end inserts 253 but configured for the shorter visor 250/260 (see FIGS. 65A-C).

The reflective inserts can be directly attached to the underside of visor combination 240/260. Alternatively, they could be attached to appropriately configured upper and lower rails such as 254 and 256 (FIGS. 56A-D and 57A-D and 58A-D) that are attached to the underside of reflector 70. In certain circumstances, there may be a transition between reflective inserts. FIGS. 58A-D illustrates transition clip 264, and FIG. 67A-C illustrate insert support bracket 268 that would be first attached to the underside of reflector 70 and then reflective inserts mounted to them.

The nature of the surface(s) of reflective inserts 252, 253, or 263 can be selected, mixed and matched, according to the type of manipulation of light that is desired. As can be seen in FIG. 46A, the reflective insert strips can be of different widths, lengths, and surface. As shown, some can be smooth and some can be pebbled or otherwise altered to be less spectacular or to diffuse light. The inserts can also be stepped along their longitudinal axis.

Visor 70 acts both to block and redirect light that otherwise likely would go off target. The high reflectivity material for the visor reflecting surface reduces light loss and thus provides more light to the target area, even over prior visors that have some reflectivity. It provides significant light gains compared to conventional visors that simply block or absorb most or all of the light that strike it.

It is furthermore to be understood that other variations of reflector 70 are possible. Examples are shown in Musco Corporation U.S. Pat. No. 5,211,473. Examples of these types of visors are available from Musco Corporation under various brand names including LEVEL 8™. They provide various degrees of glare and spill light control. They can be selectively added to fixture 10. Some of the variations shown in U.S. Pat. No. 5,211,473 are for substantial reduction of glare and spill light. Some include louvers across the visor. If used with visors 70 of this embodiment, the fixture 10 will still have good efficiency and not as big of light loss as with the type of fixtures disclosed in U.S. Pat. No. 5,211,473 (e.g. spun aluminum reflectors). Other variations are described and shown herein.

The shape of visor 70 is designed to achieve several functions. First, it supports the highly reflective inserts in a manner that controls spill and glare light. Second, it supports the reflective inserts in a manner which minimizes light loss, and can increase light to the target. Third, its shape minimizes the projected area of the visor and the fixture generally to produce a low coefficient of drag. Fourth, it accomplishes these functions in a relatively low cost but efficient way.

Even though the overall size of fixture 10 is larger than some conventional similar fixtures, the wind drag is reduced on the order of 40% or more. Spill and glare can be controlled with a visor 70, but also with other features disclosed herein, if used (e.g. lower initial output intensity, side shift, reflecting surfaces that highly control direction of light). This can allow cheaper poles to be utilized, which can significantly reduce overall capital cost of a lighting system. Less wind drag means the strength of the pole that elevates the fixtures can be less.

Visor 70 can be used even if glare and spill control is not an issue because of improved EPA of the fixture, which can reduce cost of poles. It has excellent efficiency and is relatively low cost. This is especially beneficial for outdoors sports lighting.

FIGS. 46A-B, 47A-B, 48A-B, 56A-D, 57A-D, 58A-D, 59 and illustrate how visor 70A can be built. Base visor 240 (of flat aluminum sheet) is attached to lens rim 230 (e.g. screws or rivets) (see FIG. 59). A framework of metal pieces for holding reflective inserts formed (FIGS. 56A-D). Reflective inserts are mounted on the framework (FIGS. 57A-D). The inserts/framework sub-assembly of FIGS. 57A-D is attached to the base reflector of FIG. 59 (see FIGS. 58A-D). An aluminum sheet extension (an example is shown at FIG. 61 for a long visor) is then attached to the base reflector, thus completing the visor 70.

10. Antireflective Glass Lens

Glass lens 34 includes anti-reflective coatings on both sides. These coatings are a thin film sheet that is applied to the glass. Such films are available from a variety of commercial sources. An example is the Luxar® anti-reflective coating available from McGrory Glass of Aston, Pa.

An average of eight percent of the light striking a glass panel never makes it through (4% loss by reflection at each surface of the glass). Antireflective layers at both sides of the glass minimize glare and reduce light loss by reflection down to around 0.5% instead of 8%.

An alternative to thin film applied to the glass is to dip the glass lens into a solution that deposits the anti-reflective coating on both sides. This tends to be cheaper, but may not have as much light loss reduction. Such processes are commercially available (e.g. North American Coating Laboratories (NACL) of Cleveland, Ohio).

Other coatings are available from Denglas Technologies, LLC of Moorestown, N.J., USA that reduce both surface reflections and glare. Some of them can be sputtered on. Some can be sponged on, allowed to dry, then buffed.

Another possibility is the use of low iron glass, which increases light transmission through the glass (e.g. "Solarphire™" from PPG, Pittsburg, USA). Less light is absorbed in the glass. Some of these glass types have improved UV blockage.

11. Outgassing Prevention

Another source of loss of light from fixture 10 is through degradation of materials in fixture 10. For example, light (and particularly UV light) can break down some materials and cause them to outgas. Outgassing in fixture 10 is reduced or minimized in the following ways:

(a) Assembly of fixture 10 at the factory. Even fingerprints leave residue that can either reduce efficiency of reflecting or light transmitting surfaces (and thus loss light) or cause outgassing during lamp operation (which can leave precipitated residue on reflecting surfaces or the lens and thus block light from fixture). Careful factory assembly can avoid dirt or fingerprints on interior reflecting surfaces. And complete factory assembly of fixture 10, sealing it up prior to shipment to its installation site, reduces the risk an installer at the field will create outgassing issues. The installer does not need to access an interior part of fixture 10 or handle lens 3. They just take fixture 10 out of a shipping box, avoid touching lens 3, and attach it to its appropriate knuckle plate on a cross arm 7.

(b) Seal holes in fixture. Sealing of openings to the interior of the fixture (leaving only a filter for air exchange) are similarly helpful. Examples are gaskets at openings in the lamp cone (see FIGS. 26A and E), between the lamp cone and the reflector frame (see FIG. 26J), and between the glass lens and the reflector frame. See FIGS. 49A-E. FIGS. 49A-E show U-shaped-in-cross-section lens gasket 231 (see FIGS. 52A-B) seals against lens 3 better because of the Y-shaped distal ends of gasket 231 and the pointed ridge in the interior bottom of gasket 231. Also note that gasket 231 seats into a channel in lens rim 230. The opposite walls that define the channel extend much taller than gasket 231. Gasket 231 goes all around the perimeter of lens 3. The walls of the channel in which it sits do likewise. They, thus, "hide" or prevent much direct UV light from striking the gasket 231 which reduces potential for outgassing. Still further, FIGS. 49A-E illustrate lens rim gasket 237 seats in a channel that extends around lens rim 230. Gasket 237 can be O-ring 237 in FIGS. 50A-D. Note it also seats in a channel defined by opposite walls. It is to be understood that O-ring 237 would compress when lens rim 230 is seated into a shoulder around the perimeter of the opening of reflector frame 30. The distal edges 227, 228, of channel 239 in which O-ring 237 seats are designed to have metal-to-metal contact with the shoulder to which it seats in reflector frame 40. Not only would O-ring 237 thus be hidden from any direct UV light, the metal-to-metal contact of edges 227, 228 of lens ring 230 with the continuous shoulder of metal reflector frame 30 takes advantage of the large surface area of reflective frame 30 to act as a heat radiator to reduce the heat around gasket 237, again deterring outgassing.

(c) Hide suspect materials from light. For example, as discussed, the lens gasket is recessed or placed under a protector ring and hidden from most if not all light (especially U.V. light).

(d) Use materials that do not outgas. An example is Teflon™ centering ring 112 (FIGS. 14A-C) and clamp 114 (FIGS. 15A-D) at annular bump out 36 of reflector frame 30 (see FIG. 36).

(e) Minimize U.V. light.

Figure 16B:
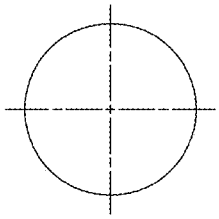

(f) Use a carbonated filter (FIGS. 16A-B) in the only air exchange opening for the interior of reflector frame 30. Less light loss from outgassing will occur if a constant clean air supply is moved through fixture 10. Note also that the filter fits in a relatively small air opening at the perimeter of reflector frame 30 which is substantially hidden from direct UV light.

It has been found that such modifications can greatly diminish deposition of outgassed materials on the inside of fixture lens and on reflective surfaces which would tend to create loss of light from fixture 10. Thus, reduction of outgassing will reduce light loss over time, reduce maintenance, reduce amount of energy put in, and could extend lamp life perhaps by double.

It is important to have a "clean" optic system. There can be outgassing, even from conventional parts of such fixtures. Silicone gaskets, plastic pieces, and even glue can outgas. If the fixture is sealed before shipment to installation site, and the above steps taken, outgassing can be greatly reduced. The installation contractor can not create outgassing or light reduction problems by handling interior parts of fixture 10.

Additionally, the peel-off covers on the high reflectance reflector inserts 120 protect against residue on the interior reflecting surfaces during factory assembly, which later could block light or outgas.

An additional optional method to try to reduce light loss would be to deter collection of dust or dirt or other substances or particles on the lens. Commercial products like Rain-X® (Sopus Products, Houston, Texas) could be applied in a thin layer to lens 3 to reduce accumulation of dust and dirt. Some thin films are available commercially for the same function. Other hydrophobic coatings or layers are commercially available.

Reduction of dust and dirt could save several percent light loss from fixture 10, and thus increase light to the field for the same energy used. Keeping substances from adhering to the glass reduces reflections caused by such substances or particles. Such reflections are virtually uncontrollable so they can cause glare.

The above-identified structures and steps can be advantageously combined with manufacturing techniques to minimize outgassing. For example, assembling the fixture 10 in a reasonably controlled factory environment, instead at the site of the lighting system (a "construction" environment), can greatly decrease dirt, debris, and other substances from getting on or into fixture 10. The factory environment can be somewhat of a "clean room" compared to outside at the construction site for building an outdoor sports lighting system. Workers can be trained to carefully handle the fixture components when assembling them to avoid getting extraneous substances on the interior parts or surfaces. Even fingerprints or smudges could detrimentally affect the reflecting surfaces. The chance for contamination and effect on performance of the fixture 10 are greatly reduced. Such steps get rid of many variables that could be detrimental to the performance of fixture 10.

The worker(s) can assemble fixture 10 and seal its interior in the factory. Use of recessed gaskets and other materials used, along with assembling procedures and environment prevent deterioration of the optic system which might outgas or absorb or reflect light in an uncontrollable manner (and thus lose light to the target space or create glare or spill light). This manufacturing regimen is easy to teach workers and can be easily replicated from fixture to fixture. It is therefore highly repeatable for consistency. It also allows assembly workers to produce a sophisticated combination without having to have sophisticated knowledge about how the components and features work. Labor costs can be reduced.

Another feature discussed above, is than the lens rim 230 can have metal-to-metal contact to dissipate heat from it (it uses the larger surface of the reflector frame as a heat sink), as well as block light reaching it, both of which could cause outgassing. Significant temperature reduction can be achieved as compared to having it exposed and simply insulated. One example is having metal-to-metal contact between the metal rim that holds the glass lens and the metal reflector frame. A relatively thin gasket could be used between the glass lens and the rim, but the metal-to-metal contact could conduct away heat from the glass lens, using the relatively large reflector frame as a heat sink.

The die cast reflector frame could be outgassed before fixture 10 is assembled (e.g. by placing in oven at temperature (e.g. 450 degrees F.) above what it will normally experience during operation.

12. Linear Reactor Ballast/More Electrically Efficient Components

A linear reactor ballast is used to supply fixture 10 with electrical energy. Such linear reactor ballasts are available commercially and have increased electrical efficiency over conventional ballasts. They can add several percent more light generated from lamp 20 for the same amount of energy used. Musco Corporation co-pending application Ser. No. 10/785,867 describes an example.

Alternatively or in addition, components transmitting electrical energy to lamp 20 for fixture 10 can provide added electrical energy to lamp 20. For example, higher magnetic permeability steel for the ballasts have been discovered to allow an increase of wattage available to arc lamp 20 for the same amount of energy used.

13. SMART LAMP™ Circuit

A circuit of the type in co-pending application Ser. No. 10/785,867, marketed under the Musco Corporation brand name Smart Lamp™, is added to operate lamp 20 of fixture 10. As described in Ser. No. 10/785,867 significant energy can be saved over operational life of the lamp. It can also extend lamp life. Although adding some additional cost to fixture 10, it is recovered through energy savings. Details regarding SMART LAMPS™ are set forth in Ser. No. 10,785,867, and are incorporated by reference herein. The Smart Lamp™ circuitry applies a lower wattage to lamp 20 during a period of its operation. Less energy is consumed than if operated at higher wattage. As the lamp ages, lumen depreciation drops lumen output of the lamp. The Smart Lamp™ circuit can switch in more capacitance to the lamp circuit at a selected time to increase lamp wattage (and thus increase lumen output) to combat the lumen depreciation. If wattage is kept below normal for extended periods of time (hundreds or even thousands of hours), energy savings will accumulate and can exceed costs of the circuitry. A lead-peak ballast or autotransformer with plural taps could be used with switchable capacitors towards this end. Alternatives include linear reactor transformers such as described above. Other methods are possible.

One option would be to allow manual selection of this feature. A manually selectable switch could have "full power" and "energy savings" positions; the latter running the lamp with the SMART LAMP energy saving circuit, the former switching out the SMART LAMP energy saving circuit. The user could then select between energy savings and higher present light output from the fixture.

Still further, as can be appreciated, existing lighting systems could be retrofitted with the SMART LAMP circuit to achieve energy savings and longer lamp life. Old capacitors could be replaced with new ones and the SMART LAMP circuit merely plugged in the ballast box. The added cost could be recovered with energy savings.

Also, most of the cost of replacement of lamps is labor and equipment costs. Lamps cost around $30 to $60. Labor and equipment (e.g. a rented crane to elevate a worker to change a lamp) can cost on the order of $120 per lamp change. If lamp life could be lengthened, perhaps by at least double, the cost of at least one lamp change would also by saved, making the retrofit of the Smart Lamp™ circuit additionally economical. Another idea is to retrofit a whole new fixture 10, with Smart Lamp™ circuitry, for a conventional fixture and lamp circuit. Presently the entire fixture 10 may cost in the $300 range. It is relatively quick and easy to put knuckle plates 60 on the old cross arms and connect knuckle 50 of new fixture 10. The aiming diagrams are usually saved for the lighting installation (either by the owner of the lighting system, its manufacturer, or the installing contractor). To retrofit, the capacitors for the old fixtures are removed from the ballast box, and new ones put in with a SMART LAMP™ circuit. Because the modified lamp 20 in new fixture 10 is operated at a lower wattage with the SMART LAMP™ circuit, the new fixtures may have to be re-aimed. But such costs, as well as the cost to replace the fixtures, can be recoverable because (a) there likely will be less total fixtures needed because of increased light from each fixture 10, and (b) because of energy savings and less lamp changes, with the added environmental benefits of less energy usage, more efficient energy usage, and less spill and glare.

Alternatively, the retrofitting project could leave the same number of fixtures but operate them at a reduced wattage (1500 Watt to 1000 Watt). A one-to-one take out and replacement would just require different capacitors and a SMART LAMP circuit, and would be cheaper than changing over all the fixtures to new fixtures 10. There likely would be no re-aiming, but would operate more fixtures.

An additional benefit of this SMART LAMP feature is the substantial reduction of glare and spill light in most applications. Less light initially is issued (e.g. approximately 30%) from each fixture 10 using the feature. Therefore, if two fixtures had generally the same light pattern relative a target area, a fixture with the SMART LAMP feature would generally create a reduced level of glare and spill light compared to one without during the initial reduced wattage period, because it is outputting less light energy. While SMART LAMP generally keeps light output at about the same level during operating life of the lamp, if the 0.7 multiplier reduction in initial light output is used, this represents a significant reduction in spill and glare initially. Conventional systems can have on the order of 50 to 60% more spill and glare during this period. This is with the added benefit that less electricity is used during this time.

This can be a significant issue, especially for lighting systems near neighborhoods or in cities. This can be an environmental issue. Some regulations or rules for glare and spill impose maximum light levels at a neighboring property line. These restrictions can apply from the moment the lighting system is turned on. Therefore conventional systems, with higher initial light output (and higher spill and glare initially) would either have to apply more and expensive spill and glare equipment to the fixtures, but this frequently would result in insufficient light levels at the field once the initial lumen depreciation period for those lamps is done. Therefore, those systems frequently must build-in more light fixtures to the lighting system, which adds cost to the system. It may even require more or more expensive light poles to handle the additional fixtures, which is a still further added cost.

Thus, this SMART LAMP feature can provide glare and spill light benefits as well as energy optimization and light output options and benefits. The system designer and end user can balance different options. The SMART LAMP is programmable or configurable for different needs and desires. It can produce different performance options. For example, it can produce a range of light outputs. It can produce different regimens of energy savings. The designer and end user can select from and balance different factors and customize the benefits to each application.

As can be seen, one benefit to the end user can be a reduction in the fixture count for a lighting system. The lower initial spill and glare but maintenance of light levels over operation life, can allow less fixtures to light the field. This reduces capital cost, and usually operating costs. It can reduce cost further by requiring fewer poles or less expensive poles to elevate the reduced fixture count.

C. Assembly and Use

In practice, a set of fixtures 10, such as described above, would be used in a sports lighting system customized for a particular sports field. Lighting specifications (usually including light quantity and uniformity minimums; and sometimes glare, spill, and halo light limitations) are usually prepared or known. As is well known in the art, computer software can design the lighting system, including what types of beams and beam shapes from how many fixtures at what locations are needed to meet the specifications. It can generate a report indicating number of fixtures, pole locations, beam types, and aiming angles to meet the design.

As described above, fixtures 10 can be assembled to produce a wide variety of beams and commonly used beam shapes for sports lighting. Using the report, a set of fixtures 10 can be pre-assembled at the factory. The appropriate reflector frame 30 for each beam type called for in the report can be pulled from inventory by the assembly worker. About one-half the reflector frames will include a side shift section 109 (and about one-half of those split between left shift and right shift). Likewise, the appropriate reflector inserts 120, visor 70A or B, and visor reflective inserts 252 will be pulled from inventory for each fixture according to its position and function in the report.

The assembly worker(s) will mount the appropriate reflective inserts 120 on the pins on each reflector frame 30, and the appropriate visor reflective strips 252 on visor 70 for each fixture 10 (depending on the precise structure of visor 70, mounting straps or brackets may first be secured to visor 70). Glass lens 3, with anti-reflective coatings on both sides installed, is assembled into lens rim 230 with visor 70 attached.

A Z-lamp™ 20 of the appropriate wattage is screwed into socket 154 for each fixture 10 and aligned, through the pin and slot method and/or by correction slots, so that the plane defined by the longitudinal axis of arc tube 12 and the longitudinal axis of lamp 20 is in appropriate alignment relative to reflector frame 30.

Other parts, including those specifically described above, are assembled, to complete each fixture 10 for the given lighting system, including latching the lens 3/visor 70 combination over reflector frame 30, and sealing all holes except for placement of filter in its designated opening. The assembly worker(s) take appropriate measures to avoid any foreign substances from adhering or being inside reflector frame 30 after lens 3/visor 70 is sealingly mounted to it. This includes peeling away the release sheet protective covers on the high reflectivity inserts for reflector frame 30 and visor 70.

Fixtures 10, a pole top with pre-assembled cross arms 7, and poles are shipped to the field to be lighted, along with aiming diagrams, showing how each pre-designed fixture should be aimed relative the field. The entire system, namely poles and bases for the poles, cross arms, fixtures, wiring, ballast boxes, etc. can substantially pre-assembled at the factory (see Musco U.S. Pat. No. 5,600,537, incorporated by reference herein). This pre-assembled system is available from Musco Corporation under the Light Structure™ brand name.

At ground level, knuckle plates 60 are attached to cross arms 7 and the appropriate fixture 10 is attached to its appropriate knuckle plate 60 by its knuckle 50 (after wiring for that fixture is connected to pre-wiring in cross arm 7). The knuckle for each fixture 10 is adjusted to match the indicated aiming for that fixture 10 according to the aiming diagram (using the pole as a reference point, as described later). Once aimed, the inner and outer knuckle straps and knuckle stop strap, are bolted in place so that the correct aiming position for the fixture is set. Any pivoting of fixture 10 above or below the reference position for arc tube 12 will result in automatic tilt factor correction movement of yoke 80 for that lamp 20.

A Smart Lamp™ circuit with linear reactor ballasts, is either in place, or placed in each ballast box for each pole 5, with appropriate capacitors. The timer for each circuit is set.

The poles are erected vertically. Electrical power from a control cabinet is connected to each ballast box on each pole.

When the lighting system is turned on, it will:

a. Begin the Smart Lamp™ operation regimen for each lamp, which will save energy, extend lamp life, and delay lamp change expenses over time.

b. For the given amount of operating energy from an electrical service;

i. Produce more lumens per fixture because of total tilt factor correction, no white oxide coatings, and increased light pool for lamp 20, and by less energy loss between the electrical service and the lamps because of linear reactor ballasts.

ii. Produce more light out of fixture 10 because of high reflectivity reflecting surfaces, anti-reflective lens 3, and reduction of outgassing.

iii. Put more light on the field because of the precise control possible with high reflectivity reflecting surfaces, the bottom less converging portion of the main reflecting surface of each fixture 10, the side shift less converging portion of the main reflecting surface for about one-half of fixtures 10, the high reflectivity visor reflecting surface.

As a result of the substantial increase in light and control of light from fixtures 10, the lighting system can be designed with less fixtures, which may require less or less expensive poles. The final installed system is more robust than systems with spun aluminum reflectors (particularly because of cast reflector frames 30), presents less wind load (particularly because of visor 70), and saves considerable energy over time (particularly because of Smart Lamp™ technology). It will tend to maintain better light levels over time and increase lamp life.

1. Example of Individual and Cumulative Benefits of Fixture 10

Table 1 below indicates the potential gains using features and aspects of the invention discussed above, with certain noted assumptions and clarifications.

TABLE 1

| Comments | Gains | Effect** |
|---|---|---|
| 1 | New lamp lumens | ABC |
| 2 | Total Tilt Factor Correction, New Lamp | ABC |
| 3 | Reflectance | ABC |
| 4 | Redirected off-field side light | ABC |
| 5 | Reflective visor | ABC |
| 6 | Anti-reflective glass | ABC |
| 7 | Linear reactor ballast | ABC |
| 8 | SMART LAMP ™ | AD |

Comments:

1. Calculations based on statistical aiming angles.
2. Will likely correct tilt factor from 5 degrees aiming up to about 60 degrees down.
3. Silver-coated aluminum inserts likely would have approximately 3% higher reflectance than enhanced aluminum inserts 120, but would likely need a system to cool the silver (e.g. blowing cool air across) because it can degrade in presence of heat.
4. 60 degree segment on side was used.
5. Derived by running a video photometer and measuring gain with uncoated arc tube. Visor included 95% reflective material.
6. May be other options that are lower cost.
7. Likely use as a part of SMART LAMP ™ regimen. Wattage loss requires a tap change as lamp ages, if wish to combat lamp lumen depreciation.
8. Does not increase light levels or reduce fixture count, but saves energy over life of the lamp. Likely will double the lamp life.

**A. Reduces energy usage. B. Reduces fixture count. C. Reduces Total cost to light field. D. Increases total cost to light field. Cost recovery would come from reduced energy usage.

A energy reduction multiplier is assigned each related to the amount of lumen increase or the amount of energy consumption decrease. As can be seen, utilizing all of the methods listed in Table 1 may presently cost an estimated additional $73.00 per fixture to achieve. However, over a normal operating life for lamps 20, the energy savings of 45% or more would likely recover at least that cost. An energy savings of 45% can provide on the order of 60% more light for the operating life of the lamp for the same energy. There can also be a reduction in EPA likely enough to reduce wind load on each fixture. In turn could allow smaller and/or cheaper poles.

Additionally, Table 2 below compares a current Musco Corporation sports lighting installation of 100 fixtures to the new methodology according to aspects of the invention described herein. It is estimated the increased light from fixtures 10 would reduce the number of fixtures for such a typical sports lighting application, on average, from 100 to 63. Even if capital cost for the hardware did not change, the energy cost savings and lamp change savings result in a net gain of $87,000 to the customer based on the assumptions in Table 2. This represents on the order of a 30% savings, which is significant, particularly to the types of customers commonly needing sports lighting systems.

TABLE 2

| FIXT | QUANT | PRICE | ENERGY COST* | LAMP CHANGE COST** | TOTAL |
|---|---|---|---|---|---|
| Musco SC2 ™ | 100 | $120K | $120K | $36K | $276K |
| New Fixture | 63 | $120K | $67K | $8K | $195K |
| | | | | | Savings $87K** * |

Costs:

| | |
|---|---|
| SC2 ™ × 100 × $300 = | $30K |
| New Fixture × 63 × $373 = | $23.5K |
| | $6.5K less cost for fixtures |
| Avg. Pole Cost Savings: | $1K |
| | $7.5K total |

*0.075 cents/kwh × 1.6 kwh × 10,000 hrs = $1200/fixt
**New Fixture = SC2 ™ @ × .625 = 63 fixts
*New Fixture = 1200/fixt × 63 × .87 (SMART LAMP multiplier) = $67K
**Lamp change @ $120/lamp, SC2 ™ requires 3 changes, new fixture requires 1 change.

As can be appreciated, the above methodology can be implemented in a variety of ways. Also, each and every one of the methodology options outlined above is not required to be used together. As pointed out, some of the options have individually been suggested in Musco Corporation's prior work. However, utilization of one or more of these methodology steps over operational time can accumulate energy savings in and of itself that are significant to an operator, but at a minimum, are significant to the world in the sense of savings of fossil-fuel based energy, both its consumption and the affects on the environment conversion of fossil-fuel to electrical power involves.

By using two or more of the above method steps, those advantages are compounded. By using most or all, significant improvement is likely. For example over a 30 year operation period for a lighting system using the apparatus and methods outlined above, assuming 300 hours of operation per year, and thus 10,000 total operation hours, and assuming 7½ cent per kilowatt-hour, and $120 for each lamp change (which would be avoided), there could be an approximately $800/fixture savings, just using the Smart Lamps methodology alone. This is substantial when it is compared to the approximate $300/fixture projected manufacturing cost.

The foregoing detailed description of fixture 10 is one exemplary apparatus according to the present invention which can be operated to produce reduced energy usage for each fixture, reduced total fixture count needed for most sports lighting systems, and reduced total cost to light the field. As can be appreciated by those skilled in the art, a combination of features in fixture 10 allow for a cumulative significant improvement in the nature and amount of light that can be applied to the target area. However, individually these features can have independent advantages. A designer can adopt one or several if desired.

2. Summary of Benefits of Fixture 10 and Its Operation a) New Lamp Lumens by Reduction of Tilt Factor It has been determined that additional lumen output can be achieved by holding the arc tube 12 horizontal during operation of lamp 20.

Figure 3A:
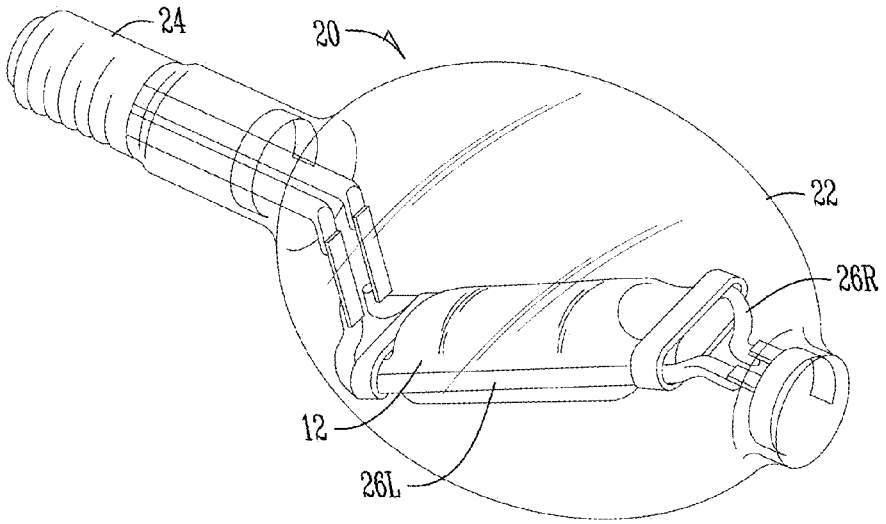
Figure 3B:
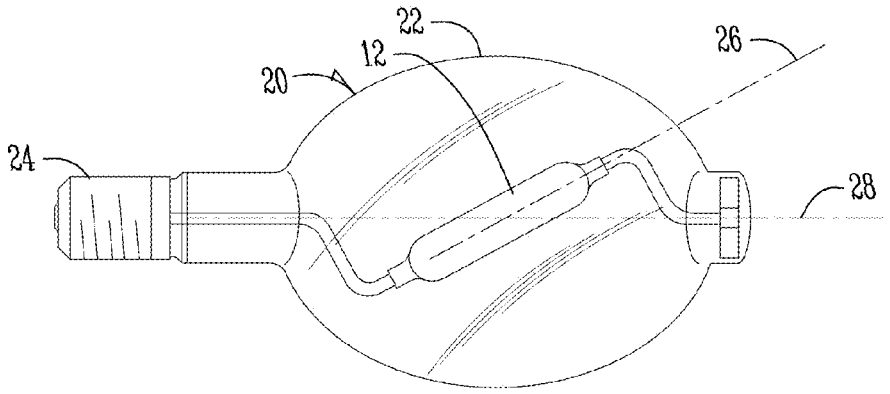
Figure 3C:
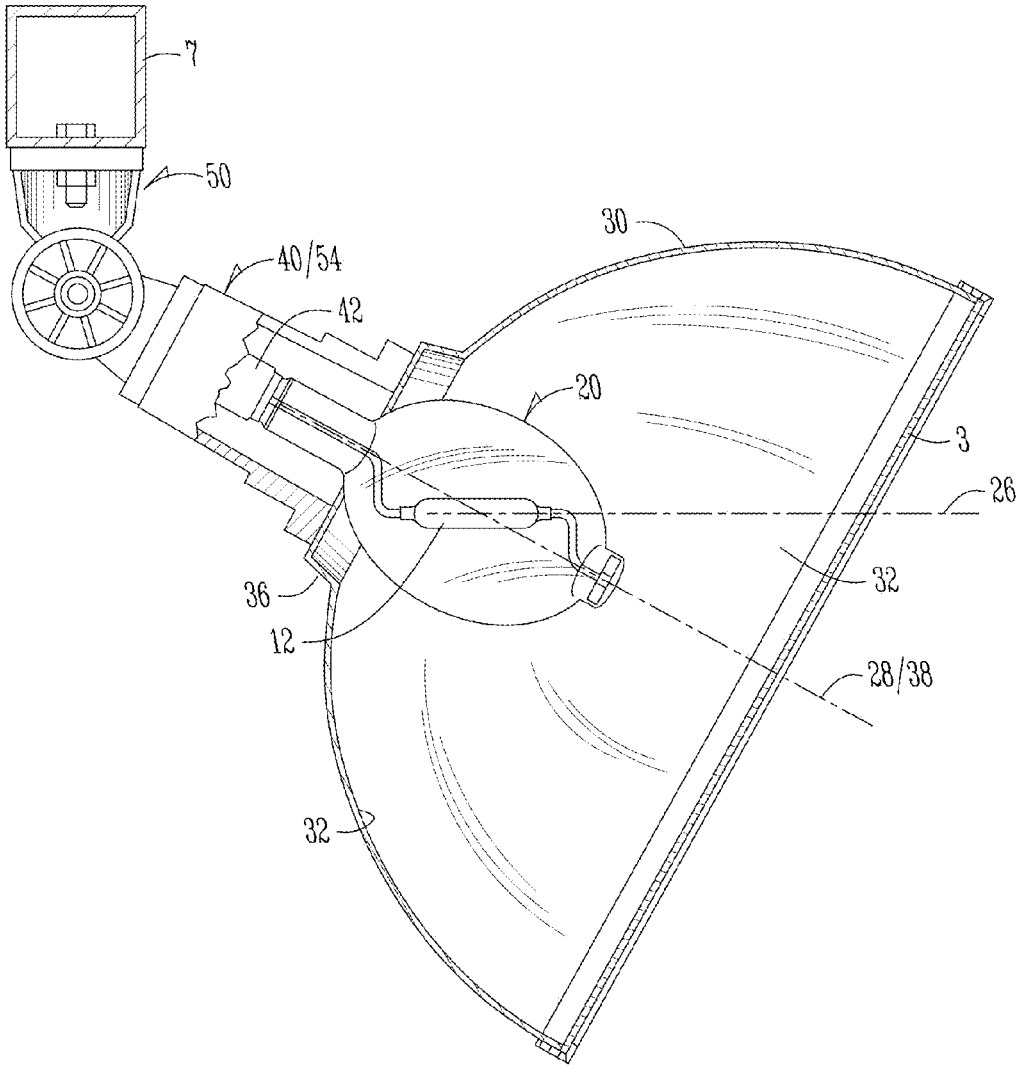
Figure 3D:
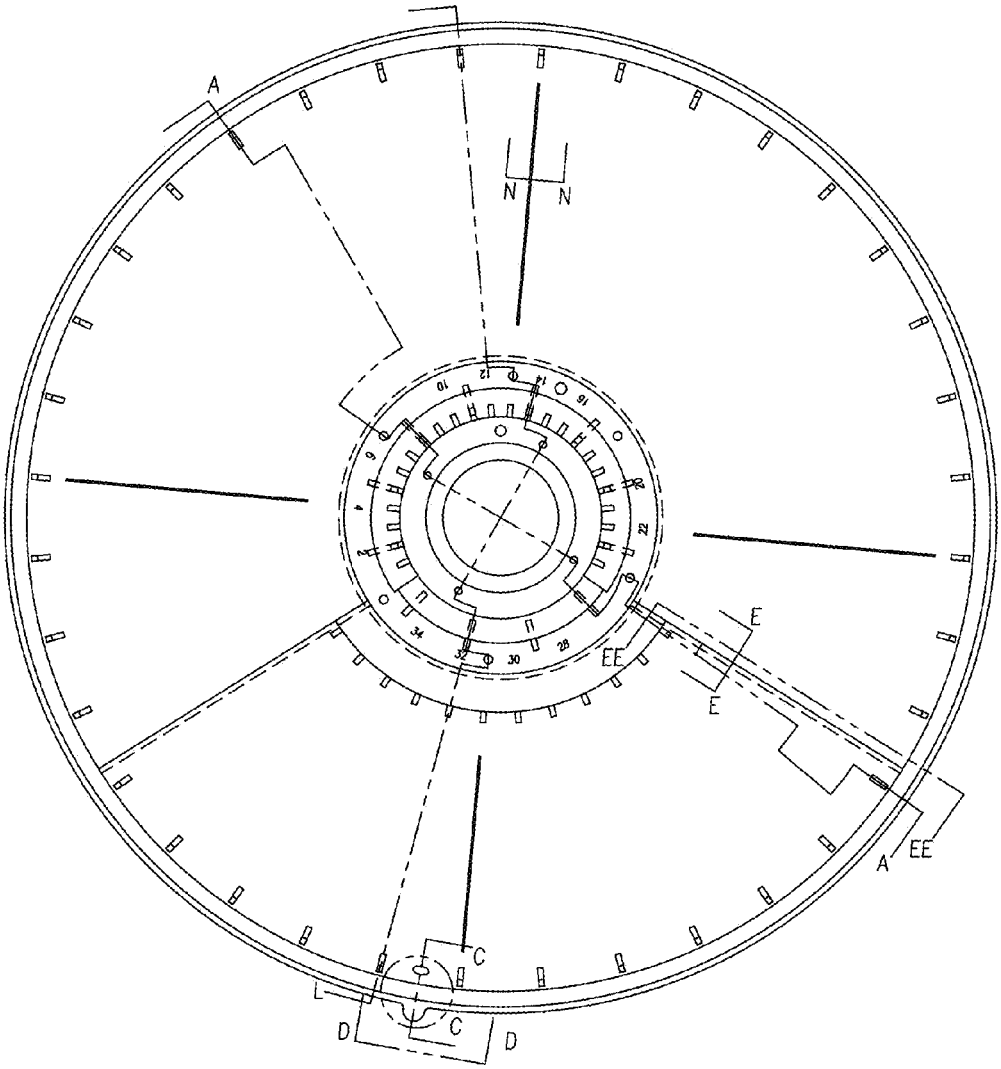

One form of lamp 20 offsets the arc tube axis 26 from lamp axis 28 by a fixed amount (e.g. 30°) (FIG. 3B). This is a frequent aiming angle for sports lighting fixtures. As noted previously, however, rarely do all fixtures for a field end up aimed exactly 30° below horizontal. As described in U.S. Pat. No. 5,856,721, and as can be appreciated by those skilled in the art, lamp 20 at least would decrease the amount of tilt factor over normal sports lighting aiming angles because it will be closer to horizontal than conventional lamps over normal sports lighting angles. Therefore, it would represent in most cases a net increase in lumen output over the life of the lamp for a given energy input.

There are other ways to adjust the relationship between the arc tube 12 and the aiming axis of the reflector surface 32. Reference is taken to Musco Corporation U.S. Pat. No. 5,161,883, incorporated by reference herein. Here fixture 10 includes an automatic horizontal leveling of the arc tube over a normal range of aiming angles for the fixture. The lamp position is retained independent of the lamp cone over a range of conventional sports lighting aiming angles for the cone (e.g. 5 degrees up to 60 degrees down relative to horizontal). This automatic total tilt factor correction feature eliminates the lumen depreciation caused by tilt factor. It also provides the added advantage of allowing a single type of HID lamp to be used in most, if not all, the fixtures for the given lighting application, even though many of the fixtures will be aimed at different angles relative the target field.

Care must be taken to ensure arc tube 12 of lamp 20 ends up in a rotational orientation so that the longitudinal axis of arc tube 12 and the longitudinal axis of arc lamp 20 are in a vertical plane during operation. This requires the correct rotational orientation of the Z-Lamp™ in its socket. This can be done manually. Alternatively, there can be structure(s) to help ensure this (see Musco U.S. Pat. No. 5,161,883—disclosing a pin on the base of lamp 20 that fits in a helical slot in socket 154 to determine rotational alignment of lamp 20). Fixture 10 includes the further feature of correction slots in yoke 80, in case the pin/slot arrangement is not precise or there is other misalignment.

b) New Lamp Lumens by Removal of Conventional Arc Tube End Coatings

It has been discovered that if an arc tube can be operated at or closely horizontal, omission of the normal white oxide coating on opposite ends of the arc tube and increase of the sodium-scandium salt pool can increase lumen output of an HID lamp, at least at some part of its operating life. An increase in lumen output is expected.

Conventionally such white oxide coatings are used to try to keep the ends of the arc tube heated to deter cooler locations which can lead to precipitation of chemicals and reduction in lumen output. It has been discovered that they can be eliminated and there is reduced lamp lumen depreciation for the HID lamp later in its operating life. Lamp lumen depreciation, as used here and as well-known in the art, refers to the loss of lumen output experienced by HID lamps as they accumulate operating hours. The reduced lumen depreciation of modified arc tube 12 has been found to begin to have substantial effect after the initial rapid lumen depreciation period (usually the first 100 hours or so of lamp operation). Therefore, just elimination of the white oxide coatings and the increased salt pool could produce additional lumens for the same input energy. However, it has also been found that removal of the coatings results in more severe and quicker tilt factor. Tilt factor, as used here and as well-known in the art, relates to loss of lumen output if certain HID lamps (metal halide included) are operated at other than vertical or horizontal. Therefore, horizontal operation of arc tube 12 would avoid any offset of light gains because of greater tilt factor.

c) New Lamp Lumens by Alteration of Conventional Arc Tube Chemistry

Over time, as these types of lamps age, some of the salts migrate through the quartz of the arc tube, especially at higher temperatures. Some of the chemicals attack the quartz and sacrifice. This can reduce the lumen output or affect the performance of the arc tube and shorten its life.

By creating the bigger "salt pool" it has been discovered that it at least keeps the lumen output higher (reduces lumen depreciation over operating hours of the lamp). Furthermore, by running the arc lamp horizontal, it does not heat up one end or the other (and deters precipitation of chemicals at a cooler spot which can occlude the tube and block useable light) and is believed to reduce migration of the salts through the quartz or attack or loss of the salts. Also, it has been found that that not only will lumen output increase during operation of the lamp, the lamp will run cooler. This decreases risk of lamp failure by extrusion of the chemicals through the quartz of arc tube 12, which risk is higher at higher temperatures. It contributes to longer life for the arc lamp. The aesthetic performance of the lamp is also maintained, if not improved, providing the right mix of light frequencies for sports lighting.

The altered chemistry, removal of arc tube end coatings, and horizontal operation will cumulatively improve performance of lamp 20 (efficiency of the lamp and aesthetic performance), increase lamp lumens, and increase lamp life. This bigger "salt pool" is believed to contribute to increased lumen output at least during certain periods during the operating life of the lamp.

It is believed the above-described changed lamp chemistry can make any HID lamp more effective, but at least, that the increase of the salt pool will be effective on different metal halide chemistries that are conventional.

d) Reduction in Loss of Light at Reflecting Surfaces

Utilization of high reflectively (over 95% total reflectance) reflecting surfaces produce more light available for use at the target for the same energy usage. Fixture 10 uses the high reflectivity material in a primary reflecting surface 32 on the main reflector frame 30 and on the underside of a reflector extension or visor 70.

It has been found that more useable light is available using a very high reflectance primary reflecting surface. The high reflectance value is not practically possible with spun aluminum reflectors.

High reflectance material not only reduces light loss at that reflecting surface, it has the subtle but important added benefit of allowing very precise control of light. There is no "fuzz" or "fuzziness" as occurs with spun reflectors (because it is just not possible to get a highly accurate surface). This results in more light on the target area. It also allows consistency from fixture to fixture. A type 4 beam type (such as are known in the art) is a type 4 beam type from fixture to fixture. In comparison, an intended type 4 in spun aluminum may end up other than a type 4 because of difficulty in consistency.

In comparison, spun aluminum reflectors have a reflectance or reflectivity value of about 80 percent. The surface can not be spun to high reflectivity. Additionally, anodizing can reduce reflectivity. Chemicals used in dip baths and the spinning process also produce different results from reflector to reflector. The "fuzziness" problem also is a fact of the process. While polishing can help, it can not eliminate these problems and it adds significant cost and time to their production.

Therefore, the high reflectivity material adds to the energy efficiency of fixture 10 by reducing light loss otherwise occur-ring in other reflecting surfaces. For the same input electrical energy, more light is available for use at the target.

But further, the highly accurate reflecting surface has added benefits. Surface striations or variations with spun reflectors can produce the difficult to control fuzziness, and also color separation. It can affect the aesthetic performance of the fixture (i.e. may not produce nice white light).

Details about these types of materials and their properties can be found in Musco Corporation, U.S. Pat. No. 6,036,338, incorporated by reference herein. The material could be made of one or just several sections and supported on reflector frame 30. Alternatively, it could be made in strips and supported by reflector frame 30. Examples of such strips and options for them are described in U.S. Pat. No. 6,036,338.

For the same reasons described regarding the primary reflecting surface 32 on reflector frame 30, addition of very high reflectance material (e.g. 95%) to the underside of visor 70 has been found to increase available light at the field for the same given amount of energy used. These visors include a construction and profile that is relatively low cost to make with no substantial increase in effective projected area ("EPA"). They basically are a continuation of the main reflector. They gain light to the field while also reducing spill and glare light.

e) Reduction in Light Loss by Use of Anti-Rreflective Glass Lens

Glass lens 3 has 4% light loss per surface, as is well-known in the art. Thus loss of light otherwise unavailable for use on the field becomes available because of such glass.

Musco Corporation has attempted to deal with such problems on other types of fixtures. See U.S. Pat. No. 5,816,691 where in a different type of reflector, altering the angle of incidence of light relative the glass front is found to assist in reducing such light loss.

However, an alternative used in this embodiment is to alter the glass to reduce or eliminate this light loss. Either a thin film dipped coating or applied sheet is added to the glass lens. These anti-reflective options have been found to eliminate light loss for unmodified glass for more useable light to the target area or field if applied to both sides of the lens.

Thin film applied to the glass tends to be relatively expensive (e.g. $14-$48 dollars when the glass lens is only $2 each). Such applied film may not be highly durable, especially on the exterior of the lens. However, it takes the high temperatures inside an HID fixture of this type and reduces reflection loss for each surface upon which it is placed from around 4% to 0.25% to 0.5%. There can be reflection loss, even with non-reflective coatings, particularly as the angle of incidence of light increases (can even be as high as 2% loss per surface). But the anti-reflective coating would still reduce light loss. This compounds over time and/or if used in combination with other features of fixture 10. Anti-reflective coating could be placed on just one side of the lens and produce some benefit of more light available to the field. However, placement on both sides would tend to double that improvement.

A cheaper method is dipping the glass in a non-reflective coating. It is not quite as effective as the applied sheet of film coating, but still provides improvement.

f) Increase Light Onto Target By Less converging Lower Portion of Primary Reflector Surface for Redirected Off-Field Light It has been found that the lower less converging, high reflectivity section of fixture 10 can increase light to the field, using the same amount of electrical energy.

As can be appreciated, less converging light from the lower hemisphere of the reflector would be directed at a steeper angle and to the target area when fixture 10 is in operative position and aimed angularly downward from an elevated cross-arm. Light from that part of the fixture otherwise tends to project more horizontally and off or outside the target area.

g) Increase Light Onto Target by Less converging Side Portion of Primary Reflector Surface on Some Fixtures for Redirected Off-Field Side Light It has been found that up to one-half of fixtures for a typical sports lighting installation are subject to the need for side shift. It is estimated that significant light may be lost from all fixtures of a system because of side spills outside the field or target. Thus, if appropriate side shift is used for one half the fixtures, it is estimated that about one-half otherwise lost light would be added back to the field for with no increase in energy usage.

The cost of these side shift offsets from the general surface of revolution of the rest of reflector frame 30 are minimal because frame 30 is cast. As indicated in the Figures, three general reflector frame 30 versions could be cast—one with just the lower less converging portion, one with right side shift and lower less converging portion, and one with left side shift and lower less converging portion. Based on a priori information about a sports field, the number of each version can be selected to optimize shifting of as much light as possible from off the field to on the field.

An example is as follows. A fixture on the left most pole in FIG. 1A and which is aimed generally towards lower right hand corner of field 5 would likely have light hitting its far side reflect out of the page. Reflector frame 30 of the present invention can be pre-designed to support primary reflecting surface 32 on that side to shift that spill light onto the field.

For any fixture on the right hand closest pole in FIG. 1A that is directing light to the left near corner of the field, reflector frame 30 could be pre-designed to tip the far side of that reflector in a manner that directs light striking that portion towards the field and not out of the page off the field.

h) Increase Light Onto Target by Reflecting Visor for Redirected Off-Field Light Unlike well-known visors that block light from spilling off the field, the high reflectivity reflecting surface 72 of reflector 70 of fixture 10, with little light loss, redirects that light to the field. It increases the amount of light to the field for the same energy. But the efficiency of the high reflectivity material allows more precise control of light, for better placement of light on the target than off the target. This also helps reduce glare.

i) Decrease Electrical Energy Loss Between Electrical Power Service and Arc Lamp By High Efficiency Ballast Utilization of electrical components that increase the amount of electrical energy between the electrical surface and lamp 20 is another option to increase lumen output and thus more light the field for a given initial quantity of energy used.

As indicated earlier, if electrical energy to operate the lamp could be more efficiently translated from the electrical power source, it could increase the amount of lumen output of the lamp for a given amount of energy used and thus translating the more light to the field. An examples is the use of a linear reactor ballast. With a conventional choke, the power factor is wasteful, especially at starting of the lamp. The linear reactor ballast provides more energy efficiency. This can add to the overall cumulative efficiency of fixture 10 by supplying more electrical power to the lamp from the electrical power purchased from the electrical service. An increase in useful light can come about by this addition for the same amount of energy input.

Alternatively, or in addition, an increase in wire size and/or an increase in the quality of steel used to house the ballast for fixture 10 would decrease electrical resistance and, thus, power loss in the transmission of electrical energy to lamp 20.

Even such steps can increase on the order of 50 watts available for powering the HID lamp. This could result in additional light useable at the field for a given amount of electrical energy used.

3. Total Expected Increase of Light to Target With No Increase in Electrical Energy The methodologies outlined above cumulatively can result in a 60% or more increase of available light to the field for a light fixture 10 compared to conventional such light fixtures. While each of the above discussed methodologies alone have been found to produce beneficial increases, cumulatively these steps produce a substantial amount of additional light available for use at the field for the same amount of energy. Moreover, this increased light continues over the operating life of the fixture. Thus, less fixtures are required to achieve a given light level. Thus, not only is there less energy required to provide a light level for a given field at any one time, the benefits continue. And, importantly, the benefits accumulate over operating time for the fixture. The result is not only reduced energy usage and thus reduced energy cost at any one time, it compounds over the substantial thousands of hours of useful light of the fixture. Like compound interest from a bank, at small incremental times the energy savings may appear small. However, over the life span of lamps and fixtures of this type, the savings grow and grow. The method therefore subtlety, but steadily, over time accumulates economic advantages to the owner of the system.

The very fact that more light is made available for use at the field allows this method to reduce the number of fixtures needed to meet lighting quantity and uniformity specifications for most sports lighting jobs. This represents the ability to reduce the front end capital hardware costs and installation costs as previously described. This also reduces the total cost to light the field, both capital costs and operating costs.

Still further, the methodology addresses an issue that has existed and continues to become increasingly important in sports lighting; that is, glare and spill light. The methodology works towards allowing for improved consistency and control of light to keep it on the field as useable light and keep it away from going off the field as spill light or causing glare.

Also, the methodology can extend the useful life of some of its components. An example is the life of lamp 20. This provides still further economic advantages to the owner.

4. Optional Operating Feature to Reduce Energy Usage Over Lamp Operating Life

The foregoing describes methods for producing more lumens from the lamp and more efficiently handling and controlling light from the fixture to make more light available to the field for a given amount of energy to create the light. An further option can materially reduce energy use of an HID sports lighting fixture during its operating life is disclosed in Applicant's co-pending U.S. application Ser. No. 10/785,867, which is incorporated by reference herein. U.S. Ser. No. 10/785,867 describes the Smart Lamp™ technology from Musco Corporation, a methodology for operation of an HID arc lamp that can produce efficient useable light at a lower energy usage to that conventionally indicated. It can also reduce lamp maintenance (or lumen depreciation) factor for the lamp and increase efficiency of the lamp. While the circuitry needed for such lamp wattage modification may increase capital costs for the system, it would in most cases be recouped by reduced energy usage over time. It has been found that the regimen described in U.S. co-pending co-owned application Ser. No. 10/785,867 could result in savings on the order of 40% to 50% total energy cost for a lamp over a normal operating life.

Additionally, as described in that application, it has been found that the regimen can increase lamp life (on the order of 20% or 3 to 6 thousand hours). This would further add to the energy savings and reduce lamp replacement labor costs.

Thus, while having benefits individually, application of all the methodologies of described above (many times cumulatively 45% or more additional light to the field for the same input energy) combined with the Smart Lamp™ technology (over time 40-50% energy savings) could together result in very substantial efficiency and energy savings.

D. Options and Alternatives

It will be appreciated that the foregoing exemplary embodiment is given by way of example only and not by way of limitation. Variations obvious to those skilled in the art will be included in the invention. The scope of the invention is defined solely by the claims.

For example, variations in dimensions, materials, and combinations are contemplated by the invention. In particular, all of the features and aspects of the exemplary embodiment are not required to produce a beneficial or advantageous result.

Specific optional features in more detail are as follows.

1. Lamp Alternatives

Utilization of the Musco Z-Lamp is not necessarily required. By appropriate modification, a standard arc lamp could be utilized. This would require either offset of the reflecting surface relative to the lamp cone (as suggested in Musco U.S. Pat. No. 5,161,883), or mounting the lamp cone off of the aiming axes of the reflector frame, as also suggested in U.S. Pat. No. 5,161,883. In either event, the principals described herein for total tilt factor correction over normal sports lighting aiming angles can be utilized. By a gearing arrangement or other functional equivalent, the lamp yoke could be maintained at a preset angular orientation to the target regardless of aiming angle of the reflecting surface.

2. Reflector Alternatives

The various beam shapes and configurations possible by shaping reflector frame 30 and selection of reflective inserts 120, etc. has been described above.

3. Visor Options

Another optional feature involves visor 70. As shown in FIGS. 77A-I, an opening 75 (FIG. 77A) can be formed in the visor extension portion 250 or 260. A frame 76 (FIGS. 77B-F) can be screwed, bolted, or otherwise attached in opening 75. A light transmissive material or insert 77 (FIGS. 77G-J) is secured in frame 76. Its shape can be basically an oblong bubble to form kind of an "eyeball" shape. Usually, insert 77 is a translucent material or has properties to diffuse the light. For example, it could be translucent to limit the amount of light (e.g. 2000 candela) that comes through it to provide some intensity, but not a lot, and diffuse the light, above the target. Alternatively, or in addition to, insert 77 can have a diffractor surface or surfaces (like with many fluorescent lights) to spread the light energy. Another alternative to translucent could be coloring or tinting (e.g. gray) the insert (i.e. a darkening agent) to control the amount of light coming through. Still further the insert surface could be sand blasted or acid etched inside and out. When lamp 20 is on, this adds some candlepower to the space above the target area. This can helpful to allow players and spectators to better see balls or objects well above the ground (e.g. high fly baseballs). Preferably some type of insert would be used in the visor opening. It could be transparent or translucent (e.g. plastic, glass, polycarbonate, acrylic, etc.). It could have optical qualities to diffuse light. For sports lighting, it is contemplated it would be translucent to place some quantity of light above the field but not provide direct view to the light source or become a source of glare (e.g. to a viewer from the stands or outside of the target field, the opening would merely glow), or shift a significant amount of light from the light source away from the field.

Optionally a prismatic material could be used in the visor opening for different lighting effects (e.g. spread light diffusely or directionally). An angled stepped prismatic reflector inside reflector 70 could also be used. Black paint could be used on the opposite sides of the visor reflecting surface for extreme glare and spill light control.

It is to be understood that a further option for the uplight function for the visor could be customization for a particular application. For example, a team color or symbol could be imprinted on the translucent insert. Still further, the visor, or the whole reflector frame/visor combination could be painted, ornamented, or otherwise configured in the colors of a team or school. Because the reflector frame and visor exteriors are cast, and do not contain the reflecting surface, painting is a more viable option.

The uplighting from inserts 77 can provide a more pleasant environment. It can provide a "soft" light. It can reduce the perception of glare, which can reduce what is sometimes called annoying or discomfort glare.

Also, insert 77 can be used in combination with visor 70 or components added to visor 70 (e.g. louvers) to assist in glare or spill control or other lighting effects. Prismatic or other surfaces could be added to the interior of visor 70 or to any louvers of other surfaces of visor 70. There could be curved, angled, or stepped reflective strips in visor 70 for additional manipulation of light. Different such components could be available to produce different performance or playability options for each fixture 10.

4. Application Alternatives

The invention can be utilized for other wide area lighting applications other than sports lighting. A few examples are parking lot lighting, architectural lighting, public event lighting, arena or stadium lighting. It can be applied to interior lighting. It is relevant to any HID fixture where a controlled concentrated beam is desired or needed. This includes to a relatively distant (e.g. on the order of 100 feet or more) target, or for special effects lighting.

5. Fixture Aiming Methods

Accuracy of aiming is important with fixture 10 because the reflecting surfaces are so precise. Several methods are possible to improve reliability of aiming of fixtures 10.

One compensates for possible warpage of cross arm 7, e.g. during its manufacturing and welding (heat could cause). Instead of basing the angle at which a lamp cone 40 is aimed relative to the cross arm 7, and risking it is not orthogonal to the pole or to the ground because of warpage, aiming could be tied to a reference point unrelated to the cross arm. If the cross arm can be ignored, any error because of warpage of the cross arm is eliminated.

One method is to (a) assume the pole is straight (it will then be straight up from earth when properly installed at the installation site; (b) attach the knuckle plates 60 to cross arms 7, (c) attach knuckles 50 to knuckle plates 60, (d) attach lamp cones 40 to knuckles 50, (e) measure the absolute angle of the knuckles 50 relative to the reference (e.g. the pole) with a digital level. A zero alignment gauge, described below, is then mounted and adjusted relative to lamp cone 40, having any needed compensation built-in.

Figure 40A:
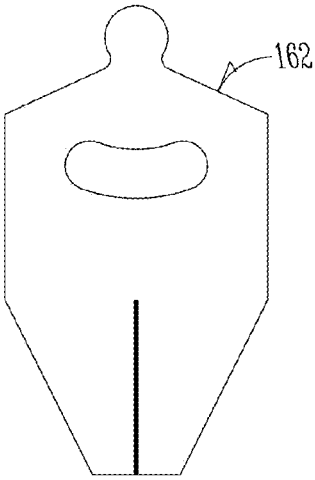
FIG. 40A and FIG. 40B are front and side views of a zero alignment gauge useable with the knuckle of FIG. 36A and the lamp cone of FIG. 26A.
Figure 40B:
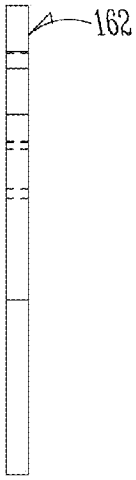
Figure 41A:
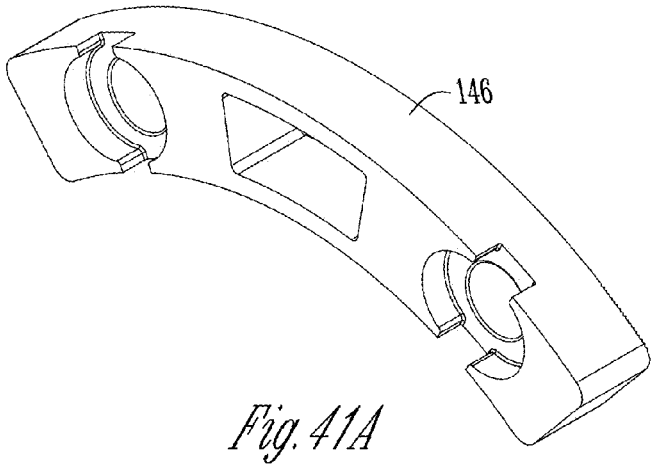
Figure 41B:
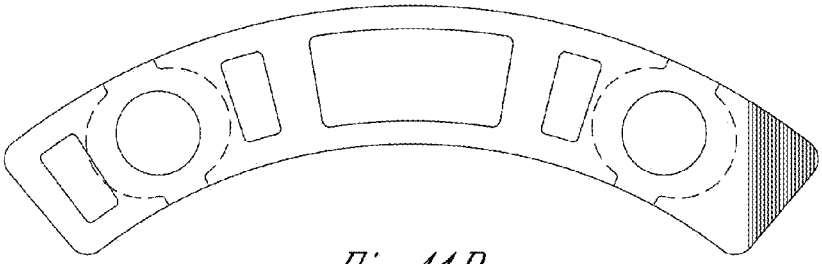
Figure 41C:
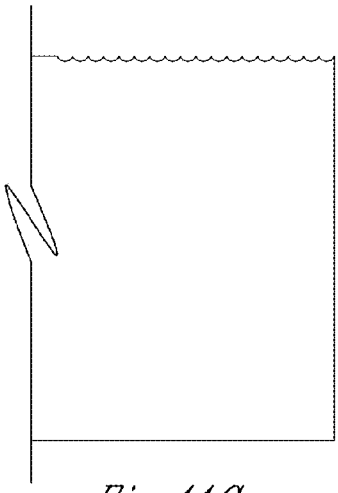
Figure 42A:
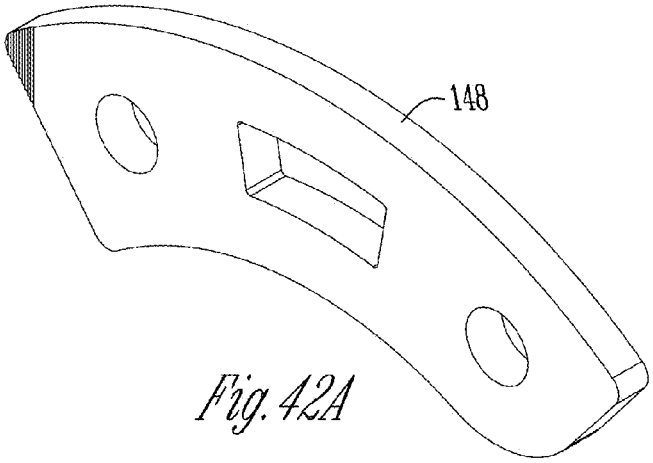
Figure 42B:
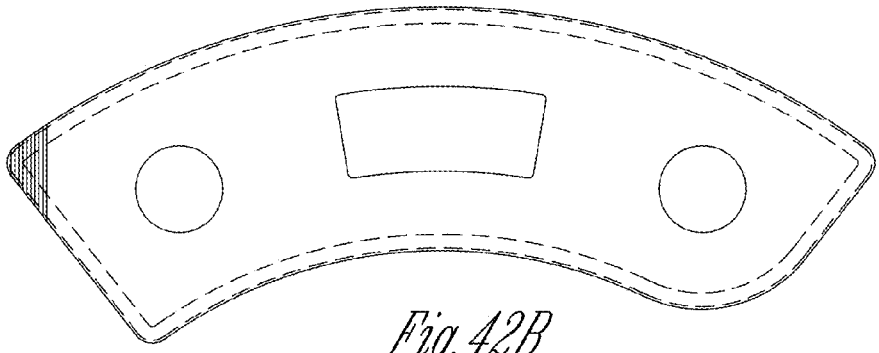
Figure 42C:
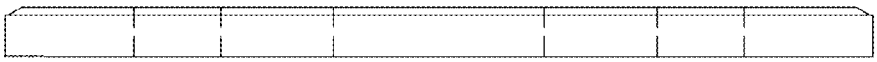
Figure 42D:
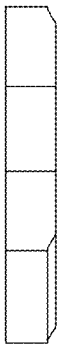
Figure 42E:
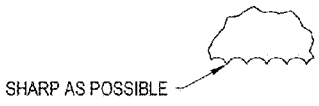
Figure 42F:
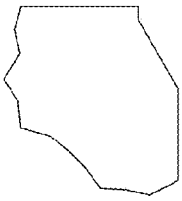
Figure 43A:
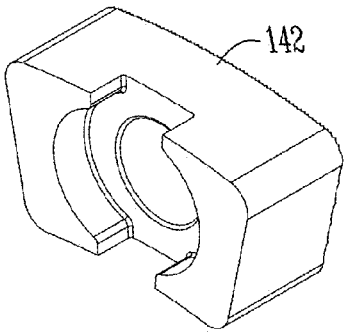
Figure 43B:
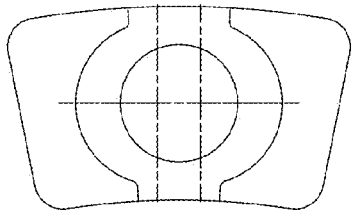
Figure 43C:
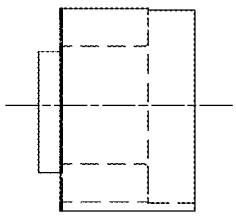
Figure 43D:
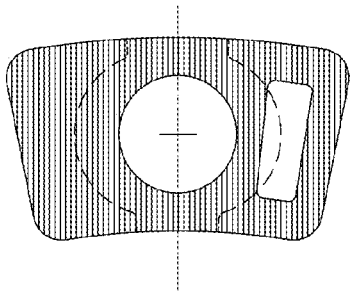
Figure 43E:
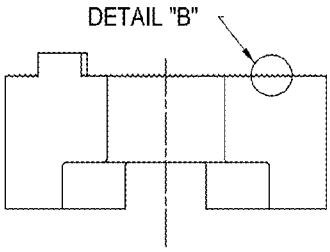
Figure 43F:
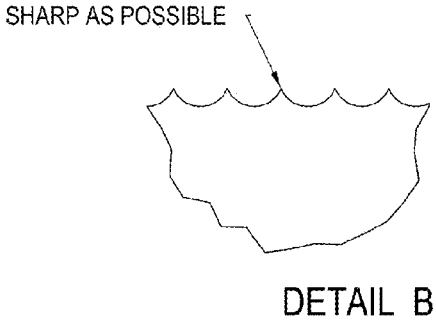

FIGS. 40A and B illustrate a zero alignment gauge 162. It is attachable to the side of cone 40. A printed scale can be cast or imprinted on knuckle 50. Aiming of fixtures 10 needs to be relative to the target area. The assumption is many times made that the rugged metal cross arm 7 can be used as a reference relative to the ground. However, cross-arms can warp during the manufacturing process (e.g. from the high temperatures of welding during fabrication). Knuckle 50, therefore, may not be perfectly vertical. To provide a more accurate and uniform frame of reference for aiming all fixtures on a pole, at the factory they can be referenced to the pole by attaching cross arm 7, knuckle plates 60 for each fixture, and knuckles 50 and bolt cones 40 for each knuckle plate 60. Each bolt cone 40 can be hung straight down vertically relative to earth. Zero alignment gauge 162 can initially be fixed via a bolt or screw to lamp cone 40 such that its printed witness mark (see FIG. 40A) is aligned with the longitudinal axes of lamp cone 40 or other reference position. A scale can be printed (e.g. with ink jet printer) on knuckle 50 in a position so that the witness mark of zero alignment gauge 162 would indicate zero if both were aligned vertically relative to earth. If the witness mark does not align with the zero position on knuckle 50, it will indicate some sort of warp age or irregularity in the cross arm. The amount of irregularity will be quantified by the offset of the witness mark from knuckle zero position. Zero alignment plate 162, can then be loosened and rotated to line up the witness mark with the zero position. Thus, compensation for cross arm warp age is accomplished. At installation of the fixtures, the compensation has occurred and the worker can assume the witness mark lined up with the knuckle zero position mark is the starting reference point for aiming.

To ensure correction rotational alignment of a set or array of fixtures 10 on cross-arms on a pole when being installed, a small centering ring or circle could be imprinted on the lens of one of the fixtures of the array (e.g. ⅛ inch thick, 2½ inch diameter circle of UV degradable yellow ink—see small centered ring 272 on lens in FIG. 1B). It can be concentric with the central axis of the fixture. From the ground with binoculars, a worker can line up the ring and the bulb or back of the reflector with his/her viewing position on the ground and check if that fixture is aimed to the correct pre-determined point on the ground. This has been found to be accurate within inches. It is a cost-effective, simple way to check the alignment of the whole array once elevated. Since each of the fixtures is pre-aimed relative to the cross-arms, checking one fixture is generally sufficient. If there is misalignment, with a slip fit pole on base arrangement, the pole simply is rotated until alignment is achieved.

6. D-shape Cross Arm

FIGS. 78A, B, and D-W illustrate an optional cross arm 7A that could be used with fixtures 10. As shown in FIGS. 78A, B and S, the cross arm has a generally rectangular in cross section shape except one vertical side 55 is generally rounded or curved (e.g. a radius of curvature). Additionally, the width of cross arm 7A, from front edge 55 to opposite back edge, is increased (e.g. 30% to 40%) over conventional square or rectangular tubular cross arms (illustrated generally by comparing prior art cross arm at FIG. 78C with all sides square or flat and shorter width W).

It has been found that the highest wind load is straight on to this front face of the cross arm. This shape reduces wind load on the cross arm, and thus on the pole. This can contribute to decreased EPA for the entire array. It therefore can sometimes allow for a cheaper pole (e.g. thinner metal wall or smaller diameter).

It can also be efficiently manufactured from readily available round tubular stock. Its flat sides can be rolled, leaving the curvature at side 55. Thus it is not an expensive addition. It also has about the same strength as rectangle tubing.

Figures 78C, 78H, 78I, 78J, 78K, 78L:
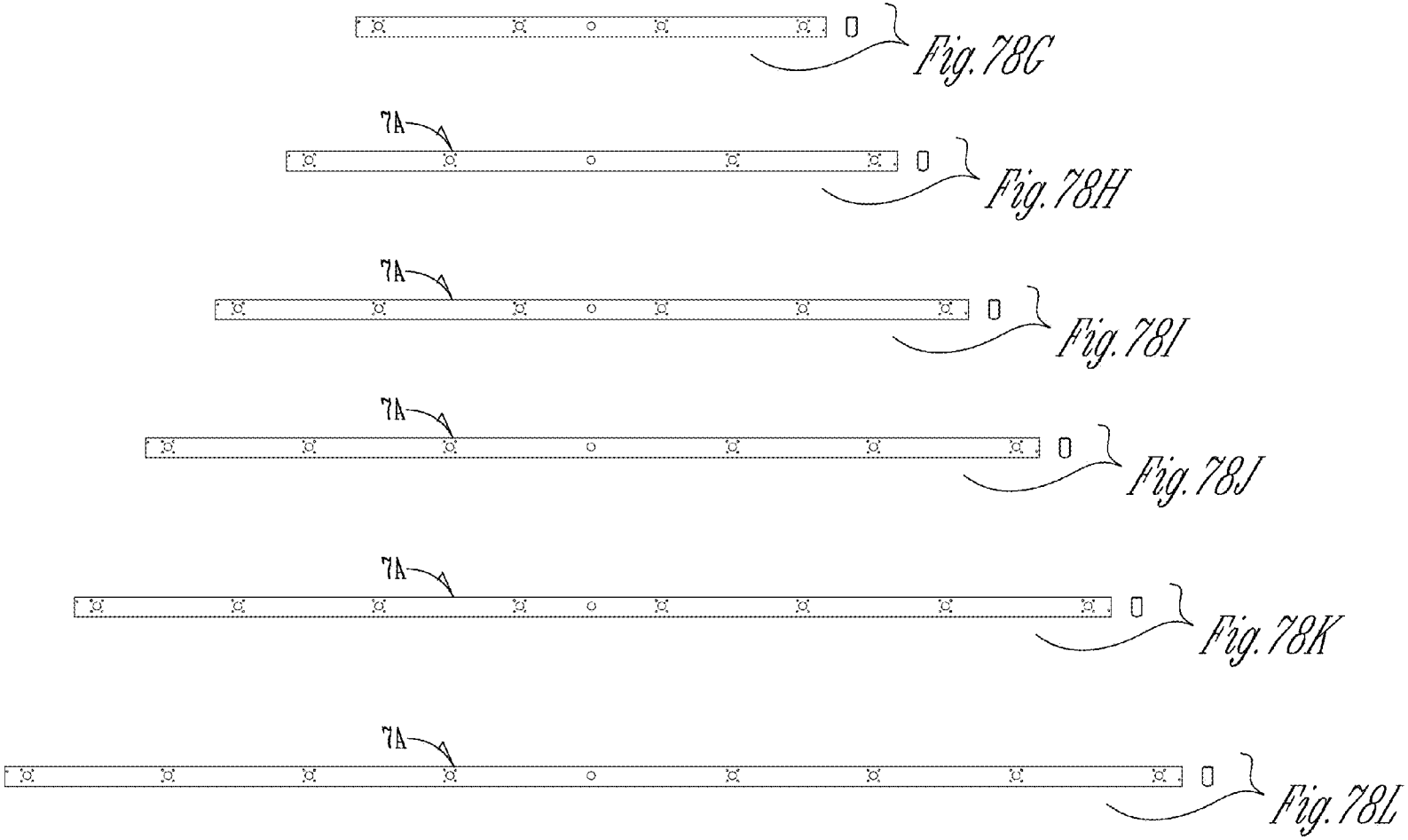
Figure 78M:
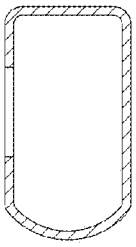
Figure 78N:
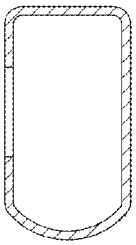
Figure 78O:
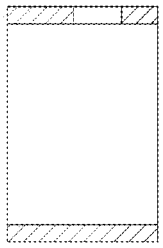
Figure 78P:
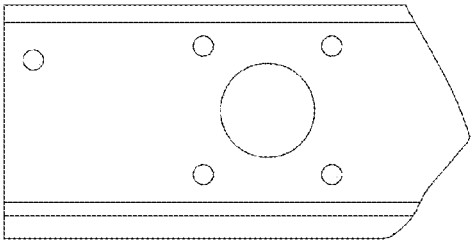
Figure 78Q:
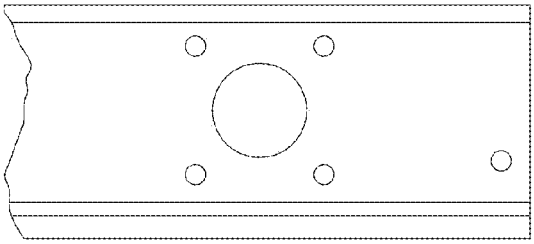
Figure 78R:
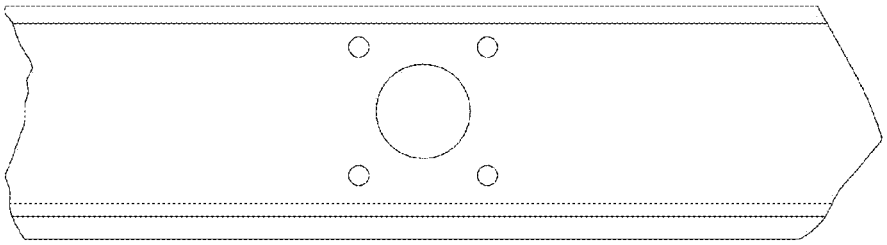
Figure 78S:
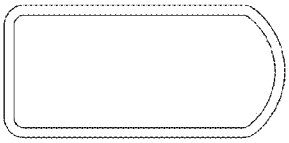
Figure 78T:
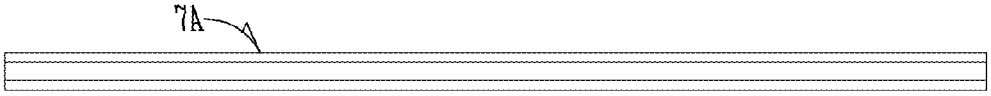
Figure 78U:
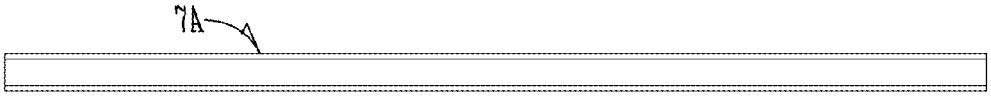
Figure 78V:
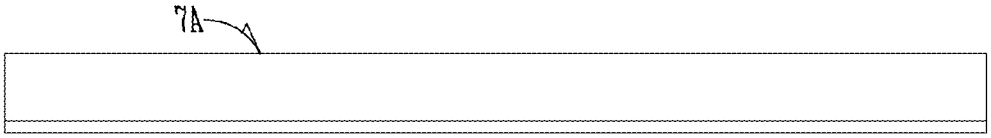
Figure 78W:
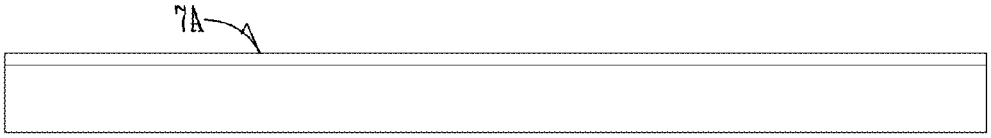

Note how it can be made to different conventional lengths (e.g. FIGS. 7D-L) and have formed mounting openings along a side for mounting a plurality of fixtures 10. In this embodiment cross arm 7A is approximately 2 inches high (H) and 3.875 inches wide (W). Length L varies between approximately 1 and ⅓ feet (FIG. 78D) to 18.7 feet (FIG. 78L).

7. Selectivity of Benefits

As described previously, features of fixture 10 can be selected in different combinations or operation regimens to achieve different goals for the end user of the lights. The end user or lighting designer can consider (a) glare/spill light benefits, (b) on field lighting, (c) structural and wind load issues, and (d) pole height requirements and select a configuration based on needs or desires relating to:

1. Capital cost for the lighting system (initial cost of fixtures, poles, and installation).
2. Operating cost (cost of operating the system including electricity and maintenance).
3. Performance/playability (how much light on the field and how it is distributed).
4. Environmental concerns (glare/spill; electrical use).

Choices can be made between these factors. For example, presently about 60% of the cost of a typical sports lighting system is in the fixtures. About 40% is in the poles. More useable light from less fixtures could produce benefits in all four areas. Less fixtures would be less capital costs (including possibly cheaper or less poles). Less fixtures (and SMART LAMP) could reduce operating costs over time. Performance and playability can be enhanced with side shift, better control of light, and other features of fixtures 10. Glare and spill is reduced, as can be energy usage, for environmental benefits.

However, the amount of benefits can be adjusted by design. For example, if a greater amount of spill and glare is acceptable, shorter poles could be used which would further decrease capital costs. If operating cost is not a significant concern, additional light could be generated from the system, at a higher cost, but perhaps for better playability. With regard to the particular configurations described herein, the drawings attempt to illustrate generally the scale and proportion of the parts to allow one of skill in the art to understand the exemplary structures and how they could be made, assembled and operated. Variations obvious to those skilled in the art will be included within the invention.

Also, various of the components have ornamentation, shape, or configuration that provide aesthetically pleasing ornamental appearance. Examples are the fixture as a whole, with of without any of the visors; the reflector frame, the lamp cone, the mounting elbow, the visors, the visor with the opening, and the D-shape cross arm.

Options And Alternatives

It will be appreciated that the foregoing exemplary embodiments are but a few examples of forms and aspects the invention can take. Variations obvious to those skilled in the art will be included within the invention, which is defined solely by its claims.

What is claimed is:

1. A high intensity wide area lighting fixture for increasing useable light to a target area without an increase in energy use comprising:

a. a lamp cone;

b. a knuckle attachable to the lamp cone for use in adjustable mounting to a cross-arm or other suspending structure;

c. a reflector frame mountable to the lamp cone and comprising a continuous outer surface, an inner surface including integrally formed mounting structure adapted for a reflecting surface, and a primary opening over which a glass lens is mountable;

d. a very high total reflectance reflecting surface of on the order of 95% or more reflectivity comprising a plurality of customizable changeable insert strips mountable to the mounting structure of the reflector frame so that more useable light from the reflecting surface is available for the target area, the reflector frame including:

i. a main portion comprising a majority of the inner surface of the reflector frame generally following a surface of revolution of the type that produces a converging beam; and ii. a secondary portion generally following a surface of revolution of the type that produces a beam of differing convergence than the main portion;

e. a visor frame having an outer side and an inner side mounted to and extending outwardly from the top of the reflector frame;

f. a very high total reflectance reflecting, surface of on the order of 95% or more reflectivity mountable to the inner side of the visor frame adapted to redirect incident light generally downward when the fixture is in operating position relative the target area, gathering more useful light to the target area;

g. a high intensity discharge lamp having a base mountable into the lamp cone and an arc tube positionable in the interior of the reflector frame substantially surrounded by the reflecting surfaces, such that more useable light is available to be directed to the target area over a substantial operating time of the lamp, the arc tube of the lamp having a longitudinal axis and operated:

i. without heat reflective coatings on either end;

ii. at or above approximately 1000 watts;

iii. at or near horizontal;

h. means for operating the arc tube at or near horizontal regardless of aiming angle of the fixture relative to the target area comprising:

i. a lamp yoke mounted in the lamp cone and pivotable around a first pivot axis;

ii. the lamp cone pivotable around a second pivot axis relative the knuckle to set different aiming angles for the lighting fixture;

iii. a mechanical linkage between the lamp yoke and the lamp cone adapted to pivot the lamp yoke around the first pivot axis proportionally to an independent pivoting of the lamp cone around the second pivot axis, the amount and direction of proportional pivoting of the lamp yoke in the lamp cone adapted to automatically maintain a selected arc tube position for a range of lighting fixture aiming angles;

i. a glass lens comprising an anti-reflective property allowing more useable light to exit the lens and thus the fixture and to the target area;

j. an electrical circuit in electrical communication with the lamp and comprising components to selectively increase operating wattage to the lamp at selected times;

k. so that cumulatively a substantial increase in useable light is available for the target area from features of the fixture without a substantial increase in energy consumption.

2. The lighting fixture of claim 1 wherein the arc tube further comprises an increased metal halide salt pool.

3. The lighting fixture of claim 2 wherein the amount of increase is approximately double over conventional metal halide HID lamps.

4. The lighting fixture of claim 1 wherein the arc lamp has a longitudinal axis and the arc tube is oblique to the longitudinal axis of the arc lamp.

5. The lighting fixture of claim 1 in combination with an electrically efficient lamp ballast between an electrical power source and the lamp.

6. The lighting fixture of claim 5 wherein the lamp ballast is a linear reactor ballast.

7. The lighting fixture of claim 1 in combination with a decreased resistance electrical transmission path between an electrical power source and the lamp.

8. The lighting fixture of claim 7 wherein the decreased resistance electrical transmission path comprises larger, and thus lower resistance, wire.

9. The lighting fixture of claim 7 wherein the decreased resistance electrical transmission path comprises more highly magnetic permeable ballast material in a lamp ballast for the lamp.

10. The lighting fixture of claim 1 wherein the arc tube has a fixed orientation relative the arc lamp.

11. The lighting fixture of claim 1 wherein the mechanical linkage comprises a gear train between the knuckle, the lamp cone, and the lamp yoke.

12. The lighting fixture of claim 1 wherein the reflecting surface comprises a high purity aluminum base layer with a super reflective outer layer having a minimum total reflectance of 95% for visible light.

13. The lighting fixture of claim 1 wherein the reflecting surface comprises silver-coated aluminum having a minimum total reflectance of at least 95% for visible light.

14. The lighting fixture of claim 1 wherein the reflector frame has a built-in main portion adapted to support a main portion of the high total reflectance reflecting surface in a manner that follows a surface of revolution of the type that produces a converging beam.

15. The lighting fixture of claim 14 wherein the reflecting frame has a built-in bottom section that supports a portion of the high total reflectance reflecting surface in a manner that produces less converging reflected light than produced by the main portion.

16. The lighting fixture of claim 15 wherein the bottom portion is below the lamp when the fixture is in operating position.

17. The lighting fixture of claim 16 wherein the bottom portion extends less than 180° around longitudinal axis of the lamp.

18. The lighting fixture of claim 15 wherein the bottom portion is of a different shape than the main reflecting portion.

19. The lighting fixture of claim 14 wherein the reflecting surface has a built-in lateral section that supports a portion of the high total reflectance reflecting surface in as manner that produces a side shift portion of the type that produces less converging reflected light than produced by the main portion.

20. The lighting fixture of claim 19 wherein the side shift portion is to a lateral side of the lamp when the fixture is in operating position.

21. The lighting fixture of claim 20 wherein the side shift portion extends less than 180° around the longitudinal axis of the lamp.

22. The lighting fixture of claim 20 wherein the side shift portion is of a different shape than the main portion of the reflecting surface.

23. The lighting fixture of claim 14 wherein the visor inner side is adapted to support a high total reflectance reflecting surface of different reflecting characteristics extending outward from the reflector frame.

24. The lighting fixture of claim 23 wherein the visor reflecting surface extends forwardly of and above the lamp when the fixture is in operating position.

25. The lighting fixture of claim 23 wherein the visor reflecting surface extends about or greater than 180° around the longitudinal axis of the lamp.

26. The lighting fixture of claim 23 wherein the visor reflecting surface is of a different shape than the main portion of the reflecting surface.

27. The lighting fixture of claim 23 wherein the visor reflecting surface redirects light substantially to the target area thereby reducing glare and spill light when the fixture is in operating position.

28. The lighting fixture of claim 1 wherein the reflector frame is die-cast.

29. The lighting fixture of claim 28 wherein the reflector frame is in the general form of a shell.

30. The lighting fixture of claim 29 wherein the shell is in the general form of a bowl with a wind shedding exterior.

31. The lighting fixture of claim 30 wherein the shell further comprises a substantially continuous outer surface.

32. The lighting fixture of claim 30 wherein the visor comprises an exterior which, in combination with the reflector frame, presents a relatively improved effective projected area (EPA) and aerodynamic characteristics compared to conventional spun aluminum reflector fixtures.

33. The lighting fixture of claim 1 further comprising an opening in the visor and the reflecting surface mounted to the inner side of the visor adapted to allow a controlled amount of light through.

34. The lighting fixture of claim 33 further comprising a translucent material or a clear material with a prismatic surface in the opening.

35. The lighting fixture of claim 1 wherein the reflective inserts are made from sheet material and are elongated along a longitudinal axis.

36. The lighting fixture of claim 35 wherein the reflective inserts are trapezoidal in shape.

37. The lighting fixture of claim 1 wherein the reflective inserts are mounted in a reflector frame side by side but generally aligned with the longitudinal axis of the lamp.

38. The lighting fixture of claim 1 wherein the anti-reflective layer for the lens is an applied thin film.

39. The lighting fixture of claim 1 wherein the anti-reflective layer is formed by dipping the lens into a solution.

40. The lighting fixture of claim 1 wherein the lens has opposite surfaces the anti-reflective layer is on both surfaces of the lens.

41. The lighting fixture of claim 1 wherein the electrical circuit comprises switchable capacitance in electrical communication with the lamp, one switchable capacitance adapted for operating the lamp at a reduced wattage over a substantial period of operation time to save energy.

42. The lighting fixture of claim 41 wherein another switchable capacitance is adapted for operating the lamp at a higher wattage to counteract lamp lumen depreciation, but maintain cumulative energy savings for the entire operating period.

43. The lighting fixture of claim 42 further comprising a plurality of switchable capacitances adapted to increase operating wattage of the lamp at substantially spaced apart times to combat lamp lumen depreciation, but maintain cumulative energy savings for the entire operating period.

44. The lighting fixture of claim 1 further comprising blocks, seals and gaskets adapted to seal the interior of the reflector frame at the lamp cone and lens.

45. The lighting fixture of claim 1 further comprising a positioning ring comprising polytetrafluoroethylene positioned around base of the lamp.

46. The lighting fixture of claim 1 further comprising a lens gasket to seal the lens and a light shield mounted to the fixture to substantially shield the lens gasket from light.

47. The fixture of claim 1 wherein the non-reflective property comprises low iron glass.

* * * * *

UNITED STATES PATENT AND TRADEMARK OFFICE

CERTIFICATE OF CORRECTION

PATENT NO. : 8,770,796 B2
APPLICATION NO. : 11/334077
DATED : July 8, 2014
INVENTOR(S) : Myron K. Gordin et al.

It is certified that error appears in the above-identified patent and that said Letters Patent is hereby corrected as shown below:

In the Claims

Col. 44, Claim 1, Line 14:
DELETE after reflectance "reflecting, surface"
ADD after reflectance --reflecting surface--

Col. 45, Claim 19, Line 43:
DELETE after in "as"
ADD after in --a--

Signed and Sealed this
Twenty-third Day of September, 2014

Michelle K. Lee

Michelle K. Lee
*Deputy Director of the United States Patent and Trademark Office*